US008015699B2

(12) United States Patent
Fulbright

(10) Patent No.: US 8,015,699 B2
(45) Date of Patent: Sep. 13, 2011

(54) FASTENER INSTALLATION SYSTEM

(76) Inventor: David J. Fulbright, Waco, TX (US)

( * ) Notice: Subject to any disclaimer, the term of this patent is extended or adjusted under 35 U.S.C. 154(b) by 1396 days.

(21) Appl. No.: 11/445,483

(22) Filed: Jun. 1, 2006

(65) Prior Publication Data

US 2007/0079504 A1 Apr. 12, 2007

Related U.S. Application Data

(63) Continuation-in-part of application No. 11/035,009, filed on Jan. 13, 2005.

(60) Provisional application No. 60/536,593, filed on Jan. 15, 2004, provisional application No. 60/604,648, filed on Aug. 26, 2004.

(51) Int. Cl.
*B23Q 7/10* (2006.01)
*B21J 15/02* (2006.01)

(52) U.S. Cl. ..... 29/818; 29/812.5; 29/816; 29/243.521; 29/243.523; 29/243.526; 29/243.53; 29/34 B; 29/525.05; 29/525.06; 72/391.4

(58) Field of Classification Search ..... 29/809, 29/812.5, 816, 818, 811.2, 243.521, 243.523, 29/243.524, 243.526, 243.53, 524.1, 525.05, 29/525.06, 34 B; 72/114, 391.8, 391.4, 391.6
See application file for complete search history.

(56) References Cited

U.S. PATENT DOCUMENTS 3,082,898 A * 3/1963 Bosch ..... 29/243.525
3,430,539 A * 3/1969 Freeman ..... 92/85 R
3,451,248 A * 6/1969 Bell ..... 29/243.523
3,457,763 A * 7/1969 Freeman ..... 29/243.523
3,654,792 A * 4/1972 Mead ..... 72/391.8
3,685,815 A * 8/1972 Wright et al. ..... 269/58
3,930,297 A * 1/1976 Potucek et al. ..... 29/431
4,027,520 A * 6/1977 Klein ..... 29/509
4,203,446 A 5/1980 Hofert et al.
4,215,808 A 8/1980 Sollberger et al.
4,580,435 A * 4/1986 Port et al. ..... 29/243.525
4,604,889 A * 8/1986 Sukharevsky ..... 29/812.5
4,858,811 A * 8/1989 Brosius et al. ..... 227/10
4,878,372 A * 11/1989 Port et al. ..... 29/243.525
4,964,292 A * 10/1990 Kaelin et al. ..... 72/453.17
5,119,554 A * 6/1992 Wilcox ..... 29/252
5,170,923 A * 12/1992 Dear et al. ..... 227/55
5,323,521 A * 6/1994 Freund et al. ..... 29/243.527
5,351,392 A * 10/1994 Wing et al. ..... 29/818
5,519,926 A * 5/1996 Rosier ..... 29/243.523
5,651,169 A * 7/1997 Ohuchi et al. ..... 29/243.525
5,720,423 A 2/1998 Kondo et al.
5,778,516 A * 7/1998 Dear et al. ..... 29/707
6,021,553 A * 2/2000 Bieber et al. ..... 29/243.521
6,301,948 B1 * 10/2001 Weiland ..... 72/391.6
6,519,997 B2 * 2/2003 Luhm et al. ..... 72/391.6
6,629,360 B2 * 10/2003 Ohuchi ..... 29/812.5
6,637,099 B1 * 10/2003 Seewraj ..... 29/812.5
6,964,362 B2 11/2005 Shkolnikov et al.
7,040,010 B2 * 5/2006 Bouman ..... 29/812.5
7,536,764 B2 * 5/2009 Weeks et al. ..... 29/407.08

(Continued)

FOREIGN PATENT DOCUMENTS

GB 2297283 A * 7/1996

*Primary Examiner* — Essama Omgba

(57) ABSTRACT

The blind fastener installation tool also comprises an optional fastener delivery assembly, said optional fastener delivery assembly constituting: (1) a clip-fed fastener delivery system; or (2) a blowline-fed fastener delivery system.

3 Claims, 85 Drawing Sheets

U.S. PATENT DOCUMENTS

| | | | | |
|---|---|---|---|---|
| 7,647,680 | B2 * | 1/2010 | Dear | 29/243.523 |
| 2005/0055816 | A1 | 3/2005 | Stoger | |
| 2007/0079504 | A1 * | 4/2007 | Fulbright | 29/812.5 |
| 2007/0295779 | A1 * | 12/2007 | Fulbright | 227/138 |
| 2009/0205192 | A1 * | 8/2009 | King et al. | 29/525.06 |

* cited by examiner

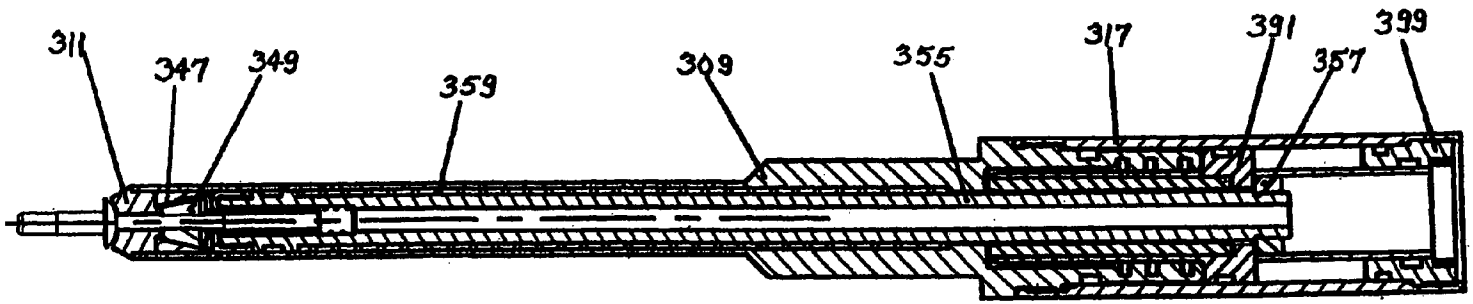
Figure 201S1
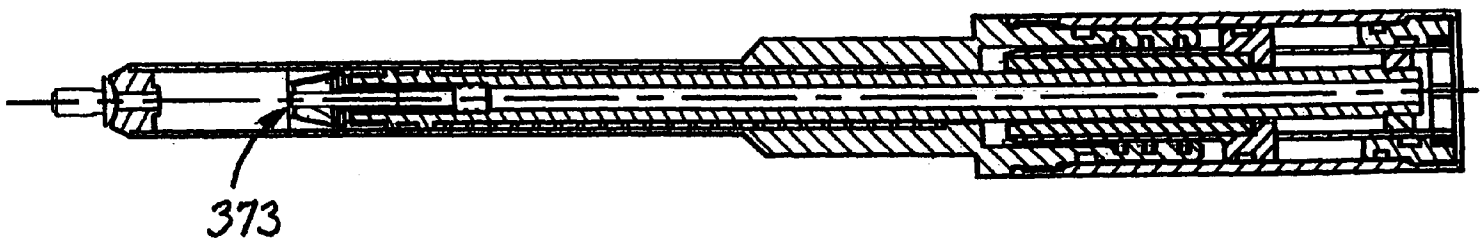
Figure 201S2

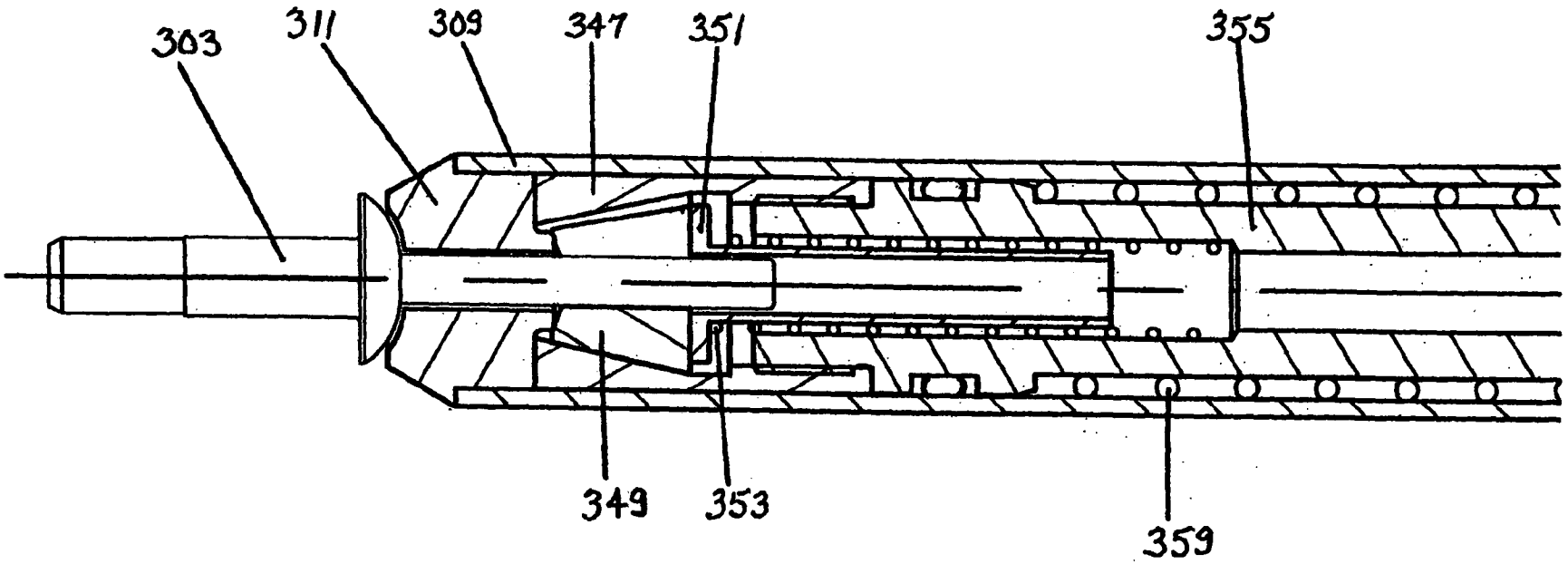
Figure 201S1a

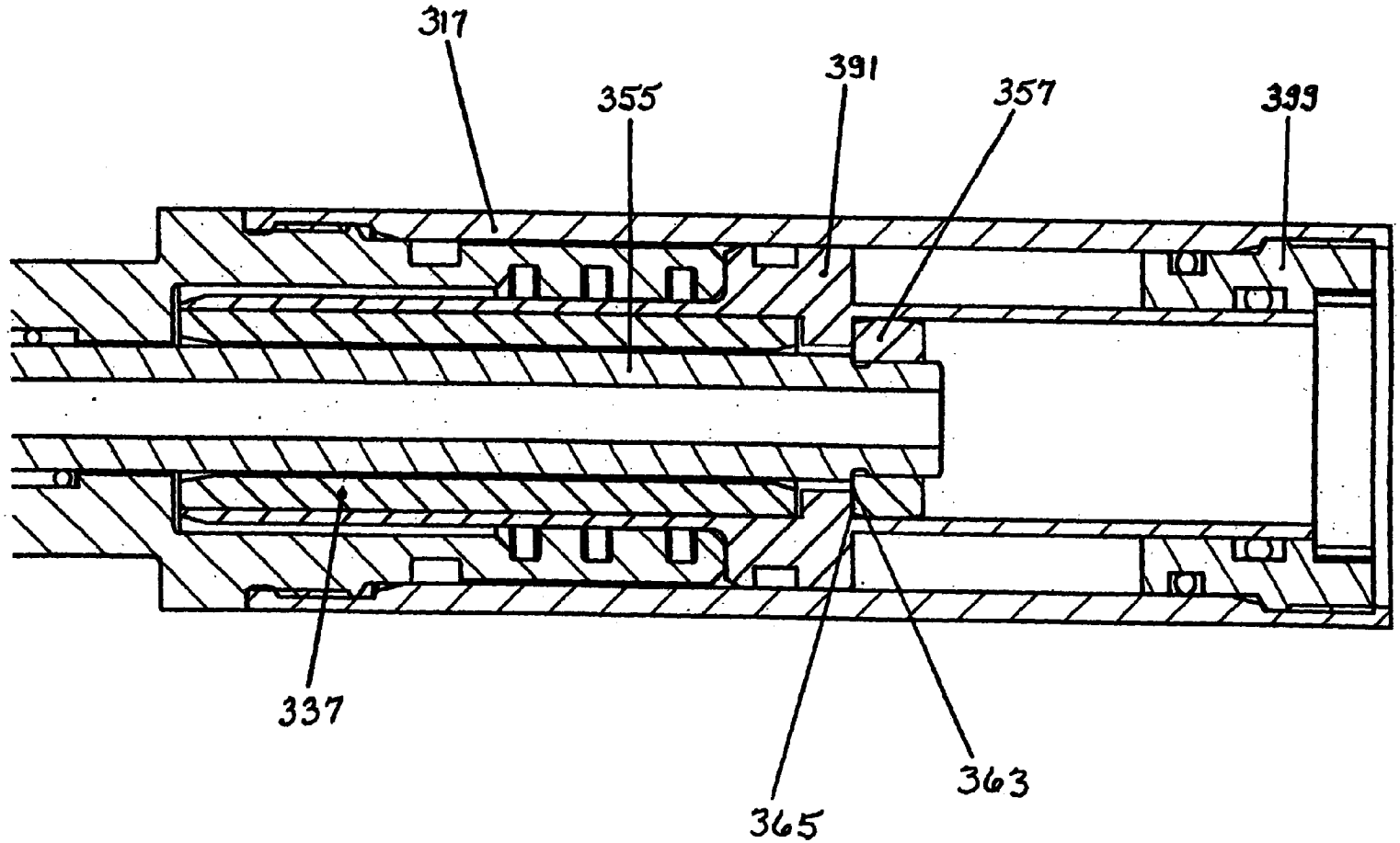
Figure 201S1b

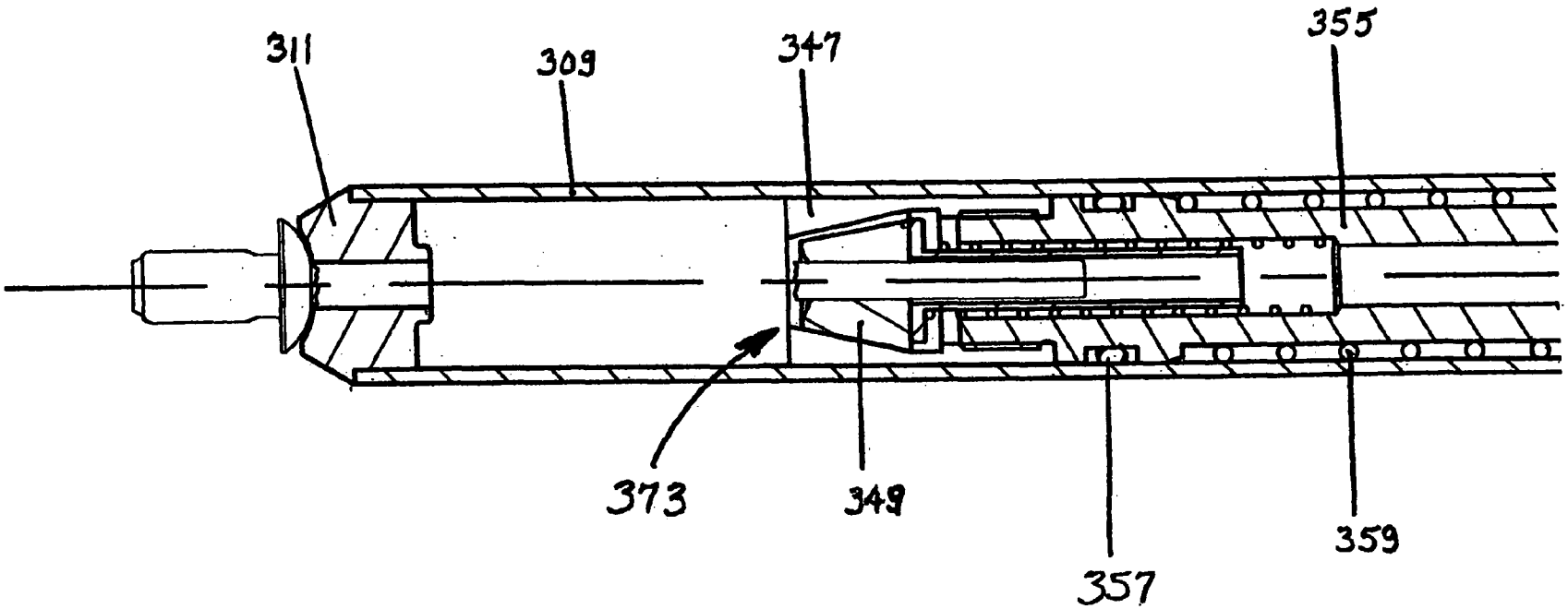
Figure 201S2a

Figure 201S2b
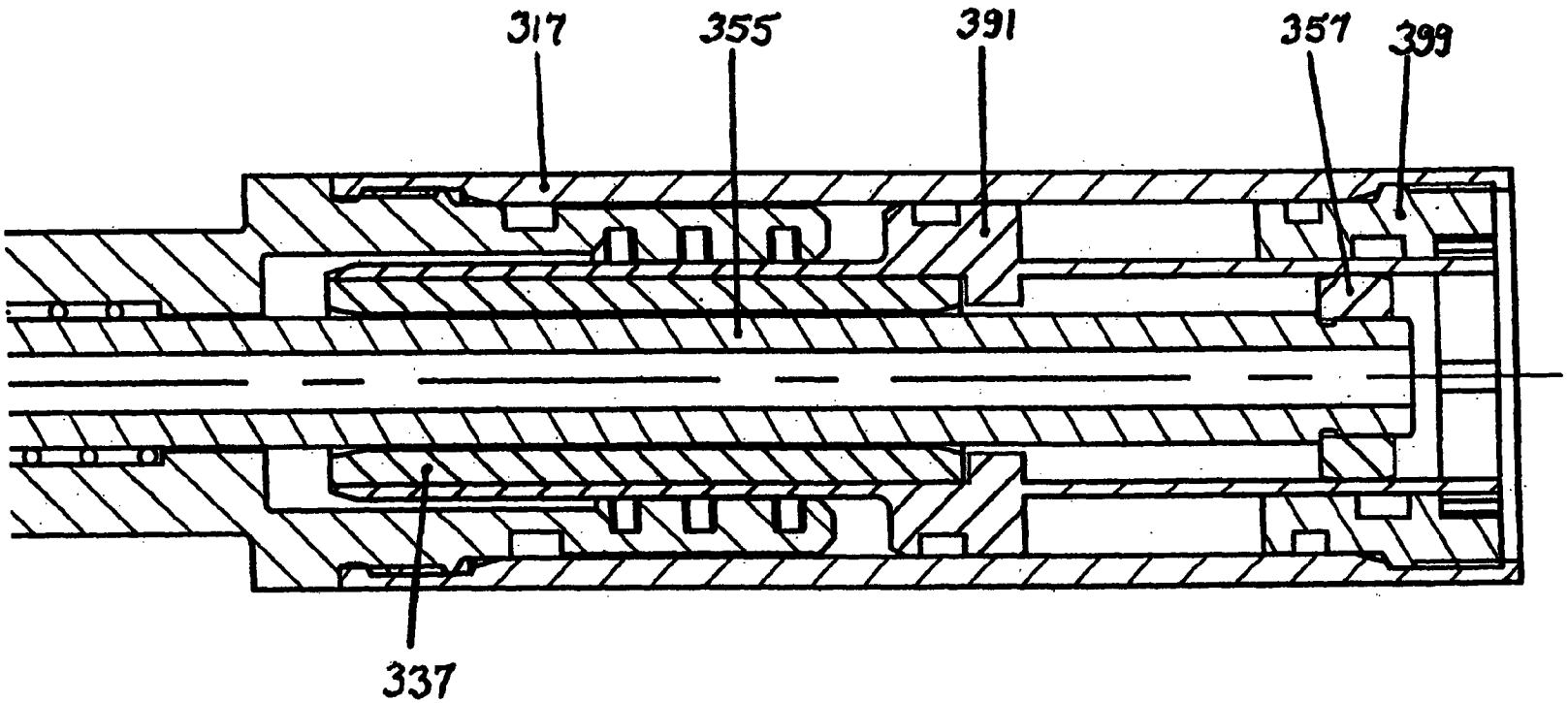

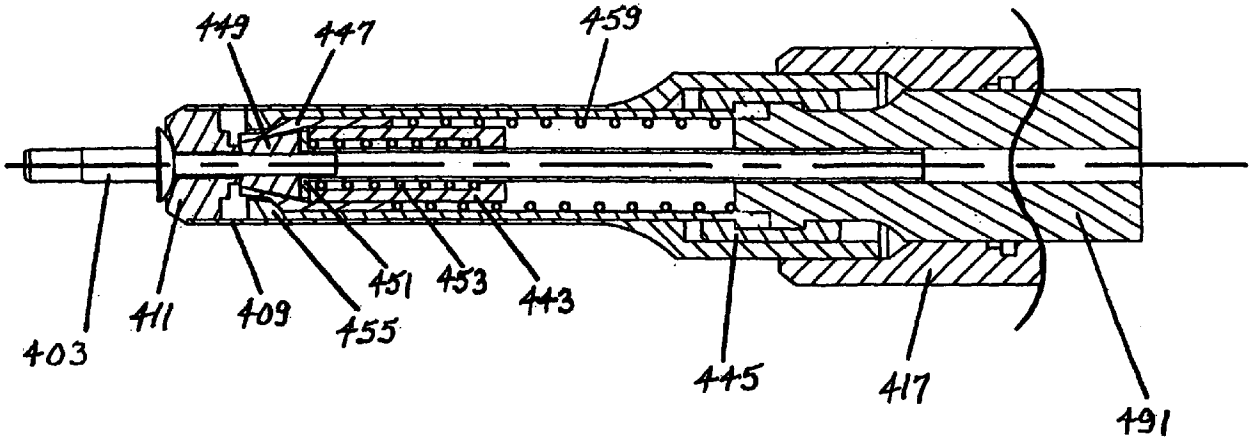
Figure 202S1
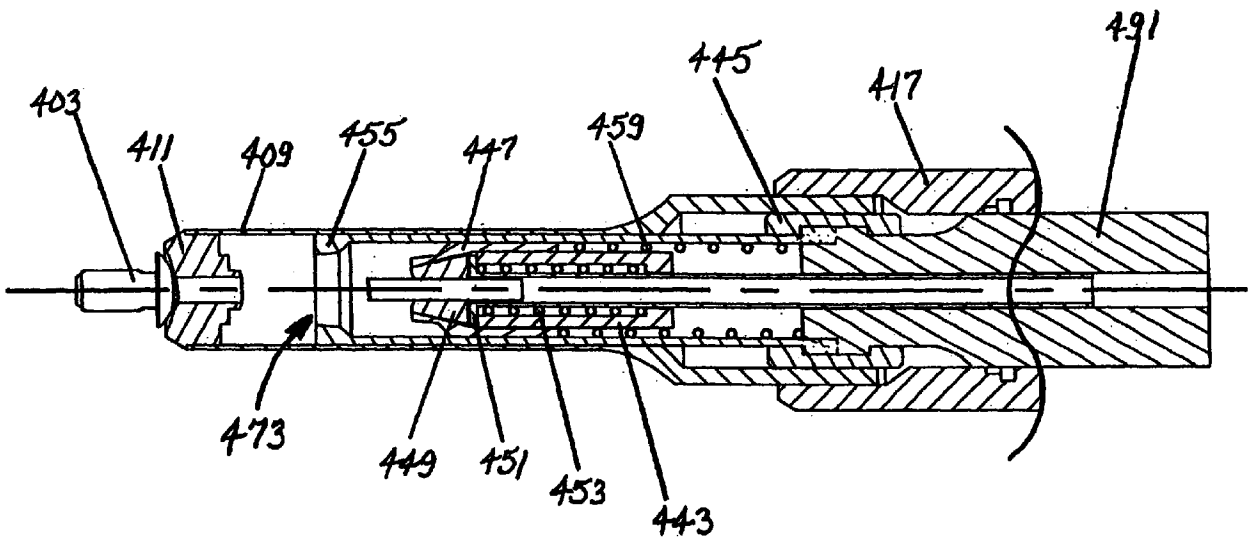
Figure 202S2

Figure 202S1 (enlarged)
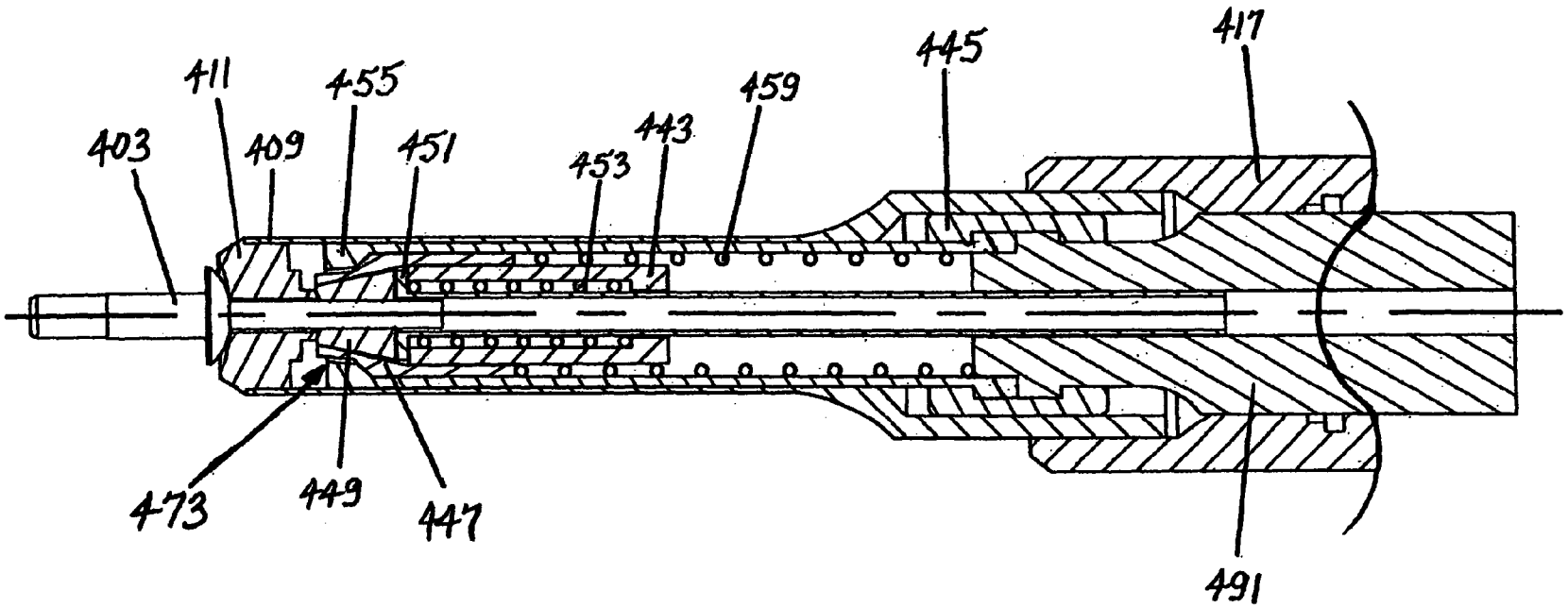

Figure 202S2 (enlarged)
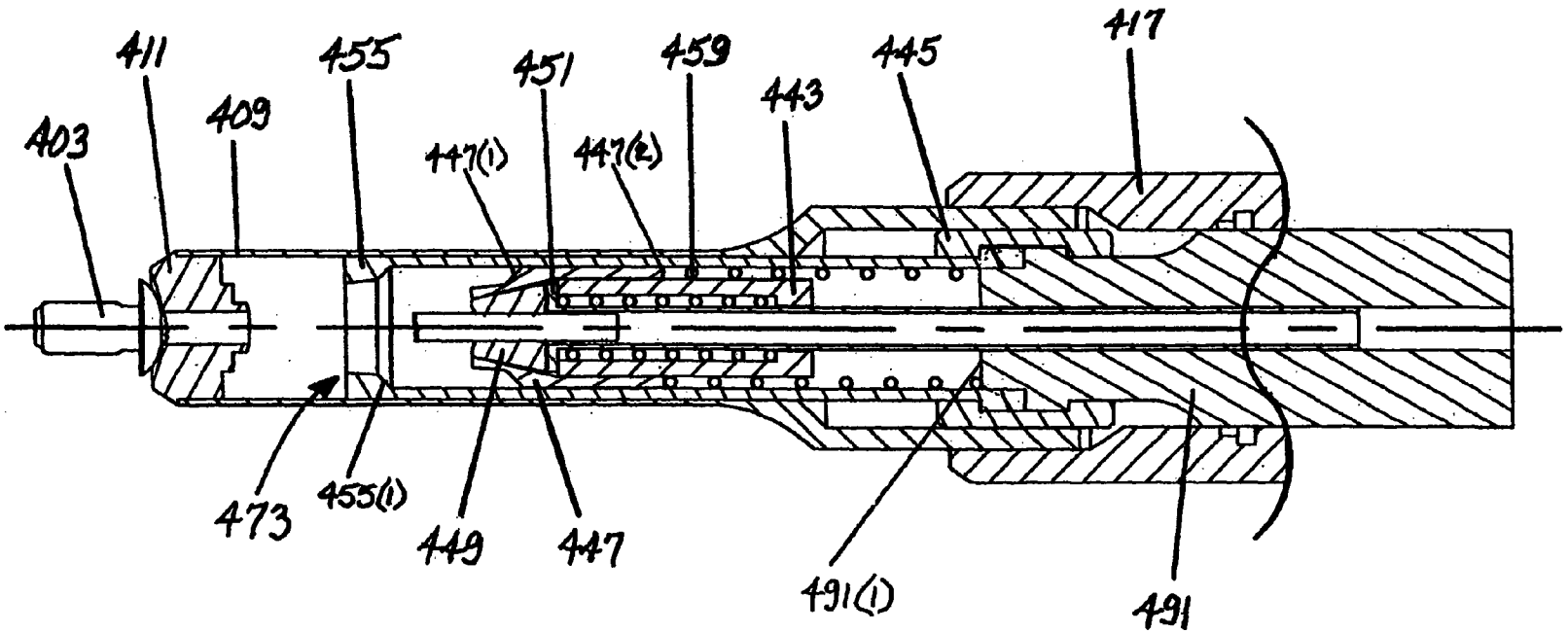

DETAIL A

SECTION A-A

DETAIL A

DETAIL B
SCALE 3 / 4

FASTENER INSTALLATION SYSTEM

CROSS-REFERENCE TO RELATED APPLICATIONS

This application is a continuation-in-part of, and claims the benefit of, and incorporates by reference the entirety of, the following applications:

U.S. Provisional Application No. 60/536,593, filed Jan. 15, 2004 (entitled "A Fastener Installation System").

U.S. Provisional Application No. 60/604,648, filed Aug. 26, 2004 (entitled "Improvements to a Fastener Installation System").

U.S. Nonprovisional Application No. 11/035,009, filed Jan. 13, 2005 (entitled "A Fastener Installation System").

BACKGROUND OF THE INVENTION

Blind rivet installation tools have been in existence for many years. However, the vast majority of prior art designs have suffered from one or more important disadvantages.

First, the vast majority of prior art designs impart recoil to the operator upon rivet installation. Second, the vast majority of prior arts designs are manually loaded, which is extremely inefficient in an industrial environment. Third, most prior art blind rivet installation tools are insufficiently reliable for industrial applications. Fourth, few, if any, prior art designs were designed to operate in multiple environments. Fifth, most prior art designs are noisy, contributing to a hostile work environment.

It is to the correction of these deficiencies, among others, that the instant disclosure is directed.

BRIEF SUMMARY OF THE INVENTION

A blind fastener installation tool which effectuates the blind installation of a series of fasteners is described in detail in this specification.

The blind fastener installation tool comprises a structural housing which itself comprises (1) means for inter-connecting with a fastener delivery assembly; (2) means for securing a fastener installation assembly in position relative to said structural housing during the blind installation of a fastener; and (3) means for reciprocating said fastener installation assembly relative to said structural housing at the conclusion of a cyclic blowline-fed or clip-fed blind installation of a fastener.

The blind fastener installation tool also comprises a fastener installation assembly, said fastener installation assembly comprising (1) a pull rod assembly comprising means for pulling a first portion of a fastener; (2) an annular, piston-actuated, direct action, piston-decoupled pull rod actuation assembly to translate the pull rod assembly relative to said fastener installation assembly when said fastener installation assembly is secured at a fastener installation assembly fastener installation position, thereby pulling said first portion of said fastener until blind installation of said fastener is complete; and (3) a nose assembly comprising (3a) a fastener receptacle for securing the position of a fastener relative to said nose assembly during blind installation of said fastener; and (3b) one or more optional pull rod translation dampening assemblies to smoothly and effectually dampen the sudden translation of said pull rod assembly after pintail break during blind installation of a pintail-break—type fastener;

The blind fastener installation tool also comprises an optional fastener delivery assembly, said optional fastener delivery assembly constituting: (1) a clip-fed fastener delivery system, said clip-fed fastener delivery system comprising means for securing the sequential oriented placement of each fastener of said series of fasteners (said series of fasteners housed within a portable housing) within one or more fastener presenters, said one or more fastener presenters securely presenting each fastener in succession to said fastener receptacle as the fastener installation assembly is reciprocated and prior to said fastener installation assembly arriving at said fastener installation assembly fastener installation position; or (2) a blowline-fed fastener delivery system, said blowline-fed fastener delivery system comprising: means for securing the sequential oriented placement of each fastener of said series of fasteners (said series of fasteners housed within a bulk supply receptacle) into a blowline, said blowline transporting each said fastener in succession to one or more fastener presenters, said one or more fastener presenters securely presenting each fastener in succession to said fastener receptacle as the fastener installation assembly is reciprocated and prior to said fastener installation assembly arriving at said fastener installation assembly fastener installation position.

BRIEF DESCRIPTION OF THE SEVERAL VIEWS OF THE DRAWINGS

FIG. 14 is omitted.

FIG. 201S1 is a side cut-away view of an alternative embodiment of a rivet installation tool featuring shock mitigation functionality.

FIG. 201S2 is a side cut-away view of the alternative embodiment of FIG. 201S1 at a different stage in operation.

FIG. 201S1*a* is a close-up side cut-away view of the nose portion of the rivet installation tool of FIG. 201S1.

FIG. 201S1*b* is a close-up side cut-away view of a rearward portion of the rivet installation tool of FIG. 201S1.

FIG. 201S2*a* is a close-up side cut-away view of the nose portion of the rivet installation tool as shown at the stage of operation depicted in FIG. 201S2.

FIG. 201S2*b* is a close-up side cut-away view of a rearward portion of the rivet installation tool as shown at the stage of operation depicted in FIG. 201S2.

FIG. 202S1 is a side cut-away view of a modular nose assembly featuring shock mitigation functionality.

FIG. 202S2 is a side cut-away view of the modular nose assembly of FIG. 202S1 at a different stage in operation.

FIG. 202S1 (Enlarged) is a close-up side cut-away view of the modular nose assembly of FIG. 202S1.

FIG. 202S2 (Enlarged) is a close-up side cut-away view of the modular nose assembly of FIG. 202S1 at the stage in operation depicted in FIG. 202S2.

DETAILED DESCRIPTION OF THE INVENTION

This application is a continuation-in-part of, and claims the benefit of, and incorporates by reference the entirety of, three (3) prior patent applications.

This application incorporates the entirety of U.S. Provisional Application No. 60/536,593, filed Jan. 15, 2004 (entitled "A Fastener Installation System"), by reference, and, herein, whenever referenced, said provisional patent application will commonly be referred to as the "fastener installation system provisional patent application."

This application also incorporates the entirety of U.S. Provisional Application No. 60/604,648, filed Aug. 26, 2004 (entitled "Improvements to a Fastener Installation System"), by reference, and, herein, whenever referenced, said provisional patent application will commonly be referred to as the "fastener installation system improvements provisional patent application."

This application also incorporates the entirety of U.S. Nonprovisional application Ser. No. 11/035,009, filed Jan. 13, 2005 (entitled "A Fastener Installation System"), by reference, and, herein, whenever referenced, said nonprovisional patent application will commonly be referred to as the "fastener installation system nonprovisional patent application."

Figure 1:
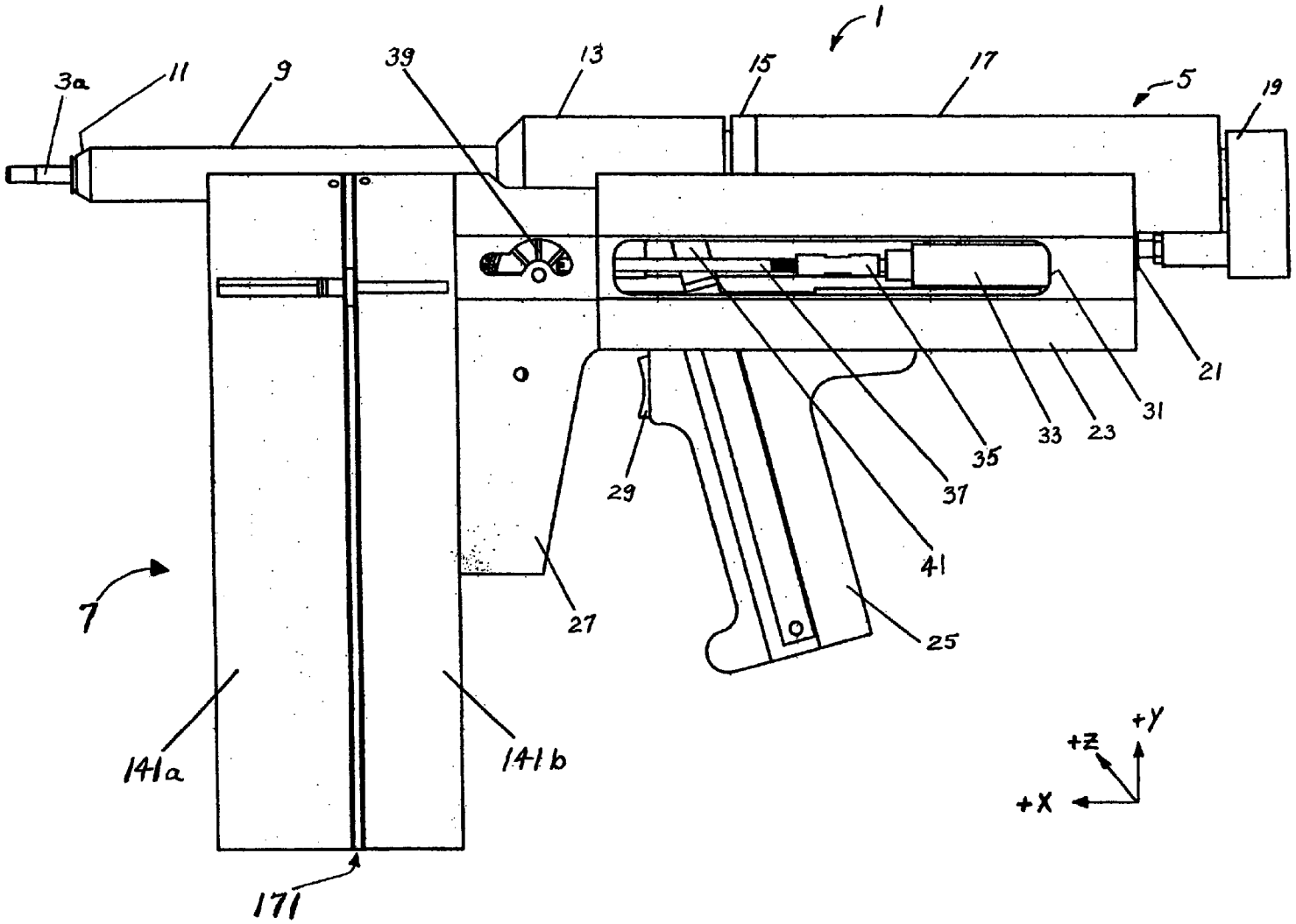
FIG. 1 is a side view of the invention at stage one of the fastener installation process described herein.

With reference now to the drawings, and in particular with reference to FIG. 1, a fastener installation system 1 for the installation of fasteners 3 is shown.

The specific fastener installation system 1 shown is a blind rivet installation system 1 for the blind installation of rivets 3, and the specific blind rivet installation system 1 shown features a blind rivet installation tool 5 equipped with a clip-fed rivet delivery system 7.

With reference now to the drawings, and in particular with reference to FIG. 1, a blind rivet installation system 1 for the installation of rivets 3 is shown. The blind rivet installation system 1 features a blind rivet installation tool 5 equipped with a clip-fed rivet delivery system 7 as shown.

The rivets 3 (such as rivet 3*a*) for which this tool is particularly well suited are what are commonly known in the industrial and aerospace fastening industries as blind rivets, although the tool will obviously perform its intended function with any rivet, fastener or workpiece similarly designed.

Overview of Stages of Blindfastener Installation.

The blind rivet installation tool 5 effectuates the blind installation of rivets 3 through a cyclic series of thirteen stages described hereinbelow. The thirteen stages of blind installation are:

Stage One: Rivet ready.

Stage Two: Inner Collet Closure.

Stage Three: Rivet Installation Complete Except for Pin Break.

Stage Four: Rivet Installation Post Pin Break.

Stage Five: Inner Collet Re-Opening.

Stage Six: Piston Return Complete.

Stage Seven: Outer Collet Opens.

Stage Eight: Reciprocation: Nose assembly retracted; rivet captured at paw stop.

Stage Nine: Reciprocation: rivet presentation.

Stage Ten: Rivet load.

Stage Eleven: Nose assembly full extension.

Stage Twelve: Stroke presenter down.

Stage Thirteen: Presenter prior to rivet capture.

The status/state of the blind rivet installation tool 5 subsystems and components, and the rivets 3 being manipulated by the blind rivet installation tool 5 as well as by the clip-fed rivet delivery system 7, at each stage of the process, are discussed in detail in this specification.

Automated/Computerized Execution of the Stages of Blind Rivet Installation.

As described in great detail hereinbelow, the blind rivet installation tool 5 effectuates the blind installation of rivets 3 through a cyclic series of thirteen stages. Execution of the thirteen stages is efficiently effectuated by means of automation, namely, through the use of programmable controllers, micro-controllers, and/or electro-mechanical sensors the uses and applications of which are well-known to persons of ordinary skill in the art of electro-mechanical automation.

The key goal of automating the thirteen-stage installation process is simply this: (a) reduce the cycle time as much as possible by, for example, executing stage steps in parallel whenever possible; and (b) ensure that the execution of no stage proceeds until any electro-mechanical sensors employed impart confidence that the pre-requisites of that stage's execution are in place. The first objective imparts operational speed; the second imparts operational safety and security.

The person of ordinary skill in the art of automation will require no extensive recitation of the automation implementation issues presented by the blind rivet installation process described herein. However, some useful lessons have been, and continue to be, learned by the inventor, and they are discussed where applicable in the discussion of each of the thirteen stages below.

Useful Conventions Regarding Relative Position.

In describing the position of each of the invention's components, as well as the rivet workpieces being acted upon, certain default conventions are useful.

Viewing the invention as shown in FIG. 1, one can utilize three perpendicular axes, denominated the x-, y- and z-axes, defining an orthogonal coordinate system, to describe relative position. As shown in FIG. 1, the x-axis describes position along a horizontal axis, with movement to the "left" (also described as "forward" movement), as shown in FIG. 1, being associated with increasing x position. Conversely, movement to the "right" (also described as "backward" or "rearward" movement), as shown in FIG. 1, is associated with decreasing x position.

As also shown in FIG. 1, the y-axis describes position along a vertical axis, with movement "upwards", or "elevating" movement, as shown in FIG. 1, being associated with increasing y position. Conversely, movement "downwards", or "lowering" movement, as shown in FIG. 1, is associated with decreasing y position.

As also shown in FIG. 1, the z-axis describes position along an axis perpendicular to both the x-axis and the y-axis, with shifting movement "to the right" (from the vantage point of a viewer facing in the positive x direction), or "into the page" as shown in FIG. 1, being associated with increasing z position. Conversely, movement "to the left", or out of the page towards the reader as shown in FIG. 1, is associated with decreasing z position.

Viewing the invention as shown in FIG. 1, one can also utilize a cylindrical coordinate system, denominated x-r-a°, to describe relative position.

In such a cylindrical coordinate system, as shown in FIG. 1, and as in the case of the orthogonal x-y-z coordinate system described above, the x-axis describes position along a horizontal axis, with movement to the "left" (also described as "forward" movement), as shown in FIG. 1, being associated with increasing x position. Conversely, movement to the "right" (also described as "backward" or "rearward" movement), as shown in FIG. 1, is associated with decreasing x position.

As also shown in FIG. 1, the r-axis describes position along a radial axis fixed or centered at the x-axis, with radial movement "outwards", as shown in FIG. 1, being associated with increasing r position. Conversely, radial movement "inwards", as shown in FIG. 1, is associated with decreasing r position.

As also shown in FIG. 1, the a°-axis describes angular position, relative to an angular origin located straight overhead (i.e., at "top dead center") when the blind rivet installation tool 5 is held as shown in FIG. 1, with rotational movement "clockwise" (from the vantage point of a viewer facing in the positive x direction), or top portion—away and bottom portion—towards the reader, as shown in FIG. 1, being associated with increasing a° position. Conversely, rotational movement "counterclockwise", or top portion—towards and bottom portion—away from the reader, as shown in FIG. 1, is associated with decreasing a° position.

It will of course be understood that these conventions should be ignored when the discussion of a particular figure makes it reasonably apparent to a person of ordinary skill in the art that a particular, and different, convention has been adopted to make or clarify a specific point.

Stage One: Rivet Ready.

Returning, now, to FIG. 1, the blind rivet installation tool 5 comprises a nose 9, said nose 9 featuring a nose insert 11, a collet lock 13, a front end cap 15, a hydraulic cylinder 17, a bridge 19, a reciprocation air cylinder 21, a left cylinder housing 23, a left handle 25, a gear drive housing 27, a trigger 29, a presentation air cylinder 33, a turnbuckle 35, a presentation connecting rod 37, a large presentation sprocket 39, and a collet lock bracket 41. The relationship of these elements, and their interoperability, are described more fully below.

As shown, and as more fully described in the figures which follow, the clip-fed rivet delivery system 7 is connected to the blind rivet installation tool 5 so as to facilitate the delivery of rivets 3 to the blind rivet installation tool 5 for blind installation.

At stage one, the following important status items should be noted (note: not all of the components or assemblies enumerated in this paragraph listing are itemized in FIG. 1; however, they are defined and described fully in the corresponding figures that follow):

(a) the nose assembly 43 (comprising nose 9) is fully extended with a rivet 3*a* ready for installation;

(b) the outer collet 45 is locked;

(b1) the collet lock bracket 41 has pivoted to a rearward location, moving the collet lock 13 back;

(b2) the collet lock air cylinder 61 is retracted;

(c) the jaws 49 are in the "accept" position; and (d) the next rivet in succession (not shown in FIG. 1), rivet 3*b*, is against the paws (i.e., rivet 3*b* fully captured as described more fully below).

Thus, as shown in FIG. 1, the nose assembly 43 (see FIG. 1A) is fully extended, thus extending a rivet 3*a* forward for blind installation. Blind installation occurs when the rivet 3*a* is placed in a rivet hole, and the trigger 29 of the blind rivet installation tool 5 is depressed, installing the rivet even though the user has immediate physical access only to one side of the rivet 3*a* during installation. Through a process more fully described below, the rivet 3*a* is automatically installed.

Figure 1A:
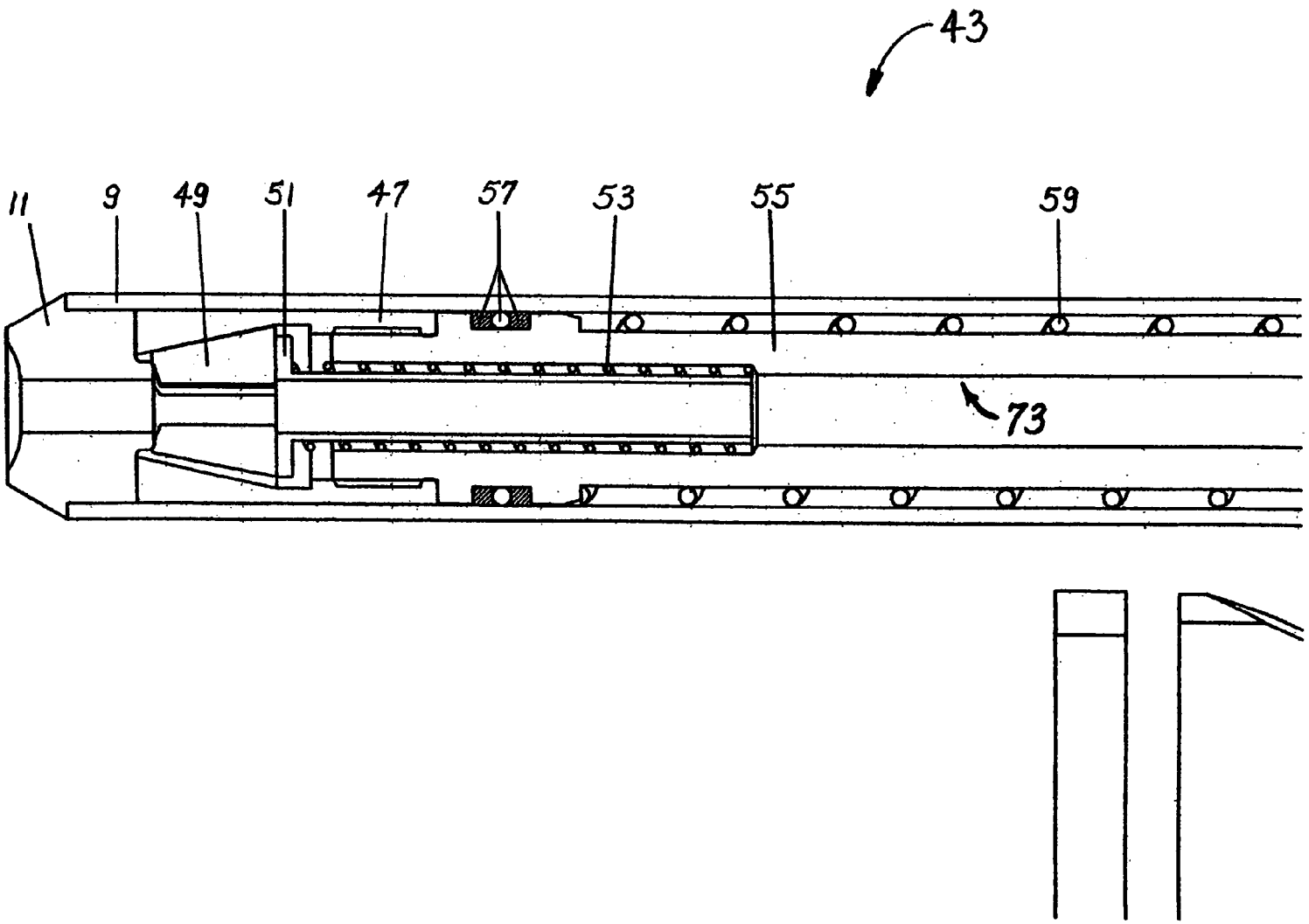
FIG. 1A is an enlarged cross-sectional view of the nose assembly of the invention at stage one of the fastener installation process described herein.
Figure 1B:
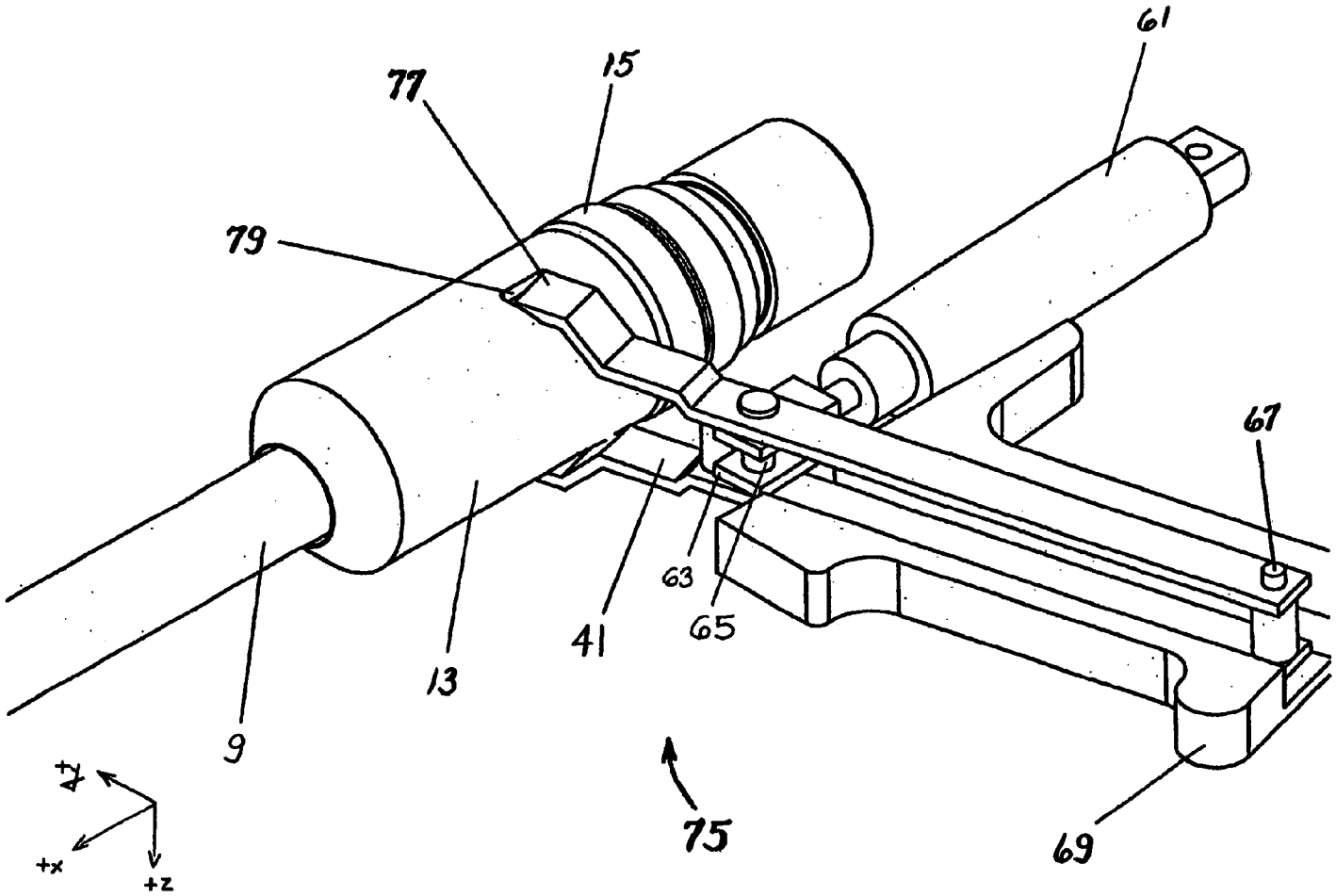
FIG. 1B is an isometric view of the collet lock actuating assembly of the invention.
Figure 1C:
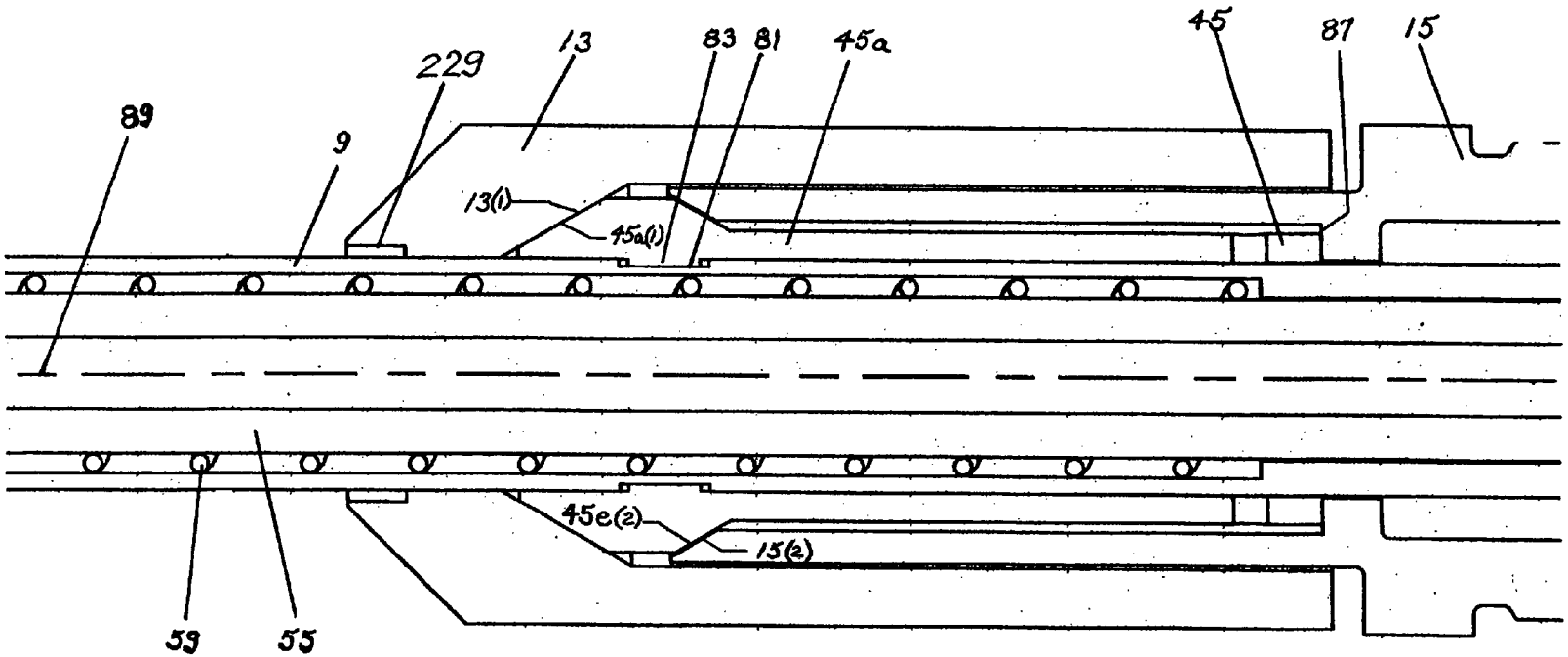
FIG. 1C is an enlarged cross-sectional view which depicts the outer collet in a locked position.
Figure 1D:
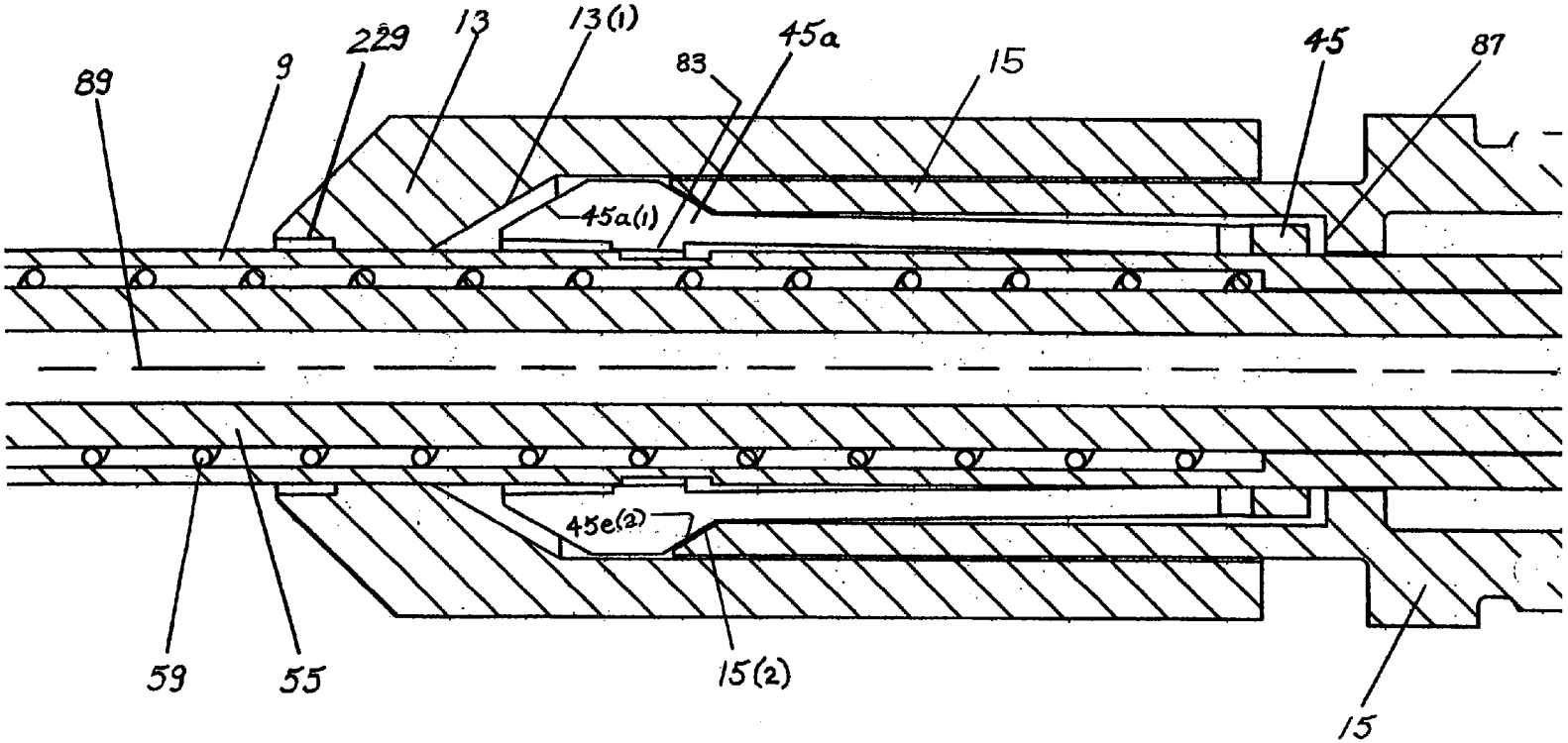
FIG. 1D is an enlarged cross-sectional view which depicts the outer collet in an unlocked position.

A comparison of FIG. 1 and FIG. 1C (showing outer collet 45 and collet lock 13 in the locked position) with FIG. 1D (showing outer collet 45 and collet lock 13 in the unlocked position) reveals the telltale gap between the collet lock 13 and front end cap 15. In FIG. 1 and FIG. 1C the gap is small (outer collet 45 and collet lock 13 locked); in FIG. 1D, the gap is comparatively larger (outer collet 45 and collet lock 13 unlocked).

Returning, now, to FIG. 1, presentation air cylinder 33, turnbuckle 35, and presentation connecting rod 37 are visible through access portal 31 and are shown in a substantially retracted/rearward position. Also visible is large presentation sprocket 39 which is connected to presentation connecting rod 37 via dowel pin 71. Large presentation sprocket 39 rotates back (i.e., clockwise from the vantage point of FIG. 1) and forth (counterclockwise) between two endpoint loci during operation of the blind rivet installation tool 5; at stage one, the position of large presentation sprocket 39 is best described as being nearly fully clockwise rotated.

Turning, now, to FIG. 1A, a close-up cross-sectional view of nose assembly 43 is depicted. Inspection of this figure reveals an important subassembly, the pull rod assembly 73, which comprises jaw collet 47, jaws 49, jaw spring follower 51, jaw spring 53, pull rod 55, forward pull rod outer seal 57, dampening spring 59, pull rod coupling 101 (not shown in FIG. 1A), and pull rod sealing tube 103 (not shown in FIG. 1A).

During operation of the blind rivet installation tool 5, pull rod assembly 73 translates back and forth within nose assembly 43. At this stage one, it is shown in its forwardmost position.

In pull rod assembly 73, jaws 49 are positioned within jaw collet 47. The jaws 49 (through the action of adjacent jaw spring follower 51) are urged forward against jaw collet 47 by jaw spring 53 which abuts a stop within pull rod 55. When jaws 49 are urged forward against jaw collet 47, the outer frusto-conical surface of the jaws 49 and the inner frusto-conical surface of jaw collet 47 results in the jaws 49 being urged into a closed (i.e., radially inward) and forward position.

At stage one, as shown in FIG. 1A, the pull rod assembly 73 is in its forwardmost position. At that position, the forward face of jaws 49 impinges upon the rearmost face of nose insert 11; this action results in jaws 49 opening (i.e., extending radially outward), and translating backward with respect to jaw collet 47, the radially outward expansion opening the jaws 49 sufficiently (to the "rivet acceptance position") to receive the pintail of a rivet 3.

Turning, now, to FIG. 1B, FIG. 1C, FIG. 1D, and FIG. 1E, a series of figures is provided that reveals the operation of the collet lock actuating assembly 75.

FIG. 1B, an isometric drawing, depicts the collet lock actuating assembly 75 which comprises collet lock 13, collet lock bracket 41, clevis 63, clevis pin 65, collet lock air cylinder 61, pivot pin 67, right handle 69, and left handle 25 (not shown in FIG. 1B).

As shown in FIG. 1B, when air cylinder 61 is retracted, collet lock bracket 41 rotates clockwise (as viewed from the vantage point of FIG. 1B along the z-axis) about pivot pin 67 which is restrained by left handle 25 and right handle 69. When collet lock bracket 41 is so rotated, the collet lock bracket tongs 77, fitted so as to engage collet lock recesses 79, urge the collet lock 13 in a rearward direction relative to the nose assembly 43 and the front end cap 15.

Figure 1E:
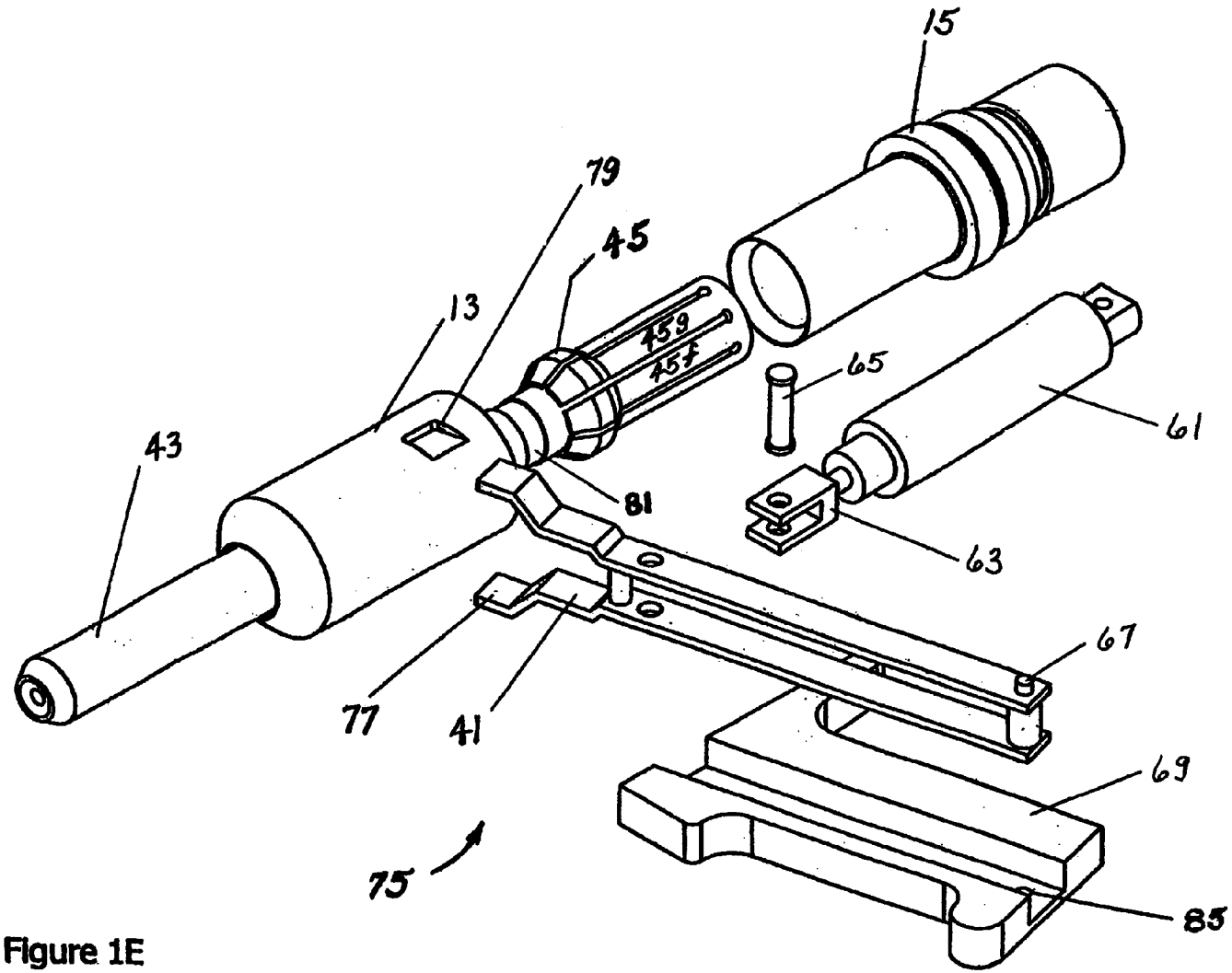
FIG. 1E is an exploded isometric view of the collet lock actuating assembly.

The details of FIG. 1B are clarified by reference to FIG. 1E which provides an exploded view of the collet lock actuating assembly 75. FIG. 1E reveals the shape of outer collet 45 and, importantly, the presence of the nose locking groove 81. It also shows the pivot pin recess 85 which receives pivot pin 67 so as to rotatably secure collet lock bracket 41.

FIG. 1C provides a close-up cross-sectional view of the outer collet 45, the collet lock 13, and portions of the nose assembly 43 and front end cap 15. Importantly, in FIG. 1C, the outer collet 45 is shown in the locked position, its position at stage one.

Note that the outer collet locking tooth 83 is fully seated within the nose locking groove 81, thus locking outer collet 45 in place and preventing forward or backward movement of nose 9 relative to front end cap 15. Note, as well, the presence of a very small gap between the forward face of outer collet locking tooth 83 and the forward face of nose locking groove 81. A similar gap, or tolerance, exists between the rearward face of outer collet locking tooth 83 and the rearward face of nose locking groove 81.

These gaps exist to ensure effective mating of outer collet locking tooth 83 and nose locking groove 81. However, it is desirable to substantially minimize these gaps in order to ensure that, for example, during stage two, when pull rod 55 is urged in a rearward direction relative to nose 9 and front end cap 15, at a time when it is desired to restrain rearward motion of the nose 9, nose 9 moves as little as practicable prior to the outer collet locking tooth 83 engaging the nose locking groove 81 so as to conserve installation stroke length.

Outer collet 45 features two frusto-conical surfaces on each of its respective tongs; reference to FIG. 1C reveals frusto-conical surface 45*a*1 and frusto-conical surface 45*e*2. These frusto-conical surfaces are designed to interact with corresponding frusto-conical surfaces on the collet lock (see surface 13(1)) and the front end cap (see surface 15(2)), so as to close the outer collet 45, as shown in FIG. 1C, or open the outer collet 45, as shown in FIG. 1D.

FIG. 1E depicts the three-dimensional shape of outer collet 45, while FIG. 1C and FIG. 1D depict its cross-sectional appearance. Notice, with reference to FIG. 1E, that the outer collet 45 features a plurality of angularly spaced outer collet tongs; in the preferred embodiment shown herein, the outer collet tongs are designated 45*a*, 45*b*, 45*c*, 45*d*, 45*e*, 45*f*, 45*g*, and 45*h*. Outer collet 45 acts as a spring, and it is produced in such a manner that, when it is at its at-rest, or "open" position, as shown in FIG. 1D, the outer collet tongs 45*a*, 45*b*, 45*c*, 45*d*, 45*e*, 45*f*, 45*g*, and 45*h* "spring open" so as to expand radially and to separate themselves from one another, and from the nose axis 89, to a greater extent than would be the case if the spring were in its radially compressed, or "closed" position, as shown in FIG. 1C. Note the contrast in the position of outer collet tong 45*a* as shown in FIG. 1C and FIG. 1D; in FIG. 1D, outer collet tong 45*a* is "sprung open" to such an extent that the innermost surface of outer collet locking tooth 83 is radially outside of the outer surface of nose 9, while, in FIG. 1C, outer collet tong 45*a* has been radially compressed, or "closed", to such an extent that the innermost surface of outer collet locking tooth 83 is fully seated within nose locking groove 81 as described above.

The methods and means by which such an outer collet 45, featuring a spring constant, is produced are well-known to those of ordinary skill in the art of collet manufacture. One method of manufacture would involve the heat treatment of a collet, said collet sprung open prior to heat treat by a predetermined amount, so that the collet naturally features the desired quality of springing open in an outward radial direction after a radially inwardly compressive force is removed.

A comparative study of FIG. 1D and FIG. 1C reveals the manner by which collet lock 13 and front end cap 15 cooperate so as to move outer collet 45 from an unlocked position to a locked position. In FIG. 1D, the outer collet 45 is, as described above, shown in an unlocked, or "open", position. Notice the forwardly displaced position of collet lock 13. Notice, as well, that, when outer collet tong 45*a* springs radially outward, its natural spring-based tendency, smooth frusto-conical surfaces 45*a*(2) through 45*h*(2) impinge upon frusto-conical surface 15(2) and, due to the outer collet 45 spring constant, outer collet 45 expands radially outward and translates forward as shown (the translation generating a small longitudinal gap between the rearmost surface of outer collet 45 and the forwardmost face of front end cap outer collet seat 87). In this unlocked position, nose 9 can slide, in a longitudinal direction, smoothly and easily past outer collet 45 without interference.

When it is desired to move outer collet 45 from the unlocked position shown in FIG. 1D to the locked position shown in FIG. 1C, the collet lock 13 is translated backwards (owing to the action of, among other things, collet lock bracket 41, as described above). The backwards movement of collet lock 13 results in surface 13(1) impinging upon surfaces 45*a*(1) through 45*h*(1), with the result being that outer collet 45 is translated backwards and radially compressed, so that, as shown in FIG. 1C, when outer collet 45 is indeed locked, frusto-conical surface 13(1) has fully engaged and matched frusto-conical surfaces 45*a*(1) through 45*h*(1), frusto-conical surface 15(2) has fully engaged frusto-conical surfaces 45*a*(2) through 45*h*(2), and outer collet locking tooth 83 is fully seated within nose locking groove 81.

At this juncture, several aspects of the design of outer collet 45 can now be appreciated.

The longitudinal length of outer collet 45 minimizes the force necessary to radially compress the cantilever outer collet tongs, such as outer collet tong 45*a*, and thus close the collet. This minimizes the work to be done by the collet lock actuating assembly 75 in closing the outer collet 45. Furthermore, the length also minimizes the bending stresses at work within the outer collet 45 as it moves back and forth from its locked and unlocked positions.

As described above, collet lock 13, outer collet 45, front end cap 15, outer collet locking tooth 83, and nose locking groove 81 have all been designed so that their respective mating surfaces, including their respective cylindrical and frusto-conical surfaces, as described above, meet and effectually match. In addition, outer collet 45, as described above, has been designed so that, when it is fully radially compressed to its closed and locked position, the innermost diameter of outer collet locking tooth 83 effectually matches the outside diameter of the nose locking groove 81; in addition, when outer collet 45 is fully radially compressed to its closed and locked position, the inner diameter of the outer collet tongs proximate to (but outside) the outer collet locking teeth effectually matches the outside diameter of the nose 9. These geometric fits, coupled with the longitudinal length of the collet lock 13, accomplish several valuable design objectives.

The collet lock 13, with its longitudinal length and frusto-conical surface 13(1), cooperates with front end cap 15, with its longitudinal length and frusto-conical surface 15(2), to insure that outer collet 45 is always in precise longitudinal and radial alignment so that outer collet locking tooth 83 easily drops into nose locking groove 81 with only a modicum of force. It is helpful to note that outer collet locking tooth 83 is not clamped into nose locking groove 81; rather, it is fitted into place, and this fitting occurs primarily as a result of a modicum of inwardly radially compressive force being applied to the outer collet tongs so as to bring the inner surface of the outer collet tongs adjacent to (but outside) the outer collet locking teeth into union with the outer surface of the nose 9. In short, when the outer collet 45 is closed, a fairly precise slip fit occurs.

The design rationale for the slip fit lies in an appreciation for the fact that outer collet 45 effectuates its intended purpose when, during stage two, the outer collet locking tooth 83 engages nose locking groove 81 so as to restrain the rearward motion of the nose 9 when pull rod 55 is urged in a rearward direction relative to nose 9. As can be seen from an inspection of FIG. 1C, when pull rod 55 is urged rearward, the forwardmost face of outer collet locking tooth 83 fully engages the forwardmost face of nose locking groove 81. During stage two, the sheer forces developed at this juncture are substantial, and a design objective of the collet lock actuating assembly 75 is to ensure that the outer collet locking tooth 83 is fully seated within the nose locking groove 81 (with the forwardmost face of outer collet locking tooth 83 meeting the forwardmost face of nose locking groove 81 across their entire respective surface areas), so that the outer collet locking tooth 83, which features a substantial longitudinal x-axis dimension, can withstand the substantial sheer forces imparted by the forwardmost face of nose locking groove 81.

The sheering force imparted upon outer collet locking tooth 83 is transferred by the action of the rearmost surface of outer collet 45 upon the forwardmost face of front end cap outer collet seat 87 which it meets (note: when outer collet 45 is open, as shown in FIG. 1D, there is a small gap between the rearmost surface of outer collet 45 upon the forwardmost face of front end cap outer collet seat 87). Front end cap 15 is secured in position relative to the blind rivet installation tool 5 by means of a threaded connection to hydraulic cylinder 17 as more fully described below.

Outer collet 45 is preferably made of a high-strength, fatigue-resistant, alloy steel.

Nose 9 can be constructed of numerous alloys, provided that the front surface of the nose locking groove 81 is capable of withstanding the bearing stresses generated at stage two when it meets outer collet locking tooth 83. Thus, the nose could be functionally and effectually constructed of any alloy which meets this technical requirement or, alternatively, for example, it might also be manufactured of a lower-strength alloy which has been surface treated so as to yield the desired performance.

The collet lock 13 is preferably made of a plastic featuring a low coefficient of friction, so as to both smoothly manipulate the outer collet 45 and to act as a forward guide for the reciprocating longitudinal movement of nose 9.

The front end cap is preferably made of a high-strength aluminum alloy to provide the necessary strength and wear characteristics while simultaneously minimizing weight.

Returning, finally, and briefly, to FIG. 1, it will be appreciated that rivet 3*a* is shown in the "rivet ready" position, with nose assembly 43 fully extended, and the next rivet in succession, rivet 3*b*, obscured from view, is still contained within the clip-fed rivet delivery system 7, awaiting its turn to be presented to the nose assembly 43 after rivet 3*a* has been installed and nose assembly 43 has been retracted/reciprocated to the rear.

From an automation/computerized control standpoint, the preferred embodiment of collet lock air cylinder 61 (as well as presentation air cylinder 33 and reciprocation air cylinder 21 referred to hereinbelow) is an air cylinder system which emits feedback signals to the system controller verifying the actual position of the air cylinder so as to facilitate effective control. For example, some air cylinder systems are referred to colloquially in the industry as "magnetic air cylinders" in that they feature the use of magnetic rings and sensors (e.g., hall effect sensors) to generate feedback signals which are easily interpreted by the system controller. Through the use of these kinds of systems, or their equivalents, the locked/unlocked condition of the outer collet 45 can be precisely and continuously controlled.

Stage Two: Inner Collet Closure.

Figure 2:
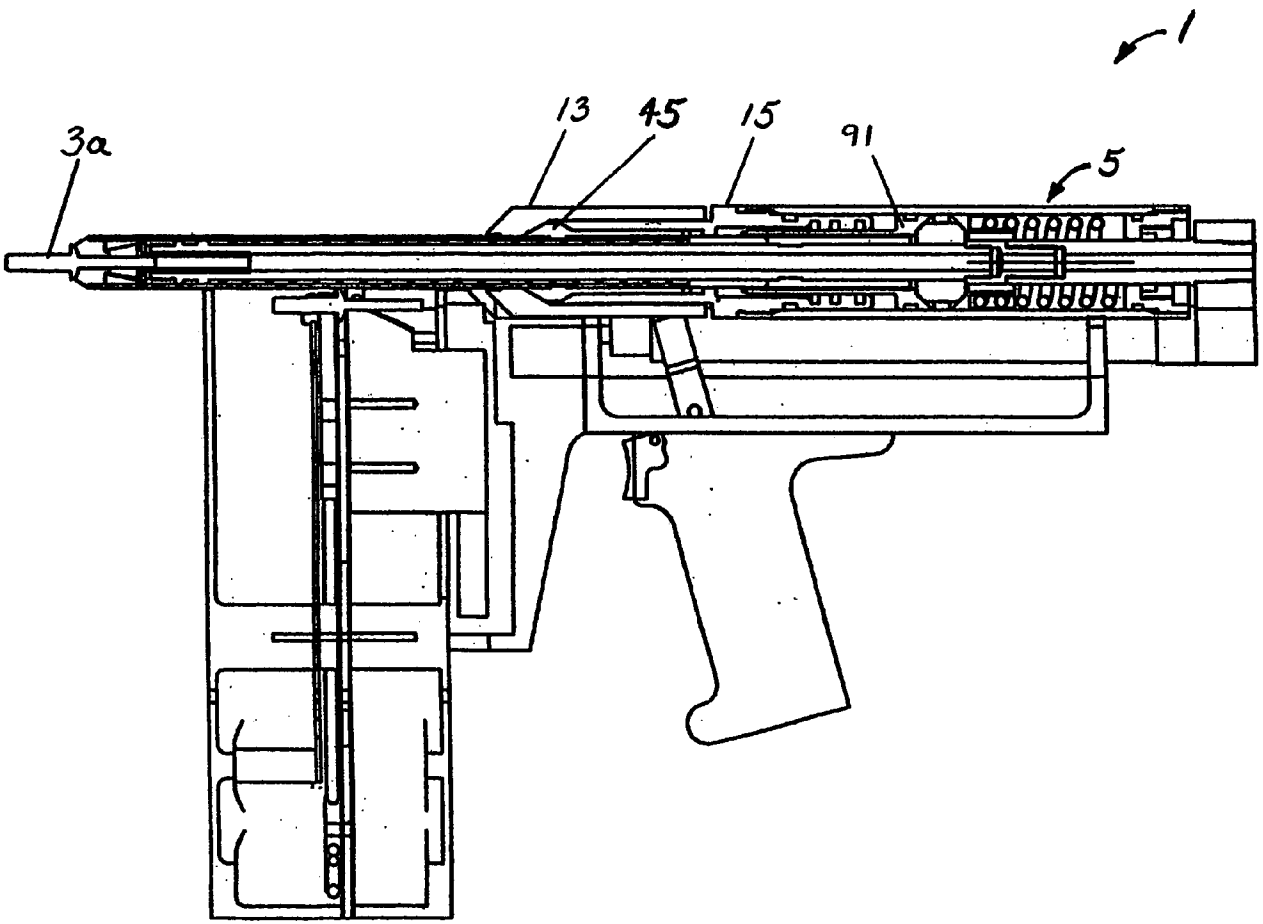
FIG. 2 is a side cross-sectional view of the invention at stage two of the fastener installation process described herein.

Turning now to FIG. 2, the blind rivet installation tool 5 is shown in its position/state during stage two of the blind rivet installation process. This stage features complete inner collet closure and shoulder engagement, as more fully described below.

Referring to FIG. 2, the reader will appreciate, based upon the description provided above, that the collet lock 13 and outer collet 45 are in their respective locked positions. An understanding of the operation of the blind rivet installation tool 5 in stage two is best developed by reference to a number of the tool components positioned in a more rearward location within the tool, as shown in FIG. 2A.

Figure 2A:
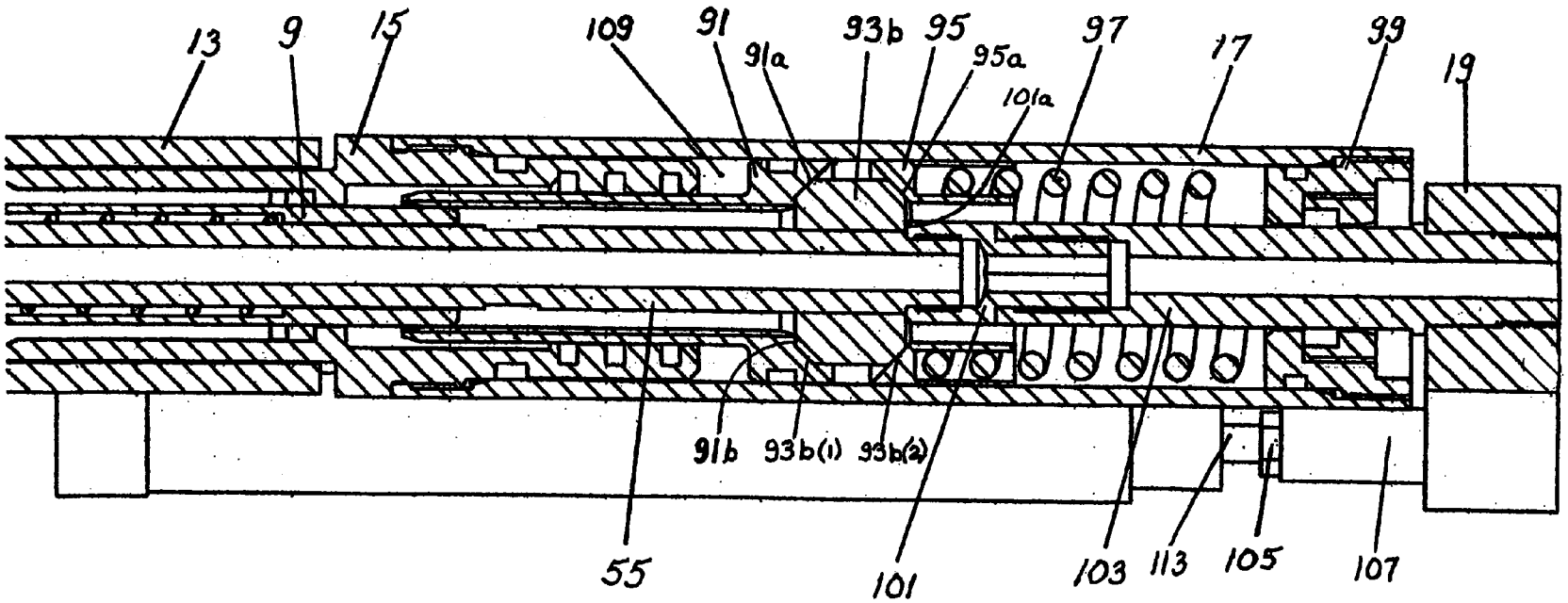
FIG. 2A is an enlarged side cross-sectional view of a rearward portion of the invention at stage two of the fastener installation process described herein.

Referring, now, to FIG. 2A, the reader will observe that piston 91 has been displaced in a rearward direction from front end cap 15 as a result of the introduction of hydraulic fluid into piston cavity 109.

At stage one, the piston 91 is abutted to front end cap 15. At stage two, shortly after trigger 29 is actuated, hydraulic fluid is introduced at high pressure into piston cavity 109. As a result, piston cavity 109 expands and piston 91 translates rearward to the position shown in FIG. 2A.

As piston 91 translates rearward, its frusto-conical surface 91*a* impinges upon the forward frusto-conical surfaces of inner collet 93.

Inner collet 93 consists of a plurality of inner collet members acted upon by a plurality of inner collet springs. In the preferred embodiment shown herein, there are two inner collet members, inner collet member 93*a* and inner collet member 93*b*. Inner collet member 93*a* and inner collet member 93*b* are centered about nose axis 89, and are urged in a radially outward direction by a plurality of inner collet springs 111; in the preferred embodiment shown herein, this is effectuated by inner collet springs 111*a*, 111*b*, 111*c*, and 111*d*. Compare FIG. 15 (which depicts inner collet 93 in its open, outwardly radially expanded, position) with FIG. 16 (which depicts inner collet 93 in its closed, inwardly radially contracted, position).

Returning, now, to FIG. 2A, inner collet member 93*b* features a forward frusto-conical surface 93*b*(1) and a rearward frusto-conical surface 93*b*(2). As piston 91 translates rearward, its frusto-conical surface 91*a* impinges upon the forward frusto-conical surfaces 93*a*(1) and 93*b*(1) of inner collet 93, and, in turn, the rearward frusto-conical surfaces 93*a*(2) and 93*b*(2) of inner collet 93 impinge upon inner collet spring follower 95 at inner collet spring follower frusto-conical surface 95*a*.

As piston 91 translates rearward, and its frusto-conical surface 91*a* impinges upon the forward frusto-conical surfaces 93*a*(1) and 93*b*(1), inner collet member 93*a* and inner collet member 93*b* are translated rearward and simultaneously radially compressed inward as they are slidably re-positioned deeper within the frusto-conical piston surface 91*a* and inner collet spring follower frusto-conical surface 95*a*. This rearward translation and radial compression continues until the inner collet 93 reaches its fully closed position as shown in FIG. 2A and FIG. 16.

Figure 15:
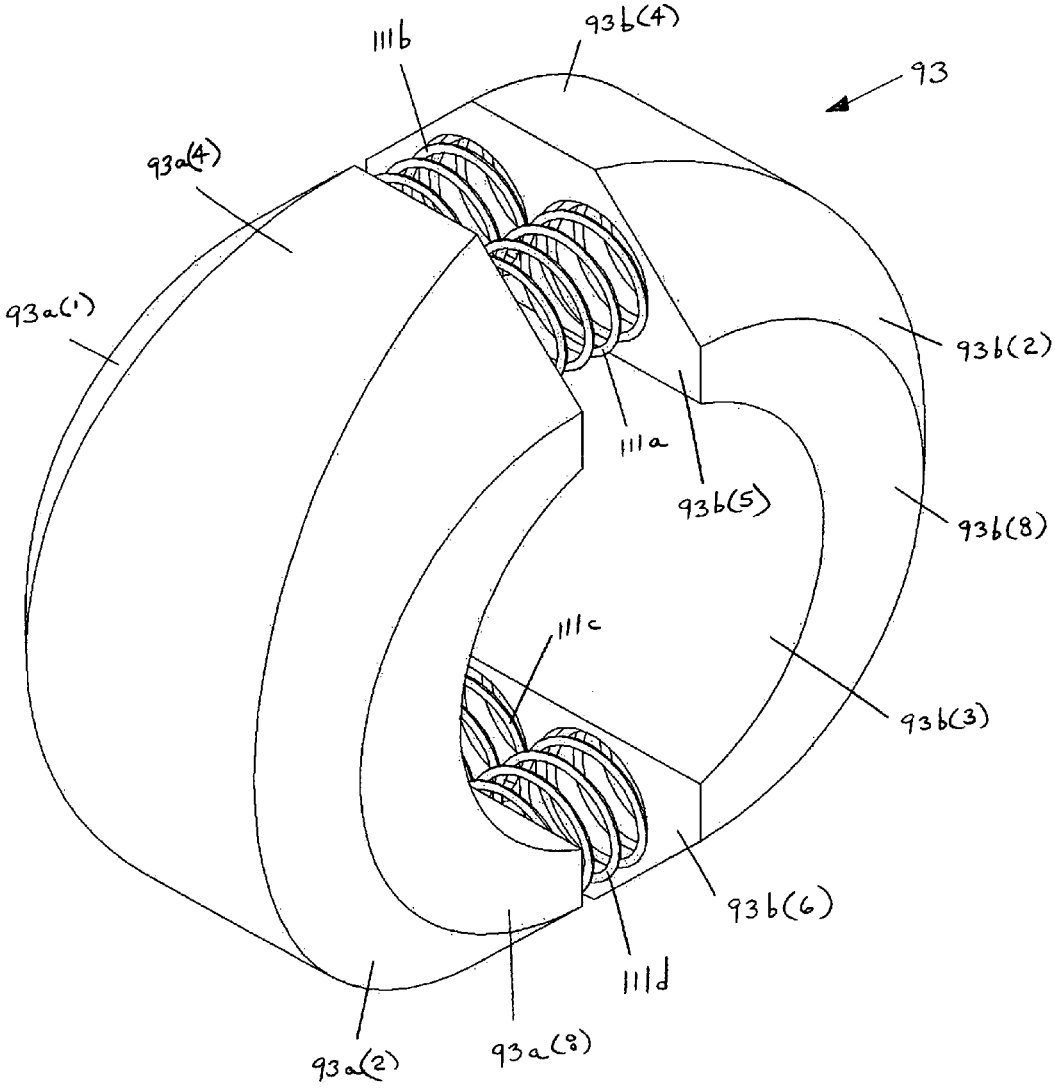
FIG. 15 is an isometric view of the inner collet in its open position.
Figure 16:
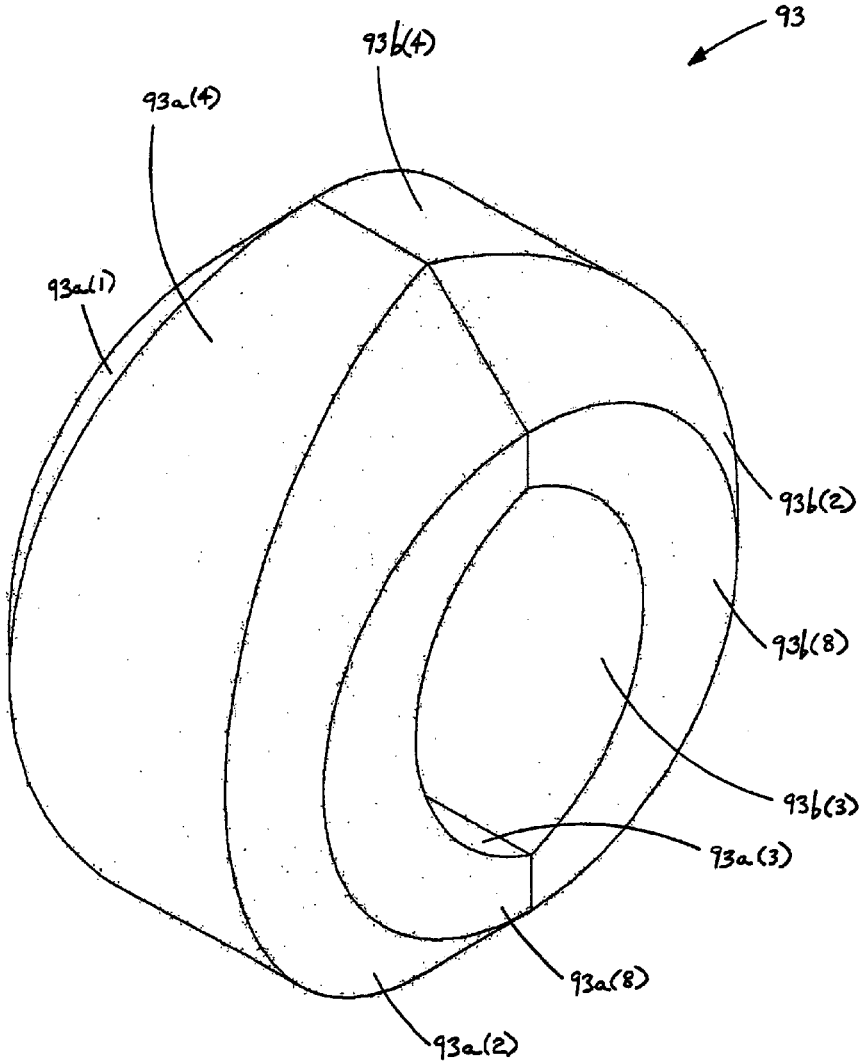
FIG. 16 is an isometric view of the inner collet in its closed position.

An inspection of FIG. 15 and FIG. 16, depicting the shape of inner collet 93 in its open and closed positions respectively, reveals that each inner collet member features no less than eight major utilitarian surfaces. Inner collet member 93*b*, for example, features:

(a) forward frusto-conical surface 93*b*(1);
(b) rearward frusto-conical surface 93*b*(2);
(c) inner cylindrical surface 93*b*(3);
(d) outer cylindrical surface 93*b*(4);
(e) first mating surface 93*b*(5);
(f) second mating surface 93*b*(6);
(g) forward bearing surface 93*b*(7); and
(h) rearward bearing surface 93*b*(8).

When inner collet 93 is fully closed, as shown in FIG. 2A and FIG. 16, the inner collet members have been inwardly radially compressed to such a complete extent that the mating surfaces of the inner collet members fully meet. In the embodiment shown, the mating surfaces of inner collet member 93*a* (i.e., the first mating surface 93*a*(5) and second mating surface 93*a*(6)) meet with the mating surfaces of inner collet member 93*b* (i.e., the first mating surface 93*b*(5) and second mating surface 93*b*(6)).

Furthermore, the inner collet members have been inwardly radially compressed to such a complete extent that the inner collet member inner cylindrical surfaces, such as inner collet member inner cylindrical surface 93*b*(3), approach and loosely, but closely, fit about and opposite the outer cylindrical surface of pull rod 55.

It should also be understood that, when the inner collet members have been fully inwardly radially compressed as shown, the inner collet rearward bearing surface 93*b*(8) has been radially re-positioned such that it is now in a longitudinally oppositional position with respect to the forwardmost bearing surface 101*a* of pull rod coupling 101. In particular, note that the inner collet rearward bearing surface 93*b*(8) has been brought radially within the reach of the forwardmost surface 101*a* of pull rod coupling 101 (pull rod coupling 101 being threadedly affixed to pull rod 55); thus, in stage three, as additional hydraulic fluid is introduced under high pressure into piston cavity 109, the inner collet rearward bearing surface 93*b*(8) will impinge upon the forwardmost bearing surface 101*a* of pull rod coupling 101.

At this point, several things about inner collet 93 can be appreciated.

When inner collet 93 is in its fully closed position, as shown in FIG. 2A and in FIG. 16, it doesn't clamp upon pull rod 55; rather, it is loosely fitted about pull rod 55. The key to the effective use of inner collet 93 is that, when it is compressed to its fully closed position, a substantial and effective surface area within inner collet rearward bearing surface 93*b* (8) is brought into effective oppositional alignment with the forwardmost bearing surface 101*a* of pull rod coupling 101. Similarly, when it is compressed to its fully closed position, the inner collet member forward bearing surfaces, such as inner collet member forward bearing surface 93*b*(7), meet a substantial and effective surface area within the rearward bearing surface 91*b* of piston 91.

When inner collet 93 is translated rearward by the action of piston 91, it is actuating spring 97 (constrained by rear end cap 99 which is threadedly connected to hydraulic cylinder 17) that provides the resistance which results in the inner collet 93 being simultaneously radially compressed inward as it is slidably re-positioned deeper within the frusto-conical piston surface 91*a* and inner collet spring follower frusto-conical surface 95*a*. Thus, it is essential to pre-set the spring constant of actuating spring 97 such that it is much greater than the spring constant of the inner collet springs 111, so that the inner collet 93 rapidly closes and opens during the cyclic rearward and forward motion of piston 91 with a minimal amount of piston stroke.

Another salient feature of inner collet 93 is its unique shape. See FIG. 15 and FIG. 16. As discussed herein, inner collet 93 moves back and forth between its open position (i.e., its forward, outwardly radially expanded, position, e.g., at stage one) as shown in FIG. 15 and its closed position (i.e., its rearward, inwardly radially compressed, position, e.g., at stage two) as shown in FIG. 16. The shape of inner collet 93 (i.e., the shape of the inner collet members, such as, in the embodiment shown in this specification, inner collet member 93*a* and 93*b*) is driven by the desired shape of inner collet 93 at its respective open and closed positions as well as by its desired performance between these two points.

Figure 6:
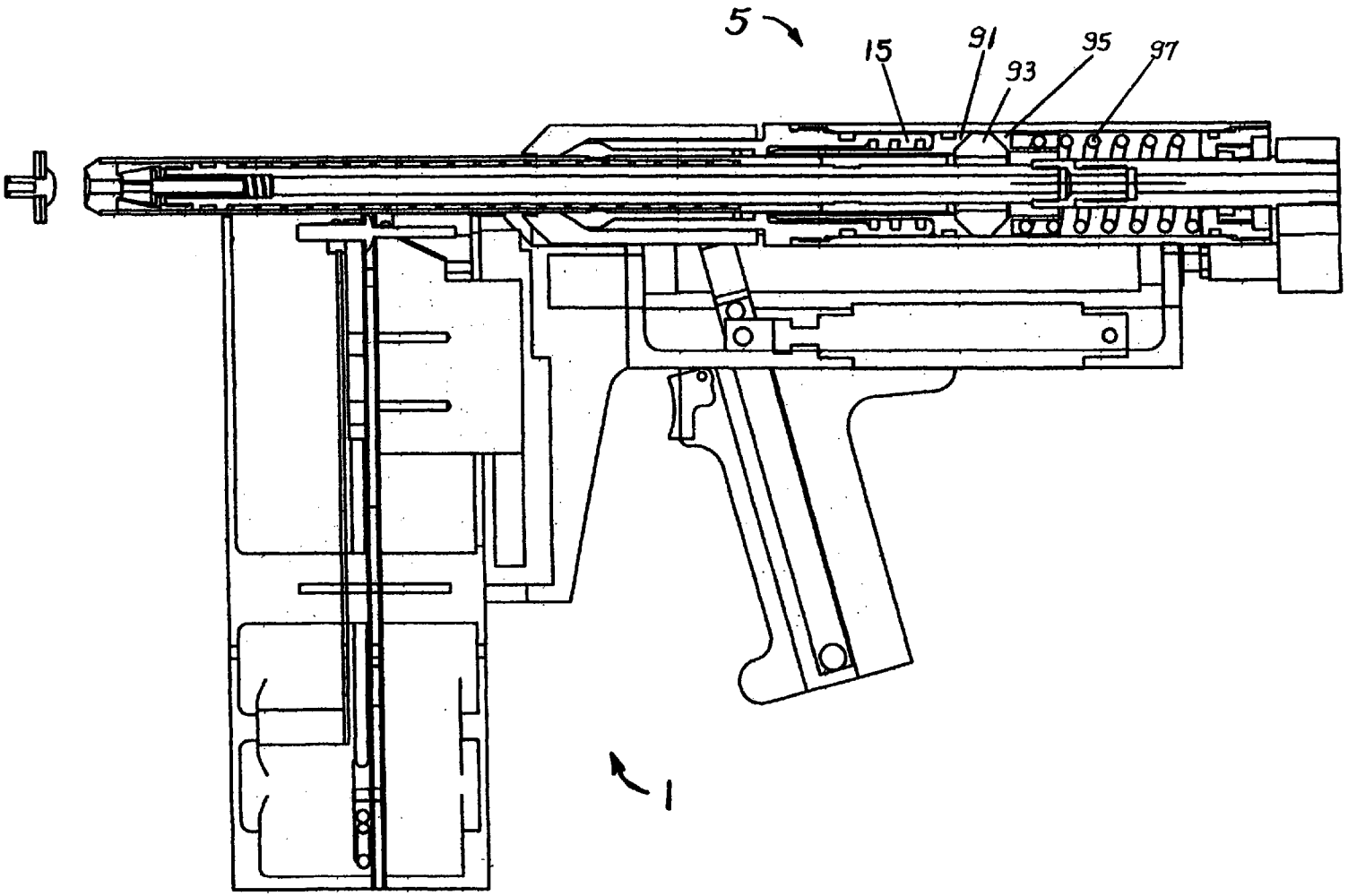
FIG. 6 is a side cross-sectional view of the invention at stage six of the fastener installation process described herein.
Figure 6A:
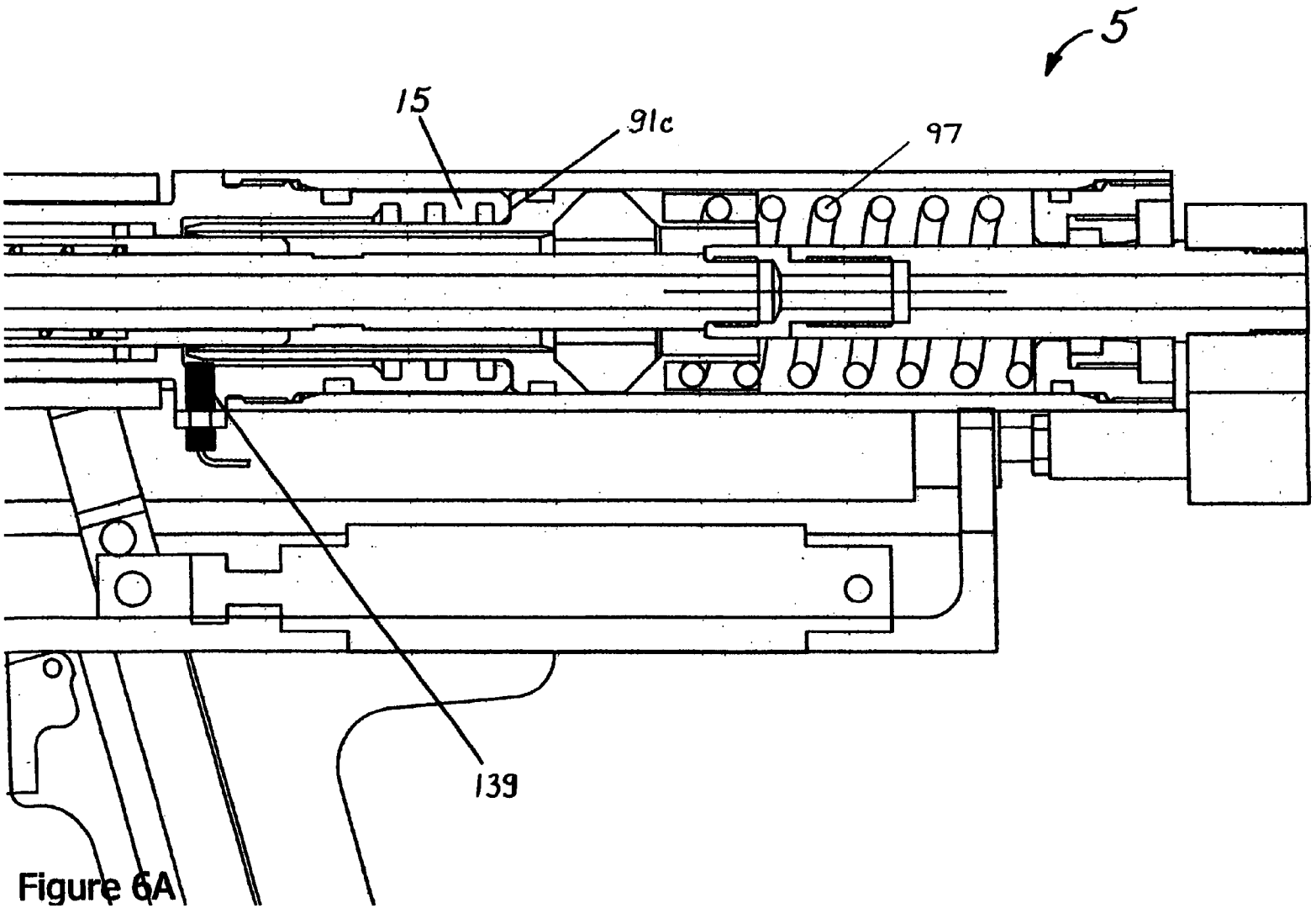
FIG. 6A is an enlarged side cross-sectional view of a rearward portion of the invention at stage six of the fastener installation process described herein.

In its open position, as shown in FIG. 6, FIG. 6A, and FIG. 15, and focusing specifically upon the forward portions of inner collet member 93*b*, it is desired for forward frusto-conical surface 93*b*(1) to effectively meet the radially outer portion of piston rearward frusto-conical surface 91*a*. By contrast, in its closed position, as shown in FIG. 2 and FIG. 16, and focusing specifically upon the forward portions of inner collet member 93*b*, it is desired for forward frusto-conical surface 93*b*(1) to effectively meet the radially inner portion of piston rearward frusto-conical surface 91*a*. It is also desired for inner collet 93 to smoothly glide between these two states as it is cyclically reciprocated between its open and closed positions.

Finally, returning to the overall state of blind rivet installation tool 5 at stage two, it should be noted that, although hydraulic fluid has entered piston cavity 109, and piston 91 has stroked rearward, resulting in inner collet 93 translating rearward and closing radially inwardly to its fully closed position, pull rod coupling 101 and pull rod 55 have not, as yet, moved longitudinally.

From an automation/computerized control standpoint, it is helpful to configure the system controller so that, if the operator of the tool releases the trigger 29 at any point prior to stage four (which occurs immediately after pintail break), the system controller initiates a controlled abort or reset of the installation process. For example, in such a case, the system controller would initiate a controlled reduction/release of hydraulic pressure, and the piston return techniques described in stage five and stage six would be employed.

Stage Three: Rivet Installation Complete Except for Pin Break.

Figure 3:
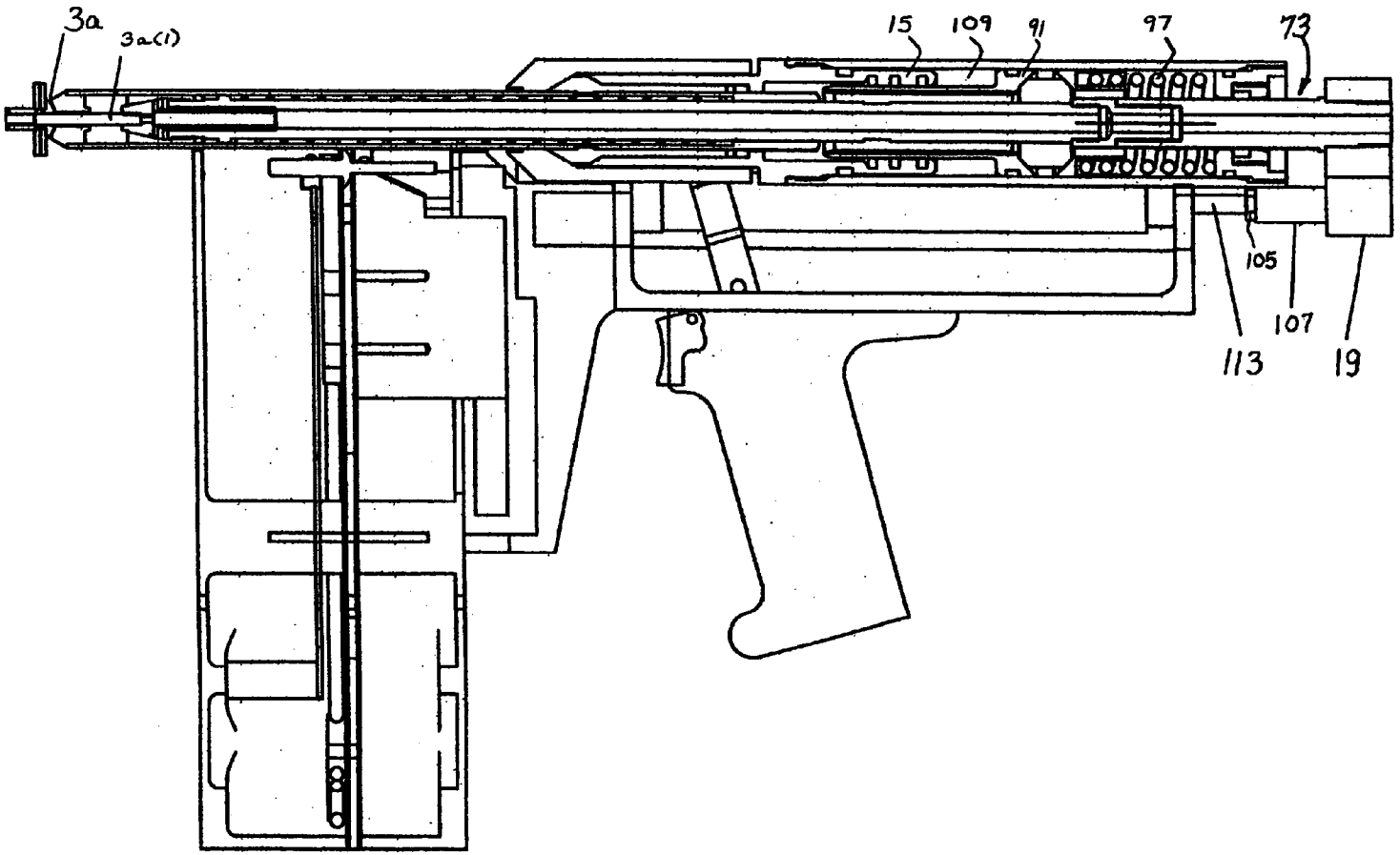
FIG. 3 is a side cross-sectional view of the invention at stage three of the fastener installation process described herein.
Figure 3A:
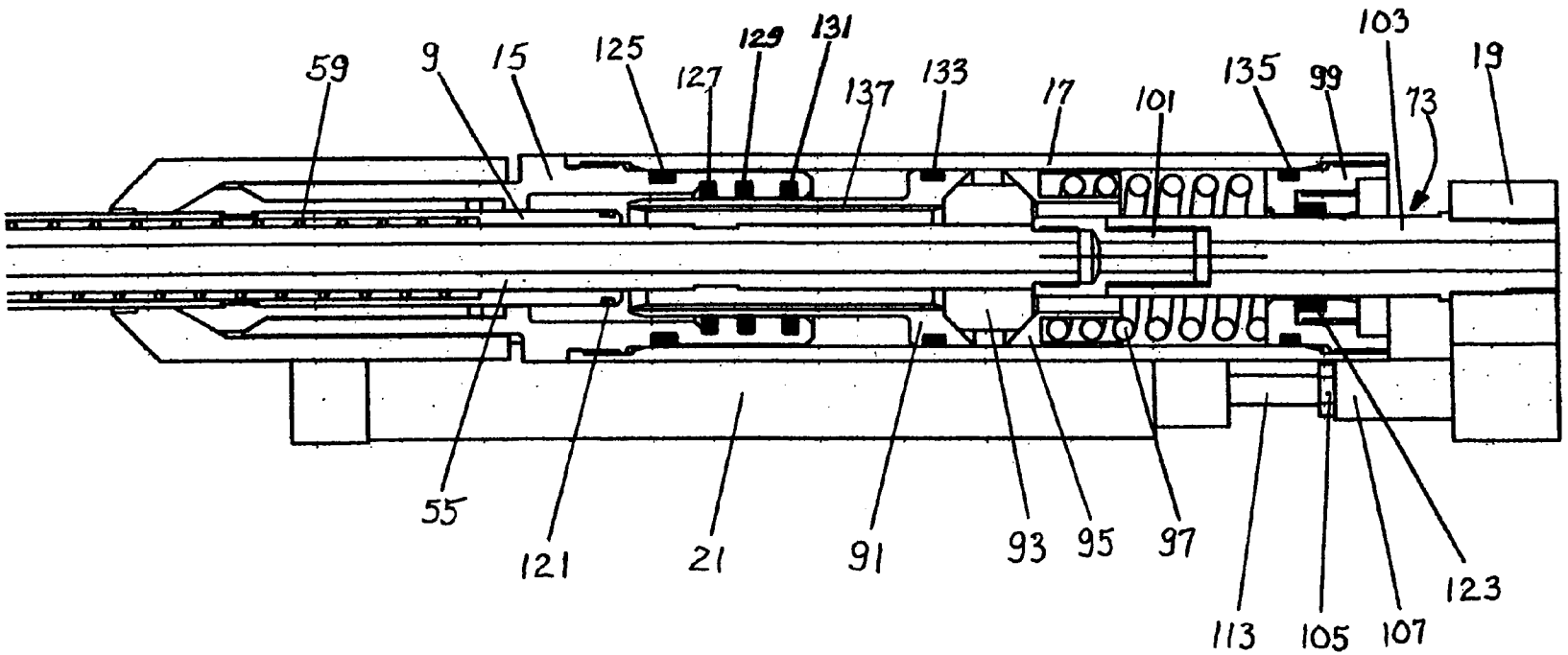
FIG. 3A is an enlarged side cross-sectional view of a rearward portion of the invention at stage three of the fastener installation process described herein.
Figure 3B:
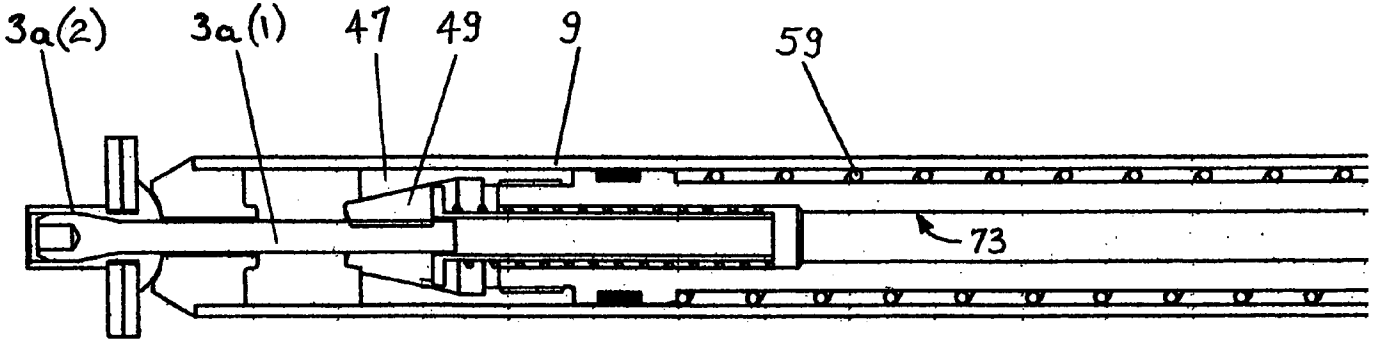
FIG. 3B is an enlarged side cross-sectional view of a forward portion of the invention at stage three of the fastener installation process described herein.

Turning, now, to FIG. 3, FIG. 3A, and FIG. 3B, the blind rivet installation system 1 is shown at stage three in the blind rivet installation process; that is, the blind rivet installation system 1 is shown in the state experienced when the installation of rivet 3 is nearly complete except for pin break (i.e., the breaking of the rivet pintail that occurs at the conclusion of rivet installation).

FIG. 3 (which reveals blind rivet installation system 1 status at stage three) is probably most easily understood and appreciated by a comparative study of it alongside FIG. 2 (which reveals blind rivet installation system 1 at stage two). Note that, in FIG. 3, and as particularly depicted in FIG. 3A, pull rod assembly 73, bridge 19, bridge coupling 107, retention nut 105, and reciprocation air cylinder extension rod 113 have been longitudinally displaced in a rearward direction relative to their respective positions shown in FIG. 2.

The displacement of pull rod assembly 73 has occurred over substantial resistance. The ultimate source of resistance: the rivet 3*a*.

Recall that, at stage one, as shown in FIG. 1A, the pull rod assembly 73 is in its forwardmost position. At that position, the forward face of jaws 49 impinges upon the rearmost face of nose insert 11; this action results in jaws 49 opening (i.e., extending radially outward), and translating backward with respect to jaw collet 47, the radially outward expansion opening the jaws 49 sufficiently (to the "rivet acceptance position") to receive the pintail of a rivet 3.

Now, at stage three, as shown in FIG. 3 and FIG. 3B, as the pull rod assembly 73 is translated towards the rear, the segmented jaws 49 now close (i.e., inwardly radially compress) upon the pintail 3*a*(1) of rivet 3*a*. Furthermore, as the translation of pull rod assembly 73 continues, the inwardly radially compressive force of the jaw collet 47 increases, thus increasing the substantially normal force (i.e., the "bite") the jaw collet 47 and the jaws 49 exert upon the pintail 3*a*(1) of rivet 3*a*.

Increases in the inwardly radially compressive force of jaw collet 47 and jaws 49 continue to occur as additional fluid is introduced under high pressure into piston cavity 109, which, as shown in FIG. 3, further rearwardly displaces pull rod assembly 73 thus increasing the longitudinal pulling force being exerted by the pull rod assembly 73 upon rivet 3*a*. The additional hydraulic fluid in piston cavity 109, and the displacement of pull rod assembly 73, is most easily recognized in FIG. 3 and FIG. 3A by noting, as compared with FIG. 2, the increased longitudinal distance between front end cap 15 and piston 91. The rearward displacement of pull rod assembly 73 is also evidenced by the compression of actuating spring 97 as also shown in FIG. 3 and FIG. 3A.

Rivets 3 are designed to deform under the influence of the pulling force generated by the pull rod assembly 73, and, in FIG. 3B, the deformation of rivet 3*a* is apparent in the region designated as deformation region 3*a*(2). This deformation, in fact, is what secures the rivet 3*a* in place and enables the performance of a "blind" installation (i.e., installation performed by immediately accessing only one physical side/face of the members to be joined) of the rivet 3*a*.

From an automation/computerized control standpoint, it is helpful to note that sensors continuously monitor the building hydraulic pressure which characterizes this stage. If abnormalities in the expected time-sequenced build and release of pressure occur, the system controller initiates a controlled abort or reset of the installation process. For example, if the hydraulic pressure profile occurs as expected (i.e., the hydraulic pressure builds as expected), then, if, for some reason, pintail break is unduly delayed, a controlled abort or reset of the installation process is executed by the controller. If, for example, the hydraulic pressure profile is abnormal (e.g., the pressure builds unusually slowly as it might if no rivet pintail was in position within nose insert 11 at the time the trigger 29 was depressed), then, again, a controlled abort or reset of the installation system may be effectuated.

Stage Four: Rivet Installation Post Pin Break.

Figure 4:
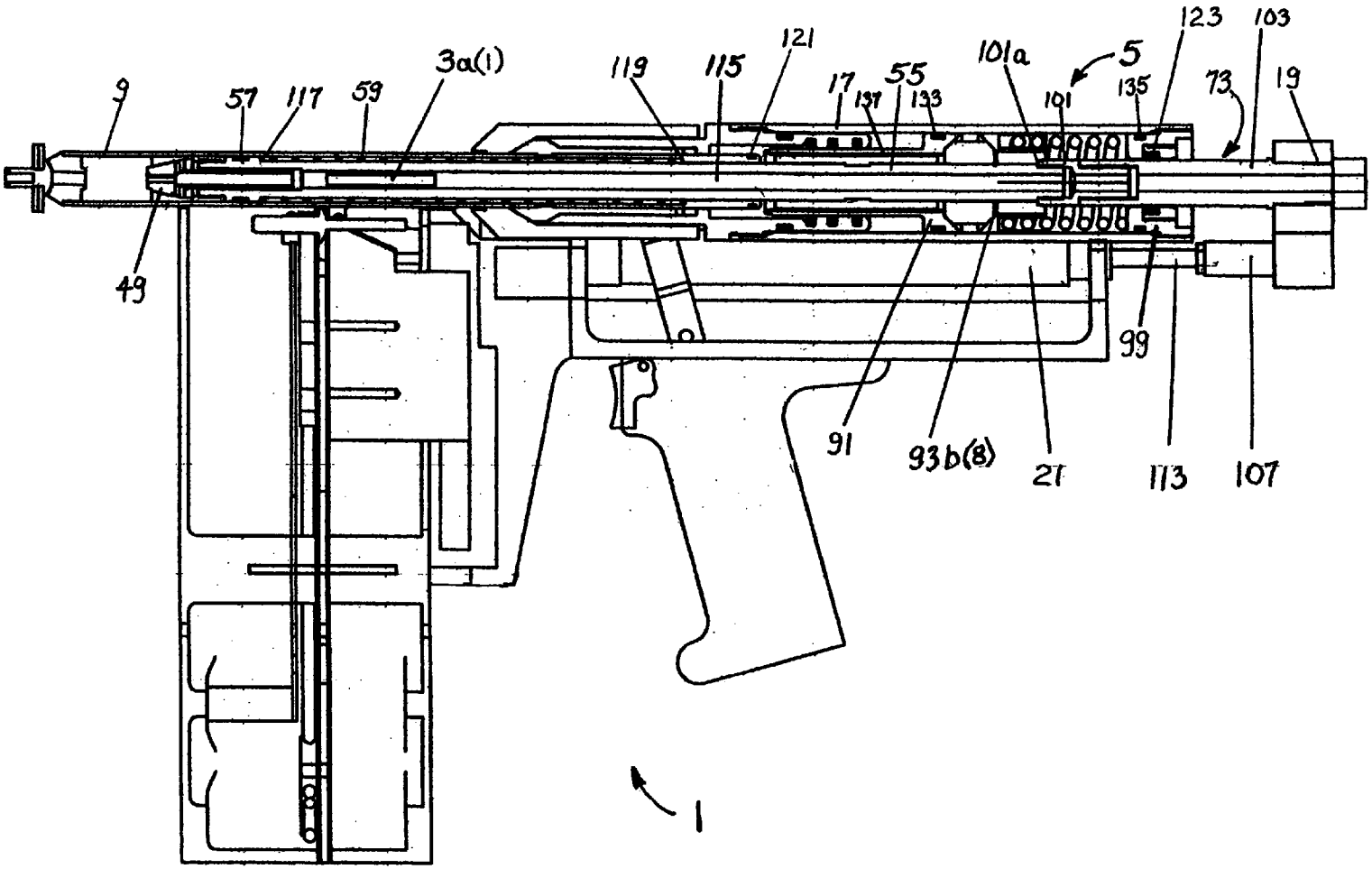
FIG. 4 is a side cross-sectional view of the invention at stage four of the fastener installation process described herein.

Turning, now, to FIG. 4, the blind rivet installation system 1 is shown at stage four in the blind rivet installation process; that is, the blind rivet installation system 1 is shown in the state experienced immediately after the installation of rivet 3 is completed and pintail break occurs.

The events immediately following pintail break are graphically depicted in FIG. 4. The reader will recall that, during stage three, as described hereinabove, pintail portion 3*a*(1) of rivet 3*a* has been pulled rearward with great force by jaws 49; at this instant in time, at stage four, immediately after pintail break occurs, pintail portion 3*a*(1) of rivet 3*a* has been accelerated rearward, released by jaws 49, and is thereby projected rearward at high speed through blind rivet installation tool 5 within the pull rod inner cavity 115 of pull rod 55 as shown in FIG. 4.

At this point in time after pintail break, pull rod assembly 73, now freed of the resistance provided by rivet 3*a*, translates rearward at high speed. This high-speed rearward translation can be readily appreciated in FIG. 4 by inspection of the displacement of bridge 19 from rear end cap 99. Similarly, a clear rearward displacement of the pull rod assembly 73 is evident from the distance between the forwardmost face 101*a* of pull rod coupling 101 from the rearward bearing surface 93*b*(8) of inner collet 93.

As the pull rod assembly 73 translates backward, it is rapidly, but smoothly, decelerated by the action of dampening spring 59. Dampening spring 59 fulfills one of its intended functions in dampening the shock, or "recoil", associated with pintail break as a result of its being secured between the dampening spring pull rod stop 117 (located on the forward exterior surface of pull rod 55) and the dampening spring nose stop 119 (located on the rearward interior surface of nose 9). This spring is preferably manufactured of high-strength spring steel, and it is believed that dampening spring 59 will enjoy a long useful life if it is designed so that, at the point of maximum compression (which occurs during recoil), it is compressed to no more than approximately forty percent of its at-rest length.

It should also be noted that pull rod assembly 73 is threadedly connected to bridge 19 which is, in turn, and in functional succession, connected to bridge coupling 107 and reciprocation air cylinder extension rod 113 of reciprocation air cylinder 21. Reciprocation air cylinder 21, as described more fully below, is useful in stage eight in effectuating reciprocation of the nose assembly 43. However, it is also useful here.

By metering the valve assemblies associated with reciprocation air cylinder 21, in accordance with means well-known to persons of ordinary skill in the art, it is possible to use reciprocation air cylinder 21 to assist dampening spring 59 in managing the pull rod assembly 73 movement that occurs after pintail break. For example, some dampening can be derived as an immediate result of the work being done in translating the at-rest reciprocation air cylinder piston rearward. The dampening can be increased if the reciprocation air cylinder 21 is pressurized so that the translation requires additional work; indeed, even the nature of the dampening (e.g., linear, non-linear) can be varied through metering the valve assemblies associated with reciprocation air cylinder 21, all in accordance with means well-known to persons of ordinary skill in the art.

In addition to dampening through the use of dampening spring 59 and/or the use of reciprocation air cylinder 21, dampening may be effected through the use of seals which serve to create a substantially airtight rearward cavity within blind rivet installation tool 5.

Figure 5:
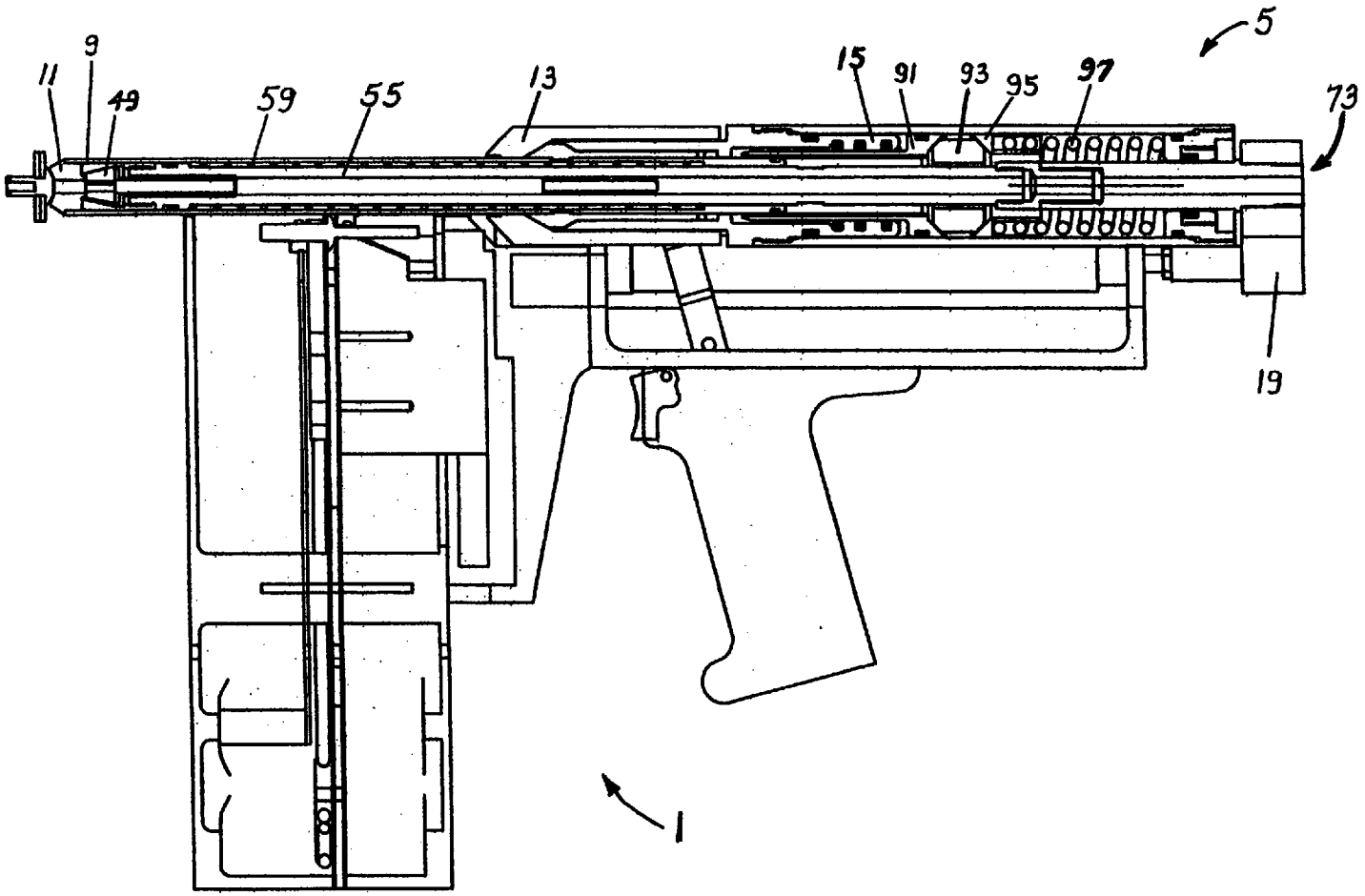
FIG. 5 is a side cross-sectional view of the invention at stage five of the fastener installation process described herein.
Figure 5A:
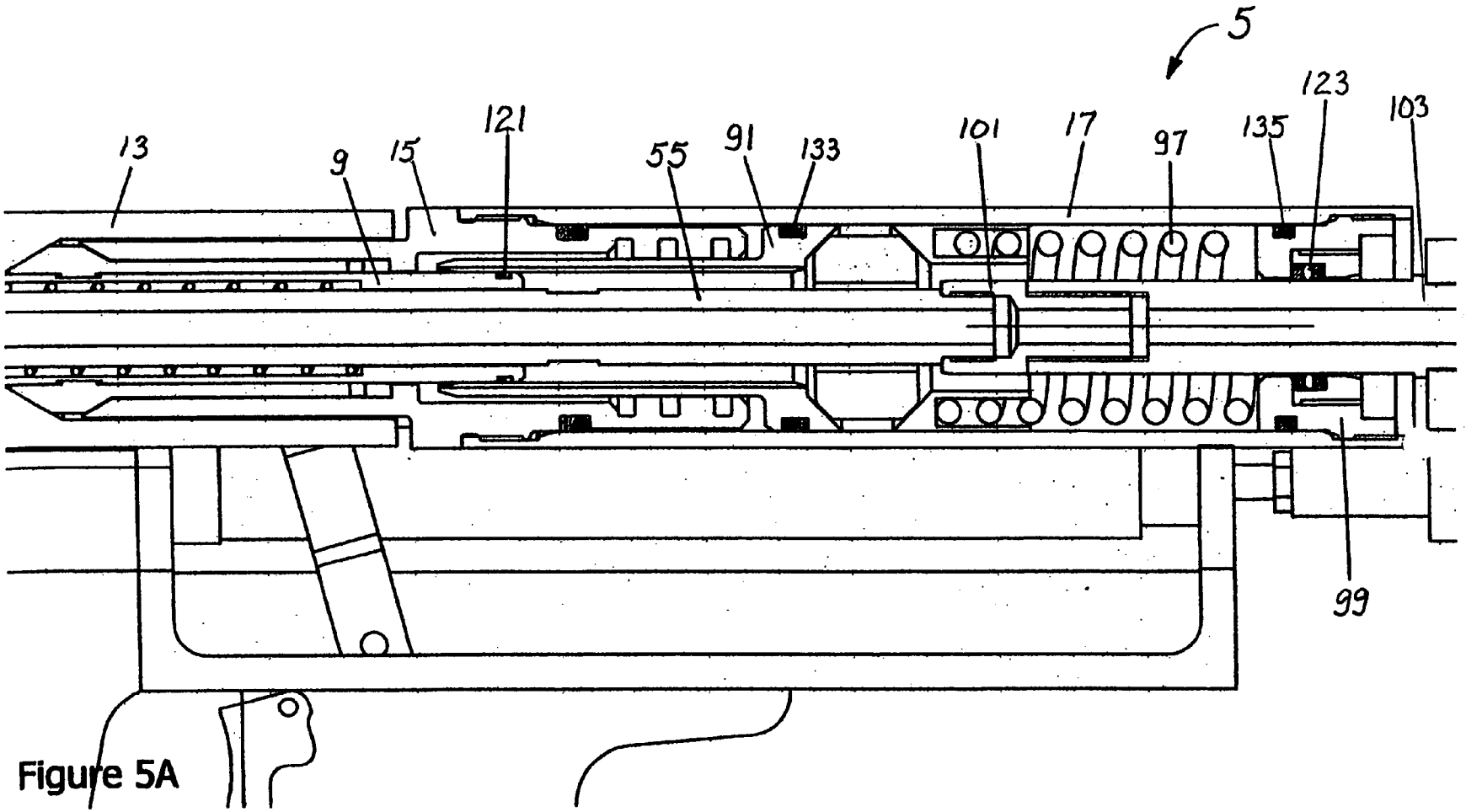
FIG. 5A is an enlarged side cross-sectional view of a rearward portion of the invention at stage five of the fastener installation process described herein.

Inspection of FIGS. 3A, 4, and 5A, reveals a rearward cavity defined by nose 9, forward pull rod outer seal 57, nose-piston seal 121, piston 91, rear end cap outer seal 135, piston flange hydraulic seal 133, hydraulic cylinder 17, rear end cap 99, rear end cap inner seal 123, pull rod coupling sealing tube 103, pull rod 55, and pull rod coupling 101. A careful inspection of the embodiment shown in FIG. 3A and FIG. 4 reveals that the rearward cavity is not an airtight cavity due in large part to the lack of a sliding engagement between closely fitted nose 9 and piston 91, the sliding engagement to be sealed by nose-piston seal 121 acting against piston bushing 137 which is press fit into the inner surface of piston 91.

Thus, if, in an alternative embodiment, a sliding engagement were arranged between closely fitted nose 9 and piston 91 throughout stage four, stage five and stage six, then a third major alternative source of dampening (i.e., dampening via compression of the trapped volume of air within the substantially airtight rearward cavity) would exist. An air supply air fitting (not shown), located in hydraulic cylinder 17 at a longitudinal location just forward of rear end cap 99, facilitates the management of the air pressure in the rearward cavity, so that, via the air supply, the desired time-sequenced amount of air compression occurs during the rearward translation of pull rod assembly 73.

At this point in time, immediately after pintail break, due to the pintail break—generated drop in resistance, the hydraulic pressure in the hydraulic line and hydraulic cylinder drops rapidly and dramatically. A hydraulic pressure sensor (not shown) in the hydraulic fluid supply detects the pressure drop, and, in response, the hydraulic valve is switched, diverting the hydraulic fluid flow from the hydraulic line to reservoir; the hydraulic line supplying hydraulic fluid to piston cavity 109 is also re-directed to the hydraulic system reservoir. Actuation spring 97, now acting through spring follower 95, urges inner collet 93 and piston 91 forward, reducing the size of piston cavity 109, and urging the hydraulic fluid contained therein into the reservoir.

After pull rod assembly 73 has completed its backward translation, it is desired for it to return expeditiously to its fully forward position; however, returning pull rod assembly 73 to its fully forward position is a step that is desirably effectuated with some care, as excessive return speed will result in a needlessly strong impact between the forwardmost surface 101*a* of pull rod coupling 101 and the rearward bearing surfaces (e.g., rearward bearing surface 93*b*(8)) of inner collet 93. Furthermore, the time-limiting step in the blind rivet installation cycle at this point is the return (by mechanisms to be discussed) of piston 91, and not pull rod assembly 73, to its return position.

Thus, while it is desired to return pull rod assembly 73 to its fully forward position expeditiously, if this return is effected by means of dampening spring 59, as it is the embodiment shown herein, then, as described above, it may well be desired to retard the forward movement of pull rod assembly 73 somewhat. This can be effectuated through a number of mechanisms. First, it may be possible to meter the valve assemblies associated with reciprocation air cylinder 21, in accordance with means well-known to persons of ordinary skill in the art, to dampen the forward return speed of pull rod assembly 73.

Second, it may also be possible, in the alternative embodiment described above (i.e., the embodiment featuring a substantially airtight rearward cavity), to meter the air supply valving associated with the air supply air fitting in hydraulic cylinder 17 so as to restrict air flow into the substantially airtight rearward cavity thereby dampening the forward return motion of pull rod assembly 73.

A variety of issues from an automation/computerized control standpoint have been identified in the description of this stage. The attentive reader will also appreciate that the valving associated with the reciprocation air cylinder 21 has been usefully configured such that air pressure only acts upon the air cylinder 21 during reciprocation; that is, once the air cylinder piston has been stroked to its desired new position, the associated air valve releases the air pressure on the air cylinder. This enables the above-referenced metering of the valve assemblies associated with reciprocation air cylinder 21.

Stage Five: Inner Collet Re-Opening.

Turning, now, to FIG. 5, the blind rivet installation system 1 is shown at stage five in the blind rivet installation process; that is, the blind rivet installation system 1 is shown in the state experienced after pintail break occurs, at a time when the pull rod assembly 73 has fully returned to its forwardmost position, the piston 91 is in the process of returning to its forwardmost position, and the inner collet 93 is in the process of re-opening.

The attentive reader will recall that, after pull rod assembly 73 has completed its backward translation, it is then translated to its fully forward position. This may be accomplished in several ways, and, in the preferred embodiment shown herein, it is effectuated in no small part by means of the dampening spring 59.

Figure 5B:
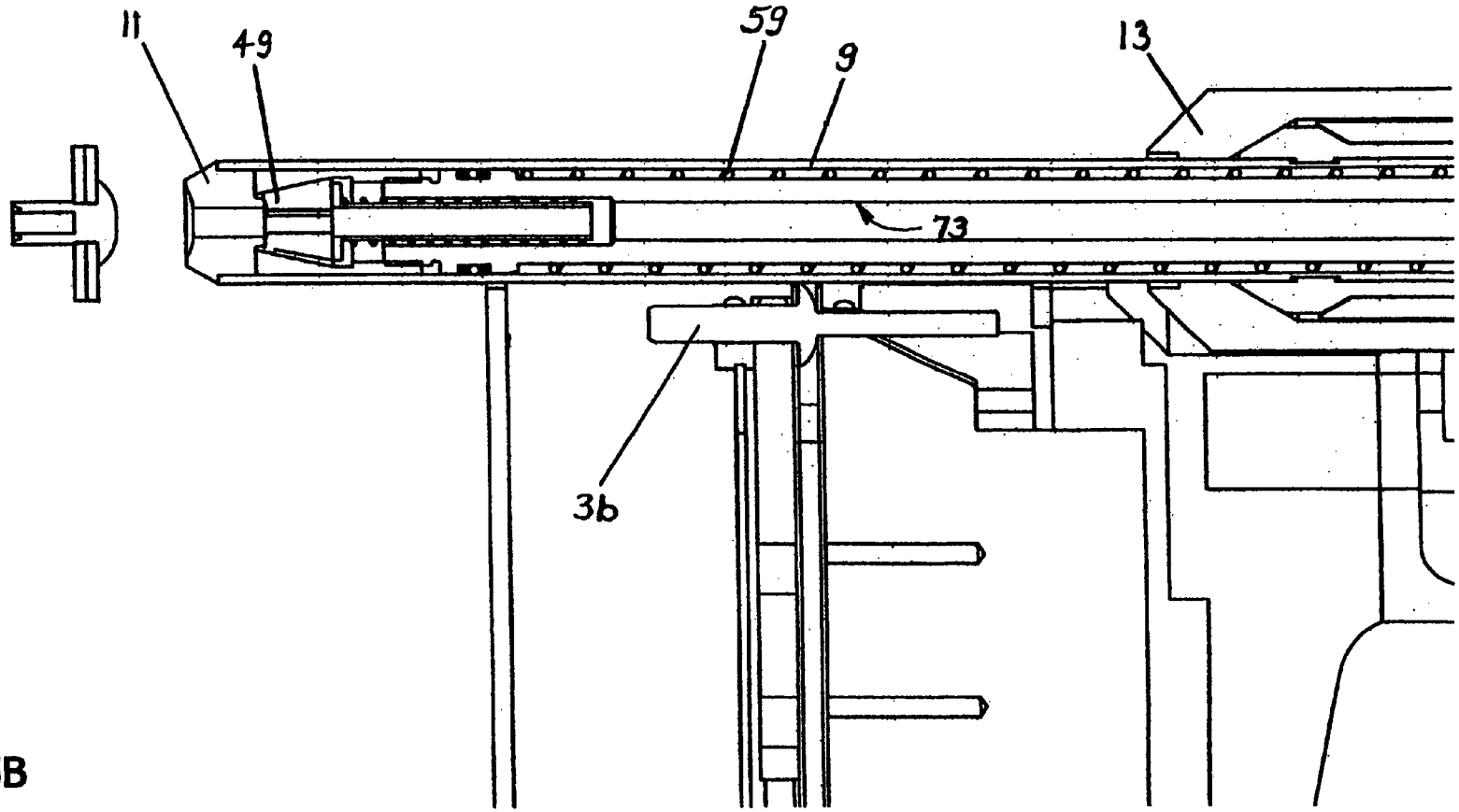
FIG. 5B is an enlarged side cross-sectional view of a forward portion of the invention at stage five of the fastener installation process described herein.

As referenced above, the return of the pull rod assembly 73 to its fully forward position is a step that should be effectuated with some care, as excessive return speed will result in a needlessly strong impact between the forwardmost surface 101*a* of pull rod coupling 101 and the rearward bearing surfaces (e.g., rearward bearing surface 93*b*(8)) of inner collet 93. In FIG. 5, this impact has, in fact, already occurred, and, as shown, inner collet 93 is continuing its forward return, while pull rod assembly 73 has reached its fully returned, forwardmost position. Perhaps the best evidence of the full and complete return of pull rod assembly 73 is the fact that, as was depicted in FIG. 1A and is now depicted in FIG. 5B, the forward face of jaws 49 now impinges upon the rearmost face of nose insert 11 resulting in jaws 49 opening (i.e., extending radially outward) sufficiently (to the "rivet acceptance position") to receive the pintail of a rivet 3. The reader will also note the fully expanded condition of dampening spring 59.

Although, at this moment in time, the pull rod assembly 73 has returned to its forwardmost position, inner collet 93 and piston 91 have not, as yet, fully returned to their respective forwardmost positions. At this point, actuation spring 97, acting through inner collet spring follower 95, is continuing to urge inner collet 93, and thereby piston 91, forward (note the partially radially expanded condition of inner collet 93). The actuation spring 97, at this point, has almost fully expanded and, as a result, the force it imparts to inner collet spring follower 95 is substantially diminishing. If the returns of inner collet 93 and piston 91 were left entirely to the work of actuation spring 97, the return completion time might be excessive; therefore, to reduce return completion time, at the time after pintail break when the hydraulic pressure sensor in the hydraulic fluid supply detects the pintail break—generated pressure drop, or very shortly thereafter, the air supply pressurizes the now substantially airtight rearward cavity (note the sliding engagement of closely fitted nose 9 and piston 91 in FIG. 5 and FIG. 5A) so as to expedite the forward movement of piston 91.

From an automation/computerized control standpoint, it is helpful to note that the return of the pull rod assembly 73 to its fully forward position is an event which could practically be evidenced by the feedback signal(s) (e.g., the hall effect signals) from reciprocation air cylinder 21.

Stage Six: Piston Return Complete.

Turning, now, to FIG. 6, the blind rivet installation system 1 is shown at stage six in the blind rivet installation process; that is, the blind rivet installation system 1 is shown in the state experienced after pintail break occurs, at a time when the pull rod assembly 73 has fully returned to its forwardmost position, the piston 91 has fully returned to its forwardmost position, and the inner collet 93 has fully re-opened.

Note, in both FIG. 6 and FIG. 6A, that the forwardmost face 91*c* of the piston flange of piston 91 is fully coincident with the rearmost face of front end cap 15. Note, as well, that actuation spring 97 has fully expanded.

Finally, from an automation/computerized control standpoint, in FIG. 6A, note the presence of a piston proximity sensor 139 (commonly, a transducer) used to detect the full return of piston 91. The piston proximity sensor 139 may be fitted to front end cap 15 as shown.

Stage Seven: Outer Collet Opens.

Figure 7:
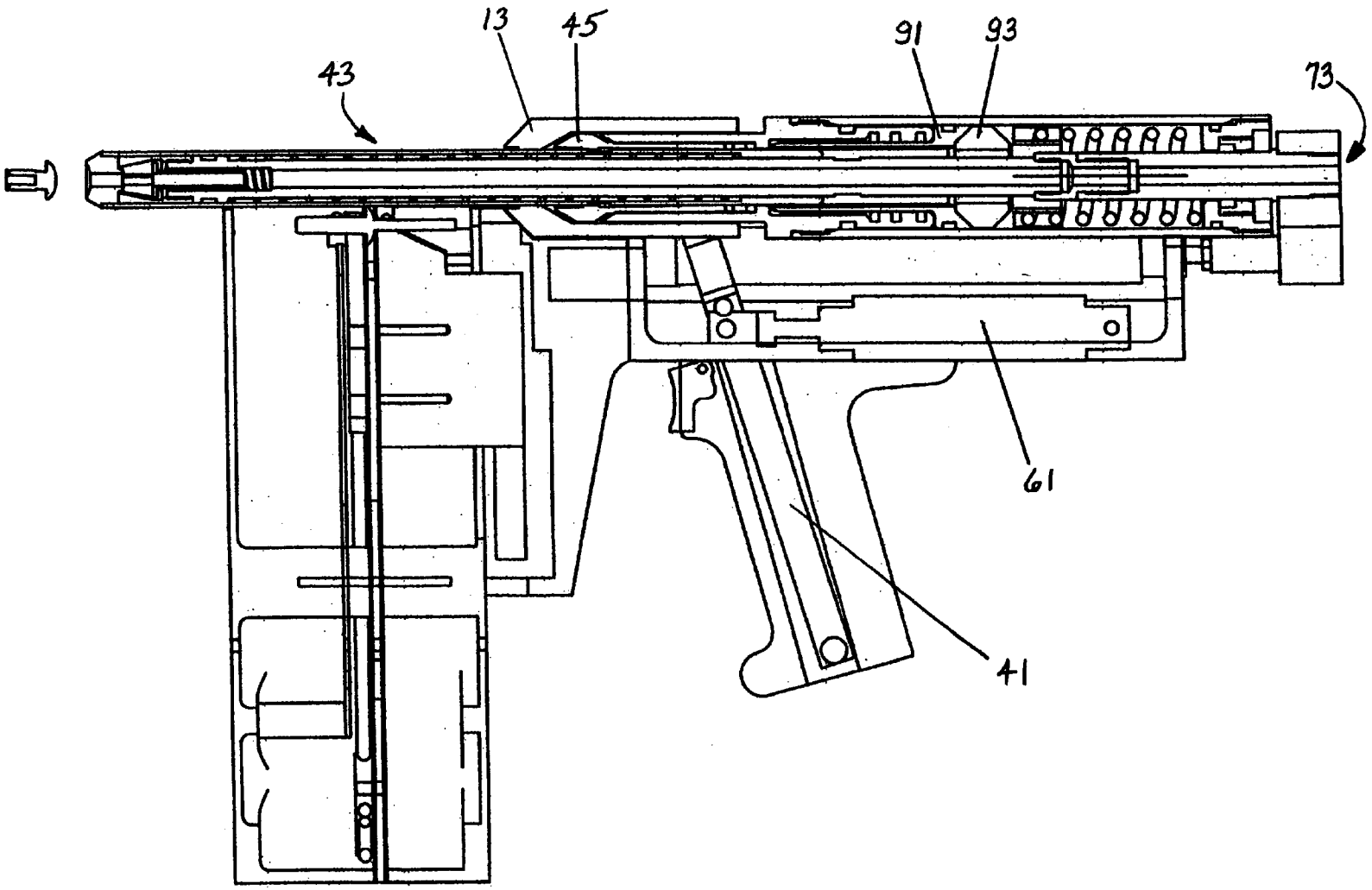
FIG. 7 is a side cross-sectional view of the invention at stage seven of the fastener installation process described herein.

Turning, now, to FIG. 7, the blind rivet installation system 1 is shown at stage seven in the blind rivet installation process; that is, the blind rivet installation system 1 is shown in the state experienced after pintail break occurs, at a time when the pull rod assembly 73, the piston 91, and the inner collet 93 have returned to their forwardmost positions; thus, at this juncture, the blind rivet installation tool 5 is ready to effectuate reciprocation of the nose assembly 43. In order for reciprocation of nose assembly 43 to occur, however, the outer collet 45 must be unlocked/opened.

The reader will recall, from the extensive discussion of stage one, how the outer collet 45 operates. In a nutshell, when air cylinder 61 is extended, collet lock bracket 41 rotates counter-clockwise (as viewed from the vantage point of FIG. 1B along the z-axis). When collet lock bracket 41 is so rotated, the collet lock bracket tongs 77 urge the collet lock 13 forward. As described more fully in the discussion of FIG. 1C and FIG. 1D, the forward movement of collet lock 13 results in outer collet 45 being translated forwards and radially expanded, so that, as shown in FIG. 1D and in FIG. 7, the outer collet 45 translates to its fully unlocked position. At this point, nose assembly 43 can reciprocate through outer collet 45 without interference.

Stage Eight: Reciprocation: Nose Assembly Retracted; Rivet Captured at Paw Stop.

Figure 8:
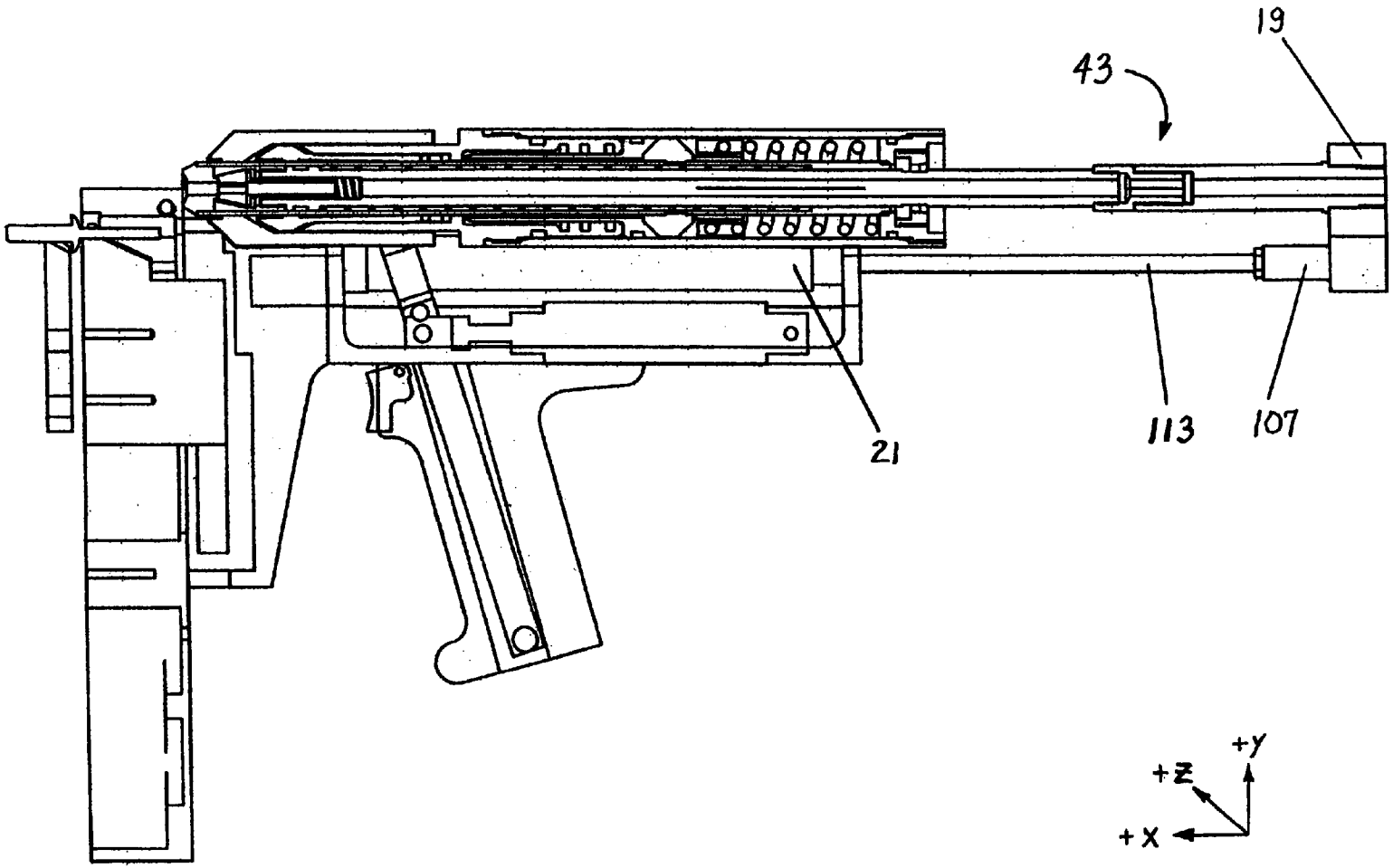
FIG. 8 is a side cross-sectional view of the invention at stage eight of the fastener installation process described herein.

Turning, now, to FIG. 8, the blind rivet installation system 1 is shown at stage eight in the blind rivet installation process; that is, the blind rivet installation tool 5 is shown in the state experienced after the nose assembly has fully retracted, with a rivet "captured" and held (as described below) at a paw stop location prior to presentation.

As shown in FIG. 8, nose assembly 43 has been fully retracted rearward by the action of reciprocation air cylinder 21. Notice the rearward location of nose assembly 43, bridge 19, bridge coupling 107, and reciprocation air cylinder extension rod 113. Once it is confirmed by piston proximity sensor 139 that piston 91 has been fully returned, as described in stage six, and the outer collet has been opened, as described in stage seven, the reciprocation air cylinder 21 extends the reciprocation air cylinder extension rod 113 so as to translate nose assembly 43 rearward through the action of bridge coupling 107 and bridge 19.

Attention is now directed to FIG. 8A, FIG. 8B, FIG. 8C, and FIG. 8D. These figures provide additional detail regarding various aspects of the clip-fed rivet delivery system 7 absent the clip-fed rivet delivery system structural housing 141 (which comprises rivet body structural housing 141*a* and rivet pintail structural housing 141*b*).

Figure 8A:
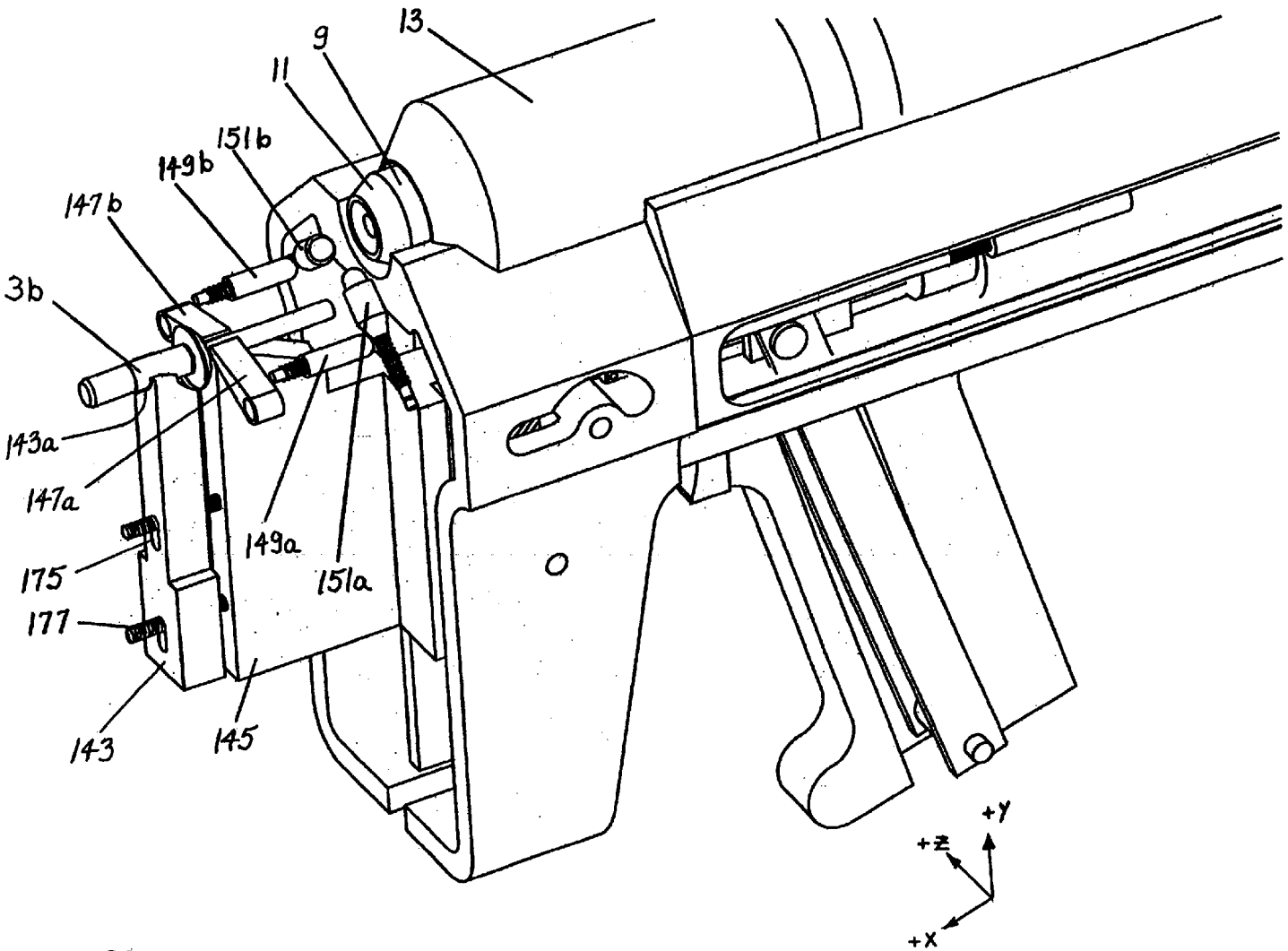
FIG. 8A is an isometric view of a portion of the invention at stage eight of the fastener installation process described herein.

Turning, now, to FIG. 8A, the next rivet in succession rivet 3*b* is shown in its position in stage eight just prior to presentation (rivet presentation occurring during stage nine). The rivet 3*b* is fully "captured" (i.e., secured for later presentation) within rivet body presenter 143 and rivet pintail presenter 145. Specifically, captured rivet 3*b* is fully seated and snapped into rivet body presenter channel 143*a* and rivet pintail presenter channel 145*a* (the rivet presenter channels also depicted in FIG. 9A and FIG. 13).

In FIG. 8A, as stated above, nose 9 has been fully longitudinally retracted rearward. This rearward retraction of nose 9 allows the spring-loaded paw stop actuators 151 to extend radially inward (i.e., towards nose axis 89) to their fully extended (i.e., "disengaged") position. Note: in FIG. 8A, the supports which hold paw stop actuators (which, in the preferred embodiment, are paw stop actuators 151*a* and 151*b*) in place have been removed from the figure for clarity.

The extension/disengagement of paw stop actuators 151 allows the spring-loaded paw stop assemblies 149 to retract rearward (i.e., to "disengage"). Notice the sliding engagement of the rearmost face of paw stop assemblies 149*a* and 149*b* against the conical surface of corresponding paw stop actuators 151. Note: in FIG. 8A, the supports which hold paw stop assemblies 149 in place have been removed from the figure for clarity.

The disengagement of the paw stop assemblies 149, as depicted in FIG. 8A and as occurs during stage eight, allows the rivet pintail paws 147 to rotate freely about their rivet pintail paw pivots 153 (not shown for clarity), although it should be noted that the rivet pintail paws 147*a* and 147*b* are spring-loaded so that the paw extremities rotate generally downwards to the closed position shown (i.e., rivet pintail paw 147*a* is spring-loaded to perform clockwise rotation when viewed facing in the positive direction of the x-axis while rivet pintail paw 147*b* is spring-loaded to perform counter-clockwise rotation). When, at other times during the blind rivet installation cycle, the paw stop assemblies 149 are engaged (i.e., fully extended forward and over the rivet pintail paws 147), the rivet pintail paws 147 are thereby blocked/precluded from rotating generally upwards so as to preclude presentation of a later rivet in succession (i.e., rivet pintail paw 147*a* is precluded from performing counter-clockwise rotation while rivet pintail paw 147*b* is precluded from performing clockwise rotation).

Thus, as shown in FIG. 8A, while the rivet pintail paws 147 are shown in their spring-actuated closed position, the disengagement of the paw stop assemblies 149 allows the rivet pintail paws 147 to rotate generally upwards (i.e., to "open") at a later time (at stage nine) when rivet presentation occurs.

Figure 8B:
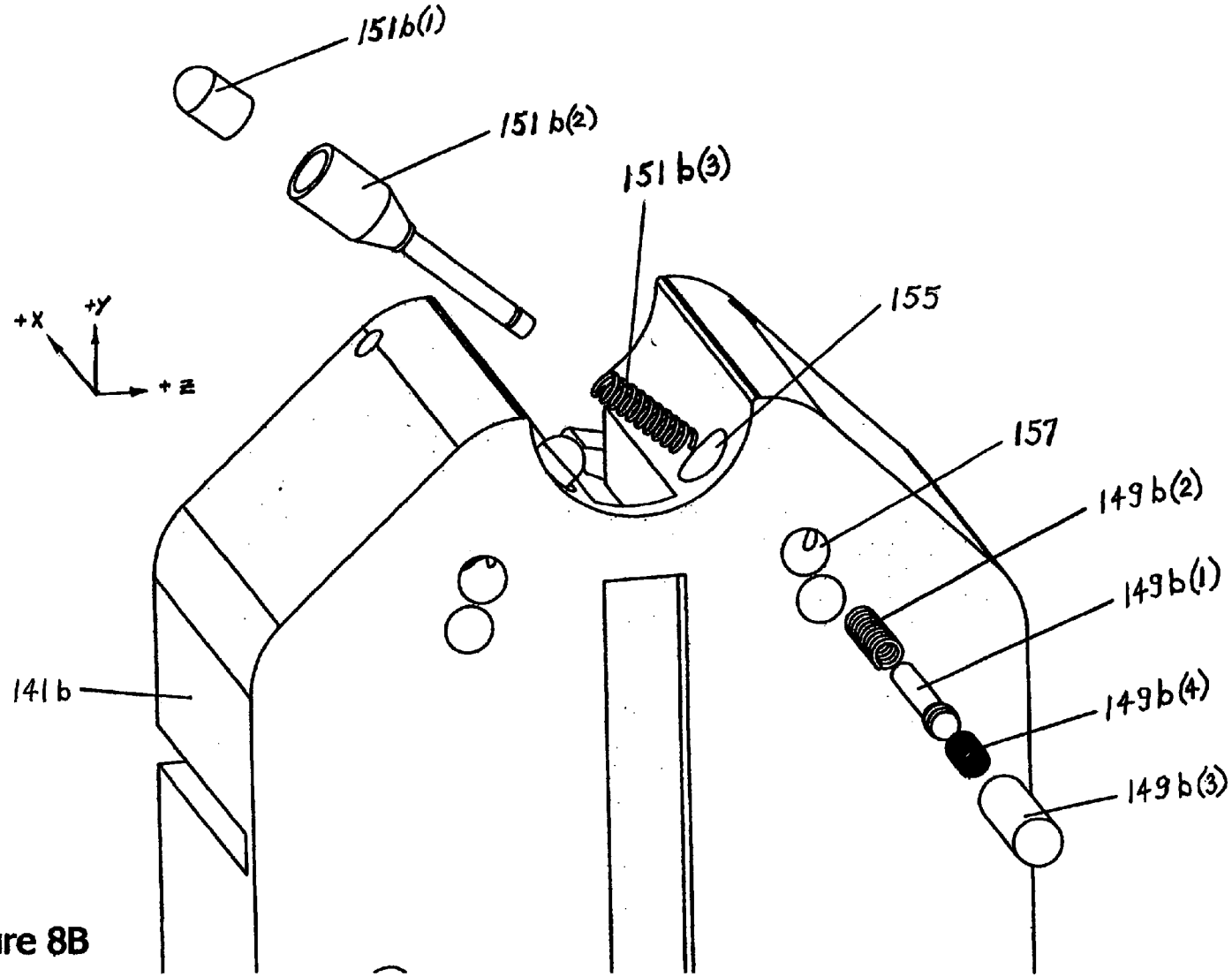
FIG. 8B is an isometric portion of the clip-fed rivet delivery system.
Figure 8C:
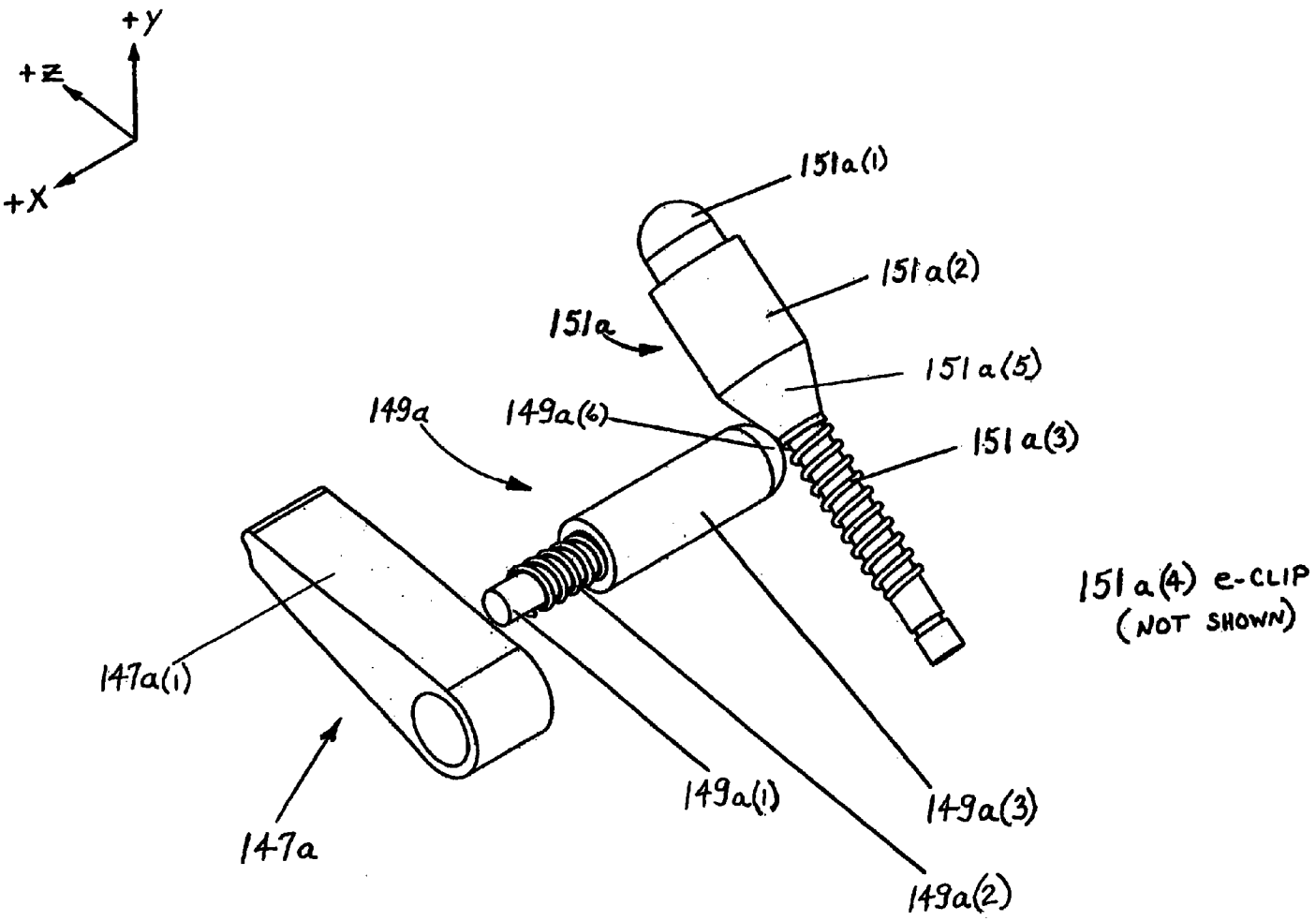
FIG. 8C is an isometric view of a paw, paw stop assembly, and paw stop actuator.

FIG. 8C, like FIG. 8A, clarifies the spatial arrangement of the rivet pintail paw 147, paw stop assembly 149, and paw stop actuator 151.

As shown in FIG. 8A, the rearward retraction of nose 9 allows the spring-loaded paw stop actuators 151 to extend radially inward (i.e., towards nose axis 89) to their fully extended (i.e., "disengaged") position. The extension/disengagement of paw stop actuators 151 allows the spring-loaded paw stop assemblies 149 to retract rearward (i.e., to "disengage").

Notice in FIG. 8C the components of the paw stop assembly 149*a* and its relationship to rivet pintail paw 147*a* and paw stop actuator 151*a*. When nose 9 reciprocates forward (not shown), the paw stop actuator 151*a* is actuated/engaged (i.e., depressed, or extended radially outward with respect to nose axis 89). Specifically, the exterior surface of nose insert 11 and then nose 9 comes into effective sliding engagement with, and thus depresses/actuates, paw stop actuator end cap 151*a* (1). As paw stop actuator 151*a* is depressed, paw stop actuator conical surface 151*a*(5) slidably and effectually engages paw stop assembly end cap 149*a*(6) (whose orientation is fixed by clip-fed rivet delivery system structural housing 141*b* (not shown)) and translates paw stop assembly 149*a* forward. The forward translation of paw stop assembly 149*a* extends paw stop 149*a*(1) longitudinally forward to a position over rivet pintail paw 147*a*, specifically to a position vertically over the upper surface 147*a*(1) of rivet pintail paw 147*a*. With the paw stop assembly 149*a* in this position, the extremity of rivet pintail paw 147*a* cannot rotate upward because the upper surface 147*a*(1) of rivet pintail paw 147*a* strikes the outer cylindrical surface of paw stop assembly 149*a* at paw stop 149*a*(1).

Conversely, when nose 9 reciprocates backwards (e.g., to the position shown in FIG. 8A), the paw stop actuator 151*a* is disengaged. Specifically, nose 9 exits sliding engagement with, and thus releases/disengages, paw stop actuator end cap 151*a*(1). As spring-actuated paw stop actuator 151*a* is released/extended, paw stop assembly end cap 149*a*(6) (whose general orientation is fixed by clip-fed rivet delivery system structural housing 141*b* (not shown)) smoothly extends and follows paw stop actuator outer cylindrical surface 151*a*(2) and then paw stop actuator conical surface 151*a* (5) (featuring a decreasing conical outer diameter) until paw stop assembly 149*a* reaches full rearward extension/disengagement. At this point, paw stop 149*a*(1) has also been translated longitudinally rearward to a position adjacent to, but not over, the upper surface 147*a*(1) of rivet pintail paw 147*a*, so that it does not interfere with the rotation of rivet pintail paw 147*a*.

FIG. 8B provides information regarding how paw stop actuators 151 and paw stop assemblies 149 are positionally secured within clip-fed rivet delivery system structural housing 141*b*.

The components of paw stop actuator 151*b*, for example, are shown ready for insertion within paw stop actuator recess 155. Paw stop actuator spring 151*b*(3) abuts a stop within recess 155, so that paw stop actuator 151*b*'s body (which may be constructed as a single unit or in parts) is continuously urged radially inward (with respect to nose axis 89) and restrained only by a stop, such as an e-clip, transversely secured within clip-fed rivet delivery system structural housing 141*b*.

The components of paw stop assembly 149*b*, for example, are shown ready for insertion within paw stop assembly recess 157. Paw stop assembly return spring 149*b*(2) abuts a stop within recess 157, so that paw stop assembly 149*b*'s body is continuously urged rearward and restrained only by the outer functional surfaces of its associated paw stop actuator (i.e., paw stop actuator cylindrical surface 151*b*(2) and paw stop actuator conical surface 151*b*(5)).

Figure 8D:
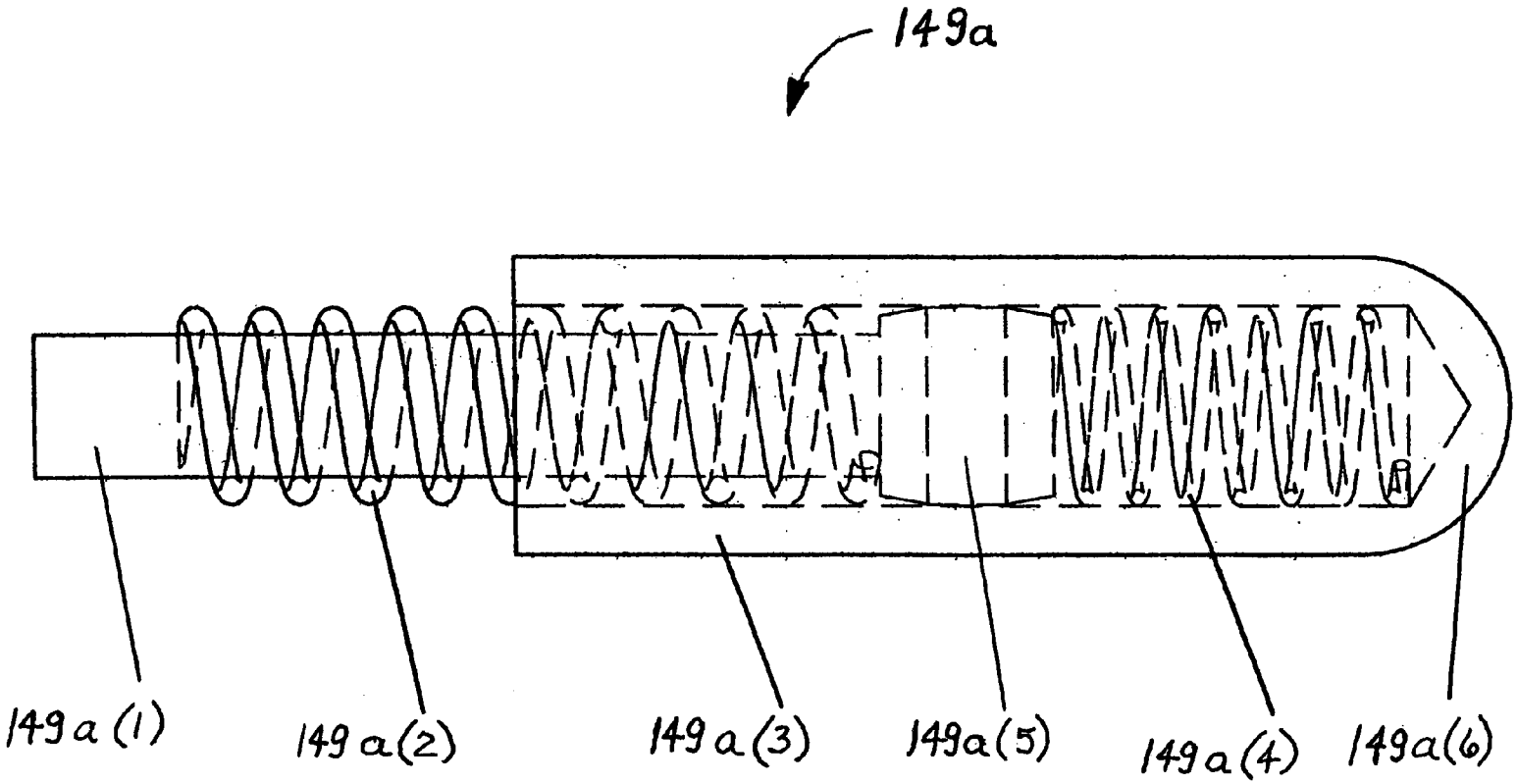
FIG. 8D is a side cross-sectional view of a paw stop assembly.

FIG. 8D provides useful additional detail regarding paw stop assembly 149, by providing a cutaway view of paw stop assembly 149*a*. Paw stop assembly 149*a* comprises paw stop 149*a*(1) (which features a paw stop flange 149*a*(5)), paw stop return spring 149*a*(2), paw stop sleeve 149*a*(3) (which features a paw stop sleeve end portion 149*a*(6)), and paw stop compression spring 149*a*(4).

The purpose of the two springs within paw stop assembly 149*a* becomes apparent when the reader understands that the paw stop will be actuated under two different circumstances. In stage thirteen, for example, when paw stop assembly 149*a* is actuated/engaged, the paw stop 149*a*(1) extends over the paw 147*a*, preventing its generally upwards rotation. In this circumstance, the forward movement of paw stop sleeve end cap portion 149*a*(6) compresses the relatively stiff compression spring 149*a*(4) which, in turn, impinges upon the paw stop flange 149*a*(5) which, in turn, urges the paw stop 149*a*(1) forward against the relatively gentle resistance of return spring 149*a*(2) (the return spring 149*a*(2) being secured against forward translation by a stop within clip-fed rivet delivery system structural housing 141*b*).

In stage ten, by contrast, when paw stop assembly 149*a* is actuated, the paw stop 149*a*(1) is extended forward and it abuts the rearmost face of paw 147*a*. In this circumstance, the forward movement of paw stop sleeve end cap portion 149*a* (6) compresses the relatively stiff compression spring 149*a* (4) which, in turn, impinges upon the paw stop flange 149*a*(5) which, in turn, urges the paw stop 149*a*(1) forward. In this case, however, forward movement of paw stop 149*a*(1) is blocked, and, as a result, compression spring 149*a*(4) is compressed.

From an automation/computerized control standpoint, it is helpful to note that the reciprocation of nose assembly 43 to its fully rearward position is an event which could practically be evidenced by the feedback signal(s) (e.g., the hall effect signals) from reciprocation air cylinder 21.

Stage Nine: Reciprocation: Rivet Presentation.

Figure 9:
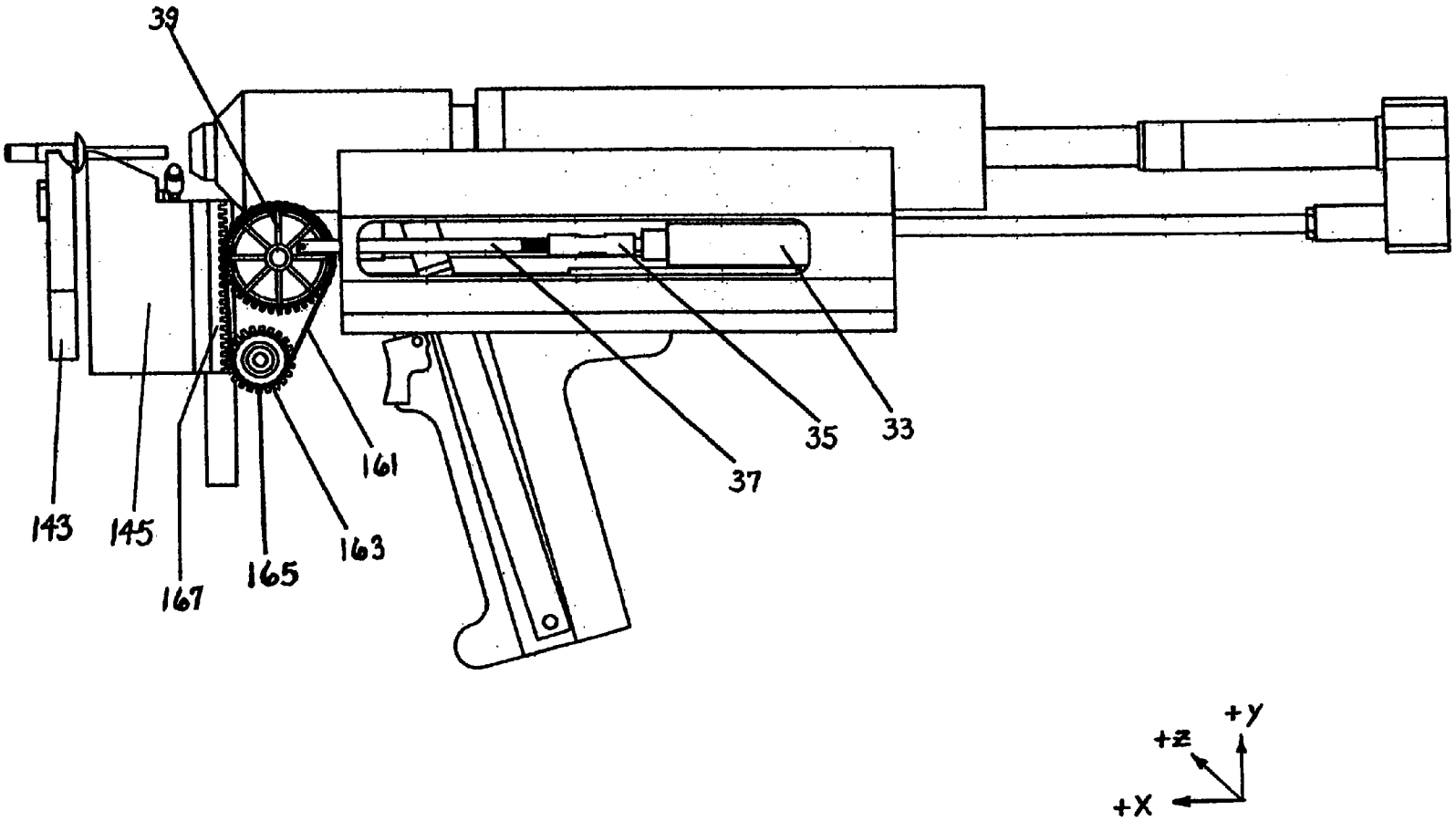
FIG. 9 is a side view of a portion of the invention at stage nine of the fastener installation process described herein.

Turning, now, to FIG. 9, the blind rivet installation system 1 is shown at stage nine in the blind rivet installation process; that is, the blind rivet installation tool 5 is shown in the state experienced after the nose assembly has fully retracted, with a rivet "presented" for subsequent loading by and within the nose assembly.

The reader will recall, with reference to FIG. 1, that presentation air cylinder 33, turnbuckle 35, and presentation connecting rod 37 are visible through access portal 31 and are shown in a substantially retracted/rearward position. Also visible is large presentation sprocket 39 which is connected to presentation connecting rod 37 via dowel pin 71. Large presentation sprocket 39 rotates back (i.e., clockwise from the vantage point of FIG. 1) and forth (counterclockwise) between two endpoint loci during operation of the blind rivet installation tool 5; at stage one, the position of large presentation sprocket 39 is best described as being nearly fully clockwise rotated.

Returning, now, to FIG. 9, which is associated with stage nine of the blind rivet installation process, the reader will observe that clip-fed rivet delivery system structural housing 141 and gear drive housing 27 have been removed so as to facilitate a review of the presentation mechanisms associated with the clip-fed rivet delivery system 7. Note that presentation air cylinder 33, turnbuckle 35, and presentation connecting rod 37 are now in a fully retracted/rearward position, and large presentation sprocket 39 is fully clockwise rotated. A careful study of FIG. 9A (and an understanding of the rivet presentation process which occurs at stage nine) reveals why this is so.

Figure 9A:
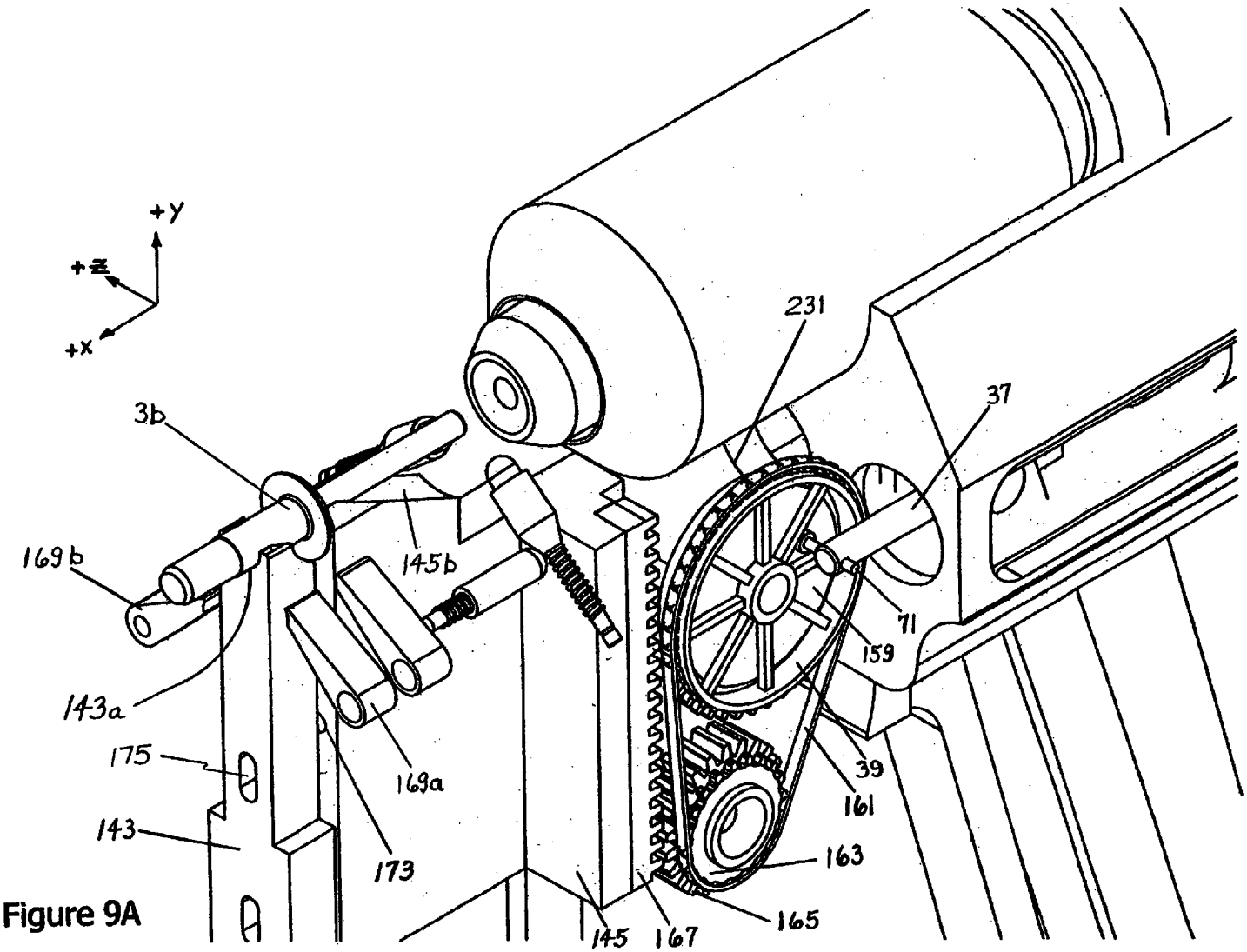
FIG. 9A is an isometric view of a portion of the invention at stage nine of the fastener installation process described herein.

Referring to FIG. 9A, it is readily observed that rivet 3*b* has been "presented" (or, elevated) to a precise central location for subsequent loading within nose assembly 43. Notice that the longitudinal axis of rivet 3*b* is nearly co-extensive with the nose axis 89. Presentation at this location is desired because, at a subsequent time, nose assembly 43 will be reciprocated forward so as to load rivet 3*b* within nose assembly 43.

The presentation of rivet 3*b* described above is accomplished through the action of rivet body presenter 143 and rivet pintail presenter 145. Recall that rivet 3*b* is securely held by both of these presenters by virtue of the snapping engagement that exists between the body of rivet 3*b* and rivet body presenter channel 143*a* and between the pintail of rivet 3*b* and rivet pintail presenter channel 145*a*.

As stated above, the rivet body presenter 143 and rivet pintail presenter 145 have been configured, and specifically cooperate, so that, at stage nine, rivet 3*b* can be properly presented to nose assembly 43 for loading. FIG. 9A reveals, as described above, that rivet body presenter 143 and rivet pintail presenter 145 are aligned so that their respective presenter channels, when presenting a rivet, present the rivet so that its longitudinal axis aligns with nose axis 89.

Furthermore, just as the nose assembly reciprocates (horizontally) at various stages of blind rivet installation tool 5 operation, so too do the rivet body presenter 143 and rivet pintail presenter 145 reciprocate (vertically) at various stages of the blind rivet installation process. Rivet body presenter 143 and rivet pintail presenter 145 are slidably secured to the clip-fed rivet delivery system structural housing 141*b* and clip-fed rivet delivery system guide track assembly 171.

Rivet presentation is effectuated as follows. Presentation air cylinder 33 retracts turnbuckle 35 and, as a result, presentation connecting rod 37 to their fully retracted/rearward positions. This has the effect of fully clockwise rotating large sprocket hub 159 and thereby large presentation sprocket 39. The clockwise rotation of large presentation sprocket 39 drives presentation chain 161 which, in turn, drives small presentation sprocket 163 (also in a clockwise direction as viewed in the positive z-direction). Small presentation sprocket 163 is fixed to presentation gear 165, and its clockwise rotation rotates presentation gear 165 clockwise. The clockwise rotation of presentation gear 165 translates presentation rack 167 upwards (i.e., in the positive y-axis direction).

Because presentation rack 167 is fixed to pintail presenter 145, the elevation of presentation rack 167 thereby raises pintail presenter 145. This explains the full and final elevation of pintail presenter 145 to presentation position.

Rivet body presenter 143 is elevated not by the direct action of presentation rack 167, but, rather, by the direct action of rivet pintail presenter 145. That is, as rivet pintail presenter 145 is elevated by the action of presentation rack 167, two rivet pintail presenter positioning rods 177, longitudinally extending through rivet pintail presenter 145, and fitted within rivet pintail presenter positioning rod recesses 173 within rivet pintail presenter 145, are also elevated. These rivet pintail presenter positioning rods 177, prior to rivet pintail presenter 145 elevation, extend into the lowermost portion of two corresponding rivet body presenter positioning slots 175 within rivet body presenter 143, and, a short time after rivet pintail presenter 145 begins its upward ascent, courtesy of presentation rack 167, the rivet pintail presenter positioning rods 177 engage the upper edge of their corresponding rivet body presenter positioning slots 175, thus effectuating elevation of rivet body presenter 143 as well. The rivet pintail presenter positioning rods 177 and rivet body presenter positioning slots 175 are positioned so that, when the rivet pintail presenter positioning rods 177 engage the upper edge of the rivet body presenter positioning slots 175, the presenter channels are in axial alignment as required for effective rivet presentation.

The motivation for the use of the rivet pintail presenter positioning rods 177 and rivet body presenter positioning slots 175 is twofold. First, for reasons outlined subsequently, it is desirable to ensure that, when the rivet body presenter and rivet pintail presenter are lowered (at a later stage in the blind rivet installation process), the rivet pintail presenter's descent precede the rivet body presenter's descent. Second, the rivet pintail presenter positioning rods 177 and rivet body presenter positioning slots 175 serve to assist the clip-fed rivet delivery system structural housing 141*b* and clip-fed rivet delivery system guide track assembly 171 in securing the position of the rivet body presenter 143 and rivet pintail presenter 145. Simply put, the rearmost longitudinal portion of the rivet pintail presenter positioning rods 177 are fixedly secured within the body of rivet pintail presenter 145, and the foremost portions of the rivet pintail presenter positioning rods 177 are loosely, but securely, fitted with a washer and retention nut so as to assist in securing the position of the rivet body presenter 143 and rivet pintail presenter 145.

From an automation/computerized control standpoint, it is helpful to note that, as in the case of reciprocation air cylinder 21, the valving associated with the presentation air cylinder 33 has been usefully configured such that air pressure only acts upon the air cylinder 33 during stroke; that is, once the air cylinder piston has been stroked to its desired new position, the associated air valve releases the air pressure on the air cylinder. This allows the forward reciprocation of nose assembly 43 in stage ten and stage eleven to depress the rivet pintail presenter 145 and rivet body presenter 143 without having to overcome additional resistance from presentation air cylinder 33.

It is also helpful to note that presentation air cylinder 33 typically strokes to no less than three discrete locations (see, e.g., stage nine, stage twelve, stage thirteen); therefore, the presentation air cylinder 33 is configured with no less than three feedback sensors (e.g., hall sensors) to facilitate the emission of control signals to the system controller.

Stage Ten: Rivet Load.

Figure 10:
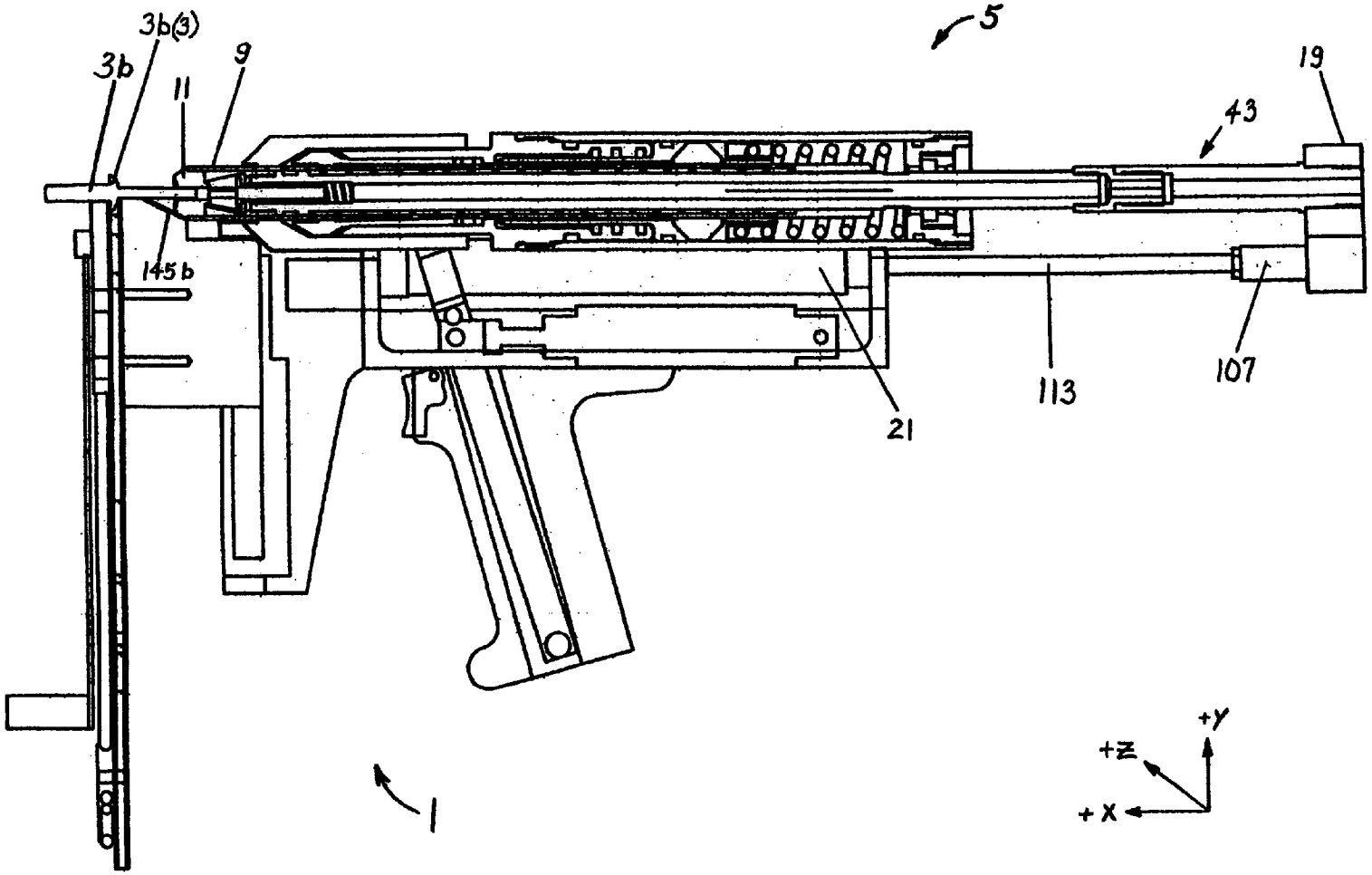
FIG. 10 is a side cross-sectional view of a portion of the invention at stage ten of the fastener installation process described herein.

Turning, now, to FIG. 10, the blind rivet installation system 1 is shown at stage ten in the blind rivet installation process; that is, the blind rivet installation tool 5 is shown in the state experienced after rivet presentation as the nose assembly initiates loading of the rivet.

Figure 10A:
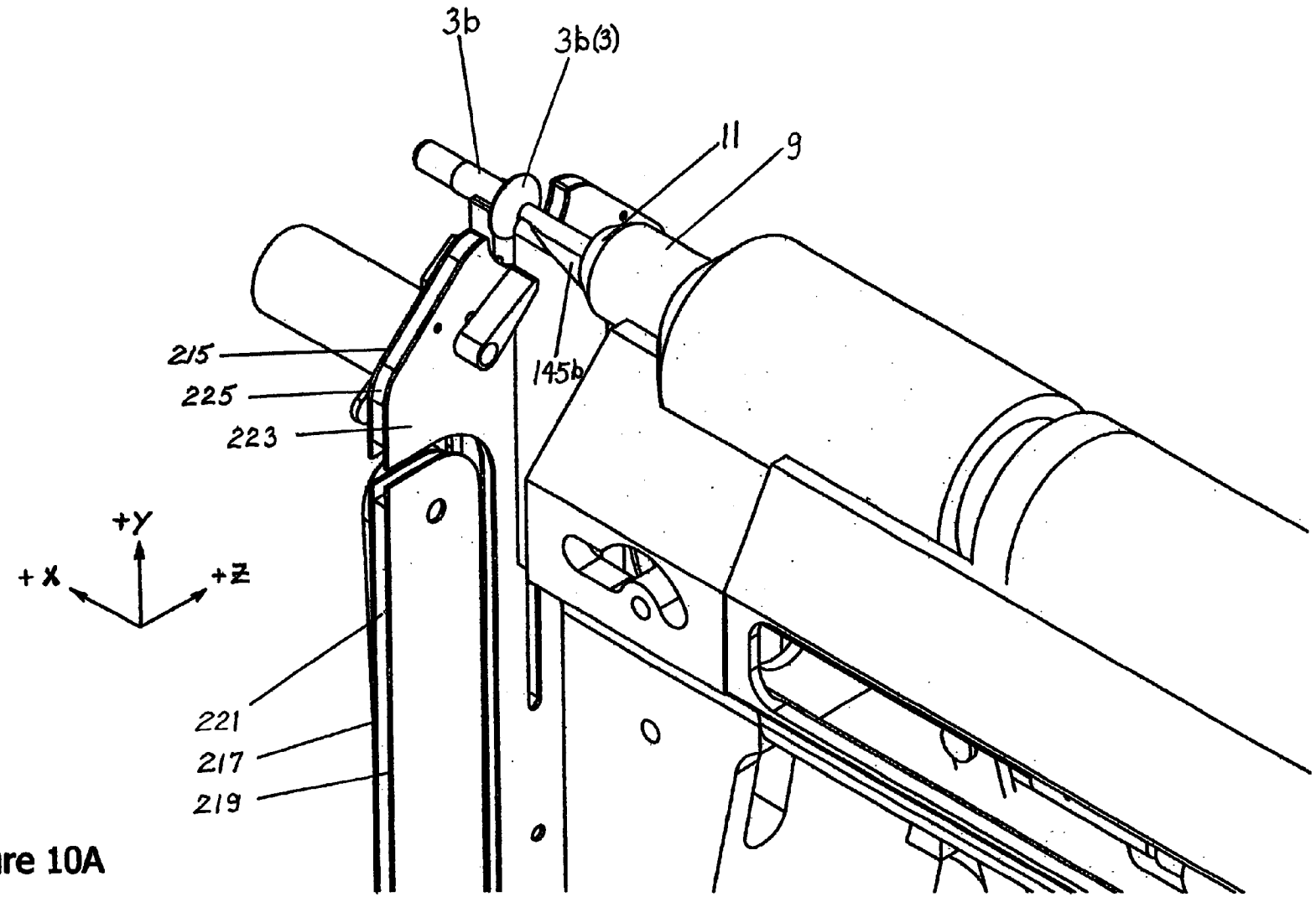
FIG. 10A is an isometric view of a portion of the invention at stage ten of the fastener installation process described herein.

Even a cursory inspection of FIG. 10 reveals that the nose assembly 43 has now reciprocated/advanced forward such that rivet 3*b* is now partially loaded within nose assembly 43 (i.e., the pintail of rivet 3*b* is now located within nose insert 11) (see also FIG. 10A). Note, in FIG. 10, that the nose insert 11 has just come into contact with the ramp 145*b* (a linear ramp in the embodiment shown) of rivet pintail presenter 145. Rivet pintail presenter linear ramp 145*b* features a channel radius of curvature which is approximately equal to that at the outer periphery of the cylindrical section of nose 9.

Designing rivet pintail presenter ramp 145*b* in the fashion described hereinabove ensures that nose 9 smoothly and easily engages rivet pintail presenter linear ramp 145*b*, urging it downward as nose assembly 43 advances during rivet load. As nose assembly 43 advances, the pintail of rivet 3*b* enters the jaws 49 and rivet pintail presenter 145 is continuously urged downward, until, as nose insert 11 approaches head 3*b*(3) of rivet 3*b*, rivet pintail presenter positioning rod 177 engages the lowermost portion of rivet body presenter positioning slot 175, urging rivet body presenter 143 downward (see FIG. 8A).

Figure 10B:
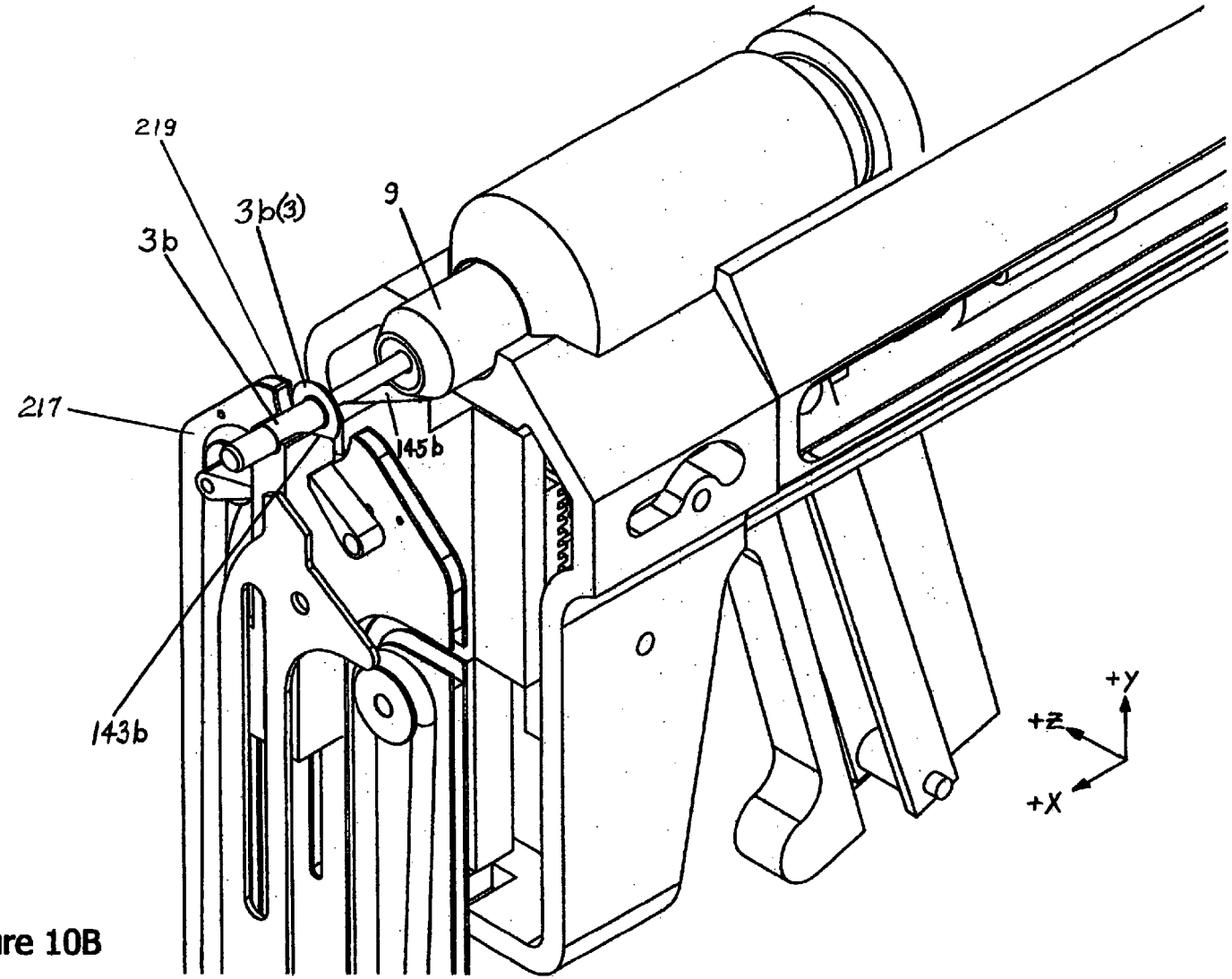
FIG. 10B is an isometric view of a portion of the invention at stage ten of the fastener installation process described herein.

It is desired for rivet body presenter positioning slot 175 to be of such a length that the rivet body presenter 143 will be urged downward shortly before rivet head 3*b*(3) strikes the surface of rivet body presenter ramp 143*b* (see FIG. 9A and FIG. 10B). Rivet body presenter ramp 143*b* (a linear ramp in the embodiment shown) has been fashioned to urge rivet body presenter 143 downward if rivet head 3*b*(3) should impinge upon rivet body presenter 143 during its forward travel, and it is desired for rivet body presenter linear ramp 143*b* to feature a channel radius of curvature approximately equal to the radius of curvature of rivet head 3*b*(3).

Finally, it should be noted that, as nose assembly 43 advanced, the paw stop actuators 151 were engaged, and these, in turn, actuated the paw stop assemblies 149. However, as discussed previously, the paw stop assemblies, at this time, harmlessly come into contact with the rearmost surface of the rivet pintail paws 147. See FIG. 9A as well as the extensive discussion of the paw stop actuators 151 and paw stop assemblies 149 at stage eight.

Stage Eleven: Nose Assembly Full Extension.

Figure 11:
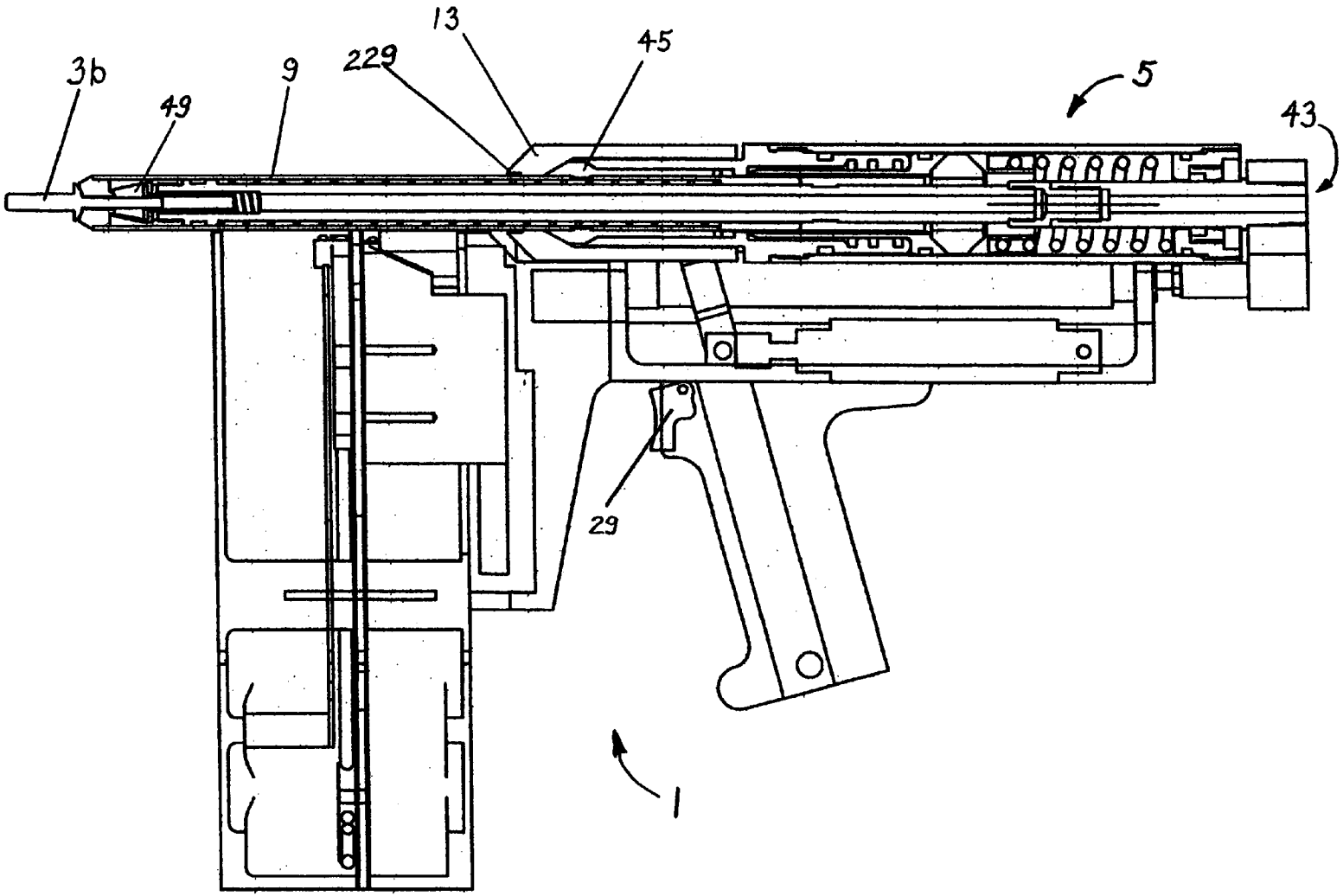
FIG. 11 is a side cross-sectional view of the invention at stage eleven of the fastener installation process described herein.

Turning, now, to FIG. 11, the blind rivet installation system 1 is shown at stage eleven in the blind rivet installation process; that is, the blind rivet installation tool 5 is shown in the state experienced after rivet loading has occurred and the nose assembly has been fully forwardly extended and locked into position. From a rivet installation standpoint, the blind rivet installation tool 5 status can be aptly described as "rivet ready" for installation.

Note, in FIG. 11, that nose assembly 43 is in its forwardmost position vis-à-vis the blind rivet installation tool 5. Note as well that nose assembly 43 has been locked into position via outer collet 45 (note, similarly, the locked position of collet lock 13). Finally, note the position of rivet 3*b*: it stands ready for installation, securely positioned within jaws 49. With a squeeze of trigger 29, blind rivet installation of rivet 3*b* (the successor of rivet 3*a*) will occur.

The reader will observe that, at this point in the installation process, nose assembly 43 has been reciprocated fully backward and fully forward. This back-and-forth movement of nose assembly 43 could have the effect of momentarily distracting the user of the tool from his installation locus, and it could also constitute a mild safety-related hazard. Thus, it is desirable to fit the tool with a pointing sleeve, a fixed, cylindrical tube which encircles nose assembly 43.

As stated, the pointing sleeve (not shown in the figures) is a simple cylindrical member which largely encircles the nose assembly 43 (the lower portion of the cylindrical member comprising a generally longitudinal, long, wide slot to allow for, among other things, the operation of the rivet presenters 143, 145 and the paw stop actuators 151). The user using the tool, and those around him or her, therefore, cannot inadvertently be struck by the back-and-forth reciprocation of nose assembly 43 that occurs at the forward sections of the tool, and the user is further benefited by having the pointing sleeve as an aid to facilitate the easy visual positioning of the extremity of the nose assembly 43 near the rivet hole during reciprocation.

The pointing sleeve can also be configured so as to serve the purpose of noise abatement. Specifically, the cylindrical wall may feature the use of sound-insulating material and the forwardmost pointing sleeve extremity may be configured to feature a noise-abating cup/edge which translates forward and seals around the rivet installation site so as to dampen/muffle the sound created when pintail break occurs.

Provision for the pointing sleeve is apparent in the figures; for example, in FIG. 11, FIG. 1C, and FIG. 1D, a pointing sleeve counterbore 229, to receive the pointing sleeve, is shown.

From an automation/computerized control standpoint, it is helpful to note that the reciprocation of nose assembly 43 to its fully forward position is an event which could practically be evidenced by the feedback signal(s) (e.g., the hall effect signals) from reciprocation air cylinder 21. At this point in time, as described above, the system controller would send a control signal to collet lock air cylinder 61 to effectuate locking of outer collet 45.

Stage Twelve: Stroke Presenter Down.

Figure 12:
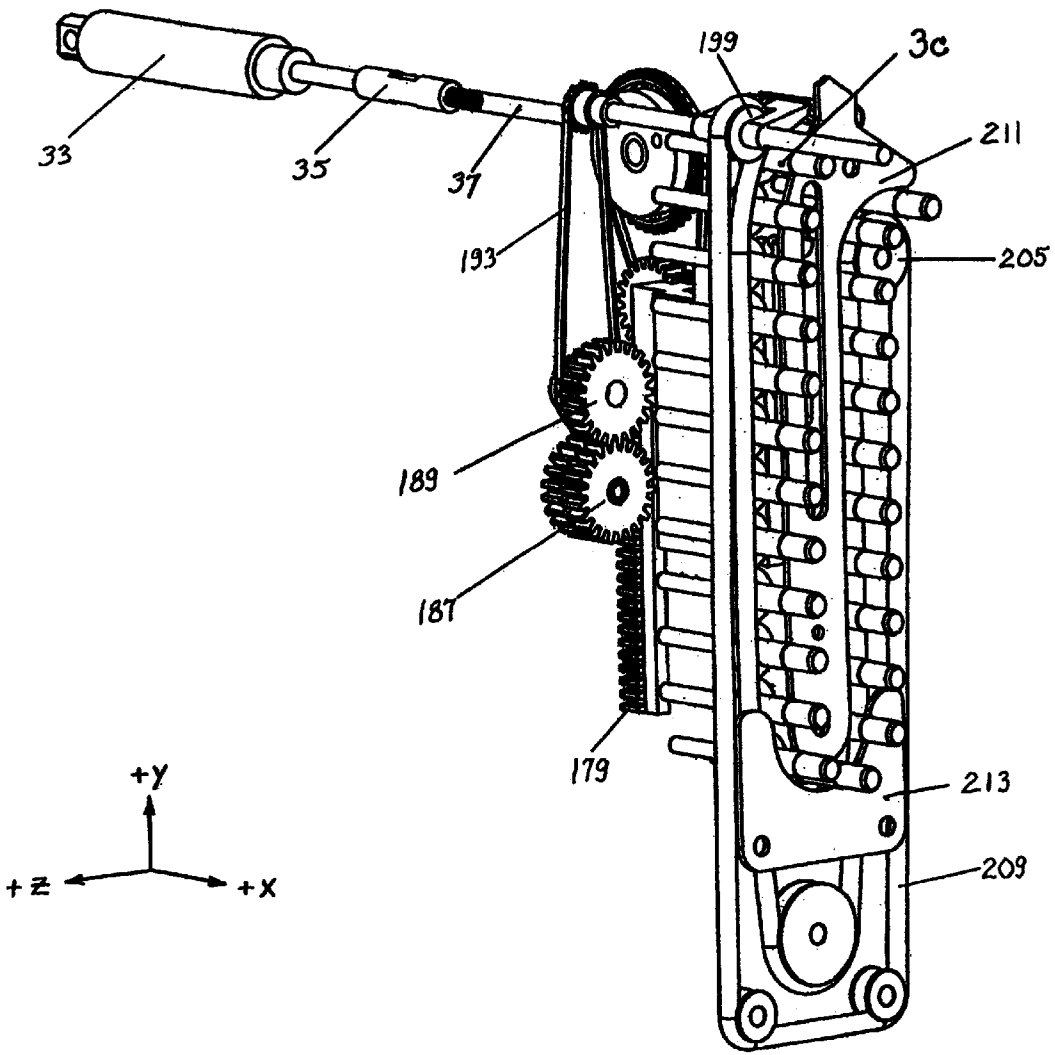
FIG. 12 is an isometric view of a portion of the invention at stage twelve of the fastener installation process described herein.

Turning, now, to FIG. 12, the blind rivet installation system 1 is shown at stage twelve in the blind rivet installation process; that is, the blind rivet installation tool 5 is shown in the state experienced after the nose assembly has been fully extended forward and the rivet pintail presenter 145 has been stroked downward, advancing a series of rivets for eventual presentation, as more fully described hereinbelow.

Figure 12A:
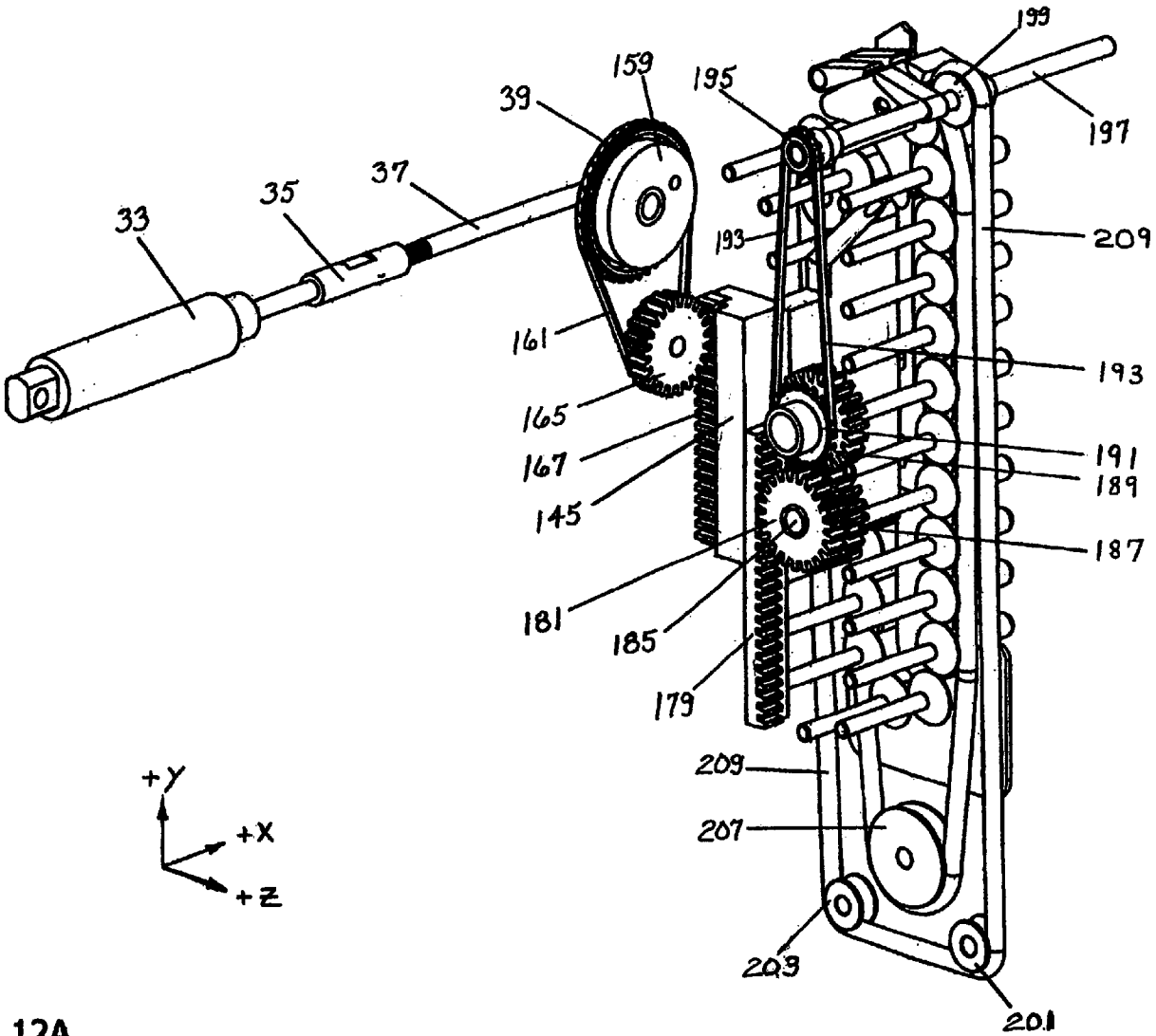
FIG. 12A is an isometric view of a portion of the invention at stage twelve of the fastener installation process described herein.
Figure 12B:
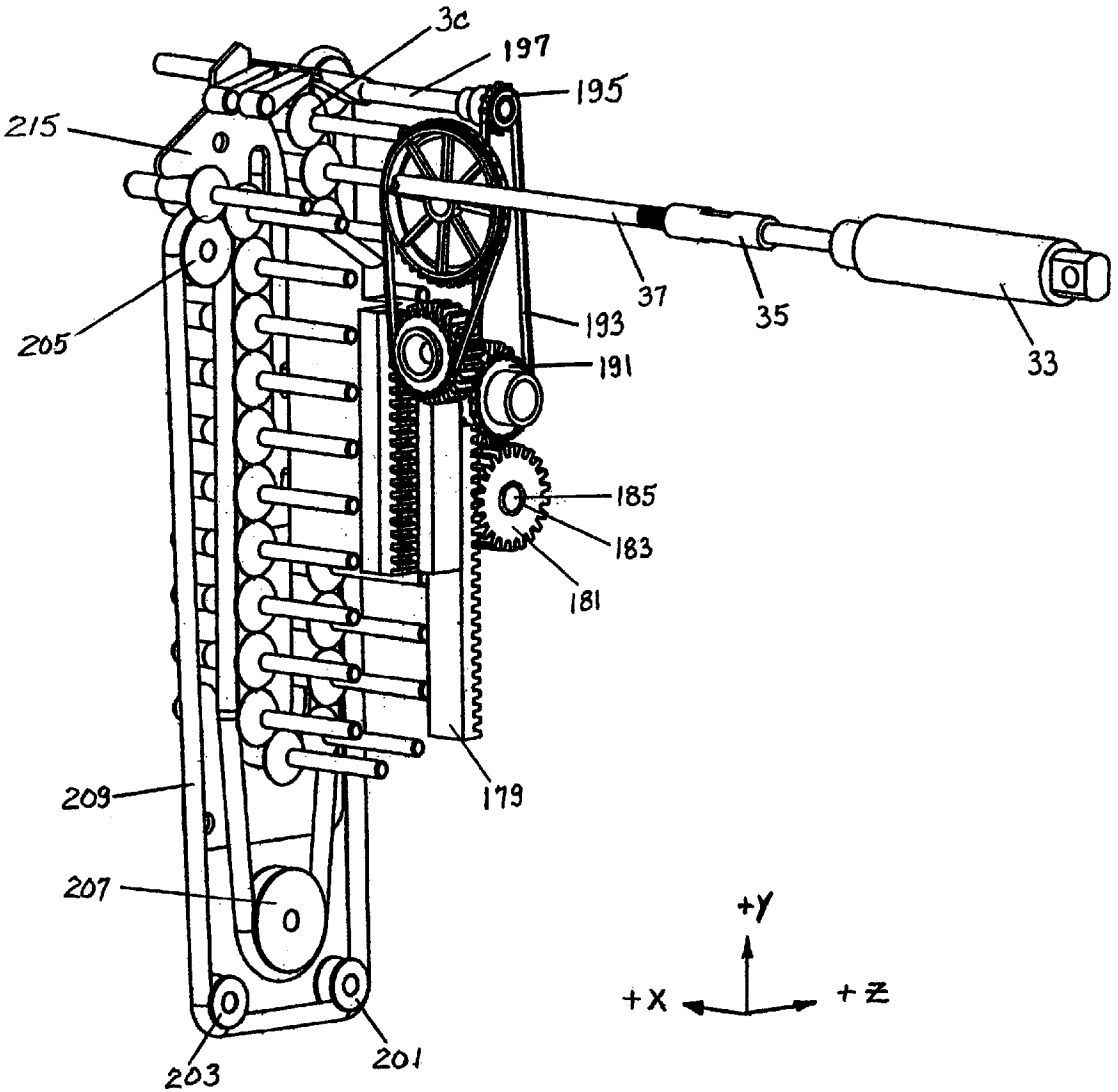
FIG. 12B is an isometric view of a portion of the invention at stage twelve of the fastener installation process described herein.

FIG. 12B depicts several components of the clip fed rivet delivery system 7. Presentation air cylinder 33 has advanced turnbuckle 35, and, thereby, presentation connecting rod 37, to the fully forward position. Presentation connecting rod 37, by means of dowel pin 71, has rotated large sprocket hub 159 counterclockwise (as viewed in FIG. 12B from the perspective of a viewer facing in the positive z-direction) so as to lower presentation rack 167 and, thereby, rivet pintail presenter 145.

Note, in FIG. 12B, the presence of a series of rivets following a generally u-shaped path leading to presentation. The next rivet to be presented is rivet 3*c*. Although additional details regarding how this series of rivets is secured within the clip fed rivet delivery system 7 are provided hereinbelow, FIG. 12B does provide insight regarding how this series of rivets is advanced along its path.

Briefly, rivet drive belt 209, which translates in a clockwise direction about entry pulley 205 (clockwise about entry pulley 205 as shown in FIG. 12B and as viewed looking in the positive x-direction), rotates about entry pulley 205 and simultaneously translates the rivets, the rivets rolling alongside rivet body side track plate island 215, so as to advance the rivets along their desired path.

Turning, now, to FIG. 12A, a different view of many of the same components presented in FIG. 12B is presented. An inspection of FIG. 12A reveals that, as presentation connecting rod 37 is urged forward, and large sprocket hub 159 is rotated clockwise (as viewed in FIG. 12A when facing the negative z-direction), presentation chain 161 drives small presentation sprocket 163 which, in turn, drives presentation gear 165 so as to rotate in a similarly clockwise direction. The rotation of presentation gear 165 drives presentation rack 167 downward, and this, in turn, drives rivet pintail presenter 145 downward as well.

Attached to rivet pintail presenter 145 is belt rack 179; it, too, is driven downward. As belt rack 179 is translated downward, it induces the counterclockwise rotation of rack gear 181.

Rack gear 181 contains one-way bearing 183 and hex drive shaft 185. Hex drive shaft 185 not only serves as a shaft for rack gear 181, in addition, it serves as a shaft for hex gear 187. One-way bearing 183 and hex drive shaft 185 cooperate to ensure that, as belt rack 179 translates downward and rack gear 181 rotates counterclockwise, hex gear 187 is rotated counterclockwise as well. However, importantly, when belt rack 179 is translated upwards, inducing a clockwise rotation in rack gear 181, hex gear 187 does not rotate; rather, hex gear 187 stands idle.

As stated previously, FIG. 12, FIG. 12A, and FIG. 12B all depict the status of the blind rivet installation system 1 and clip fed rivet delivery system 7 at stage twelve, at the conclusion of the downward stroke of rivet pintail presenter 145. As rivet pintail presenter 145 and belt rack 179 stroke downward, the counterclockwise rotation of rack year 181 and hex gear 187 induces the clockwise rotation of idler gear 189. The clockwise rotation of idler gear 189 induces the clockwise rotation of large belt drive sprocket 191, and the resulting translation of belt drive chain 193 results in a clockwise rotation of small belt drive sprocket 195. As small belt drive sprocket 195 rotates clockwise, belt drive shaft 197 is induced into clockwise rotation as well; this clockwise rotation rotates belt drive pulley 199, resulting in one-way translation of rivet drive belt 209 throughout the clip fed rivet delivery system 7.

An inspection of FIG. 12A and FIG. 12B reveals the following path of rivet drive belt 209: a locus of rivet drive belt 209 leaves belt drive pulley 199, translates toward and eventually rotates about first idler pulley 201, translates toward and rotates about second idler pulley 203, translates toward and rotates about entry pulley 205, translates toward and rotates about third idler pulley 207, and then return translates to belt drive pulley 199. It will also be appreciated that the translation of rivet drive belt 209 urges the entire series of rivets towards the uppermost portion of clip fed rivet delivery system 7 to facilitate their one-by-one presentation by means of rivet pintail presenter 145 and rivet body presenter 143.

Finally, it will be appreciated that belt rack 179, rack gear 181, hex gear 187, idler gear 189, and large belt drive sprocket 191 have all been configured so that the downward stroke of belt rack 179 has been effectively converted into a forward, driving translation of rivet drive belt 209, while the return upward stroke of belt rack 179 leaves rivet drive belt 209 idle (owing to the action of one-way bearing 183 and hex drive shaft 185).

Figure 1F:
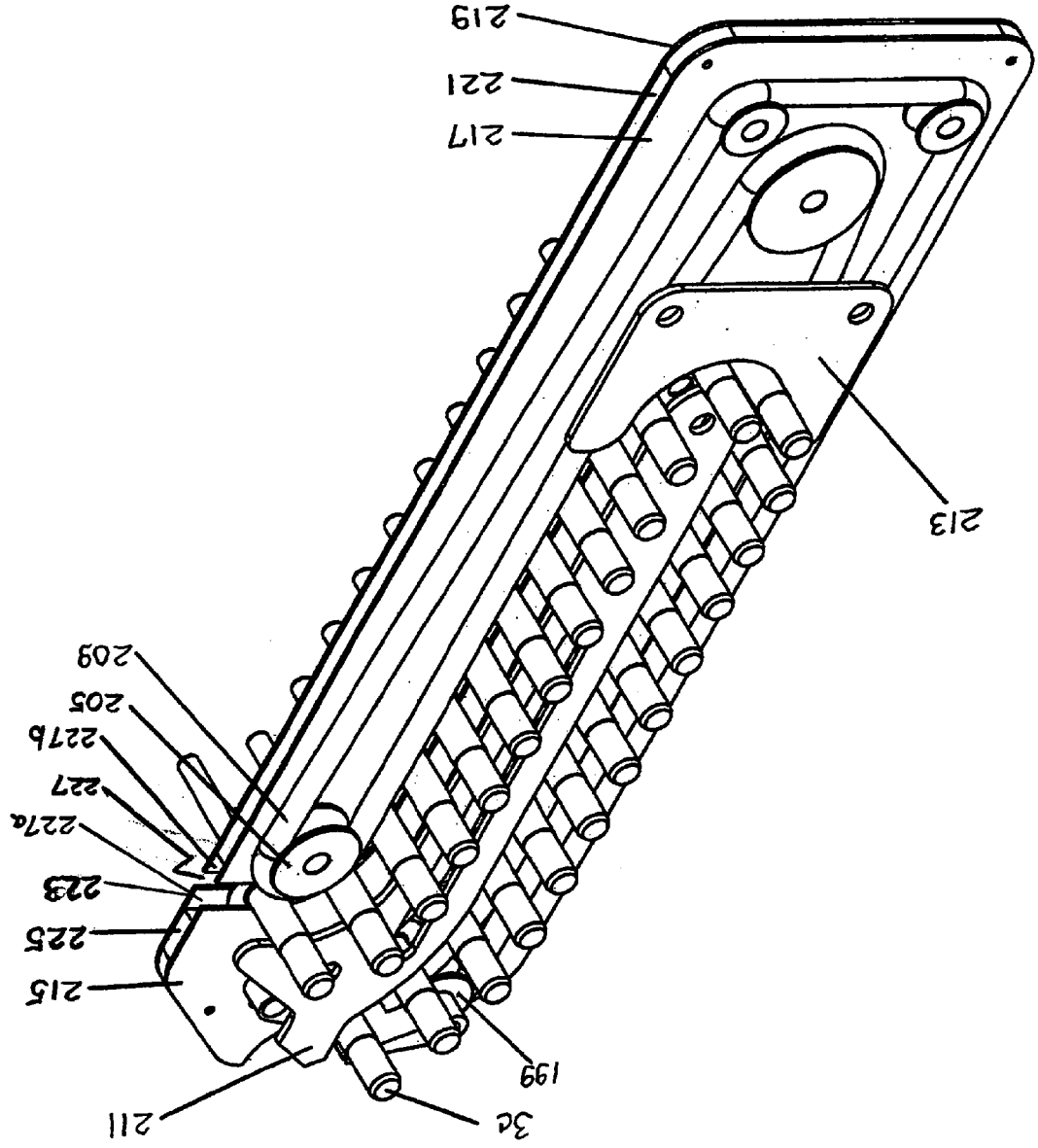
FIG. 1F is an isometric view of a portion of the clip-fed rivet delivery system.

A careful study of FIG. 12 and FIG. 1F reveals how the rivets are secured so as to facilitate their fluid march in succession towards presentation.

FIG. 1F depicts important components of the clip fed rivet delivery system 7 absent the clip fed rivet delivery system structural housing 141. Rivets are loaded in succession into clip fed rivet delivery system main rivet channel 227. Much, but not all, of the orienting of the rivets 3 after loading occurs as a result of the placement of the rivet heads within main rivet channel 227, which itself comprises two transverse rivet channels, transverse rivet channel 227*a* and transverse rivet channel 227*b*.

The main rivet channel 227 can be profitably described in two different ways. One way, as referenced hereinabove, is to describe it by reference to two opposing transverse rivet channels. The first transverse rivet channel 227*a* is formed, in the embodiment shown herein, from rivet body side track plate island 215, rivet head track plate island 225, and rivet pintail track plate island 223. These three members cooperate to create transverse rivet channel 227*a* which receives a generally semi-circular portion of the rotating and translating rivet head. It should be noted that transverse rivet channel 227*a* could easily be equivalently constructed of one homogeneous material, rather than three.

The second transverse rivet channel 227*b* is formed, in the embodiment shown herein, from rivet body side track plate 217, rivet head track plate 221, and rivet pintail side track plate 219, and these three members similarly cooperate to create a transverse rivet channel 227*b* which receives the opposite generally semi-circular portion of the rotating and translating rivet head. It should also be noted that transverse rivet channel 227*b* could easily be equivalently constructed of one homogeneous material, rather than three.

An alternative way of viewing main rivet channel 227 is to view it as a path which has been carved out of three track plates, creating, in effect, three track plate "islands." For example, one could envision defining rivet body side track plate island 215 as the "island" that has been created by carving a u-shaped path, main rivet channel 227, into rivet body side track plate 217. Similarly, rivet pintail side track plate island 223 may be viewed as the "island" that has been created by carving main rivet channel 227 into rivet pintail side track plate 219. And rivet head track plate island 225 may be viewed as the "island" that has been created by carving main rivet channel 227 into rivet head track plate 221.

Regardless of semantics, it is clear from FIG. 1F that a main rivet channel 227, a generally u-shaped path in the embodiment shown herein (to increase the number of rivets 3 that are housed within the clip-fed rivet delivery system 7), has been created, and it is through this channel that the rivets 3 progress in their march towards presentation. Thus, a primary alignment mechanism by which the rivets 3 are aligned and simultaneously translated is the creation of main rivet channel 227, which itself comprises the opposing generally u-shaped transverse rivet channels 227*a* and 227*b*, which utilize the rivet head, and the body and pintail portions immediately adjacent thereto, for alignment and translation.

A close inspection of FIG. 1F reveals that rivet drive belt 209 contacts one generally semi-circular side of the rivets and translates the rivets along the desired path by rotating/rolling them along main rivet channel 227. Thus, each individual rivet 3 is translated by means of the action of the rivet drive belt 209 and the simultaneous advance of the rivets 3 behind it.

Because the rivet drive belt 209 is not positioned within main rivet channel 227, but, rather, is located to one side of it (i.e., just forward of it in the embodiment shown), it is useful to position a rivet roll bar guide plate 211 (or some other equivalent mechanism such as a unitary extension on the rivet body side track plate island 215 or a balancing belt positioned at an opposite location vis-à-vis the main rivet channel 227) so that, as the rivet 3 rolls along main rivet channel 227, it is, throughout most of its path towards presentation, being gently squeezed between rivet drive belt 209 on one side and the rivet body side track plate island 215, rivet pintail side track plate island 223, and the normally (i.e., oppositely) positioned rivet roll bar guide plate 211 on the other. The spaced positioning of the roll bar guide plate 211 must allow for the placement of the rivet body presenter 143 between it and the rivet body side track plate island 215 and the rivet body side track plate 217.

As the rivet rolls along, twitter (i.e., movement of the rivet off of the x-axis, for example, in the direction of the y-axis) is effectually limited by the action of the two transverse rivet channels 227*a* and 227*b* which secure the rivet, by means of its head, into position. A rivet guide plate 213 facilitates the smooth translation of the rivets as they traverse the bottom of the u-shaped main rivet channel 227.

Although the clip-fed rivet delivery system 7 described herein is particularly well suited for what are commonly known in the industrial and aerospace fastening industries as blind rivets, the feed mechanisms described will obviously perform their intended functions with any substantially axis-symmetric part containing an enlarged axis-symmetric cross-section.

Stage Thirteen: Presenter Prior to Rivet Capture.

Figure 13:
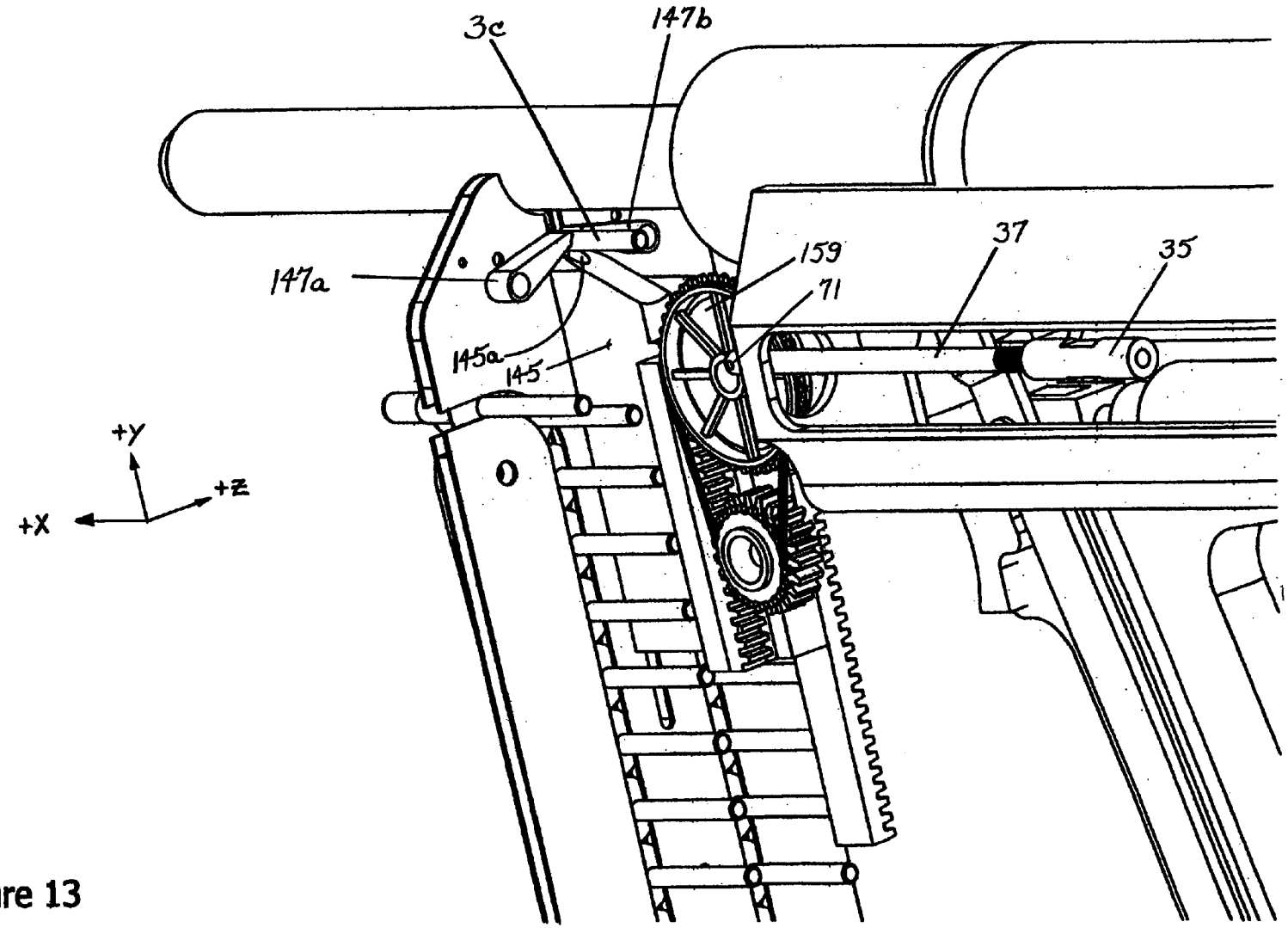
FIG. 13 is an isometric view of a portion of the invention at stage thirteen of the fastener installation process described herein.

Turning, now, to FIG. 13, the blind rivet installation system 1 is shown at stage thirteen in the blind rivet installation process; that is, the blind rivet installation tool 5 is shown in the state experienced just prior to rivet capture.

At this moment in time, presentation air cylinder 33 (not shown in FIG. 13) has retracted turnbuckle 35, and, thereby, presentation connecting rod 37, to a substantially rearward position. Presentation connecting rod 37, by means of dowel pin 71, has rotated large sprocket hub 159 clockwise (as viewed in FIG. 13 from the perspective of a viewer facing in the positive z-direction) so as to raise presentation rack 167 and, thereby, rivet pintail presenter 145, as described hereinabove.

The next rivet in succession, rivet 3*c*, is shown in its position in stage thirteen just prior to capture. When the presentation connecting rod 37 is further retracted a short distance, the rivet 3*c* will be further elevated by rivet body presenter 143 (not shown in FIG. 13) and rivet pintail presenter 145.

It should also be noted that, during this stage, when presentation connecting rod 37 translates rearward, rivet drive belt 209 does not translate due to the configuration of rack gear 181, one-way bearing 183, and hex drive shaft 185, as described in the discussion of stage twelve.

As stated, when the presentation connecting rod 37 is further retracted a short distance, the rivet 3*c* will be further elevated by rivet body presenter 143 (not shown in FIG. 13) and rivet pintail presenter 145; however, its upward ascent will be limited by the paws 147 which are secured in position by the paw stops 149 (not shown in FIG. 13).

When the rivet 3*c* is driven into the paws 147, it will be fully "captured" within rivet body presenter 143 and rivet pintail presenter 145. Specifically, captured rivet 3*c* will be fully seated and snapped into rivet body presenter channel 143*a* and rivet pintail presenter channel 145*a* (the rivet presenter channels being depicted within both FIG. 9A and FIG. 13).

At this point, the rivet 3*c* is fully secured for presentation, as described in the discussion of stage eight and stage nine.

Fastener Delivery Systems.

The reader will note that much of the discussion contained within this specification is devoted to a blind rivet installation system 1 for the blind installation of rivets 3, the specific blind rivet installation system 1 featuring a blind rivet installation tool 5 equipped with a clip-fed rivet delivery system 7.

Although a clip-fed rivet delivery system is an effective, portable method of delivering rivets 3 to the blind rivet installation tool 5, there are occasions in which a higher-volume rivet delivery system is desired.

A useful blowline-fed rivet delivery system comprises a bulk supply receptacle which stores a large volume of rivets for high-volume delivery to the blind rivet installation tool 5.

The bulk supply receptacle comprises a bin, a separator, a transfer device, an orienter, a queueing transfer device, and either a gate or an inspection/sorting device. The bin houses a large supply of rivets for high-volume delivery to the blind rivet installation tool 5. Several alternative methods may be employed in the design of the separator; a useful approach employs an elevating paddlewheel which scoops a modicum of rivets from the bin, elevates them, and transfers them to a transfer device.

The transfer device may also utilize a variety of designs. An effective transfer device employs a set of inclined, parallel, oppositely-spinning bars at the base of a trough. The spinning of the bars, and their inclined orientation, induces the sliding movement of vertically oriented rivets to the orienter.

The orienter separates the vertically oriented rivets in such a fashion that those that are properly oriented for introduction into the queueing transfer device and the inspection/sorting device are passed to those devices, while those that are oppositely oriented are returned to the bin. The orienter may profitably employ a number of design concepts; one useful approach is to employ a T-shaped rivet channel which separates the vertically oriented rivets based upon the relative difference between the rivet pintail diameter and rivet body diameter.

Properly oriented rivets exiting the orienter enter the queueing transfer device which employs a drive belt, track plates, and roll bars (in a fashion similar to that described in stage twelve) to transfer the rivets, in individual succession, along a path towards the gate or inspection/sorting device. Upon command from the system controller to pass a rivet to the tool, the gate or the inspection/sorting device (the latter culling rivets which do not meet pre-defined criteria) passes a rivet to the blowline.

The blowline passes individual rivets at high speed from the bulk receptacle to the blowline-fed rivet delivery system connected the blind rivet installation tool 5. Importantly, the blowline-fed rivet delivery system is inter-connected to the blind rivet installation tool 5 utilizing the same docking connections that are utilized by the clip-fed rivet delivery system 7 described hereinabove. Similarly, two blowline portals 231, one of which is shown in FIG. 9A, linearize the final section of blowline entering the blind rivet installation tool 5 and secure the position of the blowline directly (i.e., closely) below the hydraulic cylinder and along the longitudinal axis of the blind rivet installation tool 5.

The blowline-fed rivet delivery system comprises a rivet catcher assembly which captures arriving rivets for action by a rivet presentation assembly. The rivet presentation assembly may utilize a rivet pintail presenter, rivet body presenter, and paws in a manner similar to that depicted in stage eight, stage nine, and stage thirteen.

A Blowline—Feed Delivery System "Bulk Feeder"

Figure 201F:
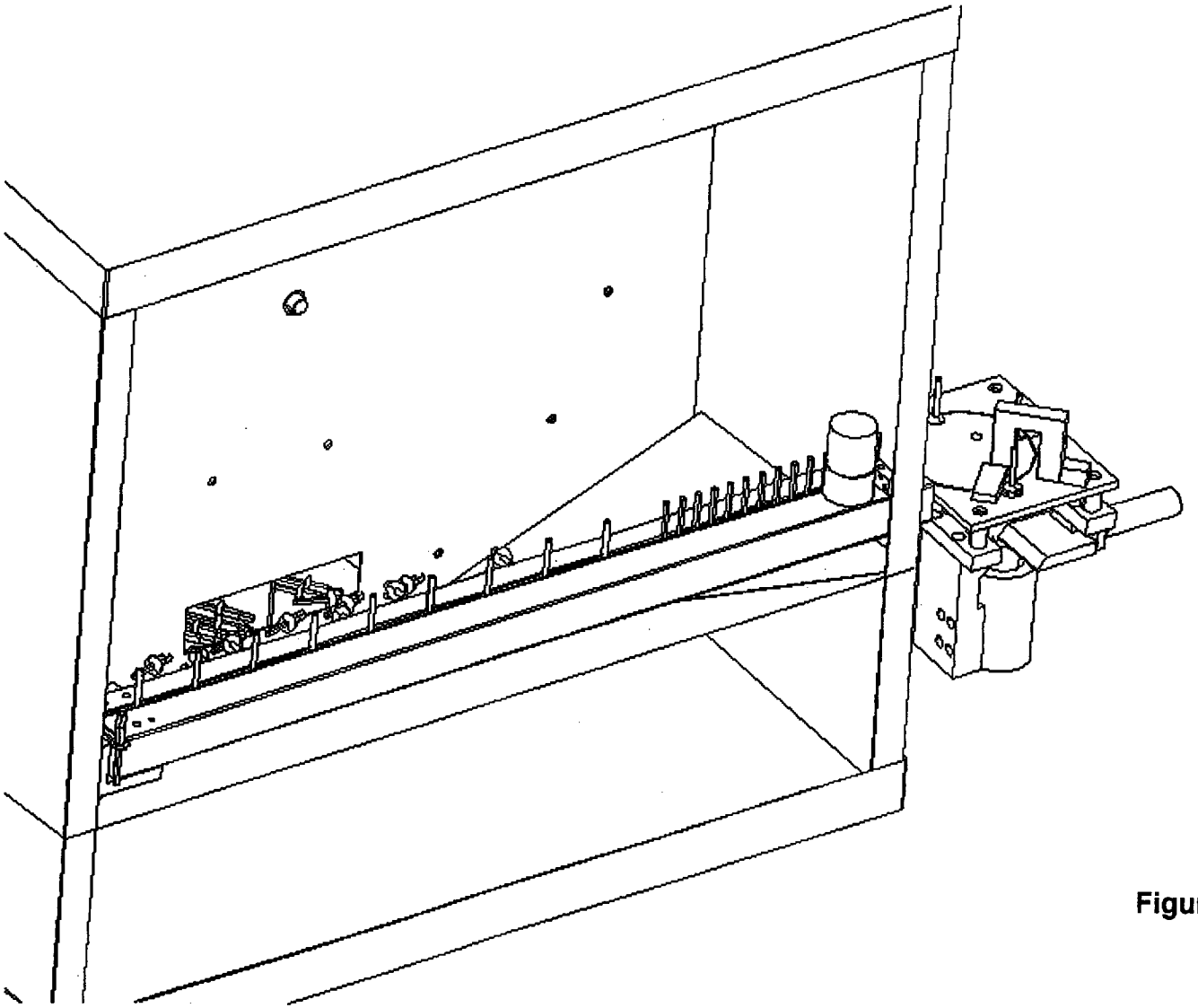
FIG. 201F is an isometric view of a bulk feeder.

With reference now to the drawings, and in particular with reference to FIG. 201F, a bulk feeder for use in conjunction with a fastener installation system is shown. Reference characters are not employed in the instant figures because, given reader familiarity with the fastener installation system provisional patent application and the technologies described therein, they are unnecessary.

Shown in FIG. 201F is the feeder and the escapement system. Looking at the feeder shown here are rivets in random orientation laying in the hopper. The reader will observe some rivets that have slid out of the hopper into the paddlewheel feed system. Also, the reader will observe that a number of rivets are being transported in the queue track. Further, a few rivets are in the escapement system.

Figure 202F:
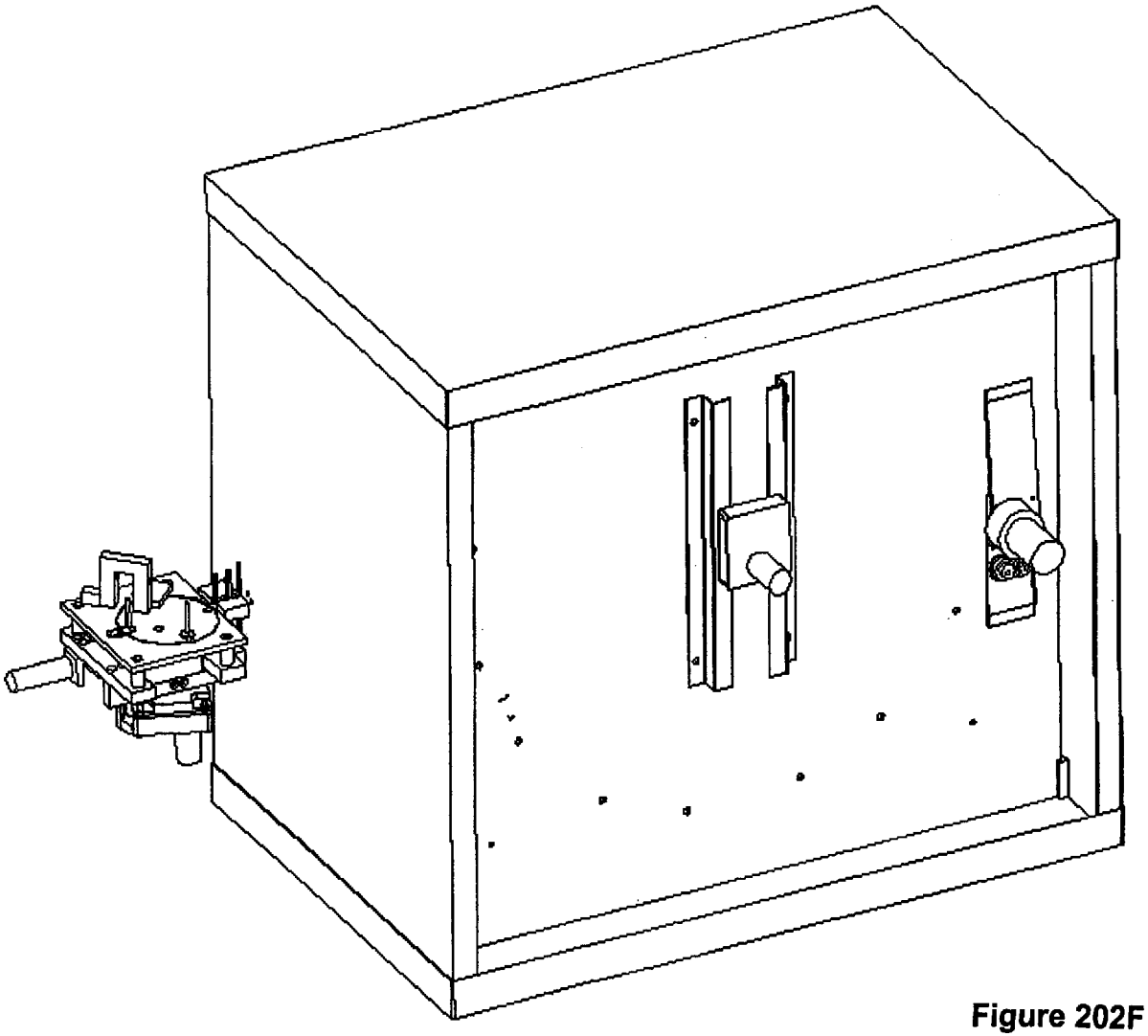
FIG. 202F is a rear isometric view of a bulk feeder.

With reference now to FIG. 202F, an opposite (or rear view) of the feeder assembly is shown. A motor is mounted to two oppositely oriented z-rails. This motor couples to the paddlewheel (not shown) in order to rotate the paddlewheel and thereby propel or lift the rivets to an elevated location where they roll down into a set of spinning transport bars. The motor to the far right is coupled to the spinning transport bars via a rubber belt.

Figure 203F:
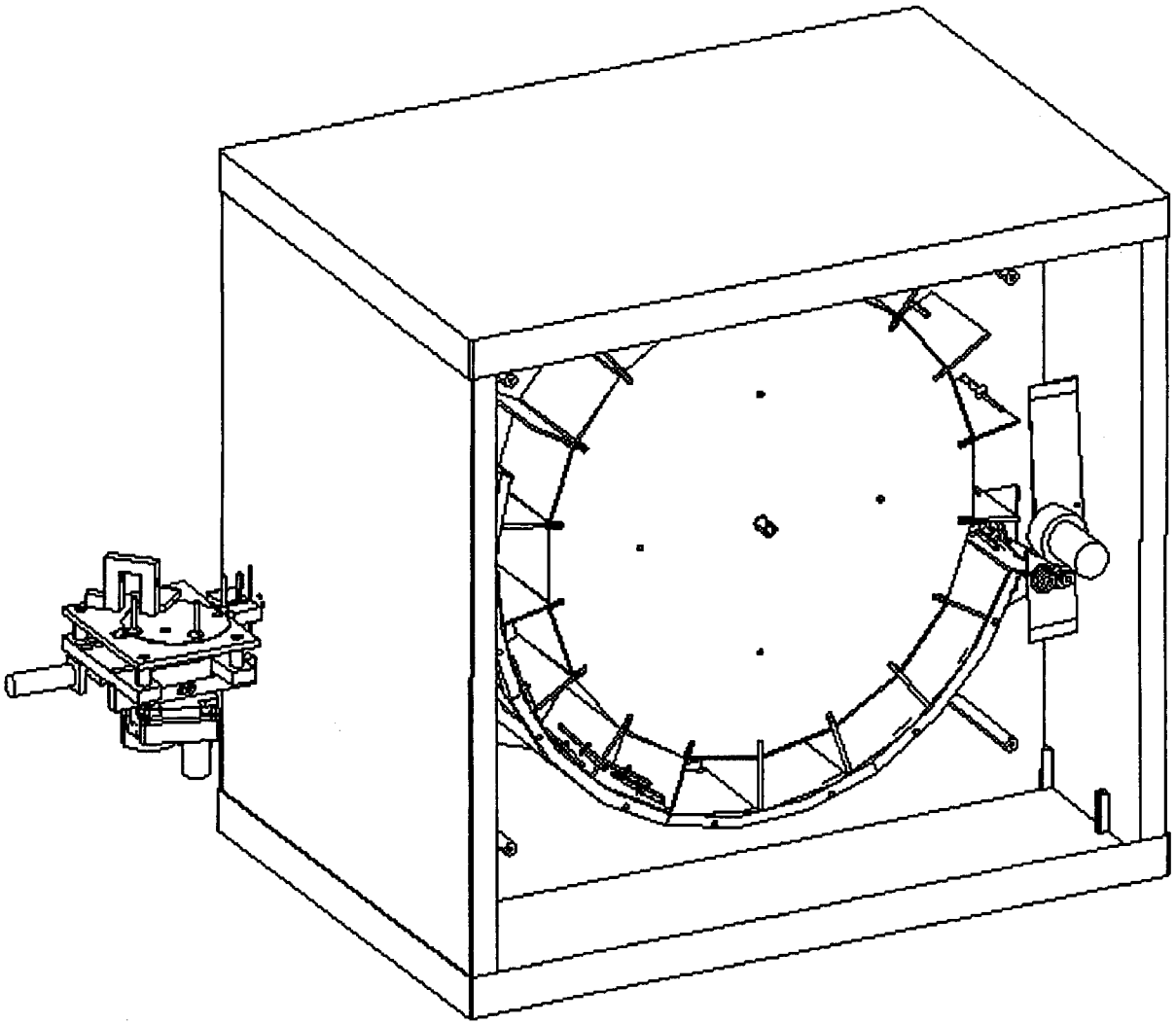
FIG. 203F is another rear isometric view of a bulk feeder with the paddlewheel guide plate removed.
Figure 204F:
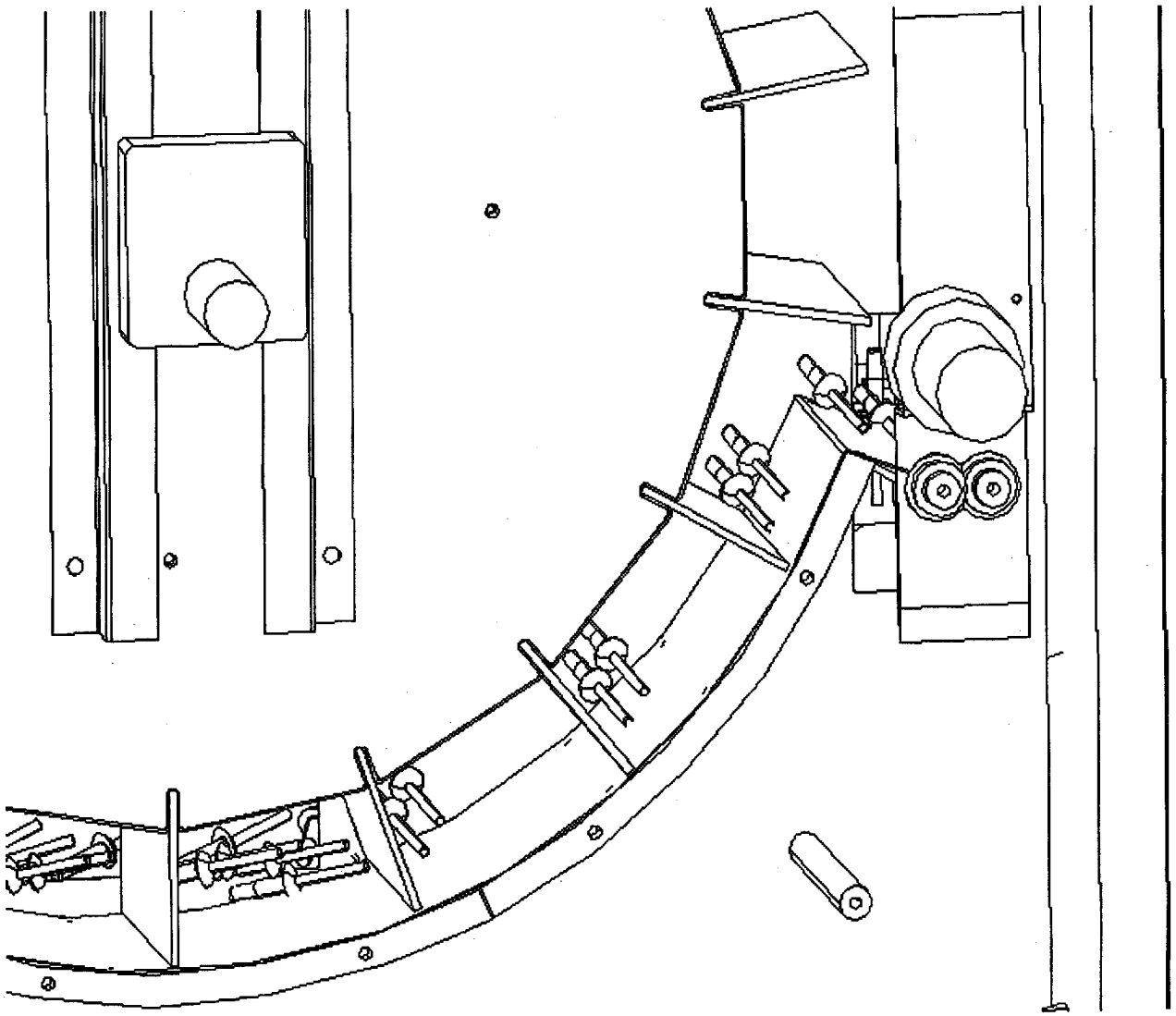
FIG. 204F is a close-up isometric view of the paddlewheel system in the bulk feeder.
Figure 205F:
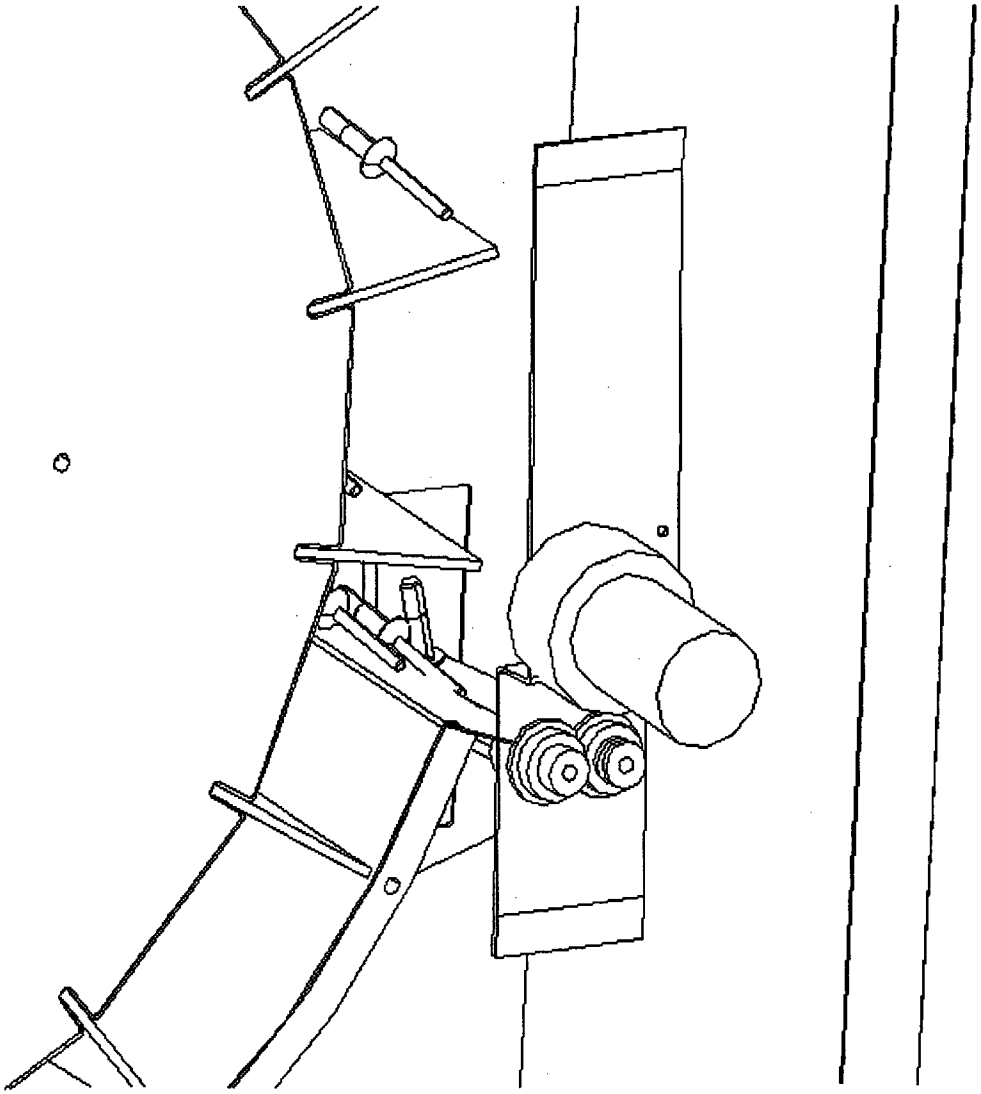
FIG. 205F is another close-up isometric view of the paddlewheel system in the bulk feeder.

With reference now to FIG. 203F, a rear view is again presented, and, in this view, the paddlewheel rear guide plate is removed for clarity. Here one observes rivets laying against the paddles. This view from the rear depicts the wheel rotating clockwise. It should be understood that the paddlewheel can be driven in either direction (clockwise or counter-clockwise) depending on the parts that are being fed. The preferred embodiment here and for many applications is counter-clockwise as viewed from the rear (and as shown in FIG. 204F and FIG. 205F). This elevates the parts and then allows them to roll off onto the spinning bars with a minimum of freefall or drop. By minimizing the freefall and/or drop, the resulting impact on the parts is minimized. It is also possible to construct the outer surface of the main paddlewheel cylinder as a conic section, so that the rivets can be elevated by the paddles to the uppermost position on the paddlewheel so as to slide down the conic surface and through a port in the front or rear guide plate on to the spinning bars (or on to a spinning bar trough feed section).

With reference now to FIG. 204F and FIG. 205F, in these views, one can observe the rivets coming through the front side paddlewheel guide plate from the hopper on the far side. As the paddlewheel rotates, it pushes the rivets along the paddlewheel trough. The trough stops and has a slide where the rivets exit onto a pair of oppositely spinning bars.

The spinning bars are spaced to allow the rivets to hang down through or between the bars. The spinning bars are also inclined or angled downward from the horizontal plane. The angle should be between 5-15 degrees depending on the parts that are being fed.

The combination of oppositely spinning bars and the inclined smooth surface of the spinning bars acts to propel the parts down the slope.

In FIG. 205F, the concentric circles located just below the motor are representations of spur gears. Gears are utilized here to create oppositely spinning bars. The bars are attached to these gears and go through bushings held in the mounting bracket.

Figure 206F:
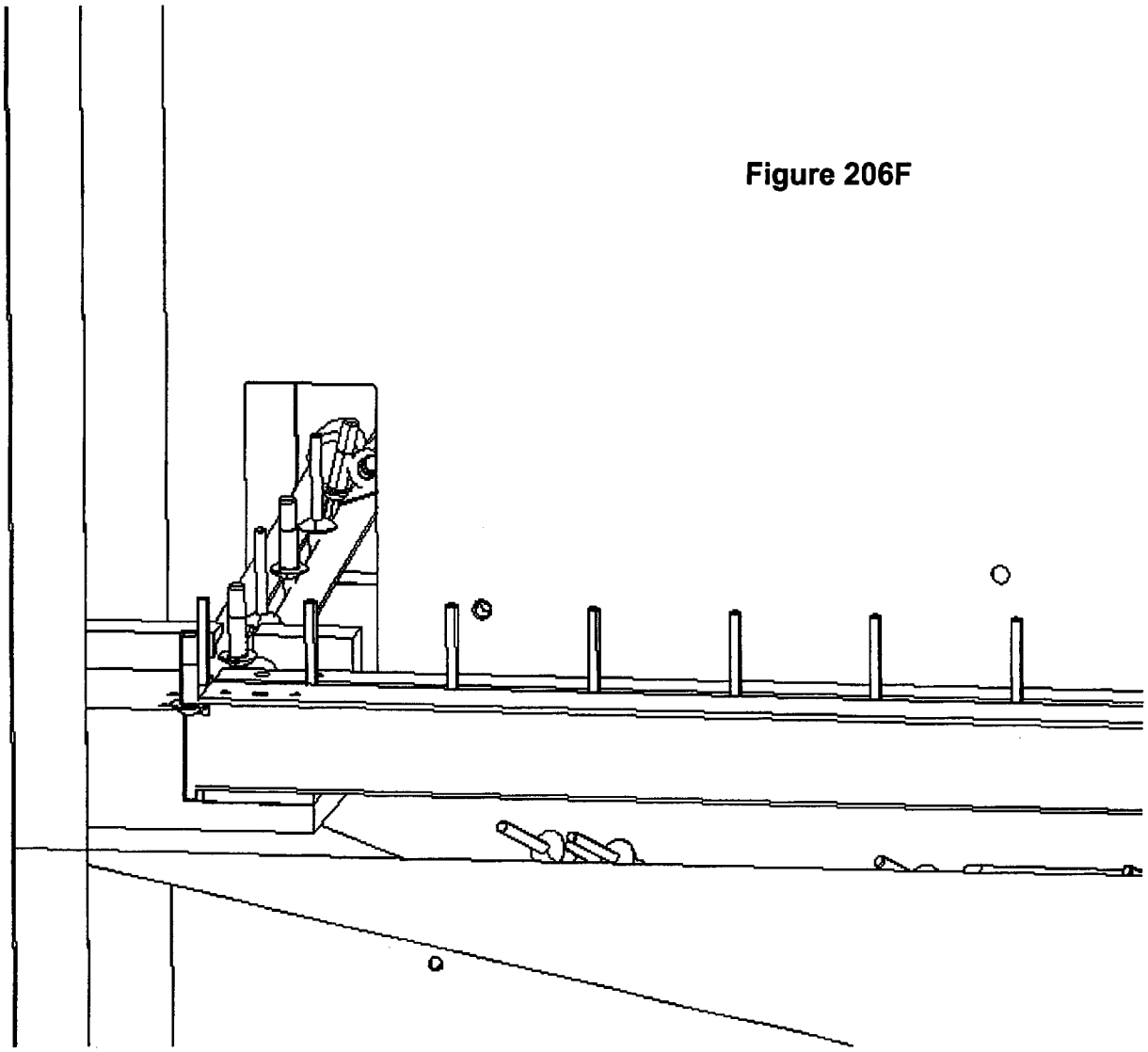
FIG. 206F is an isometric view of the spinning bar to queue track transition in the bulk feeder.

With reference now to FIG. 206F, in this view, rivets are shown in various orientations after they have slid down out of the paddlewheel into the spinning bars. Here, some of the rivets are right-side-up (i.e., in a useful orientation for convenient and effective blowline feeding) and others are upside-down (i.e., in a reverse orientation) with respect to each other.

Figure 207F:
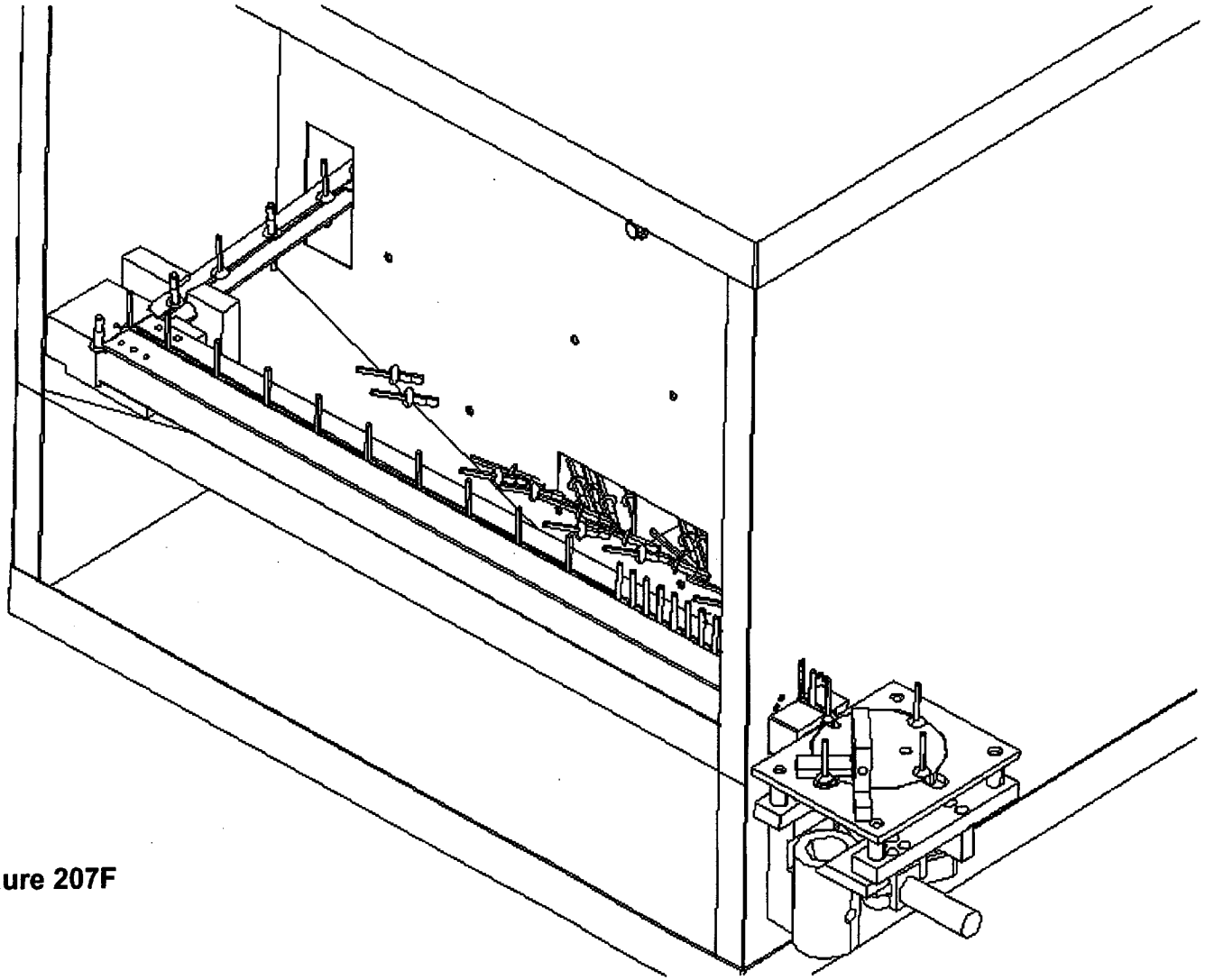
FIG. 207F is another isometric view of the spinning bar to queue track transition in the bulk feeder.

With reference now to FIG. 207F, in this view, the rivets are traveling down the inclined spinning bars and entering a sorting block. The sorting block allows upside down rivets to travel straight forward and through the sorting block and eventually falling back into the hopper.

Rivets which are right-side-up are diverted ninety degrees and into a queue track which propels the rivets to an escapement device.

Figure 208F:
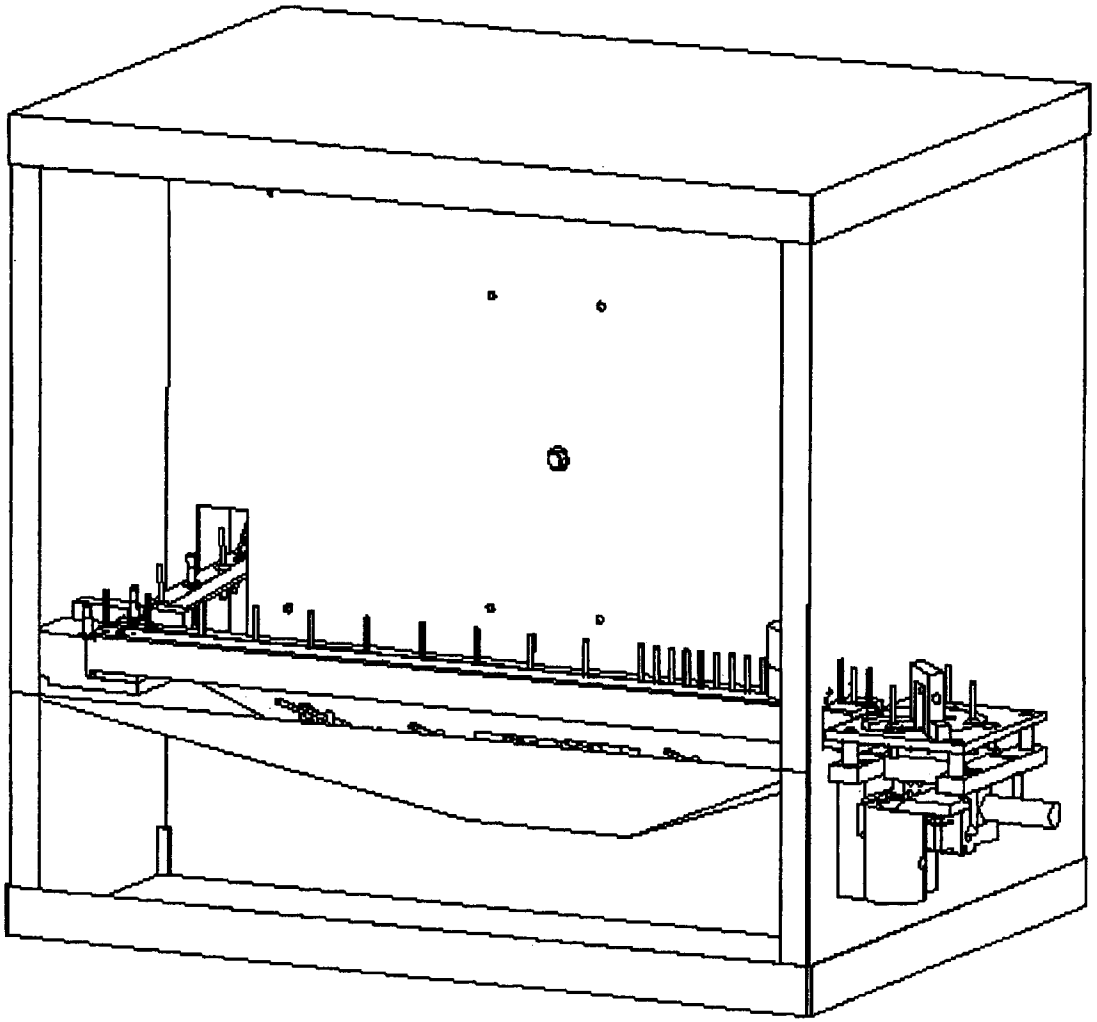
FIG. 208F is an elevational view of the bulk feeder.

With reference now to FIG. 208F, another front view of the feeder is depicted. Here, the reader can observe the elevational views of several functions.

Note the hopper and the rivets contained within it. The paddlewheel lifts the rivets to the height required to enter the spinning bars. The spinning bars ramp down to the sorting block. Upside-down rivets fall from the sorting block back down into the hopper.

Figure 209F:
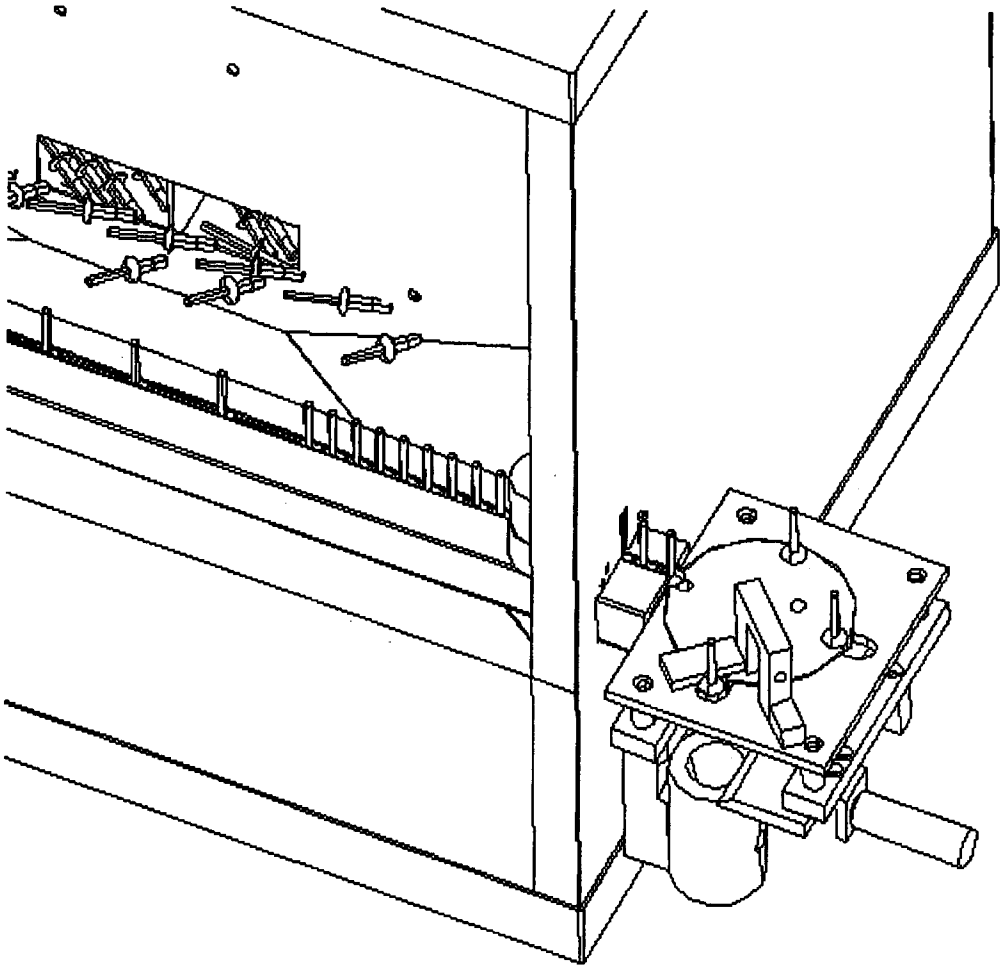
FIG. 209F is an isometric view of the queue track to escapement transition in the bulk feeder.

With reference now to FIG. 209F, in this view, several properly oriented rivets are being transported down a queue track towards the escapement system. Just inside the wall where the escapement is mounted, the reader will observe a motor. This motor drives a belt which propels the rivets down the queue track (utilizing a rivet roll bar guide plate and guide slot—based track, albeit with a flat belt, in a manner similar to that described in the fastener installation system provisional patent application).

The Blowline—Feed Delivery System Bulk Feeder Escapement

Figure 210F:
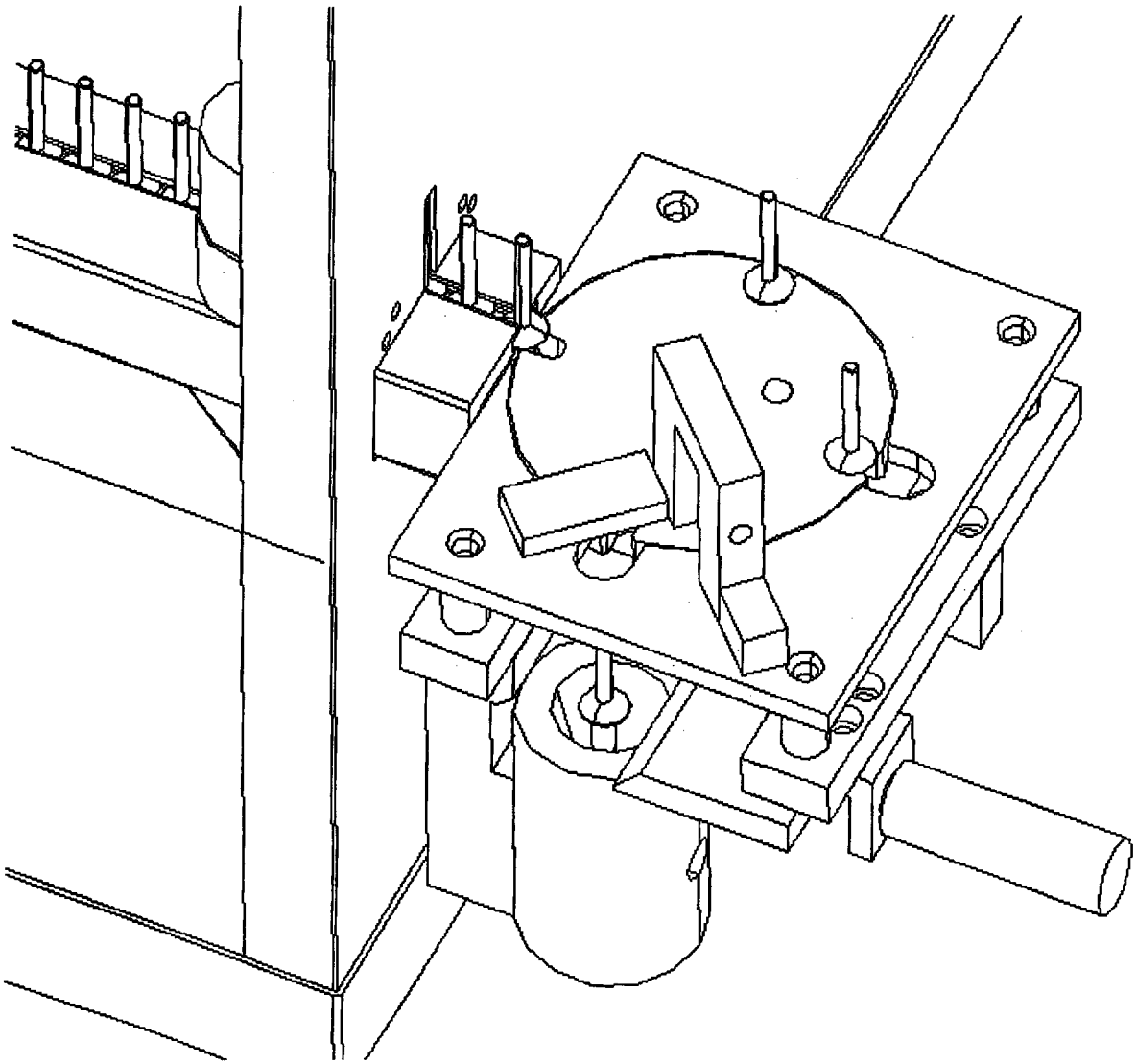
FIG. 210F is a close-up isometric view of the escapement system of the bulk feeder.

With reference now to FIG. 210F, in this view, rivets are observed entering an index wheel with specially cut slots configured to accept the rivets. Here, there is a rivet at each of three locations and one rivet that has been scrapped out of the index wheel and is shown falling down into a funnel-shaped receiver.

Also shown is a sensor block/bridge that spans over and around the path of the rivet. On both sides of the bridge infrared or other sensors are located so that, as the rivet is rotated along its path, this infrared beam is blocked (or other monitoring sensor triggered). This, in turn, signals the controller and is used to stop the index wheel at the correct location to accept a new rivet from the queue track (note that the hole halfway up the bridge is where the sensors are located).

Note that this escapement system uses no conventional gating system. Instead, the rivet is scraped from the index wheel and then the rivet falls into the funnel.

After the rivet falls into the funnel, the cover is slid over the funnel which, via a face seal, seals the blowline feed chamber and tube. Now, compressed air is introduced at a high volume flow rate which then propels the rivet down the blowline feed tube.

Figure 211F:
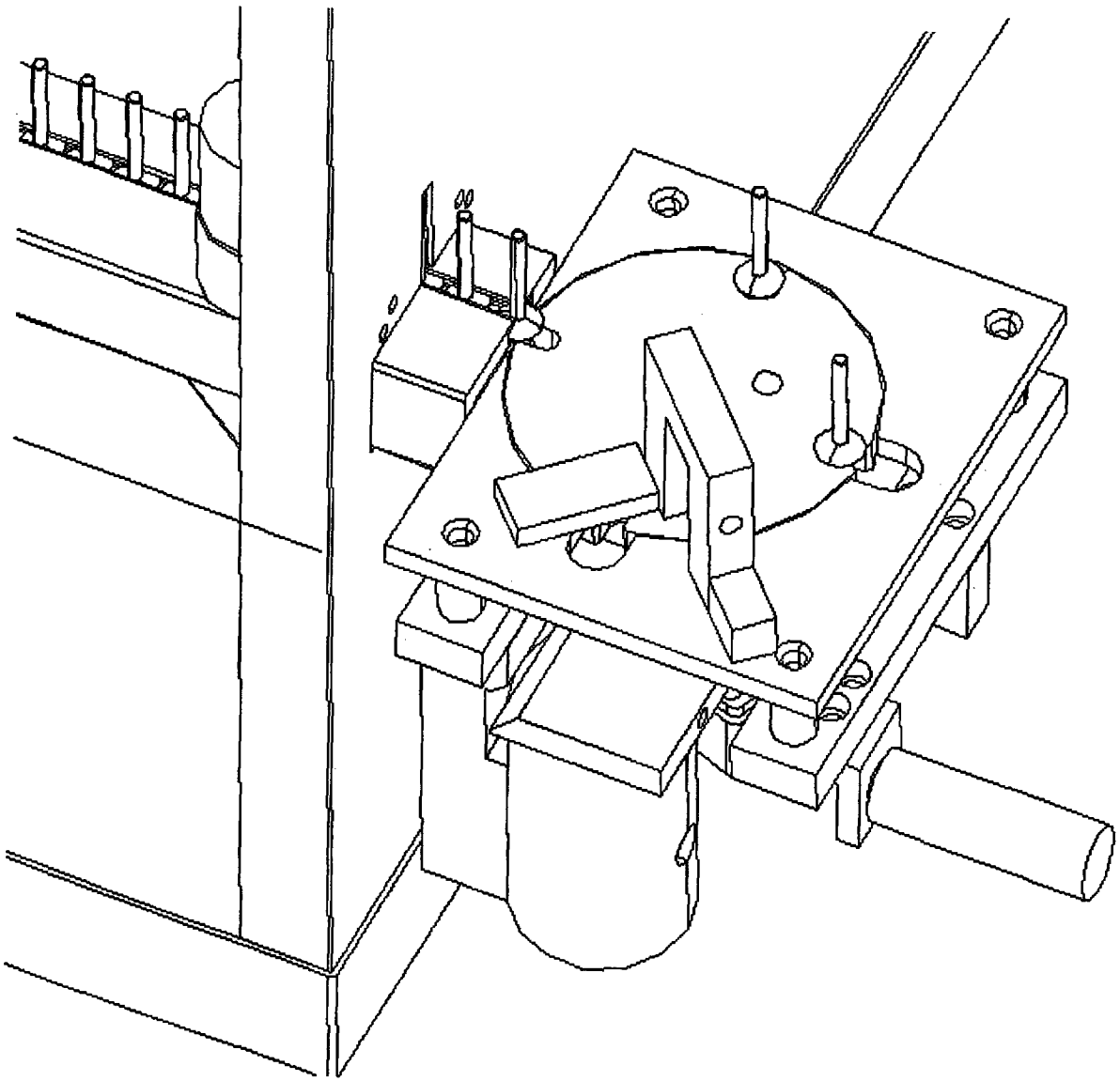
FIG. 211F is another close-up isometric view of the escapement system of the bulk feeder.

With reference now to FIG. 211F, in this view, the funnel cover is shown in its closed position, ready to blow a rivet down the feed tube.

A Blowline—Feed Delivery System "Catcher"

Figure 201C:
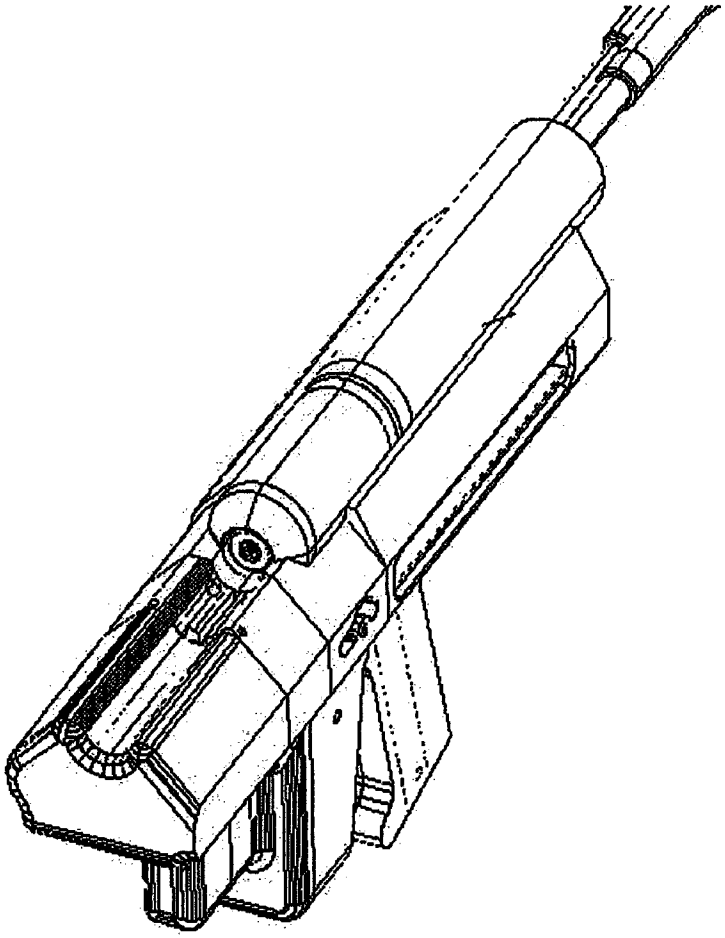
FIG. 201C is an isometric view of a blowline feed delivery system "catcher."

With reference now to FIG. 201C, in this view, the fastener installation system is shown with the nose assembly in the retracted position. The catcher assembly is attached to the gear drive housing. The catcher also has a safety cover which surrounds the catcher assembly.

Figure 202C:
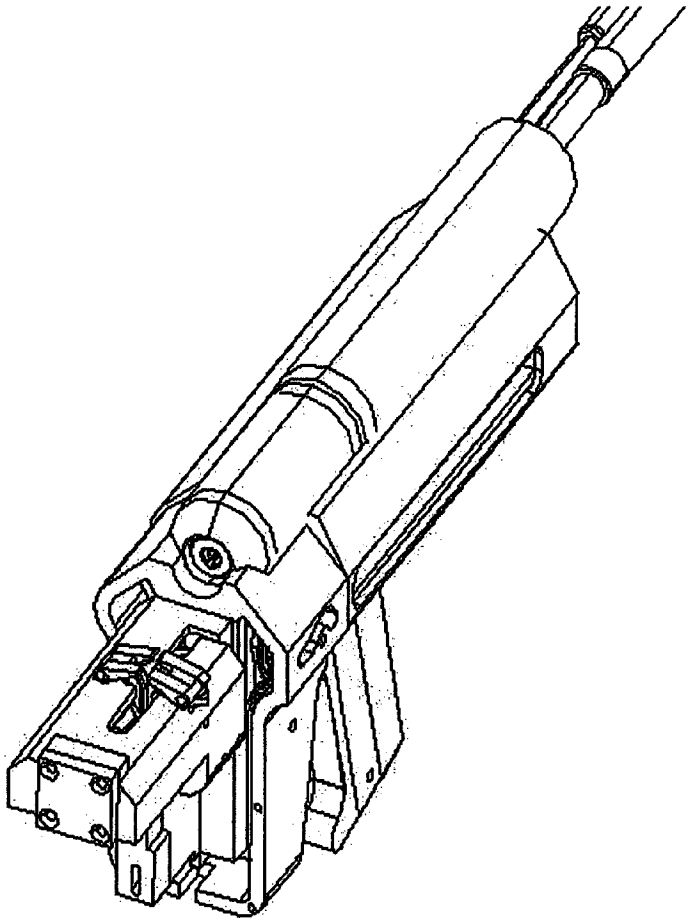
FIG. 202C is another isometric view of a blowline feed delivery system "catcher" with the cover removed.

With reference now to FIG. 202C, in this view, the tool and catcher assembly are shown alone with the paws. The catcher housing and cover are not shown for clarity. Also shown are the two presenters (i.e., the rivet pintail presenter and the rivet body side presenter).

Figure 203C:
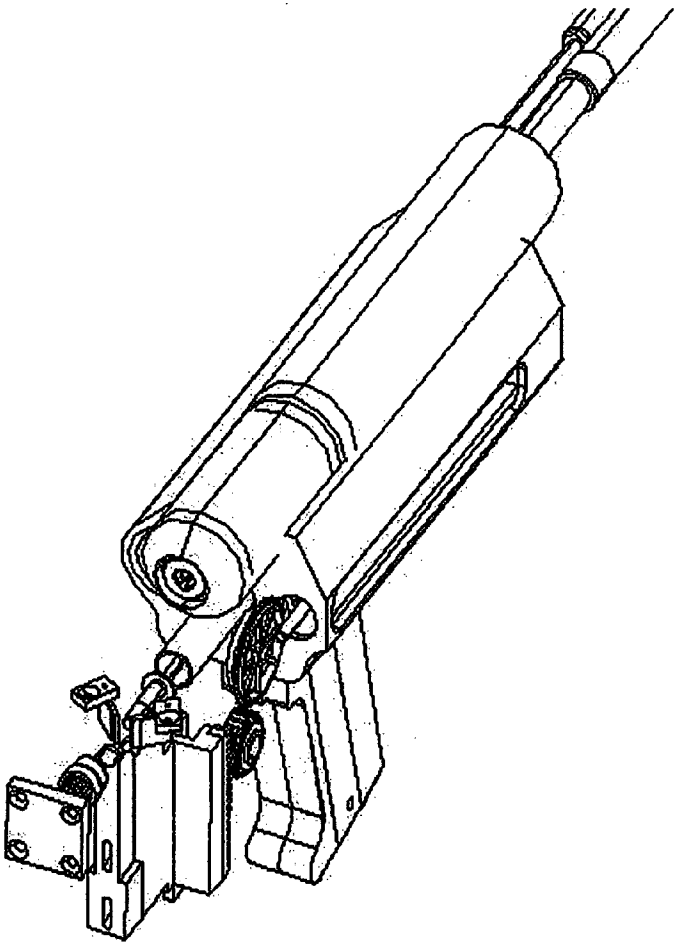
FIG. 203C is another isometric view of a blowline feed delivery system "catcher" with various housings removed.

With reference now to FIG. 203C, in this view, the catcher body is not shown in order to show the two presenters, the location gates, the gate keepers, the impact piston, the rivet, the spring cover, the blowline feed tube, the rack gear, and the rack gear drive assembly. The rivet is shown as it exits the blowline feed tube and is about to impact the location gates. Not shown are small coil compression springs that close the location gates.

Figure 204C:
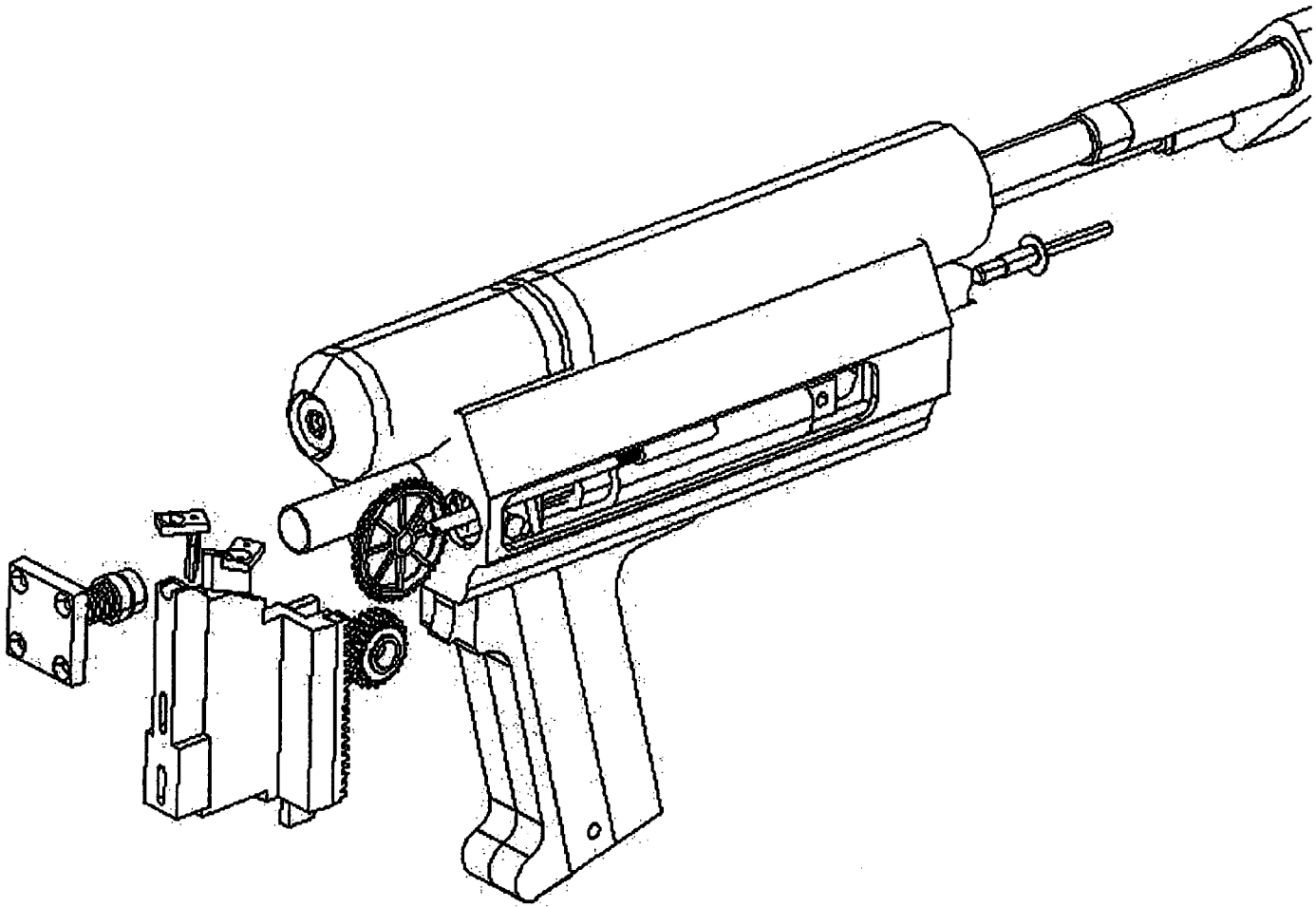
FIG. 204C is an isometric view of a blowline feed delivery system "catcher" highlighting details relating to the impact piston.

With reference now to FIG. 204C, in this view, the rivet is shown as it is entering the rear of the tool. The rivet is actually being transported through a plastic (e.g., nylon, teflon, etc.) tube and is propelled via compressed air. As the rivet approaches the tool, the plastic tube enters a closely fitted metallic tube. The plastic tube is thereby held in a straight configuration. This yields a straight line path for the rivet. This helps to ensure that the rivet travels in a predictable path.

Also shown in this view is a compression spring that reacts between the impact piston and the spring cover. The spring here acts to absorb the impact of the rivet. The rivet is actually stopped by this impact piston and spring combination.

Figure 205C:
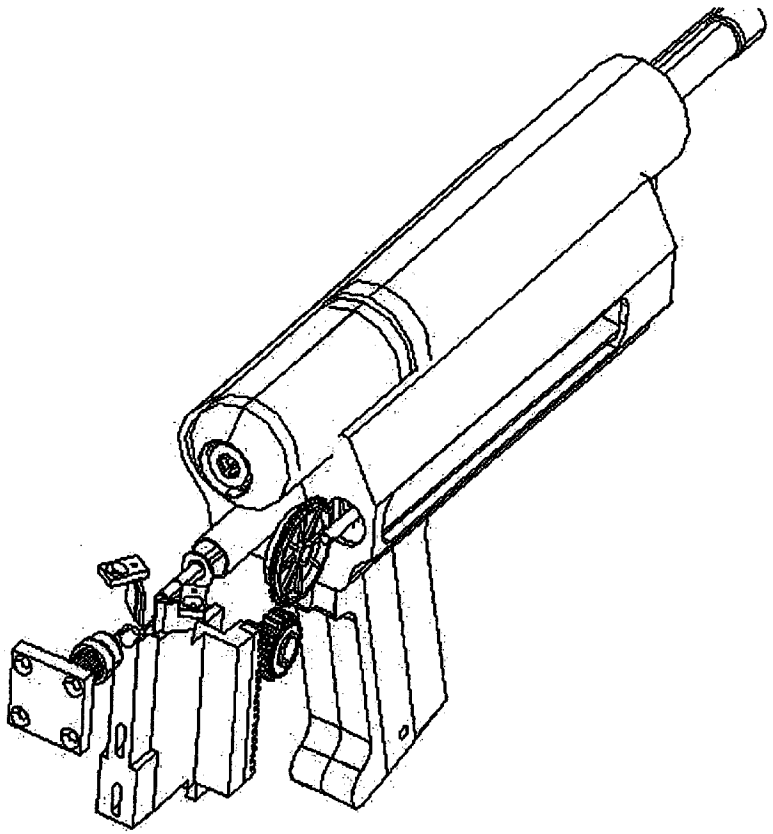
FIG. 205C is an isometric view of a blowline feed delivery system "catcher" highlighting alignment of various subassemblies.
Figure 206C:
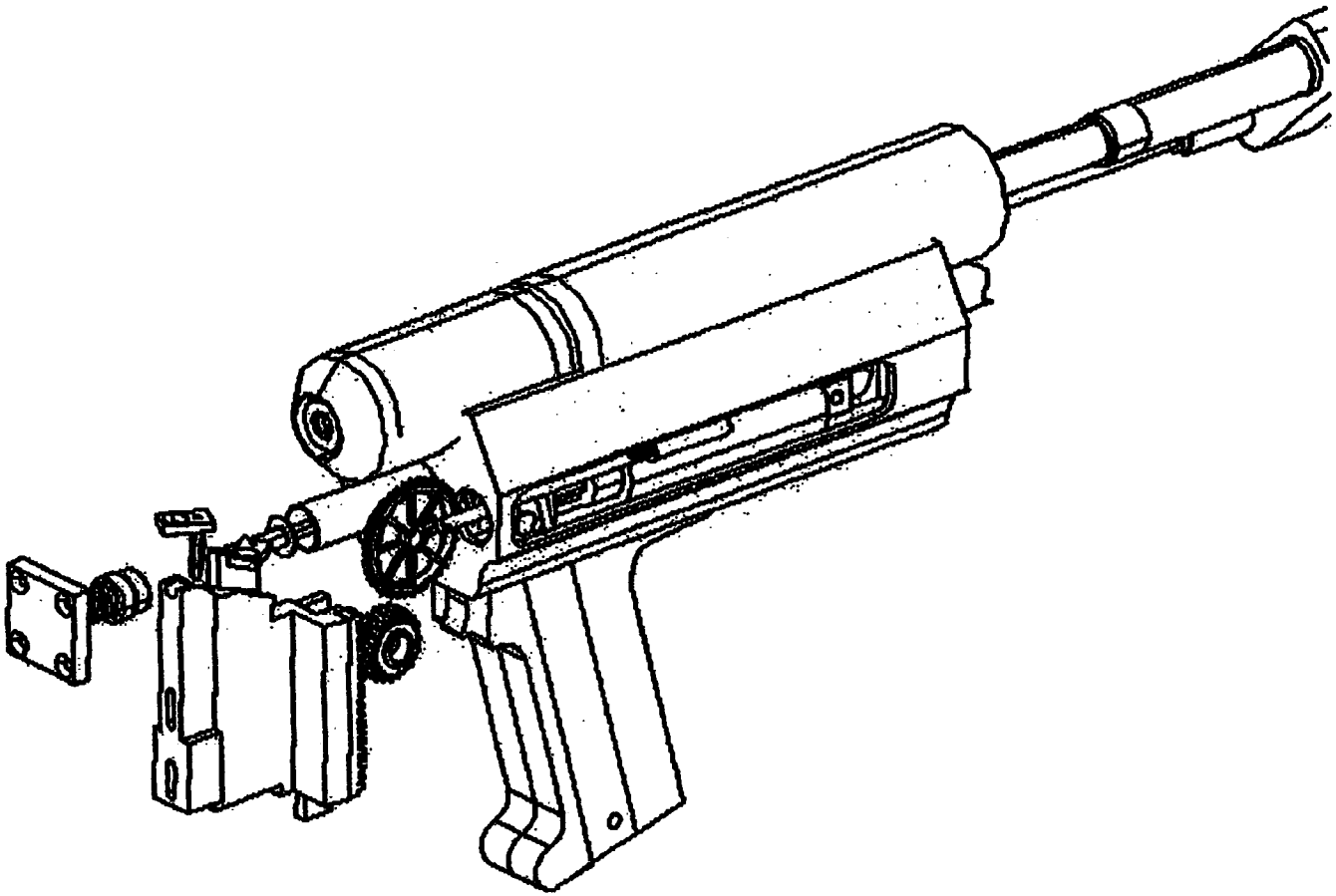
FIG. 206C is an isometric view of a blowline feed delivery system "catcher" highlighting alignment of various subassemblies.

With reference now to FIG. 205C and FIG. 206C, two different views that show the rivet as it is entering the catcher body are shown (catcher body not shown). It is noted that the rivet catcher mechanisms described herein are aligned with the blowline feed tube and the presenter assembly; however, it would be possible to enjoy further savings of cycle time by shifting the location of the catcher assembly and blowline feed tube to one side so that a shuttle mechanism can transport the most recently arrived rivet upon demand to the presenter assembly while the blowline feed tube delivers another rivet to the catcher.

Figure 207C:
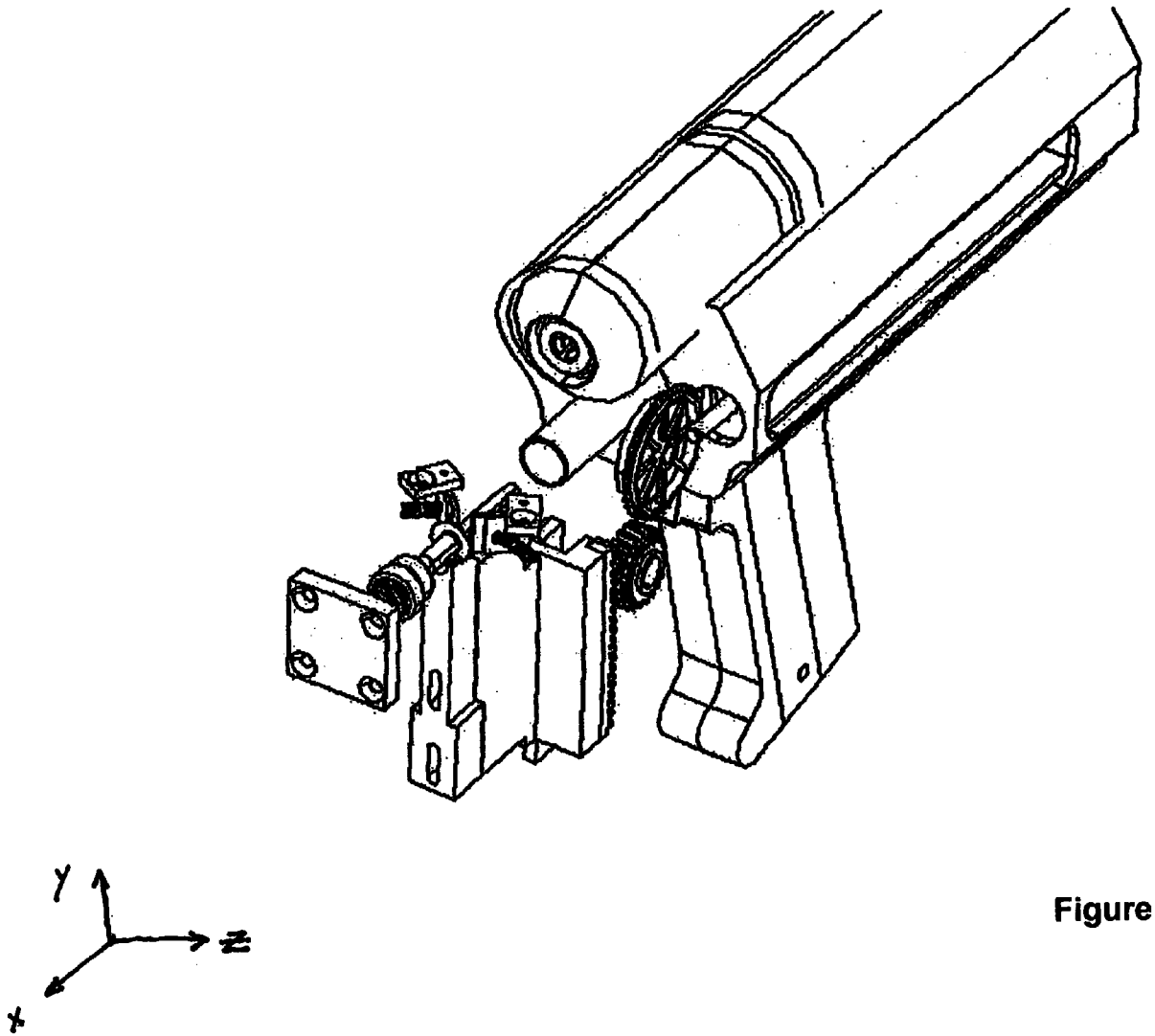
FIG. 207C is an isometric view of a blowline feed delivery system "catcher" highlighting details relating to the location gates.

With reference now to FIG. 207C, in this view, the rivet is shown just after it clears the location gates. Here, the gates have been opened by the head of the rivet and, after the head clears the gates, the gates are closed via compression springs. The gates in their most-closed position are spaced such that the pintail is a loose fit. The pintail can move unobstructed in the vertical direction.

Also shown is the impact piston and compression spring just as the rivet impacts the impact piston. Here, the impact piston and spring act to decelerate the rivet and then to move the rivet into a reproducible location. The rivet is located in the longitudinal direction along the x-axis between the piston and the location gates. The head of the rivet is larger than the location gate gap thereby stopping the travel of the rivet as it bounces back off the impact piston.

Both the gates and the impact piston are fitted with a high hardness urethane (or other similarly functional) bumper material. As shown, the gates appear in two pieces and are comprised of a light weight aluminum rectangular door or gate and attached to its impact side (i.e., its rearmost face) is a high hardness urethane bumper.

The location gates have a purpose in addition to final containment of the rivet. They also act to slow the rivet as it comes flying through the gates. At this point, the rivet might easily be traveling at a speed of fifty to one hundred miles per hour. The large variability in speed is due to several factors including the length of the blowline feed line. In twenty-five-foot blowline feed tubes, the speed can reach fifty to sixty-five miles per hour. The rivet is constantly accelerating, and, therefore, as the tube gets longer, the rivet's speed is increasing. Naturally, there is a limit to the rivet's velocity, and some control is attainable by controlling the air volume, velocity and pressure.

As stated, the impact piston also is equipped with a high hardness urethane on its impact surface. This protects the piston and rivet from damage as the rivet strikes the impact piston. As the rivet flies into place, its path crosses through or in between a set of infrared sensors. One sensor is an emitter, and the other is a receiver. As the rivet blocks this beam an electrical signal is interrupted, thereby signaling the tool controller that a rivet has been delivered. Once the rivet comes to rest, it is ready to be captured by the presenters.

Figure 208C:
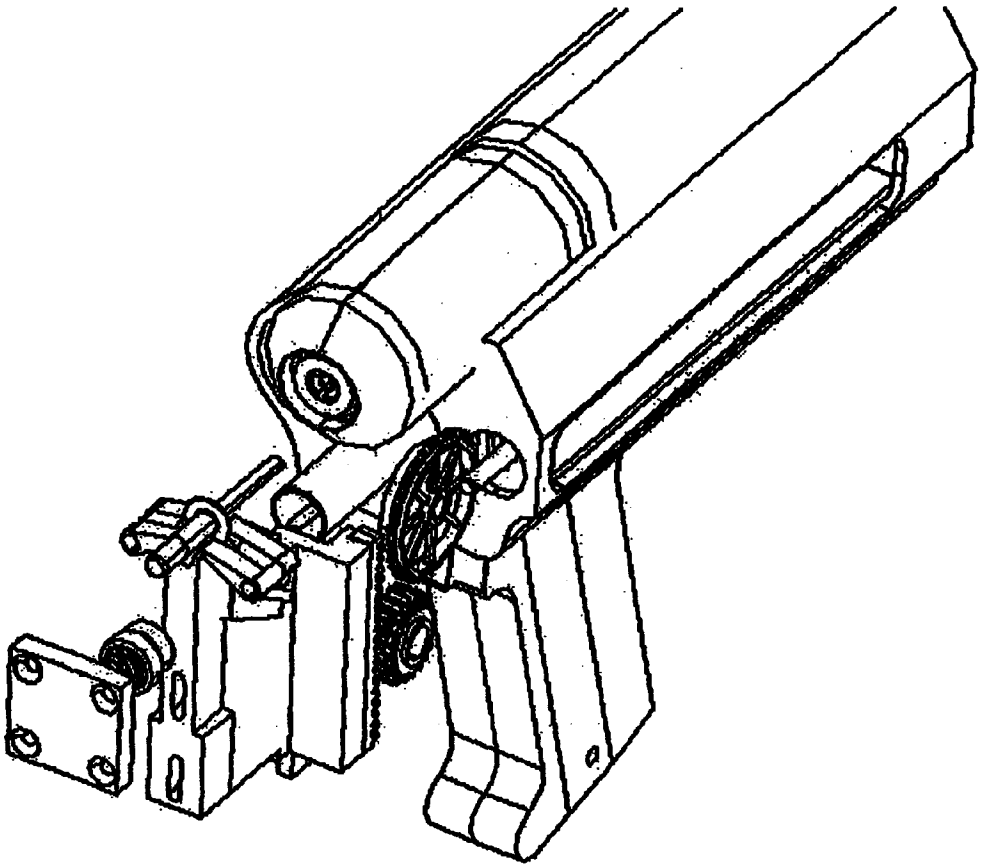
FIG. 208C is an isometric view of a blowline feed delivery system "catcher" highlighting details relating to the paws.

With reference now to FIG. 208C, in this view, the presenters have moved up through the catcher body and delivered the rivet up to the paw position (whether by means of the rack-and-gear system described in the fastener installation system provisional patent application or by a vertically mounted air cylinder positioned within the gear drive housing and coupled to the presenters). This would be expected to occur when the nose is in a somewhat extended position (note: in this figure, the nose is retracted solely for clarity).

With the nose in the extended position, the presenters and paws can be positioned such that no paw stop system is required.

It has been discovered that the nose can be used to stop the rivet and create the oppositional force required to snap the rivet body into the body side presenter. After this is accomplished, the presentation air cylinder is vented of its air pressure, allowing the entire mechanical system to relax. This basically yields the rivet captured in the body side presenter and the rivet flange located just below the nose. The paws now act as guides to facilitate the capture of the rivet in the body side presenter.

Figure 209C:
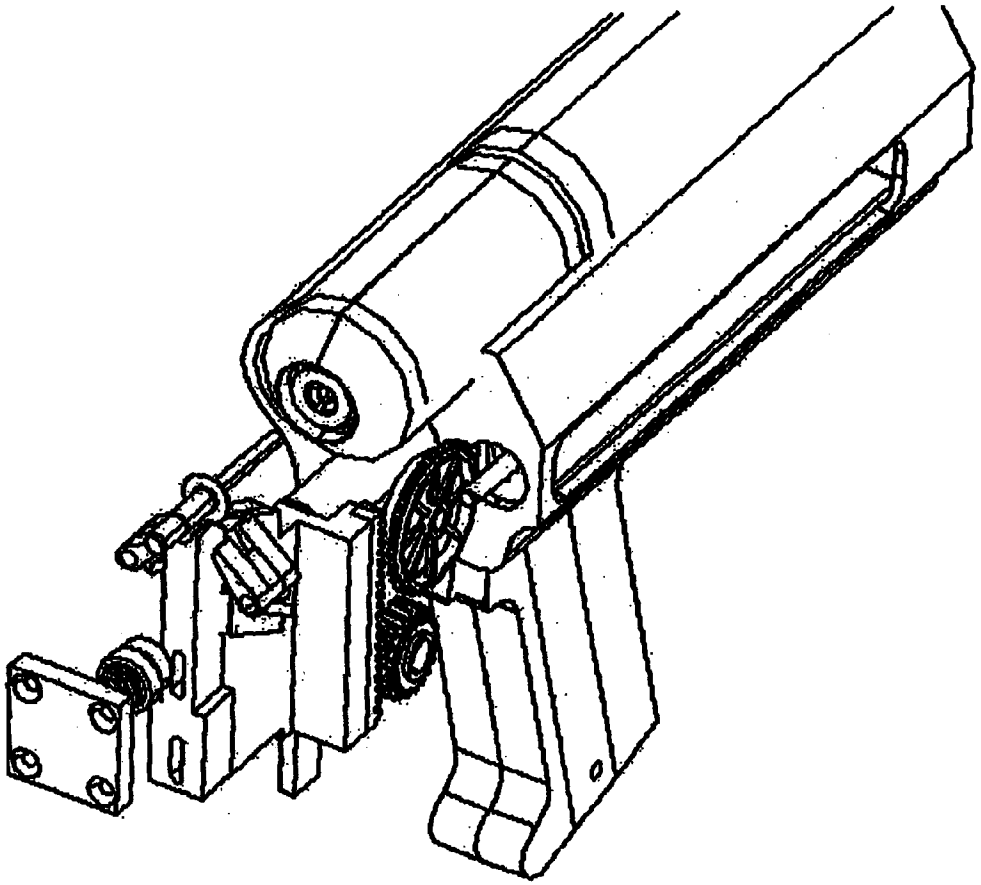
FIG. 209C is an isometric view of a blowline feed delivery system "catcher" highlighting details relating to rivet alignment.

With reference now to FIG. 209C, in this view, the presenters and rivet are shown in the fully extended load position. Now, the axis of the rivet and the axis of the nose are aligned. The nose may move forward and capture the rivet.

Figure 210C:
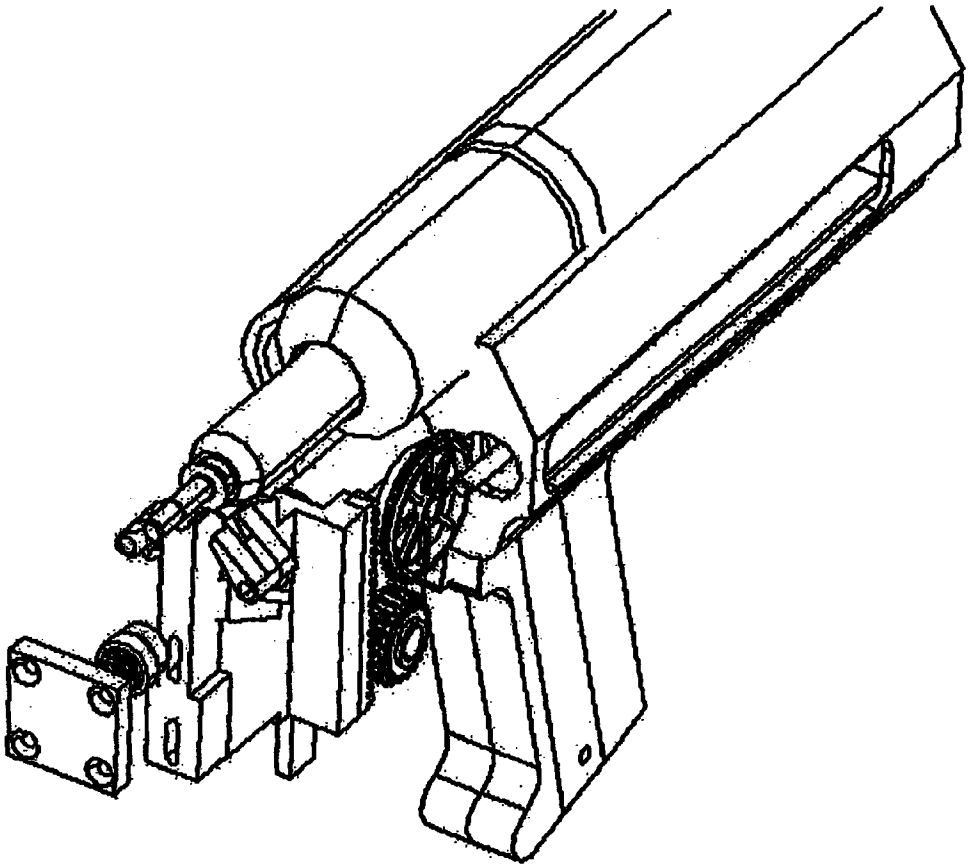
FIG. 210C is an isometric view of a blowline feed delivery system "catcher" highlighting details relating to rivet insertion.

With reference now to FIG. 210C, in this view, the nose is shown in the process of moving forward and capturing the rivet (engaging the pintail presenter in the same manner as described in the fastener installation system provisional patent application).

Modularized Embodiments of the Shock Mitigation Functionality

With reference now to FIG. 201S1 and FIG. 201S2, there are depicted alternative methods of construction of a rivet tool utilizing the shock mitigation functionality previously fully described in the fastener installation system provisional patent application. Many of the components that comprise this system are either identical to (or very similar to) the system described in the fastener installation system provisional patent application.

A cursory review of the instant embodiment reveals that this configuration does not have the components necessary for reciprocation of the nose rearward through the tool. Therefore, the necessity for an inner collet assembly is eliminated. The reader of the fastener installation system provisional patent application will recall, for example, that the inner collet 93 described in that application was utilized to impart the rearward force on the pull rod 55 in order to install a rivet 3.

In the instant application, a pull rod nut member 357 is utilized to create a similar action. In FIG. 201S1*b*, pull rod nut 357 is attached to pull rod 355. This assembly could also be produced as one part whereby a substantial shoulder and face are created in order to transfer the load from the piston rearward face to the pull rod 355. In this embodiment, the pull rod nut 357 is constructed such that its forward face 363 will mate to the rearward face 365 of piston 391.

As piston 391 is translated rearward, due to the introduction of hydraulic fluid, these two faces will translate rearward causing the pull rod 355 to move rearward also. As pull rod 355 translates rearward, the rivet installation process proceeds.

When the rivet installation process completes, and the pintail or pull mandrell breaks, the pull rod assembly 373 accelerates rearward and it is decelerated by the dampening spring 359.

In FIG. 201S2*b*, the piston 391 is shown in its rearward position illustrating the translation after introduction of hydraulic fluid. The pull rod 355 and pull rod nut 357 are shown in a rearward position illustrating the relative movement of these components to the piston 391. Notice the piston rearward face 365 and the pull rod nut forward face 363 are substantially displaced from one another (illustrating the same de-coupling action described in the fastener installation system provisional patent application).

This displacement is achieved through the compression of dampening spring 359. After pintail break, the pull rod assembly 373 accelerates rearward compressing dampening spring 359. This compression of dampening spring 359 is the primary shock absorption mechanism.

Also note the pull rod outer seal 357. This seal can also be utilized to create dampening through the work performed by rapidly compressing the air trapped between the nose 309 and the pull rod 355.

In FIG. 201S2*a*, the displacement of the pull rod assembly 373 is also apparent. Comparing this figure to FIG. 201S1*a*, one observes that components 347, 349, 357, 355, 351, and 353 have all translated rearward. The translation amplitude is the sum of the translation of the piston 391, as shown in FIG. 201S2*b*, and the translation of the pull rod assembly 373 after pintail break enabled by compression of dampening spring 359.

FIG. 201S1*b* and FIG. 201S2*b* illustrate a piston bushing 337. This component is utilized to create a guide for the pull rod. This bushing may be constructed of a hard impact-resistant plastic with a lubrication additive. The bushing serves to guide the pull rod during the rapid acceleration-deceleration cycle. A plastic would be an example of a highly advantageous, even preferred, material, because it enables the design to meet weight requirements (note: brass, bronze and similar materials would likely be effectual as well).

With reference now to FIG. 202S1 and FIG. 202S2, there are depicted designs of a shock absorbing rivet installation system designed such that the system could easily be adapted to fit on (or attach to) almost all conventional rivet tools. In the trade, such an assembly might be expected to be referred to as a "modular nose assembly." These designs also utilize the shock mitigation functionality previously fully described in the fastener installation system provisional patent application.

Hydraulic cylinder 417 and piston 491 are illustrated here in a workmanlike configuration. Whether the piston and hydraulic cylinder are a part of a pneudraulic or hydraulic—type tool is of little consequence. Further, the piston shown is illustrated with a typical half-shell coupling arrangement. The piston could be configured with threads for the coupling action.

FIG. 202S1 is a snapshot at the beginning of rivet installation. FIG. 202S2 is a snapshot after the rivet installation process is complete and pintail break has occurred.

In this design, the de-coupling action occurs between the forward conical face 447(1) of jaw collet 447 and the inner conical face 455(1) of pull rod/tube 455. The dampening spring 459 acts between the rearward face 447(2) of jaw collet 447 and the front face 491(1) of piston 491.

After pintail break, the pull rod assembly 473 comprised of 447, 449, 451, 453, 455, and 443 all accelerate rearward compressing dampening spring 459.

Notice that the spring keeper component 443 has been threadedly attached where, in the original fastener installation system provisional patent application, the original pull rod 55 coupled to the to the rear jaw collet 47. The pull rod also acted as a spring seat for the collet spring. In this design, the pull rod/tube 455 acts on the front outside conical surface of jaw collet 447.

In order to facilitate the proper jaw action (opening and closing on the pintail), the jaw spring is seated in this spring seat which is threadedly attached to the jaw collet 447.

Notice, as well, that the spring follower is extended all the way rearward and substantially into the piston 491.

Many, if not most, rivet installation tools are "rearward ejection"—based tools with regard to the ejection of pintails. In such designs, a path is required through the piston. Here, the piston would have a through-hole. A "bounded pathway" is created with the spring follower. The astute reader will note that the spring follower is a part of the pull rod assembly 473, and so it accelerate-decelerates with this assembly during the rearward/forward action.

Based upon the foregoing, the process of rivet installation utilizing such a shock mitigation modular nose assembly becomes apparent.

Piston 491 translates rearward with respect to hydraulic cylinder 417 after hydraulic fluid is introduced. Piston 491 pulls pull rod/tube 455 via the clamshell coupling 445.

Pull rod/tube conical face 455(1) pushes on jaw collet conical face 447(1) creating the translation required to install a rivet.

After pintail break has occurred, pull rod assembly 473 accelerates rearward compressing dampening spring 459. After deceleration completes, the dampening spring returns the pull rod assembly 473 forward until faces 447(1) and 455(1) mate.

A Useful "Hydraulic Circuit" to Improve Cycle Time.

The attentive reader will appreciate that an important design objective is to reduce, whenever possible and convenient, the total cycle time associated with the thirteen-stage process of fastener/rivet installation. In the discussion of stage five (inner collet re-opening) supra, for example, there was extensive discussion regarding using air to pressurize the rearward cavity which aided in the return of the piston. It may not have been obvious to the inattentive reader that, as the hydraulic piston is being urged forward, fluid is being pushed backward through the hydraulic line and the diverter valve back at the pump unit.

In the application where these systems are likely to be employed, a substantial distance between the hydraulic unit and the tool may be desired (generally and easily exceeding twenty-five to fifty feet or more). This length of hydraulic line can create a substantial resistance when one wants to push the hydraulic fluid back to the unit in a short period of time. In the configuration described particularly at stages four through seven, air pressure is used to displace that twenty-five foot oil column. The reader will appreciate that the time required to effectuate such a displacement is substantial.

Figure 301:
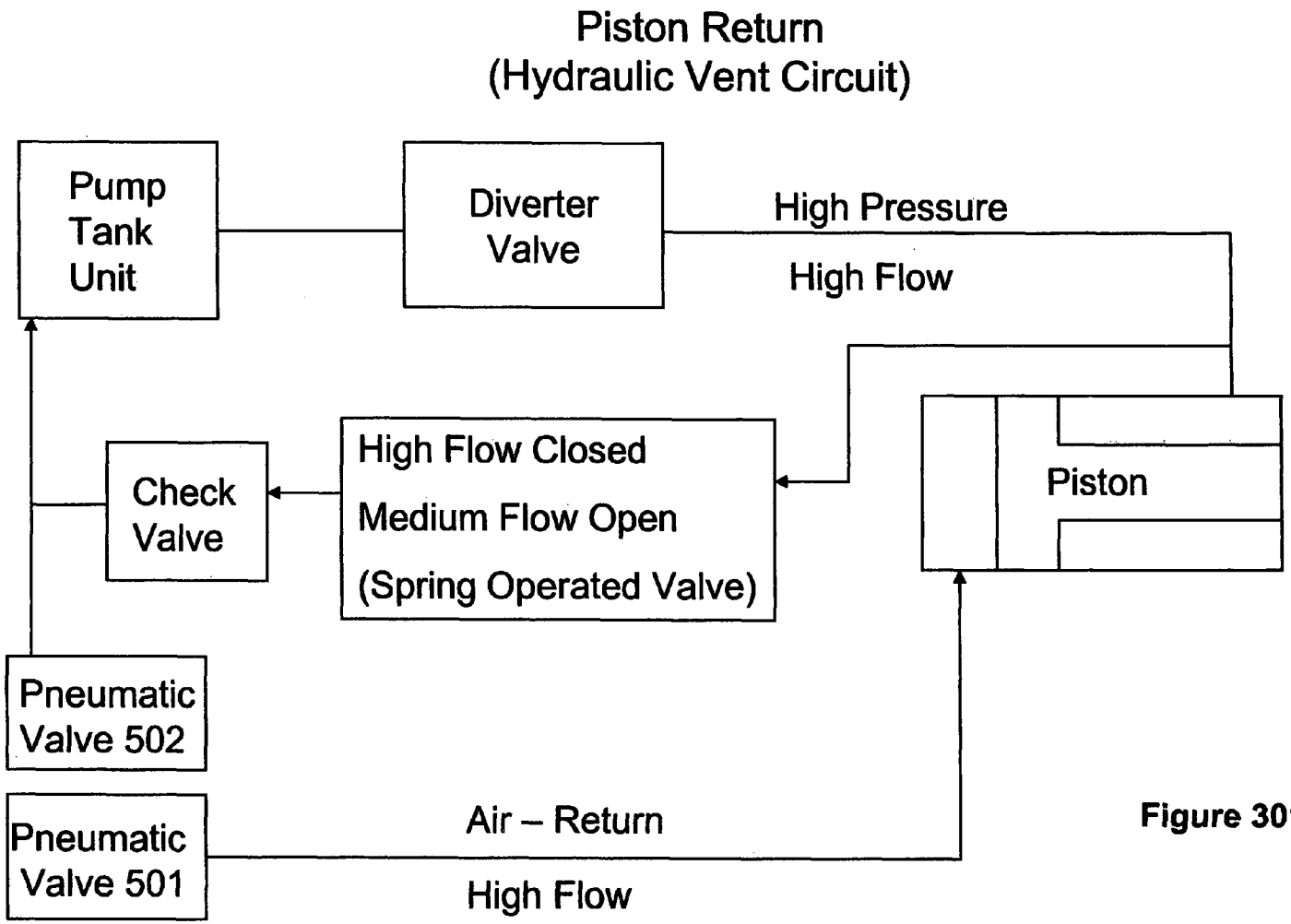
FIG. 301 is a functional diagram depicting a hydraulic circuit to improve cycle time.

An improved method employs a hydraulic "vent circuit." See FIG. 301. Here, a vent line is installed where oil may be exhausted and later returned to the tank or reservoir.

This is accomplished by installing a mechanically operating valve (e.g., a spring-operated valve) in the hydraulic circuit coincident with the tool. This valve closes when high-flow hydraulics act upon it, thus enabling the tool to build pressure and do the work required to install the rivet.

After pin break, and after the hydraulic diverter valve is released to allow the return of fluid back to the tank, this valve opens due to the reduction of fluid flow. Next in the cycle, air is introduced into the rearward cavity of the tool via a pneumatic valve (in FIG. 301, this circuit it is pneumatic valve 501). This pressurization of the rearward cavity causes the piston to move and thus eject hydraulic fluid back through the hydraulic line. At this point, the fluid has two paths for travel. The first is the path from whence it came (back down the twenty-five foot line, through the diverter valve, and into the tank). The second is the path through the new bleed valve. Here, the valve is configured to allow a flow rate of fluid that is desired to accomplish expedient piston return, and this fluid vents by and through a check valve and into a substantially empty return/drain line.

The check valve is a one way valve that allows almost unrestricted flow of fluid in one direction, but does not allow flow in the opposite direction. Here, the check valve allows a pressurization of the drain line which acts to propel the vented fluid through the line to the tank/reservoir. The tank/reservoir is vented to atmosphere through a filter/breather cap (not shown).

Thus, in summary, through the employment of such a hydraulic vent circuit, a vent chamber is created into which fluid is exhausted during the piston return cycle. This chamber's proximity to the tool is substantial in that now only inches or millimeters of fluid (rather than many feet) are being displaced, thus greatly minimizing the work required to return the piston.

It has been observed in testing that the use of such a circuit can reduce the time associated with piston return by an order of magnitude or more (experimentation has demonstrated reductions of from approximately four to six seconds to approximately two-tenths to three-tenths of a second).

The check valve may not be necessary due to the fact that both the fluid and air should take the path of least resistance. However, use of a check valve minimizes the possibility of an introduction of air into the hydraulic cylinder. Such an introduction would not be catastrophic, but it would potentially result in a dampening and/or reduction of the cycle time in the installation phase of the cycle.

Although much attention is given to cycle time in the design of cyclic automated tools, there are other benefits to the design and use of the hydraulic vent circuit. For example, the circuit also provides a cooling mechanism to the system. Because the venting occurs during each cycle, there is a circulation of hydraulic fluid. It is known that single-hose hydraulic systems using air-return or spring-return get hot if they are used in rapid cycle situations for extended periods of time. This is due to the friction generated in the oil as it is pressurized. If there is no circulation of the oil, then the fluid's temperature increases, and, over time, the increase can be substantial. The circulatory system described allows small amounts of oil to be circulated during each cycle, thus contributing to a moderation of system temperature.

Another benefit of the circuit is apparent. The circulation of the hydraulic fluid, which occurs with each cycle, also helps to keep the system free of air in the hydraulics. Each time the hydraulic diverter valve is actuated, a small amount of hydraulic fluid is circulated through the circuit and out the high flow closed/medium flow open valve. This action works to rid the hydraulic system of trapped air. Furthermore, when a new tool is connected to the system, air is often introduced, and this usually needs to be bled off through convoluted procedures. With the hydraulic vent circuit, new or replacement tools can be attached to the system, and several actuations performed on the diverter valve, resulting in a substantially air-free hydraulic system.

An Alternative "Queue Track" Design.

Another embodiment for the production of a queue of correctly oriented rivets has been developed.

In this design, in place of the queue track system depicted in FIG. 209F which employs a belt, motor, and a roll bar guide plate, a set of rails, which are inclined from the horizontal plane, is employed. These two rails are angled downward between five and ten degrees and are separated to create a free sliding fit to the rivet body. The rivet hangs between the two guide rails by the rivet head.

The guide rails are constructed of a slick material, such as Delrin, Teflon,® or a metallic material which has been coated with a friction-reducing material.

To further aid the smooth translation of rivets down the tracks to the escaping device, a series of very small air streams is employed. This is accomplished by using the rails as manifolds, whereby holes are constructed longitudinally through the rails creating a reservoir or accumulator. Then, small holes are introduced at acute angles to the longitudinal axis and intersecting the reservoir cavity. These holes are spaced and placed such that air streams exit the rails and impinge on the rivet bodies just below the rivet heads.

With the reservoir or accumulator effect, it is possible to use small flow rates of air and still the velocity of the air exiting the rails throughout its length is normalized. This system is different from other inclined rail systems in that there is frequently no need to employ hold-down rails or top-guide rails. Inclined feed rail systems are not uncommonly inclined at an angle of fifteen degrees or more to the horizontal plane (in fact, it is not uncommon to see thirty to forty-five degree tracks). These systems typically employ a hold-down rail to stop the parts being fed from spilling out. The hold-down rails add another surface which will both impart friction and, importantly, create a situation in which nesting or sticking often occurs.

Furthermore, in the instance of manipulation of the head of a rivet, in conventional systems, a shingling effect is observed. When this occurs, the parts stick and a jam in the feed system is developed due to one rivet head riding up slightly upon an adjacent rivet. Through this displacement, the gap established from the feed rail top surface to the hold down rails is closed, and, in effect, the resulting shingling creates a braking action (often resulting in jams).

The feed industry has proposed a variety of solutions to this problem. All feature various disadvantages.

The inclined rail system described herein does not require the use of hold-down rails. Therefore, as shingling occurs, no braking or added friction is produced. The air streams, or jets, are minimal since they only are required to break the static friction between the head and the rail. This factor is of practical import for two reasons. First, the use of compressed air is not without cost to the end-user. Second, often times, in industrial environments, compressed air is used to such a degree that it becomes an environmental issue (i.e., management of noise levels in the plant). By minimizing the amount of air used in a feed system, important economies are realized. And by eliminating the hold-down rails, another common variable contributing to rivet jams is eliminated, thus increasing overall system throughput and reliability.

A "Catcher" Improvement.

A modified embodiment of the catcher system, targeting a reduction in total cycle time and the elimination of through-put-reducing variables, involves the deployment of not one, but two, rivets in the blow-line feed tube at certain times.

Starting at the feeder, a rivet is dropped into the conical shaped receiver, and the cover is closed creating a seal via the face seal. Also, at this time, another rivet is at the opposite end of the feed tube adjacent the presenter. Next in sequence, with the presenters in the down (or, open) position, air would be introduced to the blow-feed line back at the receiver.

Now both rivets move. It is most likely the case that the rivet at the receiver, and closest to the air supply, experiences the greatest acceleration. The rivet adjacent to the presenter will be propelled immediately into position, due to the transmission of air pressure ahead of the oncoming rivet.

The rivet adjacent the presenter only has to move a few inches in order to be in position; therefore, it will likely not be able to accelerate to a significant speed. This is important, in that, due to this greatly reduced speed, it may be possible to eliminate the position gates, or at least use a simplified set of flexible tabs, to ensure that the rivet head is in the correct, final position. Also, the impact piston may well be eliminated and replaced with a simple bumper.

Once the rivet has been propelled into position, an infrared (IR) emitter and receiver signaling unit will be blocked. This signal change will invite the controller to sequence the presenters up. As the presenter moves upward, or shortly after it has reached the paws, the second rivet would impact the presenter rearward face. This face is fitted with an impact-absorbing compound. The impact will naturally result in the rivet bouncing backward (or, rearward) away from the presenter. In order to re-position the rivet to a position adjacent the presenter, the air flow may desirably be left on for a short duration. It is possible that another set of IR emitter receivers could usefully be employed to verify the arrival of the second rivet.

This alternate catcher embodiment is useful in several ways. First, due to the reduced length of travel, a rivet will reach proper position for presentation faster. This will allow for a reduction in the over-all cycle time. Second, the rivet presentation assembly (or cavity) will be simplified by the elimination of the impact piston and further by the elimination of the spring-loaded position gates (or the simplification of the gates into flexible tabs). These simplifications have the potential to yield an inherent increase the reliability of the system due to a reduction in operating variables.

Also, the stopping of a rivet currently in transport mode will be more controlled. This better control is achieved since the rivet will be in an enclosed tube section. The blow-feed tube, as it abuts the catcher and presenter assembly, is largely a completely enclosed tubular section. Therefore, as the rivet impacts the presenter, it has nowhere to recoil but slightly backwards down the tube. This confinement of the rivet at impact has the potential to help avert the jams that can occur when there are open passages for the bouncing rivet to be deflected into or against. This elimination/reduction of dynamic variables has the real potential to result in an important increase in overall system reliability. And, finally, through these improvements, the cost of construction and maintenance may well be reduced.

A Threaded Insert Installation System.

The astute reader will find that another useful embodiment can be produced that will automate the installation of threaded inserts. Threaded inserts are produced in a multitude of shapes and materials. Generally, they are employed to create a nut member on a piece of sheet metal. Sometimes the sheet metal is of a thin gauge and a structural thread is required. The objective may be to fasten a removable panel, to fasten a component, or to address problems of restricted access to the back or blind side of an assembly. Whatever the case, threaded inserts are utilized in many applications throughout many industries.

The basic form or shape of the threaded insert is much akin to that of the blind rivet sleeve. The blind rivet sleeve is typically described by reference to the body and the head. The primary difference between a blind rivet sleeve and a threaded insert is that the threaded insert has an internally threaded section or portion typically found at the base of the body or at the end opposite the head.

Upon installation, a threaded insert functions much like a blind rivet sleeve. The threaded insert is threadably mated to an installation tool. Here the threaded insert is coupled to a mandrel which protrudes from an anvil/nose member. Then, the threaded insert is inserted through a hole in the work piece or component. The head of the insert controls the insertion depth as does the head on a blind rivet.

Next, the tool is actuated through some type of triggering device. This, in turn starts a longitudinal motion whereby the mandrel is pulled rearward or into the anvil/nose member. When sufficient translation has occurred to abut the anvil/nose against the head of the insert, a substantial load is imparted through the mandrel which is threadably attached to the threaded section or portion of the threaded insert internal diameter.

After sufficient load is produced by the action inside the tool which is mechanically coupled to the mandrel, the back or blind side of the sleeve member of the threaded insert begins to buckle or expand similar to the body or sleeve of a blind rivet. This expansion creates a blind side or back side head in the threaded insert sleeve. Once the back side head is formed in the threaded insert, the installation tool, through the employment of a spinning action, de-couples the mandrel from the threaded insert. Now, a mechanically fastened nut member is attached to the work piece and may be utilized for a number of useful applications.

Through the modification of several components of the invention disclosed herein, an automatic threaded insert installation system can be produced. The bulk feed device would still operate in much the same manner whereby it would elevate threaded inserts via the paddlewheel, propel them along spinning bars, after which they would proceed through a sorting block, yielding properly oriented threaded inserts to an escapement device.

The escapement device would have to be modified such that, during the freefall to the receiver, the threaded inserts would not be allowed to tumble and therefore lose their associated orientation. This would be accomplished by minimizing the freefall and modifying the receiver conical shape so as to prevent tumbling. In some cases, threaded inserts are of such a shape that a tubular blow feed line would not allow for a reliable transport with the threaded insert in the most useable orientation (sleeve first and head last). In these cases, the insert would be delivered to the escapement in an inverted orientation, be introduced to the receiver, and finally be propelled through the feed tube to the installation tool.

At the tool, the threaded inset would be located, oriented, and then secured by a presenter. Next, the presenter would be positioned such that the threaded insert was axially aligned with the mandrel/anvil/nose assembly. With the presenter holding the threaded insert in the proper load location, the mandrel/anvil/nose assembly would be translated towards the threaded insert and, simultaneously, a mandrel spinning action would occur.

Fitted inside the nose would be a motor that would couple to the mandrel holder or coupling. The mandrels do wear and therefore have to be replaced periodically. Incorporated in this assembly is a sensing circuit that insures that the mandrel is sufficiently coupled to the threaded insert prior to the anvil/nose translating forward and thus removing the threaded insert from the presenter. Once the sensing circuit has verified proper threadable engagement of the mandrel to the threaded insert, the anvil/nose assembly would be reciprocated forward to the installation-ready position.

Now, the operator would insert the threaded insert into a prepared hole and a trigger actuation would activate the pulling function in the tool.

Here, the hydraulic pressure sensing system employed in the blind rivet system would be utilized to insure that the correct installation load was imparted through the mandrel to the threaded insert. Upon reaching the defined load, the mandrel/pulling assembly would be returned forward inside the anvil/nose assembly which would eliminate the axial load for installation. Now, the spinning action would be actuated in the opposite direction as before which would act to decouple the mandrel from the installed threaded insert.

As with the blind rivet system, several processes are simultaneously occurring in order to facilitate a minimal cycle time. Staging of threaded insert, blow feeding, and capturing for presentation are processes that would occur simultaneously with installation, as is done in the blind rivet system.

Furthermore, a clip feed system similar to that employed in the blind rivet installation system described herein would be very useful in this application due to the fact that some nut insert designs might prevent successful blow feeding, but could easily be loaded into clips from a bulk feed unit outfitted to automatically load the threaded inserts into clips.

The clip design previously described is designed in such a manner that, through an external rotary input, the belt transport system within the clip can be powered facilitating rapid automatic loading. Here, these clips, either blind rivet or threaded insert clips, can be aligned and coupled to a driving device that powers the belt transport within the clip and then, with proper alignment to the queue track on the bulk feed module, these clips can be loaded economically.

The system described herein would also be able to be run as a manual system with an operator loading threaded inserts by hand and then performing the installation just as the invention disclosed herein allows. Finally, as in the case of the invention, this new automated threaded insert system facilitates the use of robotic installation. With the automatic feed mechanisms employed, these systems need merely to be affixed to a robot and fully automatic installation would be attained.

An Alternative Collet Lock Actuating Assembly.

Figure 401:
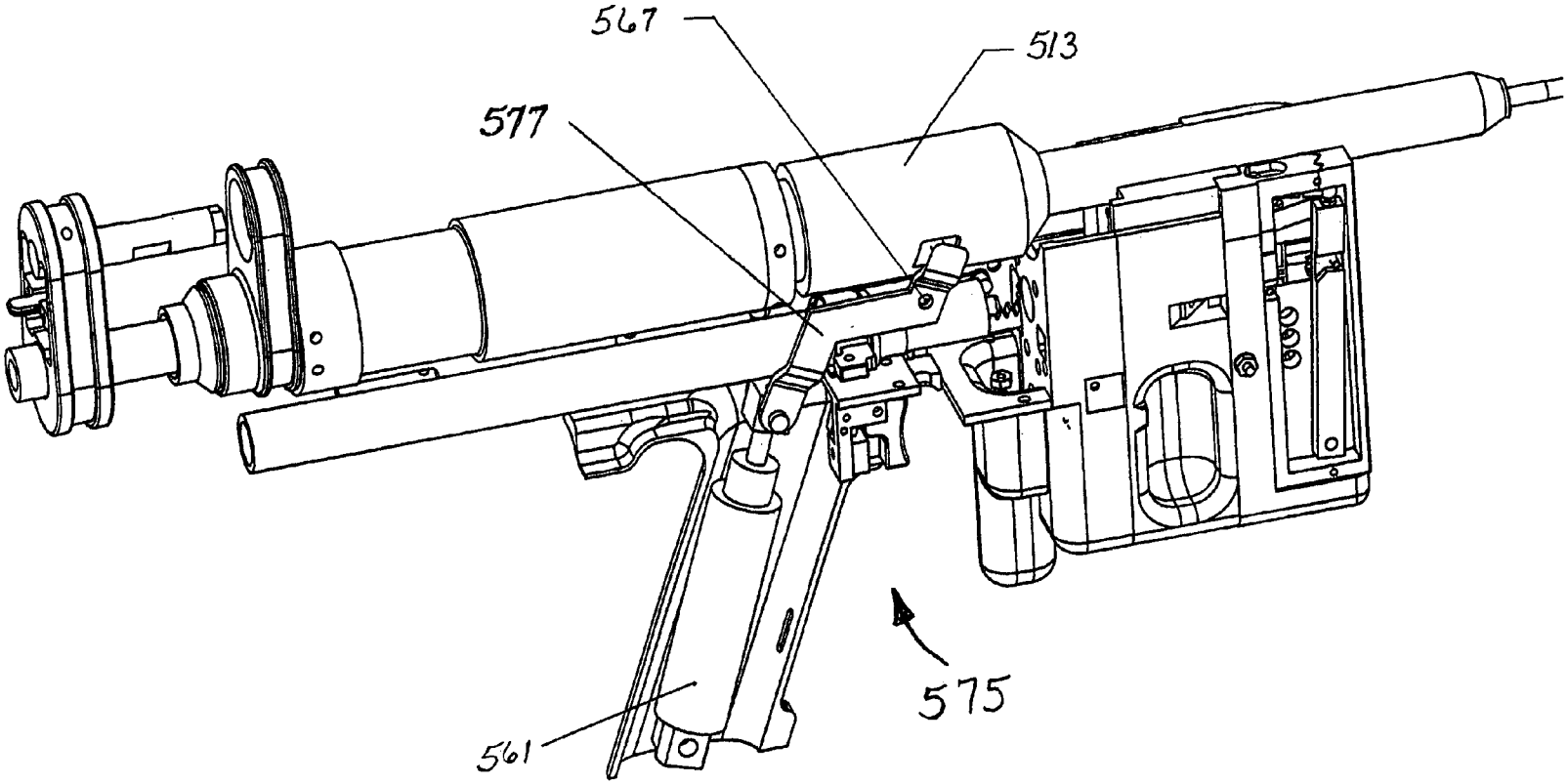
FIG. 401 is an isometric view of an alternative collet lock actuating assembly.

Referring, now, to FIG. 401, there is shown an alternative collet lock actuating assembly 475. Note that, in this assembly 475, the collet lock air cylinder 461 actuates the collet lock bracket tong 477 about pivot pin 467 so as to translate collet lock 413 as described in the description associated with stage one.

An Alternative Presentation Drive.

Figure 402A:
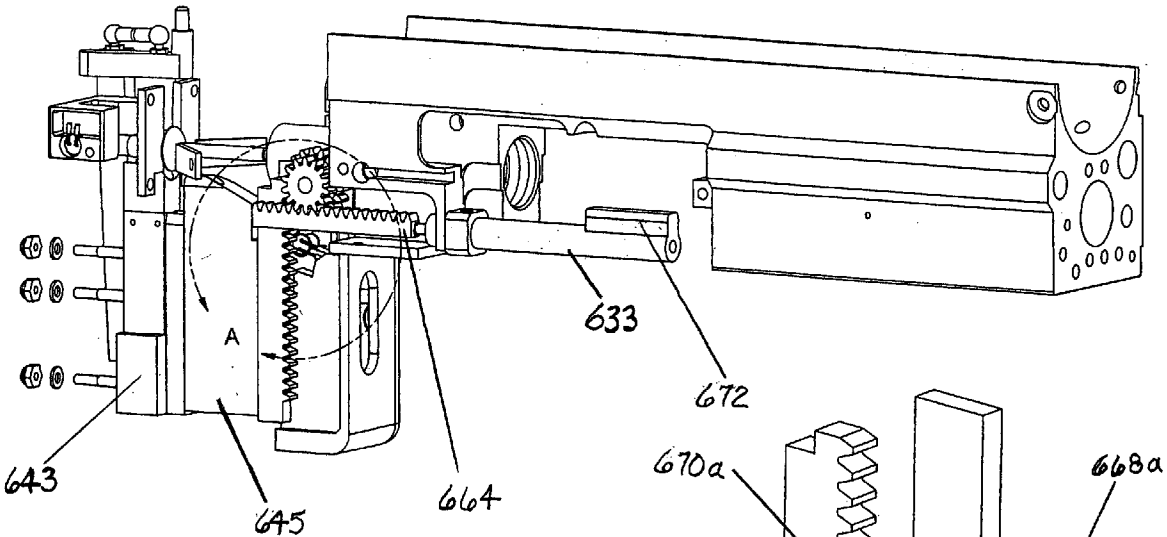
FIG. 402A is an isometric view of an alternative presentation drive with the presenters shown in their lowermost position.
Figure 402C:
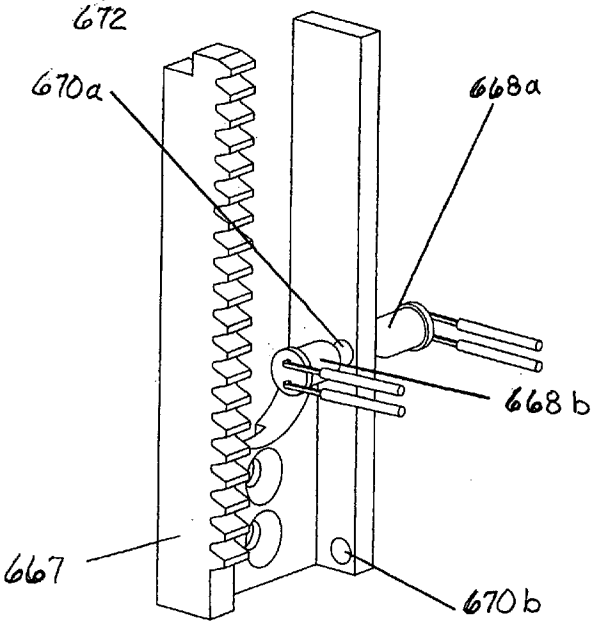
FIG. 402C is an isometric view of an alternative presentation drive with the presenters shown in a lower (but not lowermost) position.
Figure 402B:
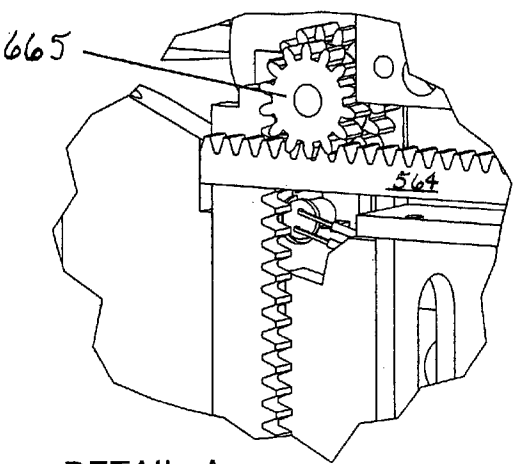
FIG. 402B is an isometric view of an alternative presentation drive focusing upon a portion of the gear and rack assembly.

Referring, now, to FIG. 402A, FIG. 402B, and FIG. 402C, there is shown an alternative presentation drive. Note that, in this assembly, the rivet body presenter and rivet pintail presenter are translated using an assembly of gears and racks, rather than an assembly of chains, sprockets, gears and racks as described hereinabove in stage nine.

Turning, now, to FIG. 402A and FIG. 402B, the presenters 543, 545 are shown in their lowermost position. Upon actuation of presentation air cylinder 533, presentation air cylinder rack 564 will extend forward rotating gear set 565 in a clockwise direction which, in turn, translates presentation rack 567 upwards. The upward translation of presentation rack 567, in turn, elevates presenters 543, 545.

Turning, now, to FIG. 402C, note that presentation rack 567 is now shown in a lower (but not lowermost) position. The presentation rack 567 is equipped with sensor holes 570*a*, 570*b*. These sensor holes 570*a*, 570*b* provide a communication conduit, so that the tool controller, acting in response to signals received from LED emitter receiver set 568*a*, 568*b*, can determine the position of presentation rack 567. Similarly, hall sensor 572 provides input signals to the tool controller regarding the position of presentation air cylinder 533.

Refinements to the Improved Catcher System.

Referring, now, to FIG. 403A, FIG. 403B, FIG. 403C, FIG. 403D, FIG. 403E, FIG. 403F, FIG. 403G, FIG. 403H, and FIG. 4031, there is shown an embodiment of the improved catcher system described hereinabove (see "A 'catcher' improvement" hereinabove).

Figure 403A:
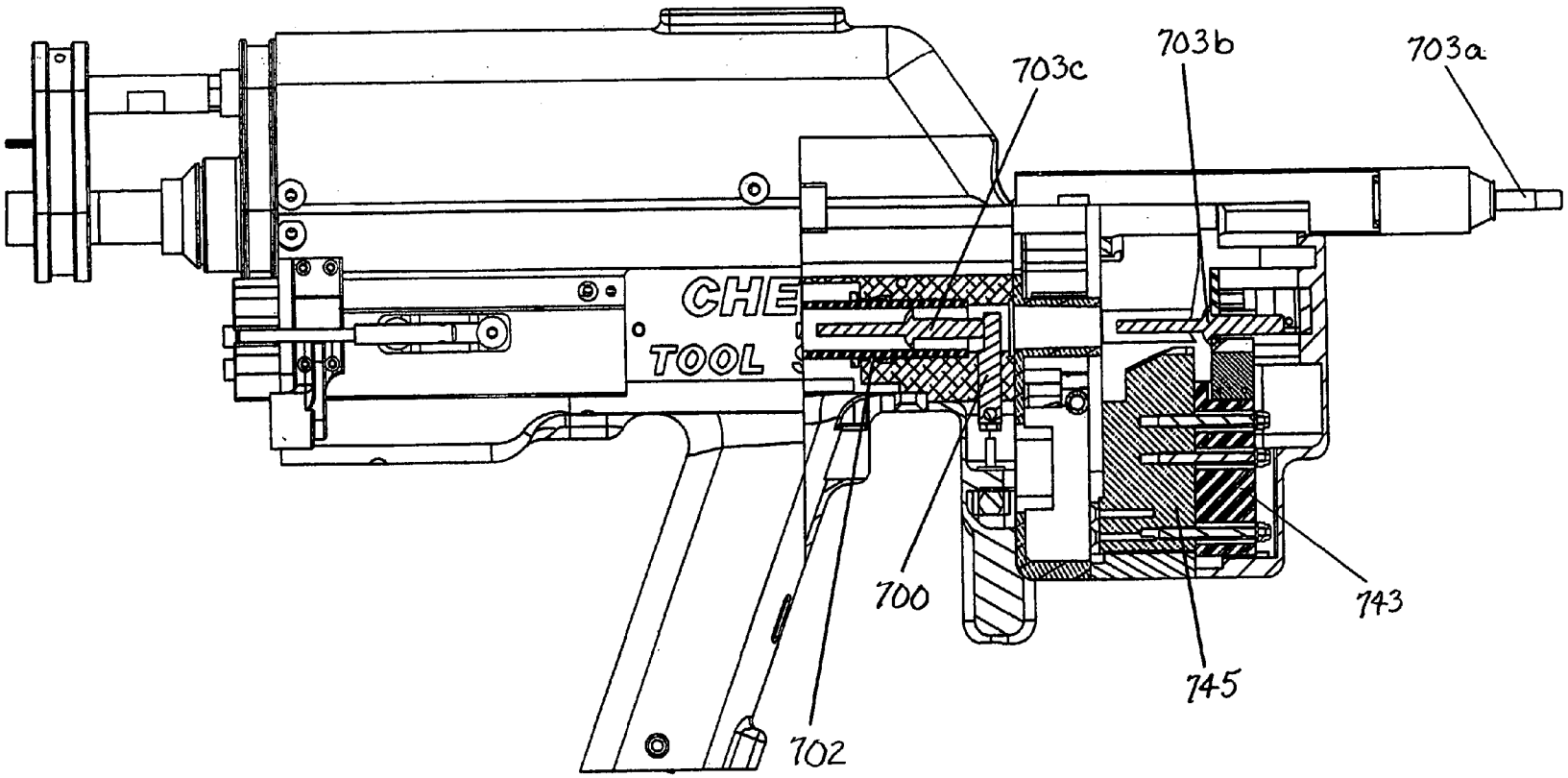
FIG. 403A is a partial cutaway of an embodiment of an improved catcher system which demonstrates the staging of rivets within the tool (including a rivet ready to be installed).

Referring, now, to FIG. 403A, a partial cutaway is shown which clearly demonstrates the staging of the rivets 703*a*, 703*b*, 703*c* within the tool. Rivet 703*a* is of course ready to be installed.

Rivet 703*b* and rivet 703*c* are staged within the tool, awaiting their respective turns for presentation. Specifically, rivet 703*b* is shown in the forward, chambered position proximate to the presenters 743, 745. By contrast, rivet 703*c* is shown in position within the blow tube 702, its forward travel having been halted by impact-absorbing stop 700.

Figure 403B:
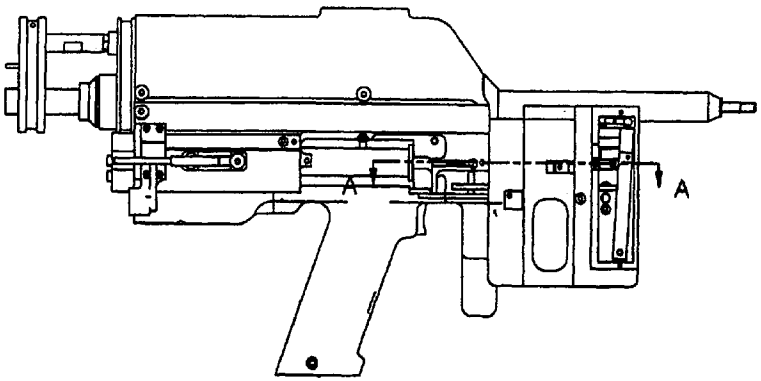
FIG. 403B is a partial cutaway view of an embodiment of an improved catcher system which demonstrates the staging of rivets within the tool (including a rivet in a forward, chambered position).
Figure 403C:
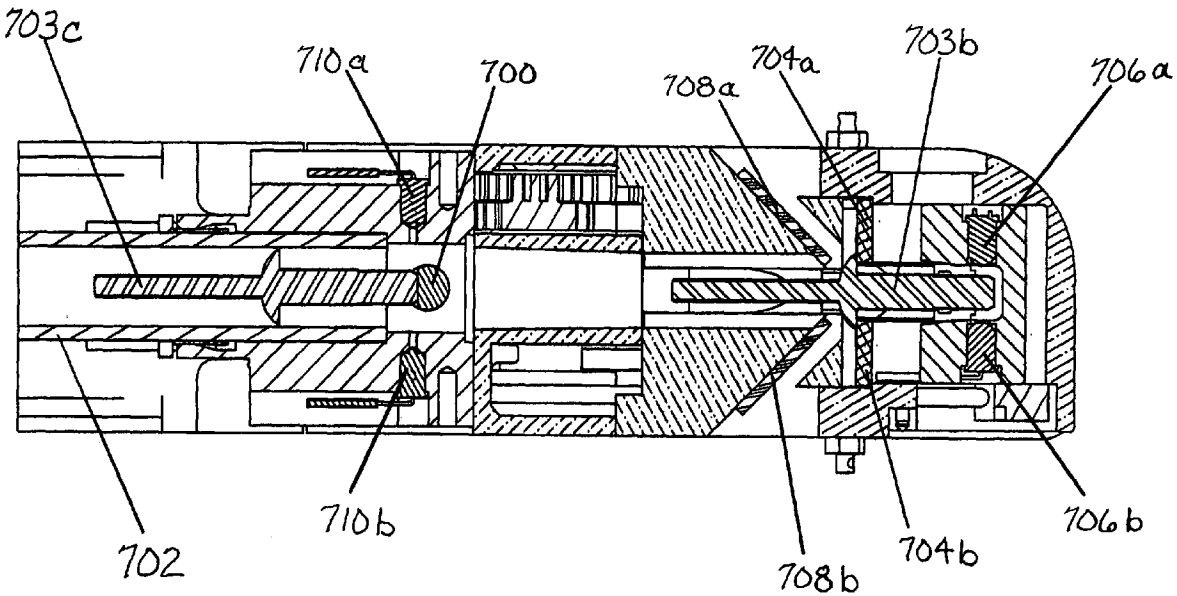
FIG. 403C is a side cutaway view of an embodiment of an improved catcher system which demonstrates the staging of rivets within the tool (including a rivet in a forward, chambered position and a rivet within a blow tube).

Referring, now, to FIG. 403B and FIG. 403C, a partial cutaway is shown which again clearly demonstrates the staging of the rivets 703*b*, 703*c* within the tool.

Specifically, rivet 703*b* is shown in the forward, chambered position. Note that the rivet head is against the bumpers 704*a,b* which served to stop its forward travel. Notice as well the head of the rivet has passed through flexible tabs 708*a,b* which now serve to prevent the rivet from recoiling/rebounding rearward back towards the blow tube 702. The position of rivet 703*b* is detected/confirmed from a control standpoint by LED emitter-receiver set 706*a,b*.

Rivet 703*c* is shown in position within the blow tube 702, its forward travel having been halted by impact-absorbing stop 700. Once again, its position is detected by LED emitter-receiver set 710*a,b*.

Figure 403D:
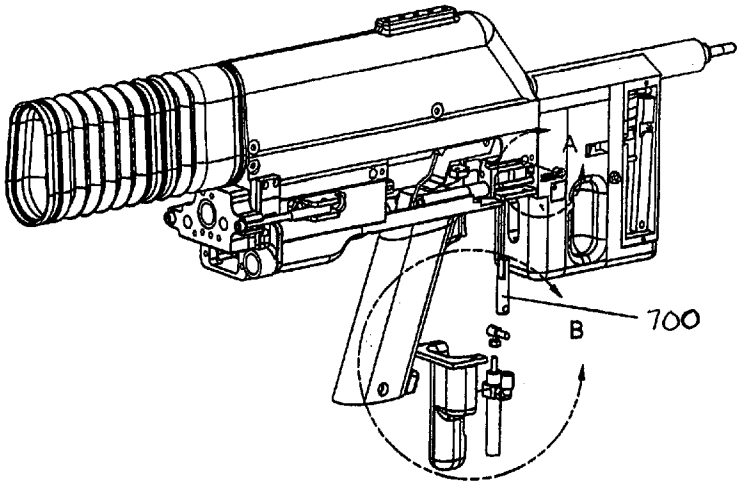
FIG. 403D is an exploded isometric view of an impact-absorbing stop and associated control components.
Figure 403E:
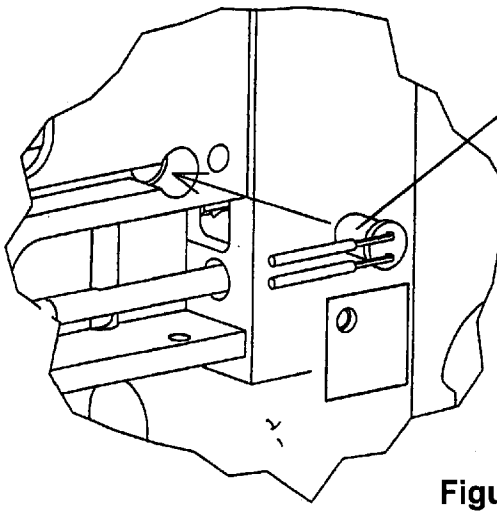
FIG. 403E is an exploded isometric view of an impact-absorbing stop and associated control components (focusing specifically upon the positioning of an LED receiver).
Figure 403F:
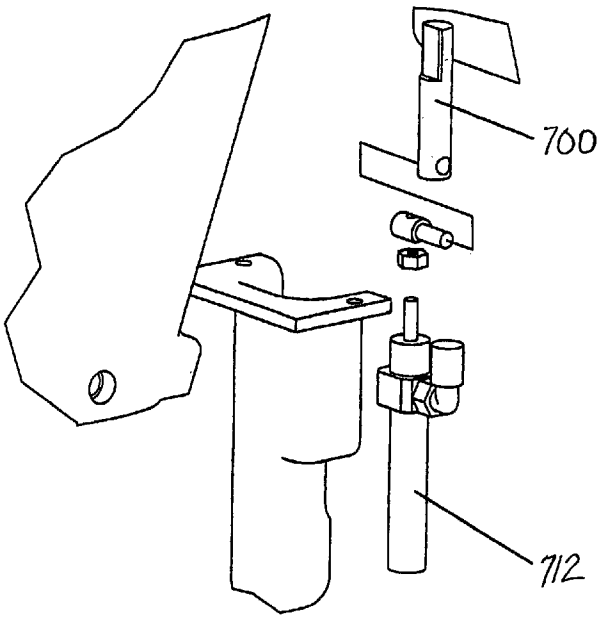
FIG. 403F is an exploded isometric view of an impact-absorbing stop and associated control components (focusing specifically upon the positioning of the impact-absorbing stop air cylinder).

Turning, now, to FIG. 403D, FIG. 403E, and FIG. 403F, various exploded, perspective views of the impact-absorbing stop 700 and various control components are shown. These figures impart a greater overall understanding of component positions within the tool. Specifically, the overall position of the impact-absorbing stop 700 and the LED receiver 710*b* are shown.

Figures 403G, 403H, 403I:
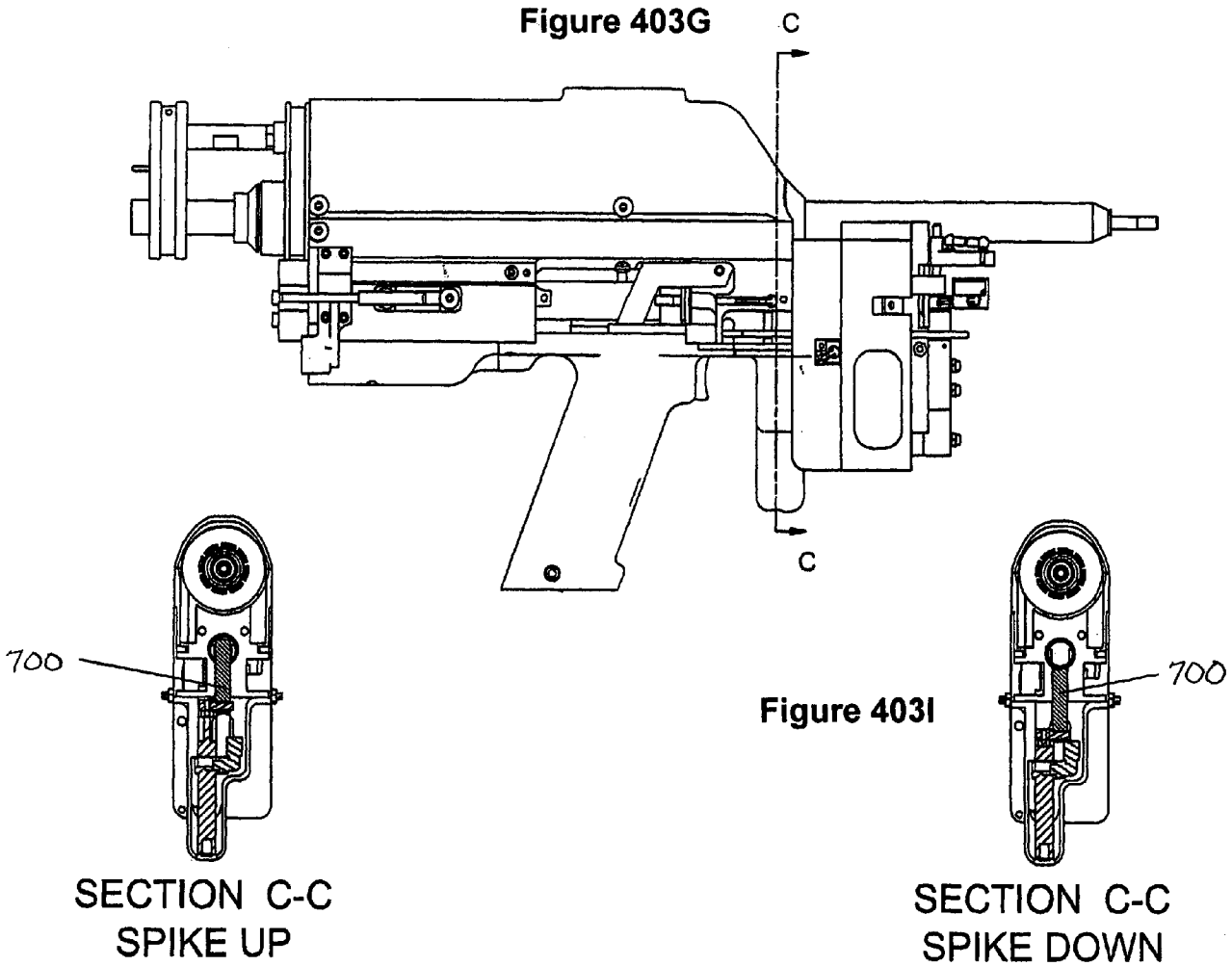
FIG. 403G is a side view of the tool highlighting the positioning of an impact-absorbing stop and associated control components.
FIG. 403H is a side cutaway view of an impact-absorbing stop in the rivet halt/spike up position.
FIG. 403I is a side cutaway view of an impact-absorbing stop in the rivet proceed/spike down position.

Turning, now, to FIG. 403G, FIG. 403H, and FIG. 4031, various views showing the operation of the impact-absorbing stop 700 are shown. Specifically, in FIG. 403H, the impact-absorbing stop 700 is shown in the rivet halt position. This view makes clear that the impact-absorbing stop 700 halts further progress by a rivet 703*c* in the blow tube 702; however, it does not significantly impede the flow of air in the blow tube 702.

In FIG. 403I, the impact-absorbing stop 700 is shown in its lowered position, allowing rivets to advance from their rearward staged position (see, e.g., rivet 703*c*) to their forward chambered position (see, e.g., rivet 703*b*).

An Alternative Paw Stop System Embodiment.

Figure 404B:
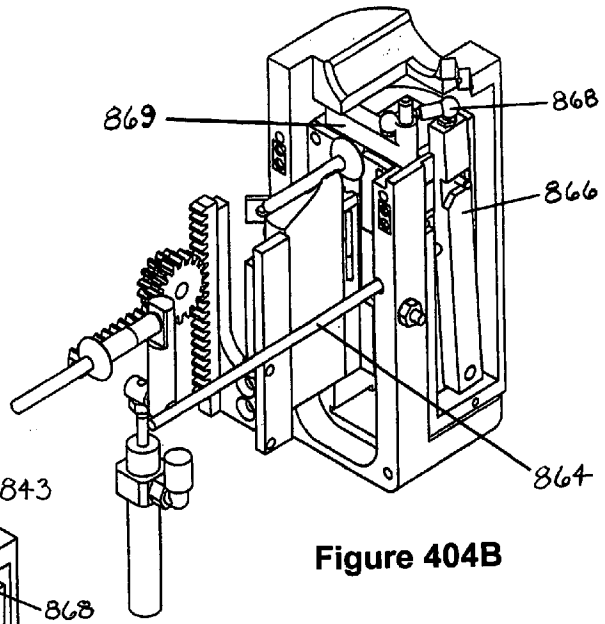
FIG. 404B is an isometric view of a flag stop system applying the resistance necessary to snap a rivet into a captured position.
Figure 404C:
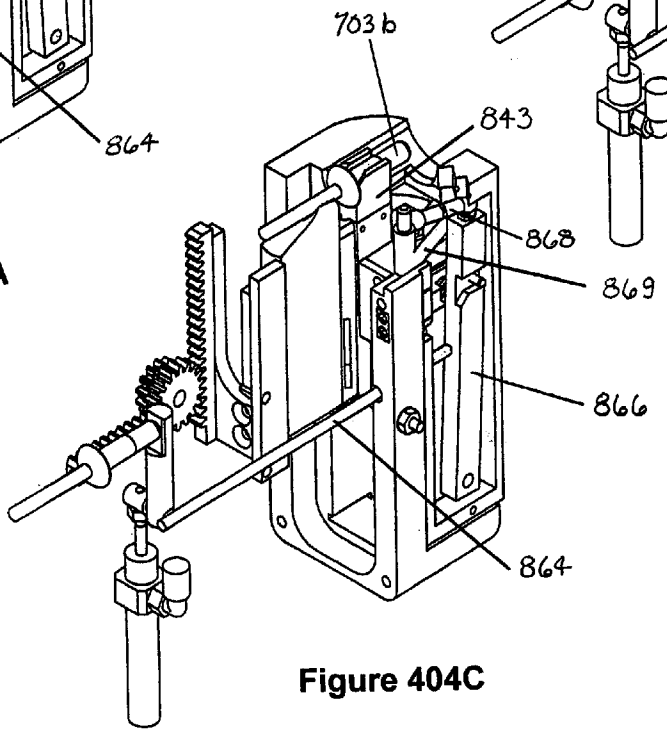
FIG. 404C is an isometric view of a flag stop which has been rotated, so that a presentation system can elevate a rivet into a loading position.
Figure 404A:
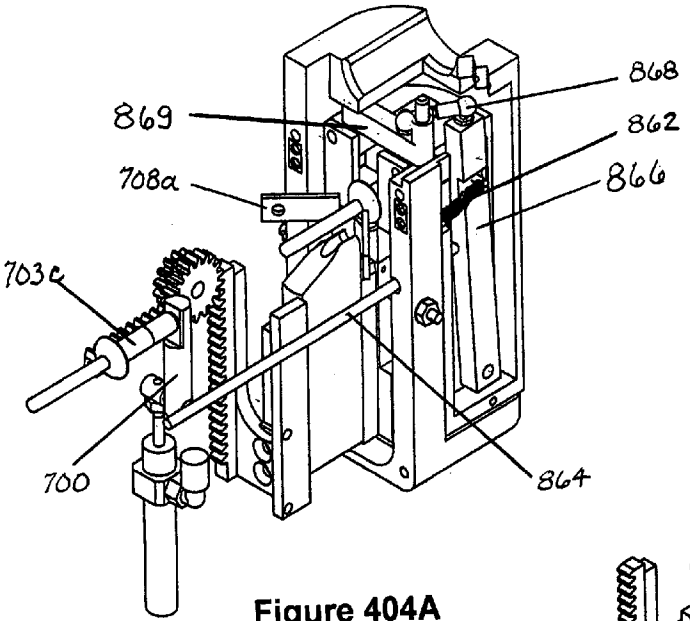
FIG. 404A is an isometric view of an alternative paw stop system embodiment, specifically, a flag stop system.

Referring, now, to FIG. 404A, FIG. 404B, and FIG. 404C, an alternative paw stop system embodiment is shown.

In FIG. 404A, a flag stop system, which serves the same purpose as the paw stop system in stage eight referenced hereinabove, is shown. In the figure, rivet 703*b* is shown in the forward, chambered position, and the flag stop 869 is shown in the stop position. In this position, the flag stop 869 is ready to provide the resistance necessary to snap rivet 703*b* into a captured position within rivet body side presenter 843.

The attentive reader will appreciate from the figures that flag stop 869 rotates between two positions, the first shown in FIG. 404A and the second shown in FIG. 404C. Upon actuation by the tool controller, an air cylinder (not shown) translates flag stop push rod 864 forward. This, in turn, rotates flag stop actuator 866 against the resistance of return spring 862 and translates the spherical link 868 so as to rotate flag stop 869.

In FIG. 404B, the flag stop 869 is shown actually applying the resistance necessary to snap rivet 703*b* into a captured position within the now-elevated rivet body side presenter 843.

Finally, in FIG. 404C, the flag stop 869 has been rotated clockwise (when viewed from above) so that the presentation system can elevate rivet 703*b* into the rivet load position.

A Quick Release Nose Assembly Mechanism.

Figure 405B:
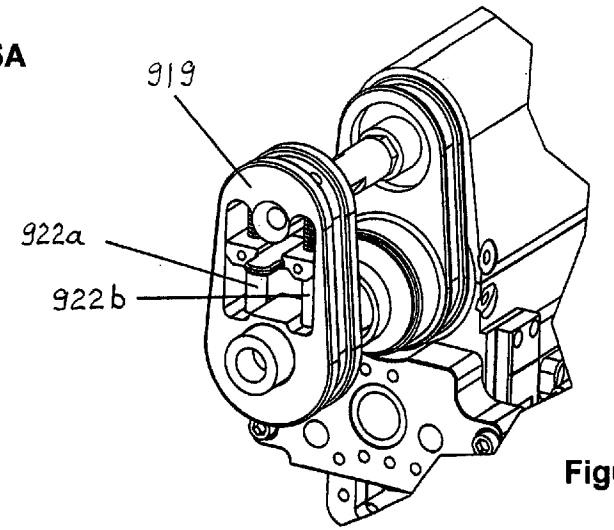
FIG. 405B is an isometric view of a quick release nose assembly mechanism, specifically highlighting a quick release retention tab shown in the open position, so that the nose assembly may be removed from the tool.
Figure 405A:
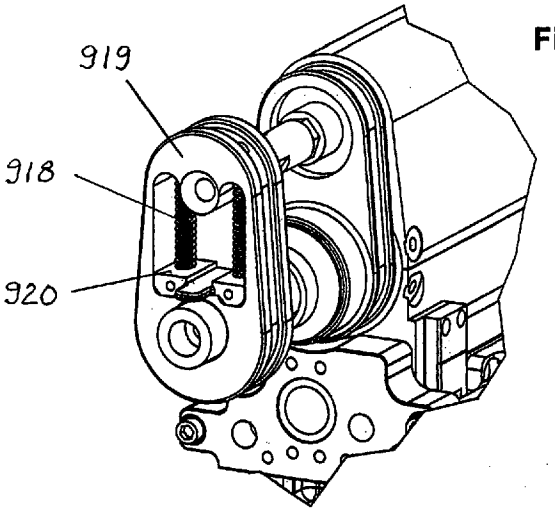
FIG. 405A is an isometric view of a quick release nose assembly mechanism, specifically highlighting a quick release retention tab.
Figure 405C:
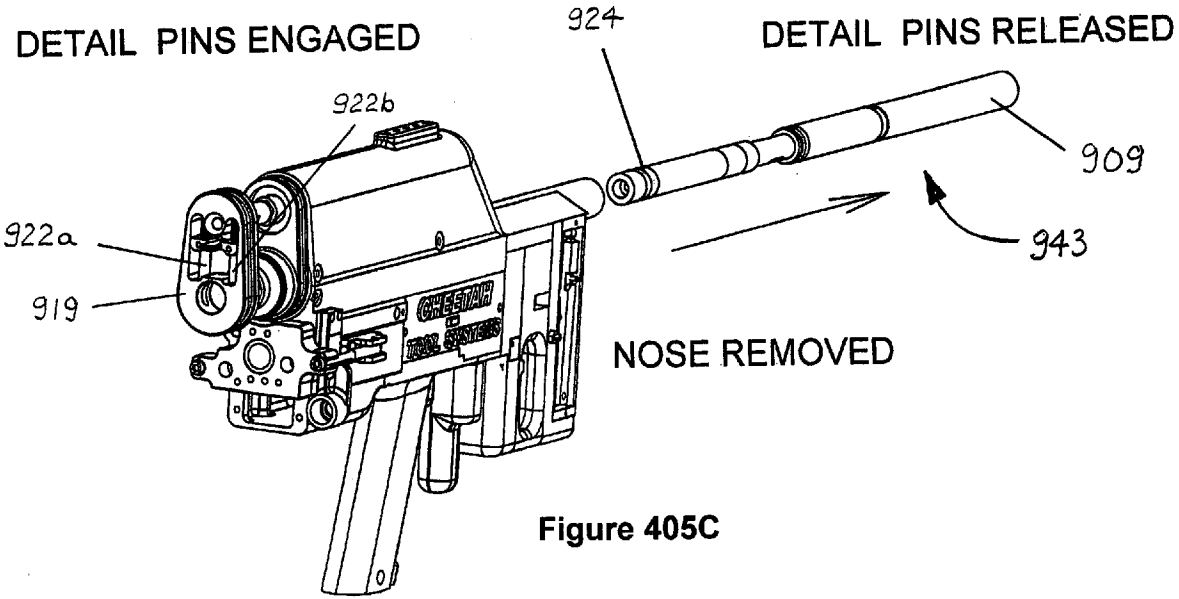
FIG. 405C is an isometric view of a quick release nose assembly mechanism, specifically highlighting removal of the nose assembly.

Referring, now, to FIG. 405A, FIG. 405B, and FIG. 405C, a quick release nose assembly mechanism is shown.

In FIG. 405A, the tool is shown as fitted with quick release retention tab 920. The tab 920 is shown in the closed position, securing the nose assembly 943 to the bridge 919.

In FIG. 405B, the quick release tab 920 is shown in the open position, allowing the nose assembly 943 to be separated from the bridge 919 and removed from the tool. Quick removal of the nose assembly 943 may be desirable to effectuate routine maintenance and/or repairs or replacements. When quick release tab 920 is elevated, as shown in FIG. 405B, quick release retention pins 922 are also elevated (against the action of quick release return springs 918) thus disengaging nose assembly retention groove 924.

FIG. 405C depicts removal of nose assembly 943.

An Alternative Rivet Capture Mechanism.

Figure 406:
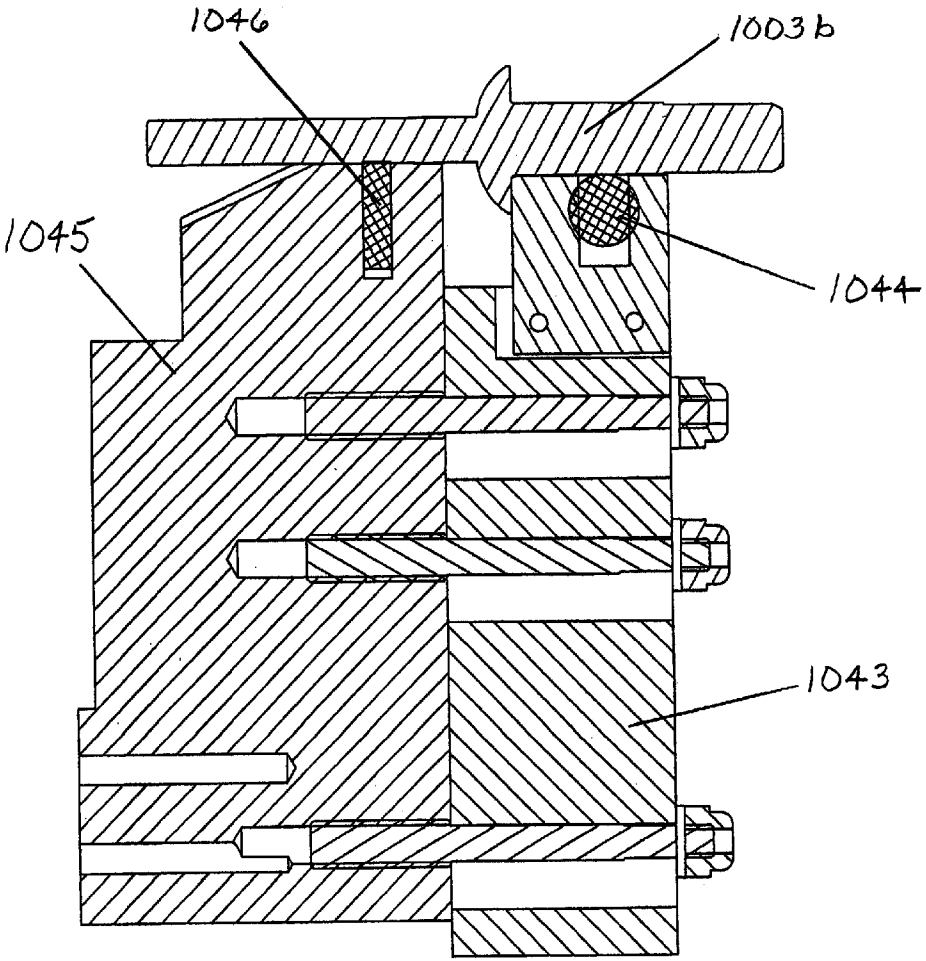
FIG. 406 is a side cutaway view of an alternative rivet capture mechanism utilizing magnets.

Referring, now, to FIG. 406, an alternative rivet capture mechanism is shown. In FIG. 406, rivet pintail presenter 1045 has been equipped with a bar magnet 1046, and rivet body side presenter 1043 has been equipped with a ball magnet 1044. These magnets secure rivet 1003*b* to the presenters for rivet loading and, as such, serve as a substitute for the presenter "snap" fit functionality described in stage eight.

Another Alternative Collet Lock Actuating Assembly.

Figure 501A:
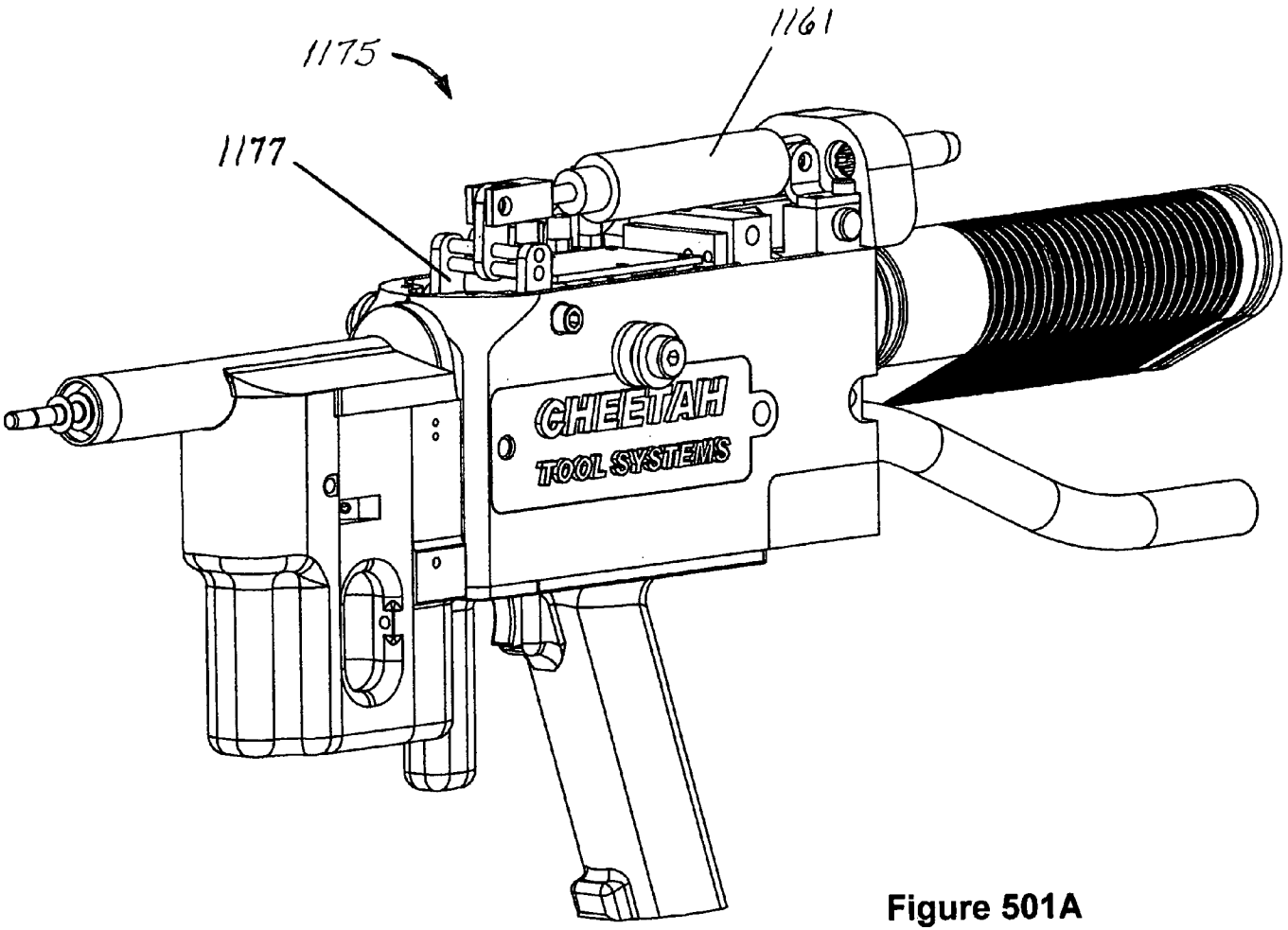
FIG. 501A is an isometric view of an alternative collet lock actuating assembly which actuates a collet lock bracket tong about a pivot pin.
Figure 501B:
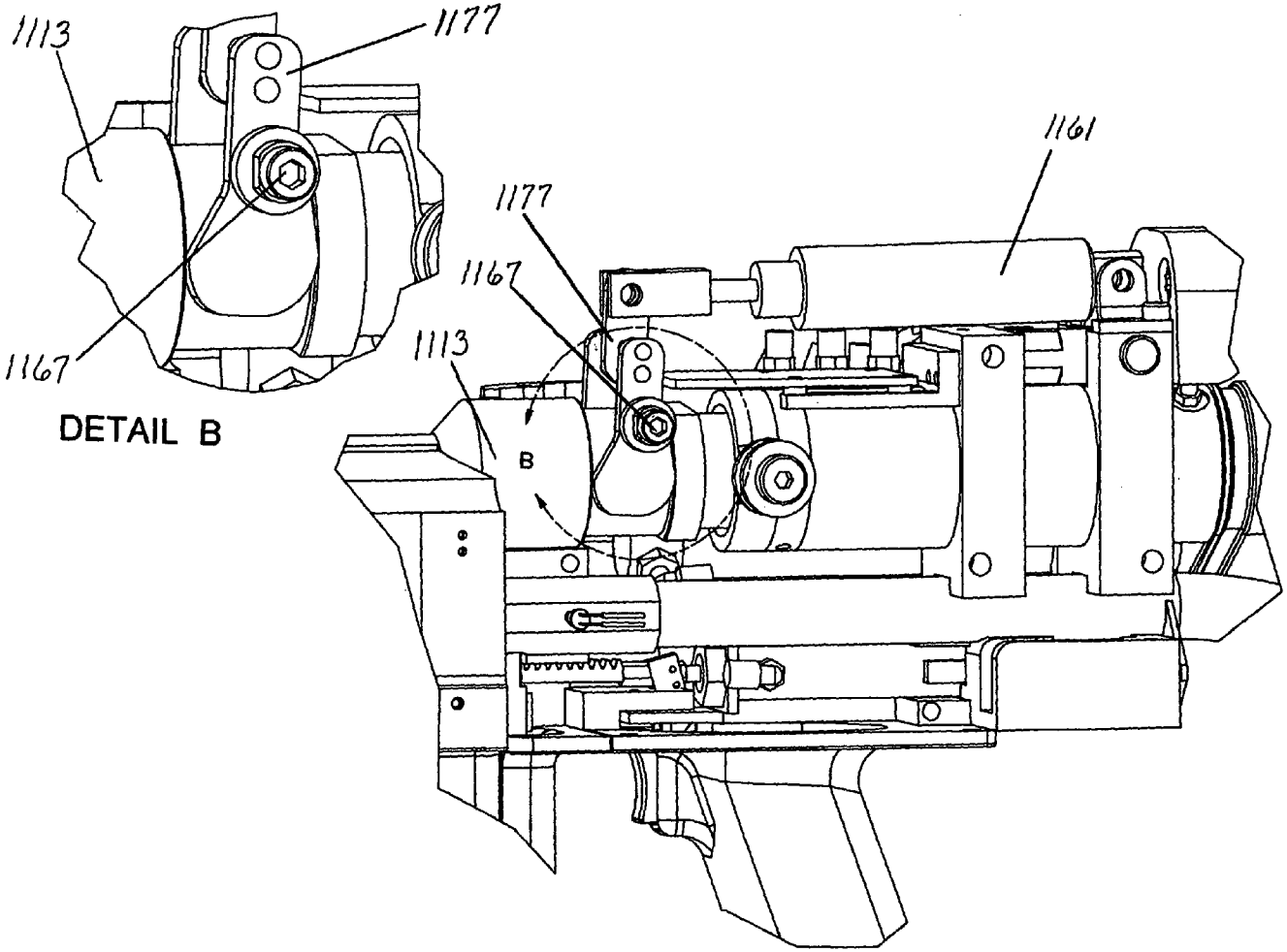
FIG. 501B is an isometric view of an alternative collet lock actuating assembly which actuates a collet lock bracket tong about a pivot pin, specifically highlighting the configuration of the collet lock bracket tong and pivot pin.

Referring, now, to FIG. 501A and FIG. 501B, there is shown another alternative collet lock actuating assembly 1175.

Note that, in this assembly 1175, the collet lock air cylinder 1161 actuates the collet lock bracket tong 1177 about pivot pin 1167 so as to translate collet lock 1113 as described in the description associated with stage one.

Additional Refinements to the Improved Catcher System.

Figure 502A:
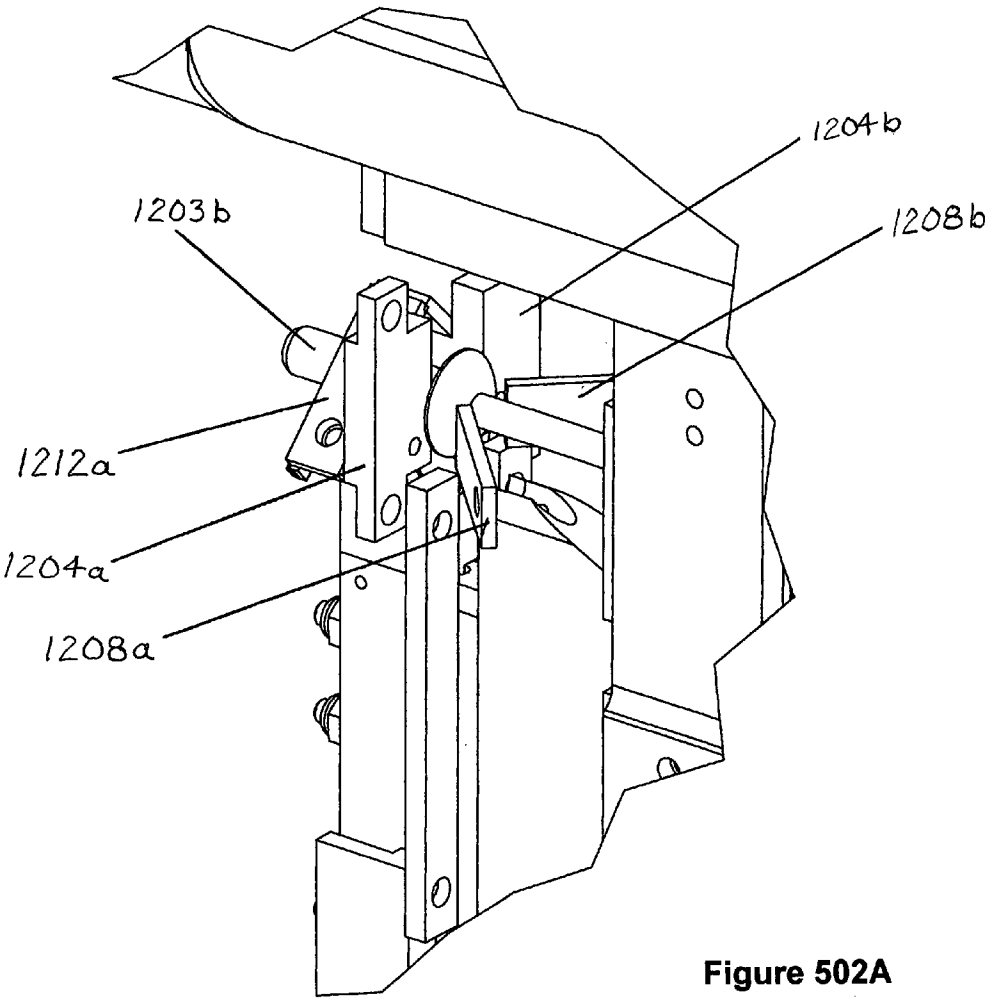
FIG. 502A is an isometric view of an improved catcher system utilizing bumpers and flexible tabs.
Figure 502B:
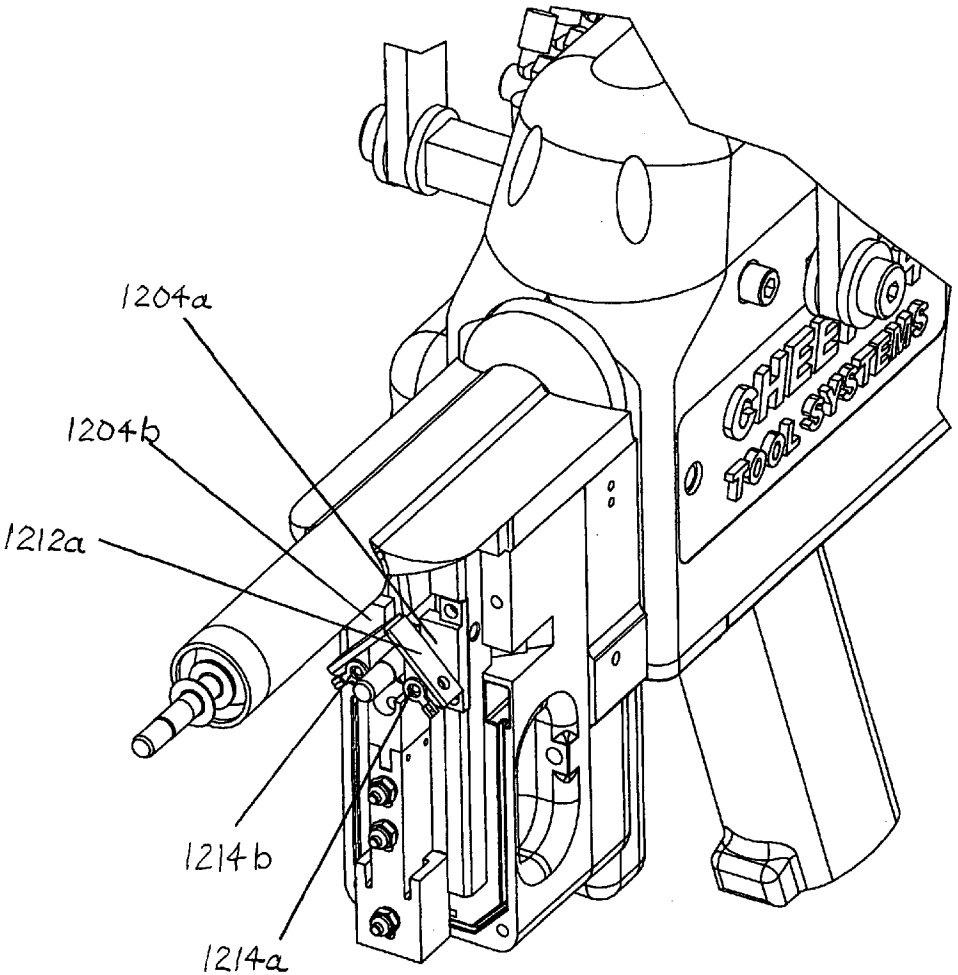
FIG. 502B is an isometric view of an improved catcher system utilizing vertical flexible tabs.

Referring, now, to FIG. 502A and FIG. 502B, there are shown various additional refinements to the improved catcher system described hereinabove (see "A 'catcher' improvement" hereinabove).

In FIG. 502A, the rivet 1203*b* is shown in its chambered position. In this figure, the head of the rivet 1203*b* has abutted the bumpers 1204*a,b* and is constrained in the longitudinal x-direction direction by the action of flexible tabs 1208*a,b*.

Turning to FIG. 502B, the attentive reader will appreciate that, if the bumpers 1204*a,b* are fashioned of an appropriate, hard, conductive material, then, once the rivet 1203*b* comes into contact with the bumpers 1204*a,b*, an electrical path will be created. This presents an opportunity for yet another process control detection mechanism. Specifically, if the tool is configured such that conductivity across electrical contacts 1214,*b* is measured, then the chambering of a rivet 1203*b* can be detected.

FIG. 502B also reveals the presence of vertical flexible tabs 1212*a,b*. These vertical flexible tabs 1212*a,b* gently constrain the body of rivet 1203*b* during chambering.

An Alternative Decoupled Piston-Pull Rod Nexis.

Referring, now, to FIG. 503A, FIG. 503B, FIG. 503C, FIG. 503D, FIG. 503E, FIG. 503F, and FIG. 503G, there is shown an alternative embodiment of the decoupled nexis between the piston and pull rod assembly.

Figure 503A:
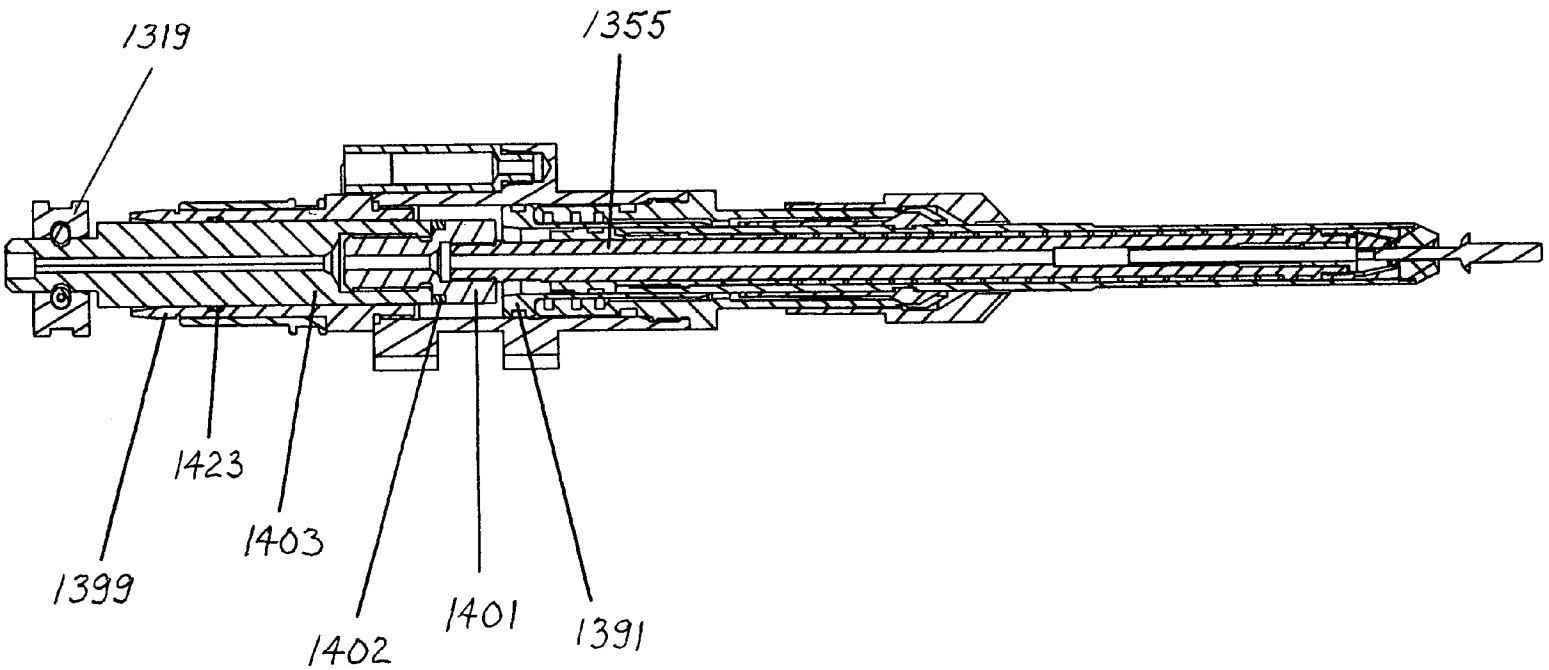
FIG. 503A is a side cross-sectional view of an alternative embodiment of the invention featuring decoupling of the piston and pull rod assembly.
Figure 503B:
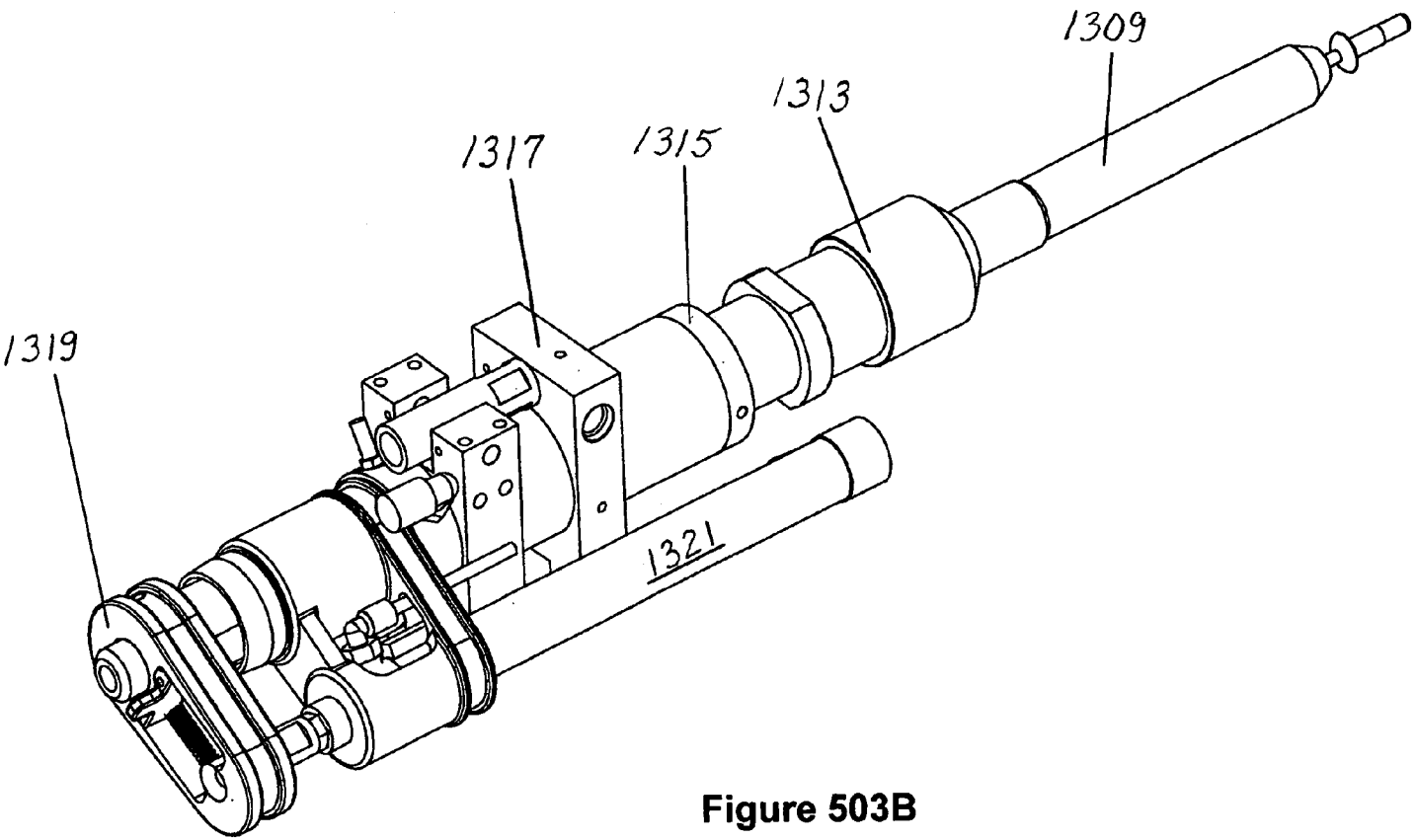
FIG. 503B is an isometric view of an alternative embodiment of the invention featuring decoupling of the piston and pull rod assembly, specifically highlighting the relative position of a bridge and hydraulic cylinder.
Figure 503C:
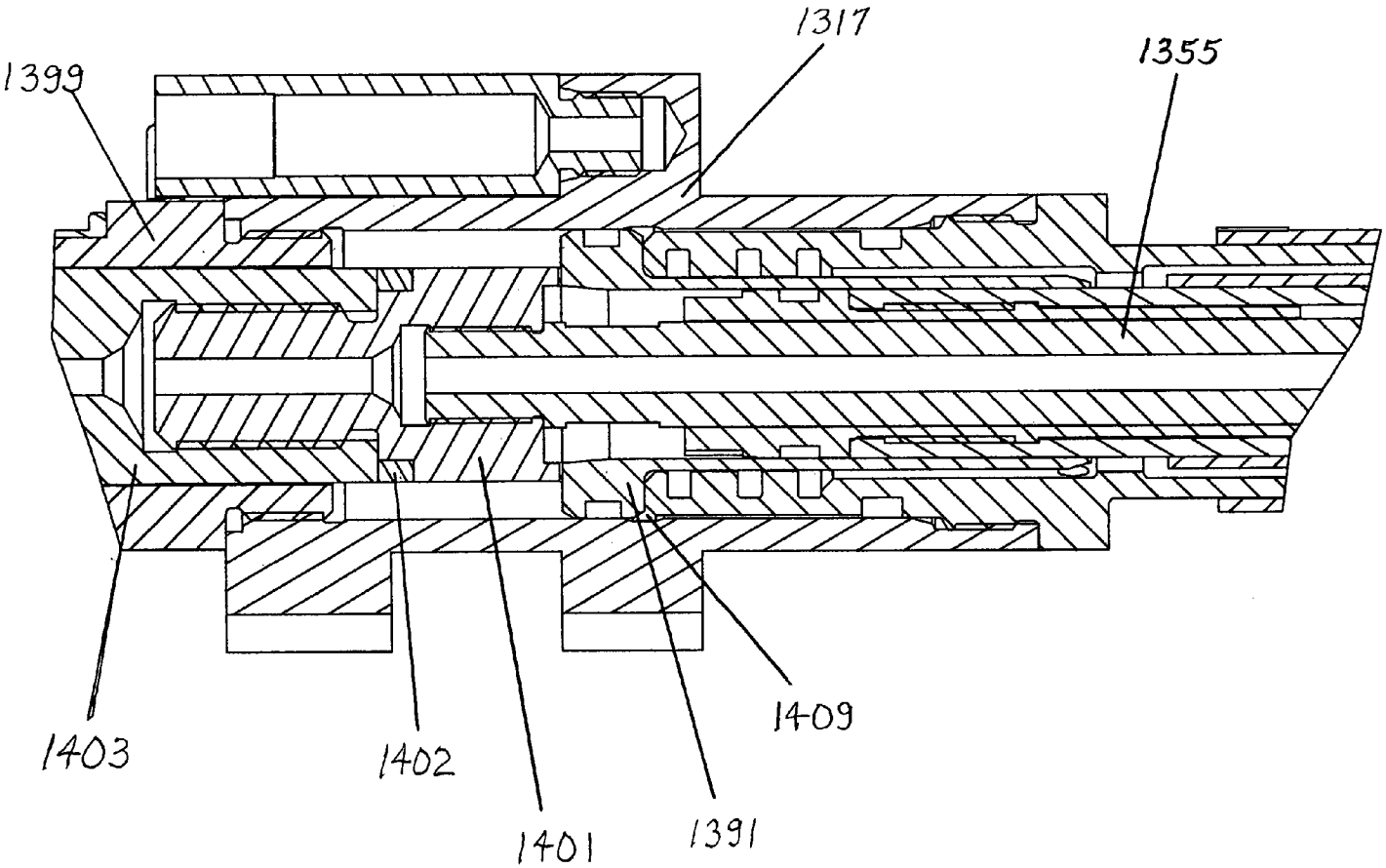
FIG. 503C is a close-up side cross-sectional view of an alternative embodiment of the invention featuring decoupling of the piston and pull rod assembly.

Turning, now, to FIG. 503A and FIG. 503C, the attentive reader will note that, when these figures are compared to FIG. 2A, two components from FIG. 2A are conspicuously missing—the inner collet 93 and actuation spring 97. Actually, several components from FIG. 2A have been eliminated, but those two are immediately apparent from even a casual perusal of the figures.

One of the important functions of the inner collet 93 and its related components and subassemblies of FIG. 2A et al was to effectuate the decoupled action of the piston 91 against pull rod coupling 101. In FIG. 503A and FIG. 503C, which depict the tool in a state comparable to that encountered in stage six as described hereinabove, this decoupled action is effectuated generally as follows.

The rearward face of piston 1391 is positioned to act against the forwardmost face of pull rod coupling 1401. The coupling 1401 is threadedly connected to pull rod 1355 (which, as described above, is the direct means by which blind rivet installation is effectuated). Pull rod coupling 1401 is also threadedly connected to seal rod 1403 which is then connected through a quick release mechanism to bridge 1319.

The reader will understand and appreciate that, if air pressure is utilized to expedite piston return (as generally described in stage five and as shown in this figure), a rear end cap inner seal 1423 is useful for securing a substantially airtight cavity.

Pull rod coupling 1401 is shown in this figure as being fitted with sensor ring 1402. This ring 1402 provides a means for detecting pin break (a means to be contrasted with the monitoring of hydraulic pressure as described in stage four hereinabove). Sensor ring 1402 comprises a ferrous material, so that a proximity sensor (such as proximity sensor 139 of FIG. 6A) can detect the motion of pull rod assembly 1373 when pin break occurs.

It will also be appreciated that, as hydraulic fluid is introduced into piston cavity 1409, the piston 1391 will be translated rearward (for example, as described in stage two hereinabove). In this alternative embodiment, the rearward translation of the piston 1391 is limited by the forwardmost face of rear end cap 1399 which is threadedly connected to hydraulic cylinder 1317.

Although this configuration of the piston assembly, pull rod assembly, and their functional interconnection differs from that shown in FIG. 2A et al, the person of ordinary skill in the art will appreciate that the piston and pull rod assembly continue to be decoupled. This decoupling continues to impart all of the benefits (for example, shock mitigation, nose assembly reciprocation) described above.

Turning, now, to FIG. 503B, the reader will understand and appreciate that this figure appears so as to provide a high-level overview of the exterior appearance of some of the tool components when this alternative embodiment is employed. The reader will note, for example, the relative position of the bridge 1319 and the hydraulic cylinder 1317.

Another Quick Release Nose Assembly Mechanism.

Figure 504A:
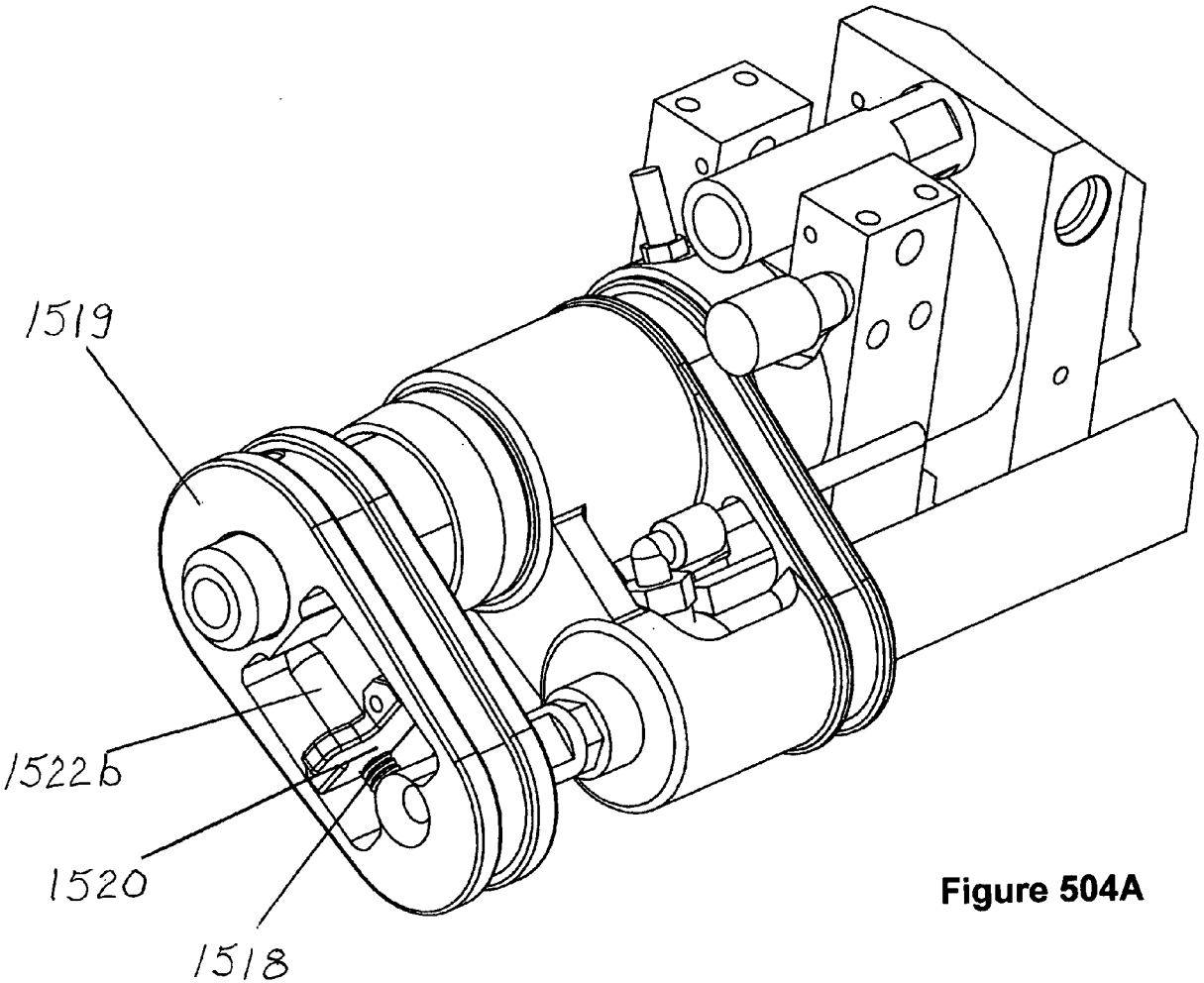
FIG. 504A is an isometric view of an alternative quick release nose assembly mechanism, specifically highlighting the use of a quick release retention tab (shown in the open position).
Figure 504B:
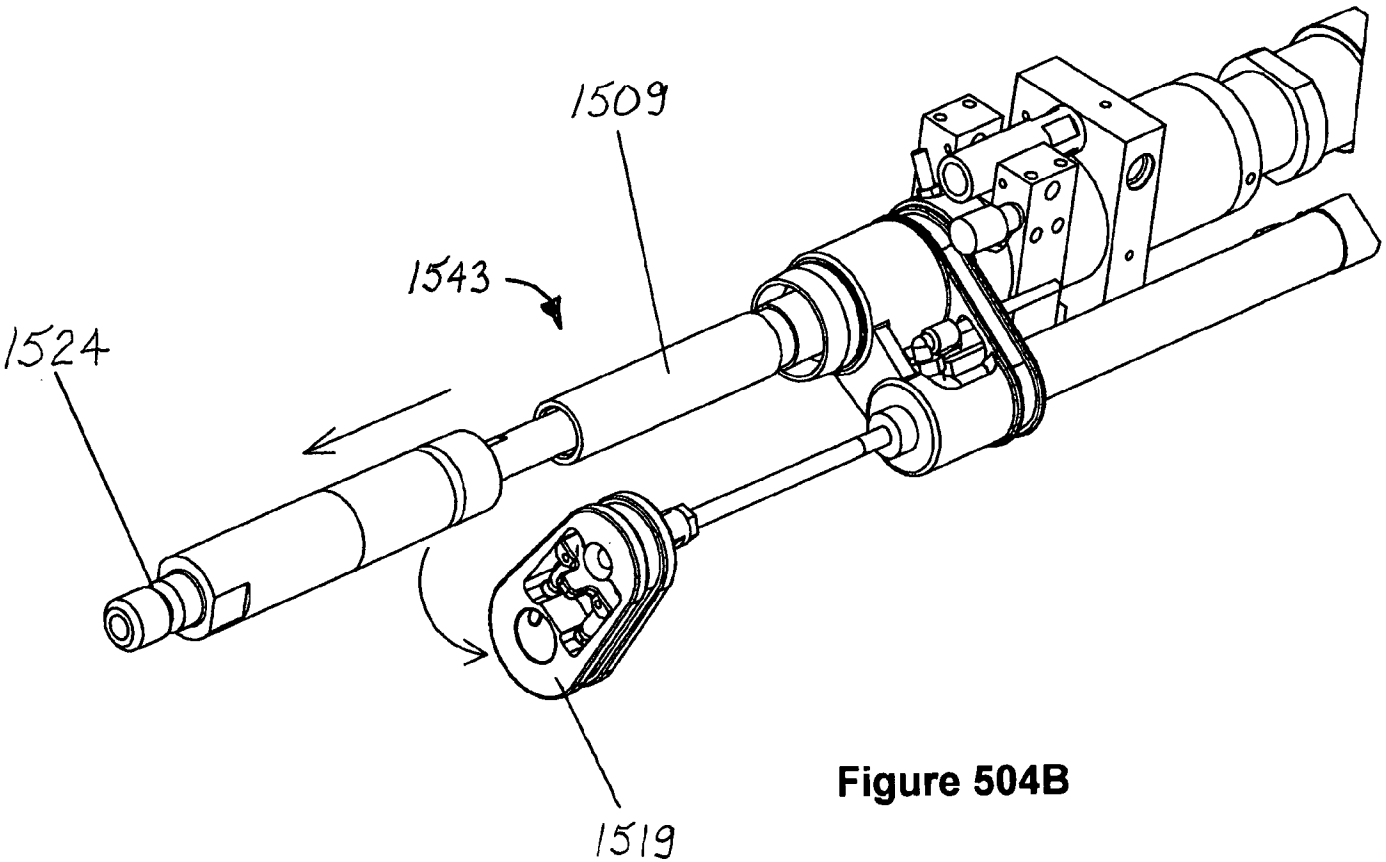
FIG. 504B is an isometric view of an alternative quick release nose assembly mechanism, specifically highlighting an open quick release retention tab and the ongoing removal of a nose assembly.
Figure 504C:
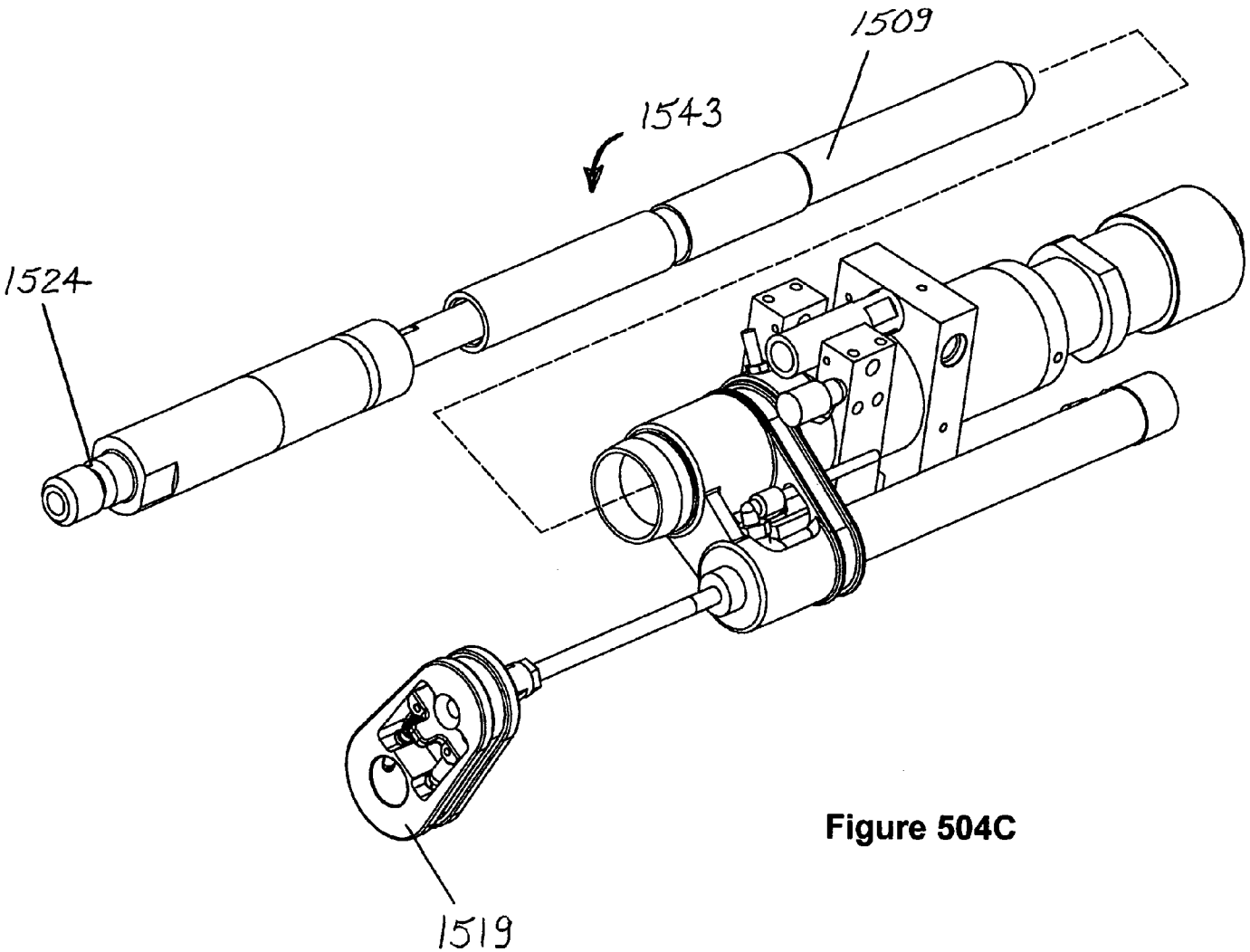
FIG. 504C is an isometric view of an alternative quick release nose assembly mechanism, specifically highlighting an open quick release retention tab and the completed removal of a nose assembly.

Referring, now, to FIG. 504A, FIG. 504B, and FIG. 504C, another quick release nose assembly mechanism, similar in operation to that of 405A, FIG. 405B, and FIG. 405C, is shown.

In FIG. 504A, the tool is shown as fitted with quick release retention tab 1520. The tab 1520 is shown in the open position, allowing the nose assembly 1543 to be separated from the bridge 1519 and removed from the tool.

Specifically, as shown in FIG. 504B and FIG. 504C, the bridge 1519 can now be rotated away from the nose axis 1589 (not shown) so that the nose assembly 1543 can now be removed in a rearward direction from the tool.

I claim:

1. A fastener installation tool comprising:

(a) a nose assembly comprising a jaw collet assembly; and (b) an actuation assembly featuring a passageway large enough to pass said jaw collet assembly, wherein said passageway of said actuation assembly is large enough to pass said nose assembly, said nose assembly is capable of translating between at least two longitudinal positions relative to said actuation assembly, and wherein said fastener installation tool further comprises a lock assembly capable of securing said nose assembly into one or more longitudinal positions relative to said actuation assembly.

2. The fastener installation tool of claim 1 further comprising:

(a) a nose assembly translation assembly comprising a drive to translate said nose assembly to one or more longitudinal positions; and (b) a releasable linkage between said drive and said nose assembly.

3. The fastener installation tool of claim 1 wherein:

(a) said nose assembly comprises a locking groove; and (b) a lock assembly comprising a collet, said collet comprising one or more collet tongs, at least one of said collet tongs comprising a locking tooth which will fit within said locking groove when said nose assembly is at a predetermined location and said lock assembly is locked, so as to secure said nose assembly's longitudinal position relative to said actuation assembly.

* * * * *